US007545396B2

(12) United States Patent
Ng

(10) Patent No.: US 7,545,396 B2
(45) Date of Patent: Jun. 9, 2009

(54) ASYNCHRONOUS DISPLAY DRIVING SCHEME AND DISPLAY

(75) Inventor: Sunny Yat-san Ng, Cupertino, CA (US)

(73) Assignee: Aurora Systems, Inc., San Jose, CA (US)

( * ) Notice: Subject to any disclaimer, the term of this patent is extended or adjusted under 35 U.S.C. 154(b) by 413 days.

(21) Appl. No.: 11/154,984

(22) Filed: Jun. 16, 2005

(65) Prior Publication Data

US 2006/0284814 A1 Dec. 21, 2006

(51) Int. Cl.
*G09G 5/02* (2006.01)

(52) U.S. Cl. ..... 345/693; 345/205

(58) Field of Classification Search ..... 345/204, 345/205, 214, 690–693
See application file for complete search history.

(56) References Cited

U.S. PATENT DOCUMENTS

| | | | | |
|---|---|---|---|---|
| 4,591,842 | A | 5/1986 | Clarke, Jr. et al. | 345/634 |
| 5,285,214 | A | 2/1994 | Bowry | 345/97 |
| 5,731,802 | A * | 3/1998 | Aras et al. | 345/692 |
| 6,140,983 | A | 10/2000 | Quanrud | 345/55 |
| 6,151,011 | A | 11/2000 | Worley, III et al. | 345/147 |
| 6,246,386 | B1 | 6/2001 | Perner | 345/90 |
| 6,353,435 | B2 | 3/2002 | Kudo et al. | 345/204 |
| 6,388,661 | B1 | 5/2002 | Richards | 345/204 |
| 6,441,829 | B1 | 8/2002 | Blalock et al. | 345/690 |
| 6,636,206 | B1 | 10/2003 | Yatabe | 345/204 |
| 6,771,240 | B2 | 8/2004 | Inoue et al. | 345/87 |
| 6,864,643 | B2 | 3/2005 | Min et al. | 315/246 |
| 6,873,308 | B2 | 3/2005 | Sagano et al. | 345/75.2 |
| 6,903,516 | B2 * | 6/2005 | Tanada | 315/169.4 |
| 6,965,357 | B2 | 11/2005 | Sakamoto et al. | 345/39 |
| 6,985,164 | B2 | 1/2006 | Rogers et al. | 345/692 |
| 7,071,905 | B1 | 7/2006 | Fan | 345/76 |
| 7,196,683 | B2 | 3/2007 | Yamamoto et al. | 345/87 |
| 7,274,363 | B2 | 9/2007 | Ishizuka et al. | 345/211 |
| 7,301,518 | B2 | 11/2007 | Hosaka | 345/94 |
| 7,317,464 | B2 * | 1/2008 | Willis | 345/691 |
| 2002/0135553 | A1 | 9/2002 | Nagai et al. | 345/89 |
| 2003/0210257 | A1 | 11/2003 | Hudson et al. | 345/692 |
| 2004/0113879 | A1 | 6/2004 | Sekiguchi et al. | 345/94 |
| 2004/0150596 | A1 | 8/2004 | Uchida et al. | 345/84 |
| 2004/0239606 | A1 | 12/2004 | Ota | 345/98 |
| 2005/0062709 | A1 | 3/2005 | Zeiter et al. | 345/99 |
| 2005/0110720 | A1 | 5/2005 | Akimoto et al. | 345/76 |
| 2006/0001613 | A1 | 1/2006 | Routley et al. | 345/76 |
| 2006/0267896 | A1 | 11/2006 | Edwards | 345/94 |

* cited by examiner

*Primary Examiner*—Richard Hjerpe
*Assistant Examiner*—Tom V Sheng
(74) *Attorney, Agent, or Firm*—Henneman & Associates, PLC; Larry E. Henneman, Jr.

(57) ABSTRACT

A novel method for asynchronously driving a display device including a plurality of pixels arranged in a plurality of columns and a plurality of rows includes the steps of receiving a first multi-bit data word indicative of a first grayscale value to be displayed on a pixel of a first row of the display, defining a first time period during which an electrical signal corresponding to the first grayscale value can be asserted on the pixel of said first row, receiving a second multi-bit data word indicative of a second grayscale value to be displayed on a pixel of a second row of the display, and defining a second time period that is temporally offset from the first time period during which an electrical signal corresponding to the second grayscale value can be asserted on the pixel of said second row. A novel display driver for performing the methods of the present invention is also disclosed.

48 Claims, 64 Drawing Sheets

Circular Memory Buffer

| | |
|---|---|
| $B_0$: 1280 x 156 | 1402 |
| $B_1$: 1280 x 156 | 1404 |
| $B_3$: 1280 x 411 | 1406 |
| $B_2$: 1280 x 615 | 1408 |

1708

| Storage Element | Global D / $\overline{D}$ | Pixel Voltage |
|---|---|---|
| 1 | 0 | 1 |
| 1 | 1 | 0 |
| 0 | 0 | 0 |
| 0 | 1 | 1 |

2300A

2400

2400

2400

2706

Circular Memory Buffer

| | |
|---|---|
| $B_0$: 1280 x 12 | 3402 |
| $B_1$: 1280 x 12 | 3404 |
| $B_7$: 1280 x 387 | 3406 |
| $B_6$: 1280 x 579 | 3408 |
| $B_5$: 1280 x 675 | 3410 |
| $B_4$: 1280 x 723 | 3412 |
| $B_3$: 1280 x 747 | 3414 |
| $B_2$: 1280 x 759 | 3416 |

FIG. 34

Time Interval

| Update Count | Transition Value | 1 | 2 | 3 | 4 | 5 | ... | 252 | 253 | 254 | 255 |
|---|---|---|---|---|---|---|---|---|---|---|---|
| 0 | 1 | 0 | 1 | 2 | 3 | 4 | | 251 | 252 | 253 | 254 |
| 1 | 2 | 254 | 0 | 1 | 2 | 3 | | 250 | 251 | 252 | 253 |
| 2 | 3 | 253 | 254 | 0 | 1 | 2 | | 249 | 250 | 251 | 252 |
| 3 | 4 | 252 | 253 | 254 | 0 | 1 | | 248 | 249 | 250 | 251 |
| 4 | 8 | 248 | 249 | 250 | 251 | 252 | | 244 | 245 | 246 | 247 |
| 5 | 12 | 244 | 245 | 246 | 247 | 248 | ... | 240 | 241 | 242 | 243 |
| 6 | 16 | 240 | 241 | 242 | 243 | 244 | | 236 | 237 | 238 | 239 |
| 7 | 20 | 236 | 237 | 238 | 239 | 240 | | 232 | 233 | 234 | 235 |
| 8 | 24 | 232 | 233 | 234 | 235 | 236 | | 228 | 229 | 230 | 231 |
| 9 | 28 | 228 | 229 | 230 | 231 | 232 | | 224 | 225 | 226 | 227 |
| 10 | 32 | 224 | 225 | 226 | 227 | 228 | | 220 | 221 | 222 | 223 |
| 11 | 36 | 220 | 221 | 222 | 223 | 224 | | 216 | 217 | 218 | 219 |
| ⋮ | ⋮ | ⋮ | | | | | | ⋮ | | | |
| 60 | 232 | 24 | 25 | 26 | 27 | 28 | | 20 | 21 | 22 | 23 |
| 61 | 236 | 20 | 21 | 22 | 23 | 24 | | 16 | 17 | 18 | 19 |
| 62 | 240 | 16 | 17 | 18 | 19 | 20 | | 12 | 13 | 14 | 15 |
| 63 | 244 | 12 | 13 | 14 | 15 | 16 | ... | 8 | 9 | 10 | 11 |
| 64 | 248 | 8 | 9 | 10 | 11 | 12 | | 4 | 5 | 6 | 7 |
| 65 | 252 | 4 | 5 | 6 | 7 | 8 | | 0 | 1 | 2 | 3 |

3602 3604 3606

Group

FIG. 36A

2706A

Circular Memory Buffer

| | |
|---|---|
| $B_0$: 1280 x 24 | 4002 |
| $B_1$: 1280 x 24 | 4004 |
| $B_2$: 1280 x 24 | 4006 |
| $B_7$: 1280 x 387 | 4008 |
| $B_6$: 1280 x 579 | 4010 |
| $B_5$: 1280 x 675 | 4012 |
| $B_4$: 1280 x 723 | 4014 |
| $B_3$: 1280 x 747 | 4016 |

FIG. 40

| Update Count | Transition Value | Time Interval 1 | 2 | 3 | 4 | 5 | 6 | 7 | 8 | 9 |
|---|---|---|---|---|---|---|---|---|---|---|
| 0 | 1 | 0 | 1 | 2 | 3 | 4 | 5 | 6 | 7 | 8 |
| 1 | 2 | 254 | 0 | 1 | 2 | 3 | 4 | 5 | 6 | 7 |
| 2 | 3 | 253 | 254 | 0 | 1 | 2 | 3 | 4 | 5 | 6 |
| 3 | 4 | 252 | 253 | 254 | 0 | 1 | 2 | 3 | 4 | 5 |
| 4 | 5 | 251 | 252 | 253 | 254 | 0 | 1 | 2 | 3 | 4 |
| 5 | 6 | 250 | 251 | 252 | 253 | 254 | 0 | 1 | 2 | 3 |
| 6 | 7 | 249 | 250 | 251 | 252 | 253 | 254 | 0 | 1 | 2 |
| 7 | 8 | 248 | 249 | 250 | 251 | 252 | 253 | 254 | 0 | 1 |
| 8 | 16 | 240 | 241 | 242 | 243 | 244 | 245 | 246 | 247 | 248 |
| 9 | 24 | 232 | 233 | 234 | 235 | 236 | 237 | 238 | 239 | 240 |
| 10 | 32 | 224 | 225 | 226 | 227 | 228 | 229 | 230 | 231 | 232 |
| 11 | 40 | 216 | 217 | 218 | 219 | 220 | 221 | 222 | 223 | 224 |
| ⋮ | ⋮ | ⋮ | | | | | | | | |
| 32 | 208 | 48 | 49 | 50 | 51 | 52 | 53 | 54 | 55 | 56 |
| 33 | 216 | 40 | 41 | 42 | 43 | 44 | 45 | 46 | 47 | 48 |
| 34 | 224 | 32 | 33 | 34 | 35 | 36 | 37 | 38 | 39 | 40 |
| 35 | 232 | 24 | 25 | 26 | 27 | 28 | 29 | 30 | 31 | 32 |
| 36 | 240 | 16 | 17 | 18 | 19 | 20 | 21 | 22 | 23 | 24 |
| 37 | 248 | 8 | 9 | 10 | 11 | 12 | 13 | 14 | 15 | 16 |

Group 4202 4204 4206

4202 4204 4206

FIG. 42

ASYNCHRONOUS DISPLAY DRIVING SCHEME AND DISPLAY

BACKGROUND OF THE INVENTION

1. Field of the Invention

This invention relates generally to driving electronic displays, and more particularly to a display driver circuit and methods for driving a multi-pixel liquid crystal display. Even more particularly, the present invention relates to a driver circuit and methods for driving a liquid crystal on silicon display device with a digital backplane.

2. Description of the Background Art

FIG. 1 shows a block diagram of a prior art display driver 100 for driving an imager 102, which includes a pixel array 104 having 1280 columns and 768 rows. Display driver 100 also includes a select decoder 105, a row decoder 106, and a timing generator 108. In addition to pixel array 104, imager 102 also includes an input buffer 110, which receives and stores 4-bit video data from a system (e.g., a computer that is not shown). Timing generator 108 generates timing signals by methods well known to those skilled in the art, and provides the timing signals to select decoder 105 and row decoder 106 via a timing signal line 112 to coordinate the modulation of pixel array 104.

Video data is written into input buffer 110 according to methods well known in the art. In the present embodiment, input buffer 110 stores a single frame of video data for each pixel in pixel array 104. When input buffer 110 receives a command from the system (not shown), input buffer 110 asserts video data for each pixel of a particular row of pixel array 104 onto all 1280 output terminals 114. In the present example, input buffer 110 must be sufficiently large to accommodate four bits of video data for each pixel of pixel array 104. Therefore, input buffer 110 is approximately 3.93 Megabits (i.e., 1280×768×4 bits) in size. Of course, if the number of bits in the video data increases (e.g., 8-bit video data), then the required capacity of input buffer 110 would necessarily increase proportionately.

The size requirement of input buffer 110 is a significant disadvantage. First, the circuitry of input buffer 110 occupies space on imager 102. As the required memory capacity increases, the chip space required by input buffer 110 also increases, thus hindering the ever present objective of size reduction in integrated circuits. Further, as the memory capacity increases, the number of storage devices increases, thereby increasing the probability of manufacturing defects, which reduces the yield of the manufacturing process and increase the cost of imager 102.

There have been attempts to reduce the size of input buffer 110. However, any such reduction comes at the expense of a significant increase in the bandwidth required to write the video data into input buffer 110 and/or an increase in the size of off-chip memory. For example, if input buffer 110 has a capacity smaller than one frame of video data, then the same video data may need to be written into input buffer 110 more than once in order to write a single frame of data to pixel array 104.

Row decoder 106 receives row addresses from the system (not shown) via a row address bus 116, and responsive to a store command from timing generator 108, row decoder 106 stores the asserted row address. Then, responsive to row decoder 106 receiving a decode instruction from timing generator 108, row decoder 106 decodes the stored row address and enables one of 768 word-lines 118 corresponding to the decoded row address. Enabling word-line 118 causes data being asserted on data output terminals 114 of input buffer 110 to be latched into the enabled row of pixel cells in pixel array 104.

Select decoder 105 receives block addresses from the system (not shown) via a block address bus 120. Responsive to receiving a store block address command from timing signal generator 108 via timing signal line 112, select decoder 105 stores the asserted block address therein. Then, responsive to timing generator 108 asserting a load block address instruction on timing signal line 112, select decoder 105 decodes the asserted block address and asserts a block update signal on one of 24 block select lines 122 corresponding to the decoded block address. The block update signal on the corresponding block select line 122 causes all of the pixels cells of an associated block of rows (i.e., 32 rows) of pixel array 104 to assert the previously latched video data onto their associated pixel electrodes (not shown in FIG. 1).

FIG. 2A shows an example dual-latch pixel cell 200(*r,c,b*) of imager 102, where (r), (c), and (b) indicate the row, column, and block of the pixel cell, respectively. Pixel cell 200 includes a master latch 202, a slave latch 204, a pixel electrode 206 (e.g., a mirror electrode overlying the circuitry layer of imager 102), and switching transistors 208, 210, and 212. Master latch 202 is a static random access memory (SRAM) latch. One input of master latch 202 is coupled, via transistor 208, to a Bit+ data line 214(*c*), and the other input of master latch 202 is coupled, via transistor 210, to a Bit− data line 216(*c*). The gate terminals of transistors 208 and 210 are coupled to word line 118(*r*). The output of master latch 202 is coupled, via transistor 212, to the input of slave latch 204. The gate terminal of transistor 212 is coupled to block select line 122(*b*). The output of slave latch 204 is coupled to pixel electrode 206.

An enable signal on word line 118(*r*) places transistors 208 and 210 into a conducting state, causing the complementary data asserted on data lines 214(*c*) and 216(*c*) to be latched, such that the output of master latch 202 is at the same logic level as data line 214(*c*). A block select signal on block select line 122(*b*) places transistor 212 into a conducting state, and causes the data being asserted on the output of master latch 202 to be latched onto the output of slave latch 204, and thus onto pixel electrode 206.

Although the master-slave latch design functions well, it is a disadvantage that each pixel cell requires two storage latches. It is also a disadvantage that separate circuitry is required to write data to the pixel cells and to cause the stored data to be asserted on the pixel electrode.

FIG. 2B shows the light modulating portion of pixel cell 200 (*r, c, b*) in greater detail. Pixel cell 200 further includes a portion of a liquid crystal layer 218, contained between a transparent common electrode 220 and pixel storage electrode 206. Liquid crystal layer 218 rotates the polarization of light passing through it, the degree of rotation depending on the root-mean-square (RMS) voltage across liquid crystal layer 218.

The ability to rotate the polarization is exploited to modulate the intensity of reflected light as follows. An incident light beam 222 is polarized by a polarizer 224. The polarized beam then passes through liquid crystal layer 218, is reflected off of pixel electrode 206, and passes again through liquid crystal layer 218. During this double pass through liquid crystal layer 218, the beam's polarization is rotated by an amount which depends on the data being asserted on pixel electrode 206 by slave latch 204 (FIG. 2A). The beam then passes through polarizer 226, which passes only that portion of the beam having a specified polarity. Thus, the intensity of the reflected beam passing through polarizer 226 depends on the amount of polarization rotation induced by liquid crystal layer 218, which in turn depends on the data being asserted on pixel electrode 206 by slave latch 204.

A common way to drive pixel electrode 206 is via pulse-width-modulation (PWM). In PWM, different gray scale levels (i.e., intensity values) are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5V or low, e.g., 0V) is asserted on the pixel storage electrode 106. There are, therefore, 16 (0-15) different gray scale values possible. The actual value displayed depends on the number of "high" pulses asserted during the frame time. The assertion of 0 high pulses corresponds to a gray scale value of 0 (RMS 0V), whereas the assertion of 15 high pulses corresponds to a gray scale value of 15 (RMS 5V). Intermediate numbers of high pulses correspond to intermediate gray scale levels.

FIG. 3 shows a series of pulses corresponding to the 4-bit gray scale value (1010), where the most significant bit is the far left bit. In this example of binary-weighted pulse-width modulation, the pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low, the third pulse B1 (2 intervals wide) is high, and the last pulse B0 (1 interval wide) is low. This series of pulses results in an RMS voltage that is approximately $\sqrt{2/3}$ (10 of 15 intervals) of the full value (5V), or approximately 4.1V.

Because the liquid crystal cells are susceptible to deterioration due to ionic migration resulting from a DC voltage being applied across them, the above described PWM scheme is modified as shown in FIG. 4. The frame time is divided in half. During the first half, the PWM data is asserted on the pixel storage electrode, while the common electrode is held low. During the second half of the frame time, the complement of the PWM data is asserted on the pixel storage electrode, while the common electrode is held high. This results in a net DC component of 0V, avoiding deterioration of the liquid crystal cell, without changing the RMS voltage across the cell, as is well known to those skilled in the art. Although pixel array 104 is debiased, the bandwidth between input buffer 110 and pixel array 104 is increased to accommodate the increased number of pulse transitions.

The resolution of the gray scale can be improved by adding additional bits to the binary gray scale value. For example, if 8 bits are used, the frame time is divided into 255 intervals, providing 256 possible gray scale values. In general, for (n) bits, the frame time is divided into ($2^n-1$) intervals, yielding ($2^n$) possible gray scale values.

If the PWM data shown in FIG. 4 was written to pixel cell 200 of pixel array 104 then the digital value of pixel electrode 206 would transition between a digital high and digital low value six times within the frame. It is well known that there is a delay between when the data is first asserted on pixel electrode 206 and when the intensity output of pixel 200 actually corresponds to the steady state RMS voltage of the grayscale value being asserted. This delay is referred to as the "rise time" of the cell, and results from the physical properties of the liquid crystals. The cell rise time can cause undesirable visual artifacts in the image produced by pixel array 104 such as blurred moving objects and/or moving objects that leave ghost trails. In any case, the severity of the aberrations in the visual image increases with an increase of pulse transitions asserted on pixel electrode 206. Further, visually perceptible aberrations result from the assertion of opposite digital values on adjacent pixel electrodes for a significant portion of the frame time, at least in part to the lateral field affect between adjacent pixels.

What is needed, therefore, is a system and method for driving a display that reduces the number of pulse transitions experienced by the pixels of a display. What is also needed is a system and method that reduces the amount of input memory and bandwidth needed to drive the display. What is also needed is a system and method that reduces visually perceptible aberrations in images generated by a display. What is also needed is a driving circuit and method that can drive pixel arrays with only one storage latch per pixel.

SUMMARY

The present invention overcomes the problems associated with the prior art by providing a display driver and method for asynchronously driving the rows of a display device. The invention facilitates driving each row of the display over a time period that is temporally offset with respect to the time periods associated with the other rows of the display, which among other advantages, results in significant memory savings.

A novel method for asynchronously driving a display device including an array of pixels includes the steps of receiving a first multi-bit data word indicative of a first intensity value to be displayed on a pixel of a first row of the display, defining a first time period during which an electrical signal corresponding to the first intensity value is to be asserted on the pixel of the first row, receiving a second multi-bit data word indicative of a second intensity value to be displayed on a pixel of a second row of the display, and defining a second time period that is temporally offset from the first time period, during which an electrical signal corresponding to the second intensity value will be asserted on the pixel of the second row. In a particular method, the second time period is temporally offset from the first time period by $$\frac{T_1}{2^n-1},$$

where $T_1$ represents the duration of the first time period, and n represents the number of bits in each of the first and second multi-bit data words.

A more particular method according to the present invention further includes the steps of receiving a third multi-bit data word indicative of a third intensity value to be displayed on a pixel of a third row of the display, and defining a third time period during which an electrical signal corresponding to the third intensity value is to be asserted on the pixel of the third row. In this particular method, the third time period is temporally offset from both the second time period and the first time period. For example, the third time period can be temporally offset from the second time period by an amount equal to $$\frac{T_1}{2^n-1},$$

and from the first time period by an amount equal to $$\frac{2T}{2^n-1}.$$

Finally, it should be noted that in this method, the first, second, and third time periods are all equal in duration.

In another particular method, the first and second time periods are each composed of $(2^n-1)$ coequal time intervals, where n represents the number of bits in each of the first multi-bit data word and the second multi-bit data word. In this particular method, the second time period is temporally offset with respect to the first time period by an amount equal to one of the coequal time intervals.

For driving purposes, the rows of the display are divided into groups. If the display device contains more than $(2^n-1)$ rows, the rows are divided into $(2^n-1)$ groups, such that a first number of the groups each include a first number of rows and a second number of groups each include a second number of rows. In a more particular method, the rows of the array are grouped in the same order as they are arranged in the display. When the rows are divided into $(2^n-1)$ groups, a more particular method includes the step of defining an additional plurality of time periods for each group of rows. The additional time periods are equal in length to the first time period, are temporally offset with respect to one another, and begin during respective one of the $(2^n-1)$ time intervals associated with the group of rows. The method further includes the steps of associating each of the additional time periods with one of the rows, and asserting electrical signals corresponding to intensity values on the pixels of each row during the additional time period associated with the row. Data is then written to the rows of the display by group such that the rows within a group are written to sequentially, with some but not all of the groups being written to during each time interval.

The first number of groups and the second number of groups, as well as the number of rows contained in each, can be determined according to formulas presented. For example, each of the first number of groups and the second number of groups contain at least INT $$\left(\frac{r}{2^n-1}\right)$$

rows, where r represents the number of rows in the array of pixels and INT is the integer function. In a more particular method, the first number of groups include $$\left(INT\left(\frac{r}{2^n-1}\right)+1\right)$$

rows of the array if $(\mathrm{rMOD}(2^n-1)\neq 0)$, where MOD is the remainder function. In such a case, the first number of groups includes $(\mathrm{rMOD}(2^n-1))$ groups. Finally, the second number of groups includes $((2^n-1)-\mathrm{rMOD}(2^n-1))$ groups.

Another particular method of the present invention includes the steps of initializing an electrical signal on the pixel of the first row at a first time selected from a first plurality of predetermined times depending on the value of at least one of the bits of the first multi-bit data word, and terminating the electrical signal on the pixel of the first row at a second time selected from a second plurality of predetermined times, such that the duration from the first time to the second time during which the electrical signal is asserted on the pixel corresponds to the first intensity value.

Still another particular method of the present invention further includes the steps of initializing an electrical signal on the pixel of the first row at a first time depending on the value of at least one of the bits of the first multi-bit data word, discarding at least one bit of the first multi-bit data word, and terminating the electrical signal on the pixel at a second time determined from any remaining bits of the first multi-bit data word such that the duration from the first time to the second time that the electrical signal is asserted on the pixel corresponds to the first intensity value. The second time is determined after at least one bit has been discarded.

Yet another particular method of the present invention further includes the steps of dividing the first time period into a plurality of coequal time intervals, updating a signal asserted on the pixel of the first row during each of a plurality of consecutive ones of the time intervals during a first portion of the first time period, and updating the signal asserted on the pixel of the first row every $m^{th}$ time interval during a second portion of the first time period, m being an integer greater than one.

Still another particular method of the present invention further includes the steps of dividing the first time period into a plurality of coequal time intervals, asserting an electrical signal on the pixel of the first row in a first bias direction with respect to a common electrode of the display for a first group of the coequal time intervals, and asserting the electrical signal on the pixel of the first row in a second bias direction with respect to the common electrode for a second group of the coequal time intervals.

A novel display driver for performing the methods of the present invention includes a data input terminal set for receiving multi-bit data words, and control logic for performing the asynchronous driving functions of the display. The control logic is operative to receive a first multi-bit data word via the data input terminal set indicative of a first intensity value to be displayed on a pixel of a first row of the display, to define a first time period during which an electrical signal corresponding to the first intensity value is to be asserted on the pixel of the first row, to receive a second multi-bit data word via the data input terminal set indicative of a second intensity value to be displayed on a pixel of a second row of the display, and to define a second time period temporally offset with respect to the first time period during which an electrical signal corresponding to the second intensity value is to be asserted on the pixel of the second row. In a particular embodiment, the control logic is further operative to receive a third multi-bit data word via the data input terminal set indicative of a third intensity value to be displayed on a pixel of a third row of the display, and define a third time period temporally offset with respect to the first time period and the second time period during which an electrical signal corresponding to the third intensity value is to be asserted on the pixel of the third row.

In another particular embodiment, the control logic is further operative to divide the first and second time periods into $(2^n-1)$ coequal time intervals, such that the second time period is temporally offset with respect to the first time period by an amount equal to one coequal time interval. In a more particular embodiment when the rows of the array are grouped as described above, the control logic is further operative to define an additional plurality of time periods for each group of rows, such that each of the additional time periods for a particular group is equal in length to the first time period, the additional time periods are temporally offset with respect to one another, and each begins during one of the time intervals associated with the particular group of rows. The control logic is also further operative to associate each of the additional time periods with one of the rows, and assert electrical signals corresponding to intensity values on the pixels of each row during the additional time period associated with each row. Finally, control logic is operative to write data to the rows of the display by group by sequentially writing to each row of the group. The control logic writes data to some, but not all of the groups during each of the coequal time intervals. The first number of groups and the second number of groups, as well as the number of rows in each group, are determined as described above.

In yet another particular embodiment of the present invention, the control logic is further operative to initialize an electrical signal on the pixel of the first row at a first time selected from a first plurality of predetermined times depending on the value of at least one of the bits of the first multi-bit data word and to terminate the electrical signal on the pixel of the first row at a second time selected from a second plurality of predetermined times such that the duration from the first time to the second time during which the electrical signal is asserted on the pixel corresponds to the first intensity value.

In still another particular embodiment of the present invention, the control logic is further operative to initialize an electrical signal on the pixel of the first row at a first time depending on the value of at least one of the bits of the first multi-bit data word, to discard at least one bit of the first multi-bit data word, and to terminate the electrical signal on the pixel of the first row at a second time determined from any remaining bits of the first multi-bit data word such that the duration from the first time to the second time that the electrical signal is asserted on the pixel corresponds to the first intensity value. The second time is determined from some or all of the remaining bits, after at least one of the bits has been discarded.

In yet another particular embodiment of the present invention, the control logic is further operative to divide the first time period into a plurality of coequal time intervals, update a signal asserted on the pixel of the first row during each of a plurality of consecutive ones of the time intervals during a first portion of the first time period, and update the signal asserted on the pixel of the first row every $m^{th}$ one of the time intervals during a second portion of the first time period, m being an integer greater than one.

In still another particular embodiment of the present invention, the control logic is further operative to divide the first time period into a plurality of coequal time intervals, assert the electrical signal on the pixel of the first row in a first bias direction with respect to a common electrode of the display for a first group of coequal time intervals, and assert the electrical signal on the pixel of the first row in a second bias direction with respect to the common electrode for a second group of coequal time intervals.

Finally, in yet another particular embodiment, the control logic includes a timer operative to output a series of time values and output logic coupled to receive the time values and multi-bit data words to be written to particular pixels of the display. The output logic is operative to provide a single data bit to each pixel having a value dependent on values of at least some of the bits of the multi-bit data words and the time values. In operation, for a multi-bit data word having a particular value, the output logic provides a data bit having a first predetermined value to a particular pixel responsive to a first particular time value and provides a data bit having a different predetermined value to said particular pixel responsive to a different particular time value.

BRIEF DESCRIPTION OF THE DRAWINGS

The present invention is described with reference to the following drawings, wherein like reference numbers denote substantially similar elements:

FIG. 34 is a block diagram showing the capacities of portions of the circular memory buffer of FIG. 27 for each bit of the 8-bit display data shown in FIG. 32;

FIG. 36A is a table showing input and output values of the address counter, transition table and group generator of FIG. 35;

FIG. 40 is a block diagram showing the capacities of portions of the circular memory buffer of FIG. 27 for each bit of the 8-bit display data based on the modulation scheme of FIG. 37 and the processing method of FIG. 38;

FIG. 42 is a table displaying input and output values of the address counter, transition table and group generator of FIG. 41;

DETAILED DESCRIPTION

The present invention overcomes the problems associated with the prior art, by providing a display and driving circuit/method wherein each pixel is modulated with a single pulse, thereby reducing aberrations present in prior art displays. Aberrations are further reduced by asynchronously driving the rows of the display. Further, the driving scheme of the present invention significantly reduces the amount of memory needed to store the display data in the imager and facilitates the use of single latch display pixels. In the following description, numerous specific details are set forth (e.g., display start-up operations, particular grouping of rows of the display, particular pixel driving voltages, etc.) in order to provide a thorough understanding of the invention. Those skilled in the art will recognize, however, that the invention may be practiced apart from these specific details. In other instances, details of well known display driving methods and components have been omitted, so as not to unnecessarily obscure the present invention.

The invention will be described first with reference to an embodiment for displaying 4-bit image data, in order to simplify the explanation of the basic aspects of the invention.

Then, a more complicated embodiment of the invention for displaying 8-bit image data will be described. It should be understood, however, that the invention can be applied to systems for displaying image data having any number of bits and/or weighting schemes.

Figure 1:
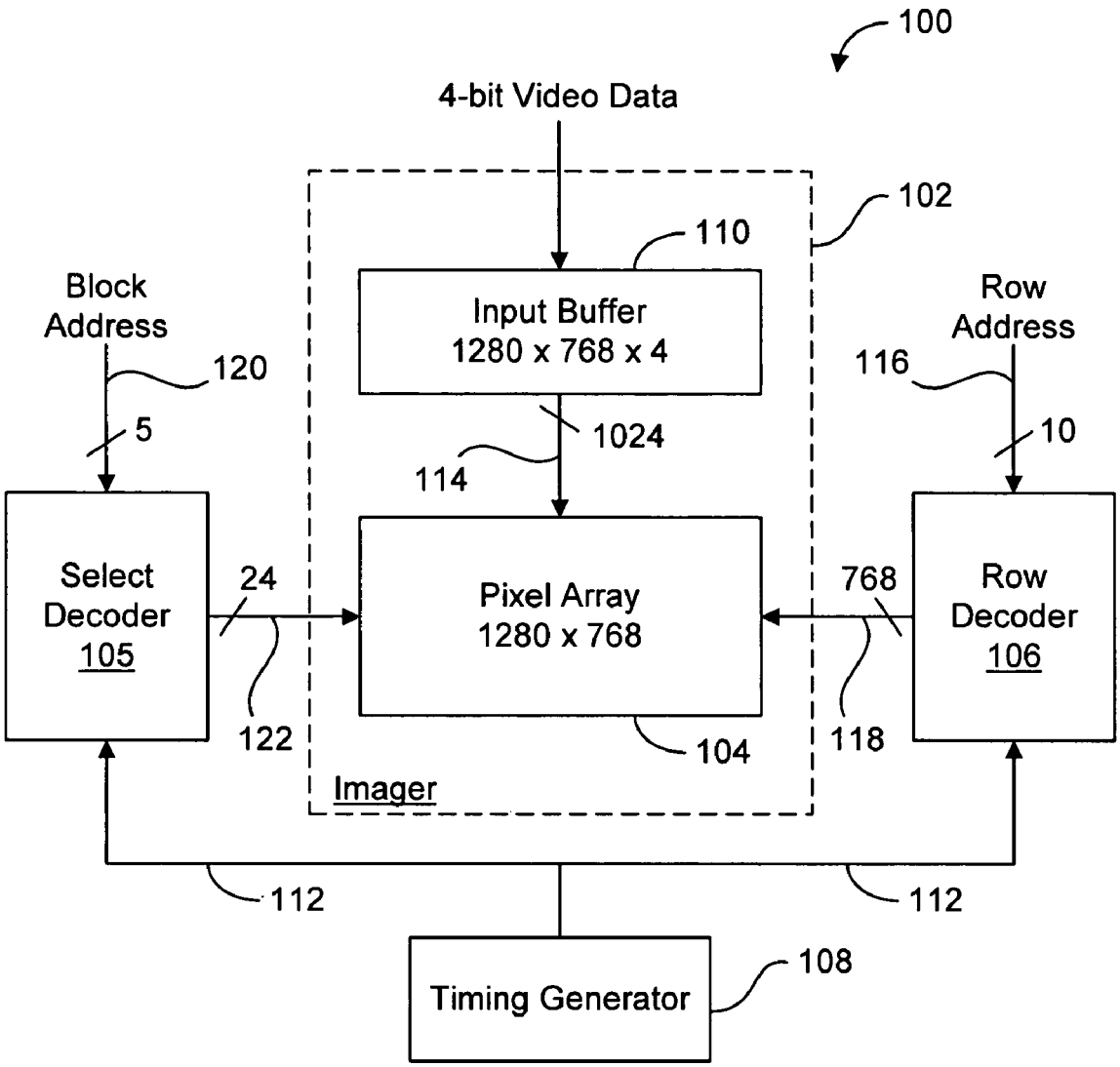
FIG. 1 Prior Art
FIG. 1 is a block diagram of a prior art display driving system.
Figure 2A:
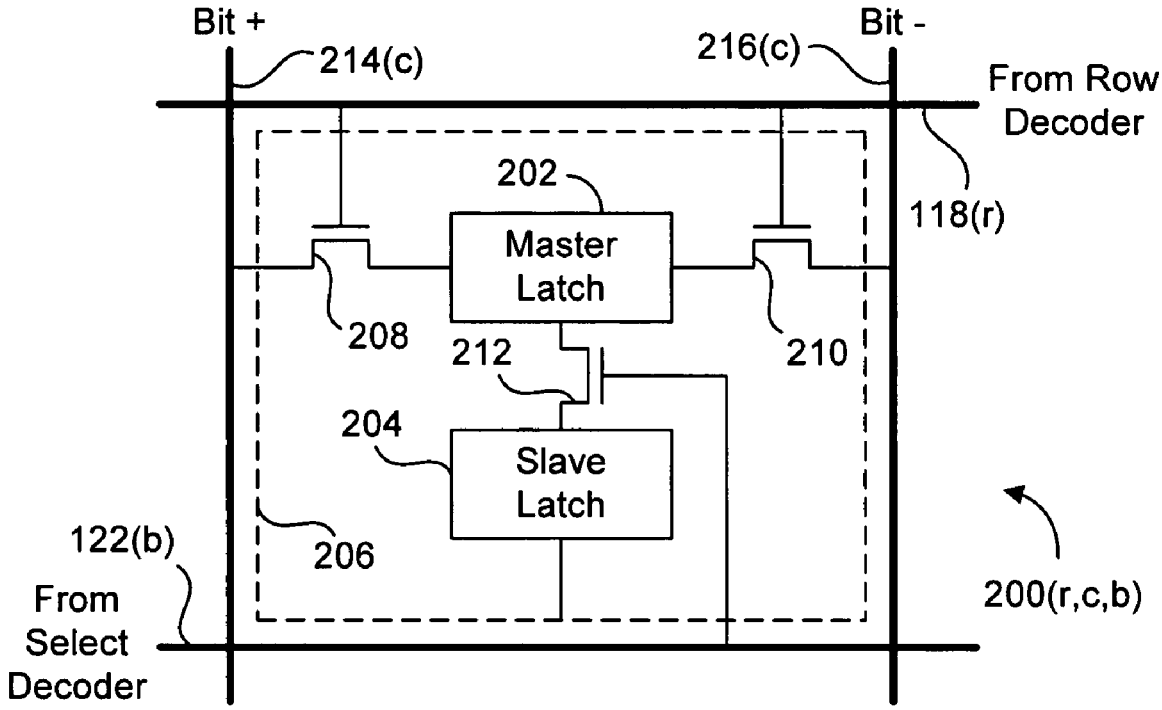
FIG. 2A Prior Art
FIG. 2A is a block diagram of a single pixel cell of the pixel array of FIG. 1.
Figure 2B:
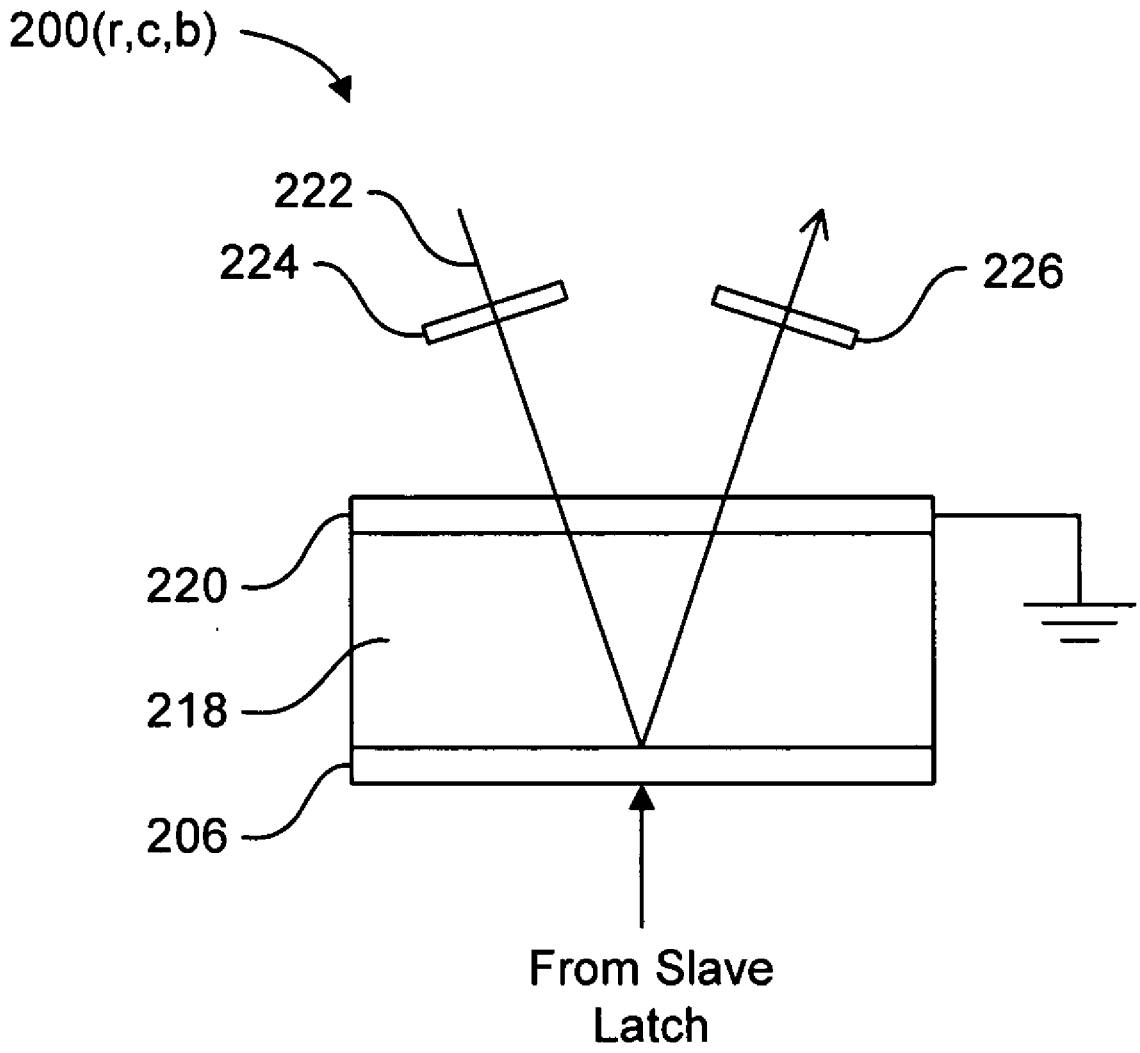
FIG. 2B Prior Art
FIG. 2B is a side elevational view of the light modulating portion of the pixel cell of FIG. 2A.
Figure 3:
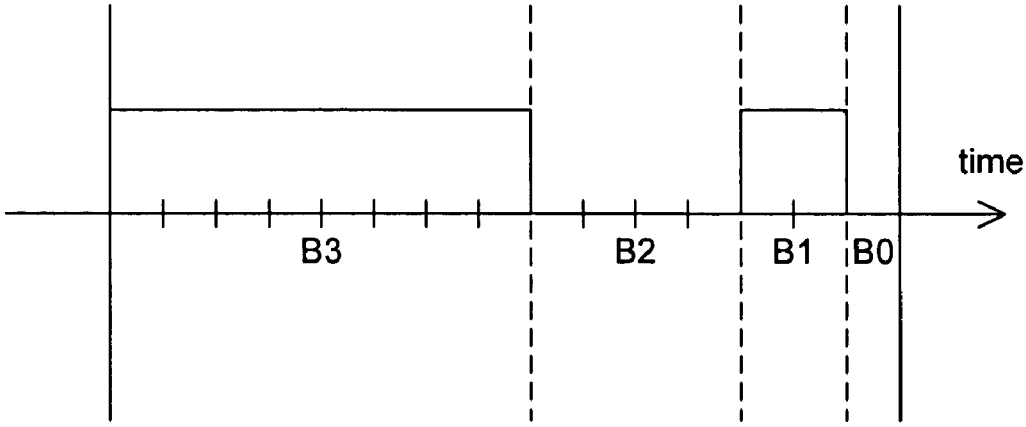
FIG. 3 Prior Art
FIG. 3 shows one frame of 4-bit pulse-width modulation data.
Figure 4:
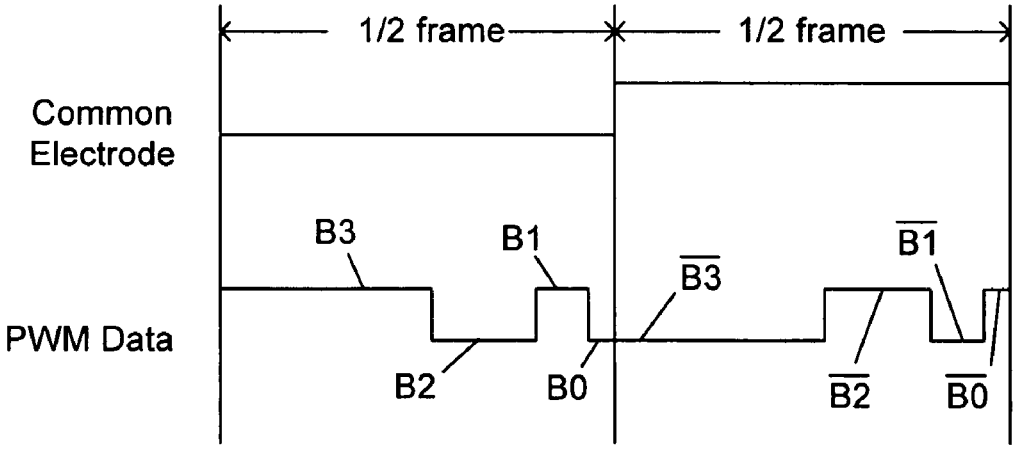
FIG. 4 Prior Art
FIG. 4 shows a split frame application of the 4-bit pulse-width-modulation data of FIG. 3 resulting in a net DC bias of 0 volts.
Figure 5:
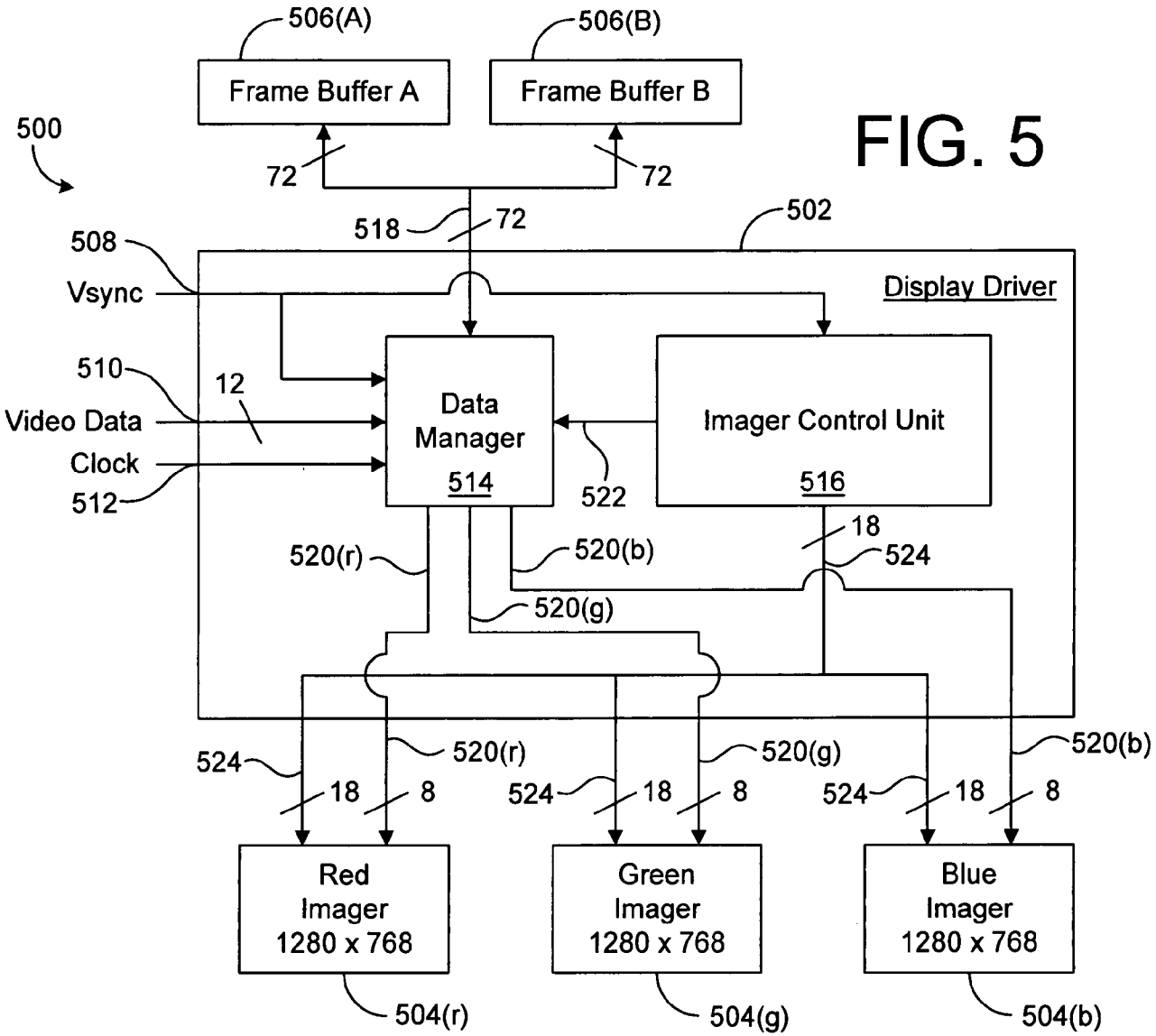
FIG. 5 is a block diagram of a display driving system according to one embodiment of the present invention.

FIG. 5 is a block diagram showing a display system 500 according to one embodiment of the present invention. Display system 500 includes a display driver 502, a red imager 504(*r*), a green imager 504(*g*), a blue imager 504(*b*), and a pair of frame buffers 506(A) and 506(B). Each of imagers 504(*r, g, b*) contain an array of pixel cells (not shown in FIG. 5) arranged in 1280 columns and 768 rows for displaying an image. Display driver 502 receives a plurality of inputs from a system (e.g., a computer system, television receiver, etc., not shown), including a vertical synchronization (Vsync) signal via input terminal 508, video data via a video data input terminal set 510, and a clock signal via a clock input terminal 512.

Display driver 502 includes a data manager 514 and an imager control unit (ICU) 516. Data manager 514 is coupled to Vsync input terminal 508, video data input terminal set 510, and clock input terminal 512. In addition, data manager 514 is coupled to each of frame buffers 506(A) and 506(B) via 72-bit buffer data bus 518. Data manager is also coupled to each imager 504(*r, g, b*) via a plurality (eight in the present embodiment) of imager data lines 520(*r, g, b*), respectively. Therefore, in the present embodiment bus 518 has three times the bandwidth of imager data lines 520(*r, g, b*) combined. Finally, data manager 514 is coupled to a coordination line 522. Imager control unit 516 is also coupled to synchronization input 508 and to coordination line 522, and to each of imagers 504(*r, g, b*) via a plurality (eighteen in the present embodiment) of imager control lines 524(*r, g, b*).

Display driver 502 controls and coordinates the driving process of imagers 504(*r, g, b*). Data manager 514 receives video data via video data input terminal set 510, and provides the received video data to one of frame buffers 506(A-B) via buffer data bus 518. In the present embodiment, video data is transferred to frame buffers 506(A-B) 72 bits at a time (i.e., (6) 12-bit data words at a time). Data manager 514 also retrieves video data from one of frame buffers 506(A-B), separates the video data according to color, and provides each color (i.e., red, green, and blue) of video data to the respective imager 504(*r, g, b*) via imager data lines 520(*r, g, b*). Note that imager data lines 520 (*r, g, b*) each include 8 lines. Thus, two pixels worth of the 4-bit data can be transferred at one time. It should be understood, however, that a greater number of data lines 520 (*r, g, b*) could be provided to reduce the speed and number of transfers required. Data manager 514 utilizes the coordination signals received via coordination line 522 to ensure that the proper data is provided to each of imagers 504(*r, b, g*) at the proper time. Finally, data manager 514 utilizes the synchronization signals provided at synchronization input 508 and the clock signals received at clock input terminal 512 to coordinate the routing of video data between the various components of display driving system 500.

Data manager 514 reads and writes data from and to frame buffers 506 (A and B) in alternating fashion. In particular, data manager 514 reads data from one of the frame buffers (e.g., frame buffer 506(A)) and provides the data to imagers 504 (*r, g, b*), while data manager writes the next frame of data to the other frame buffer (e.g., frame buffer 506(B)). After the first frame of data is written from frame buffer 506(A) to imagers 504 (*r, g, b*), then data manager 514 begins providing the second frame of data from frame buffer 506(*b*) to imagers 504(*r, g, b*), while writing the new data being received into frame buffer 506(A). This alternating process continues as data streams into display driver 502, with data being written into one of frame buffers 506 while data is read from the other of frame buffers 506.

Imager control unit 516 controls the modulation of the pixel cells of each imager 504(*r, g, b*). Imagers 504(*r, g, b*) are arranged such that video data provided by data manager 514 can be asserted to form a full color image once each of the colored images are superimposed. Imager control unit 516 supplies various control signals to each of imagers 504(*r, g, b*) via common imager control lines 524. Imager control unit 516 also provides coordination signals to data manager 514 via coordination line 522, such that imager control unit 516 and data manager 514 remain synchronized and the integrity of the image produced by imagers 504(*r, g, b*) is maintained. Finally, imager control unit 516 receives synchronization signals from synchronization input terminal 508, such that imager control unit 516 and data manager 514 are resynchronized with each frame of data.

Responsive to the video data received from data manager 514 and to the control signals received from imager control unit 516, imagers 504(*r, g, b*) modulate each pixel of their respective displays according to the video data associated with that pixel. Each pixel of imagers 504(*r, g, b*) are modulated with a single pulse, rather than a conventional pulse width modulation scheme. In addition, each row of pixels of imagers 504(*r, g, b*) are driven asynchronously such that the rows are processed during distinct modulation periods that are temporally offset. These and other advantageous aspects of the present invention will be described in further detail below.

Figure 6:
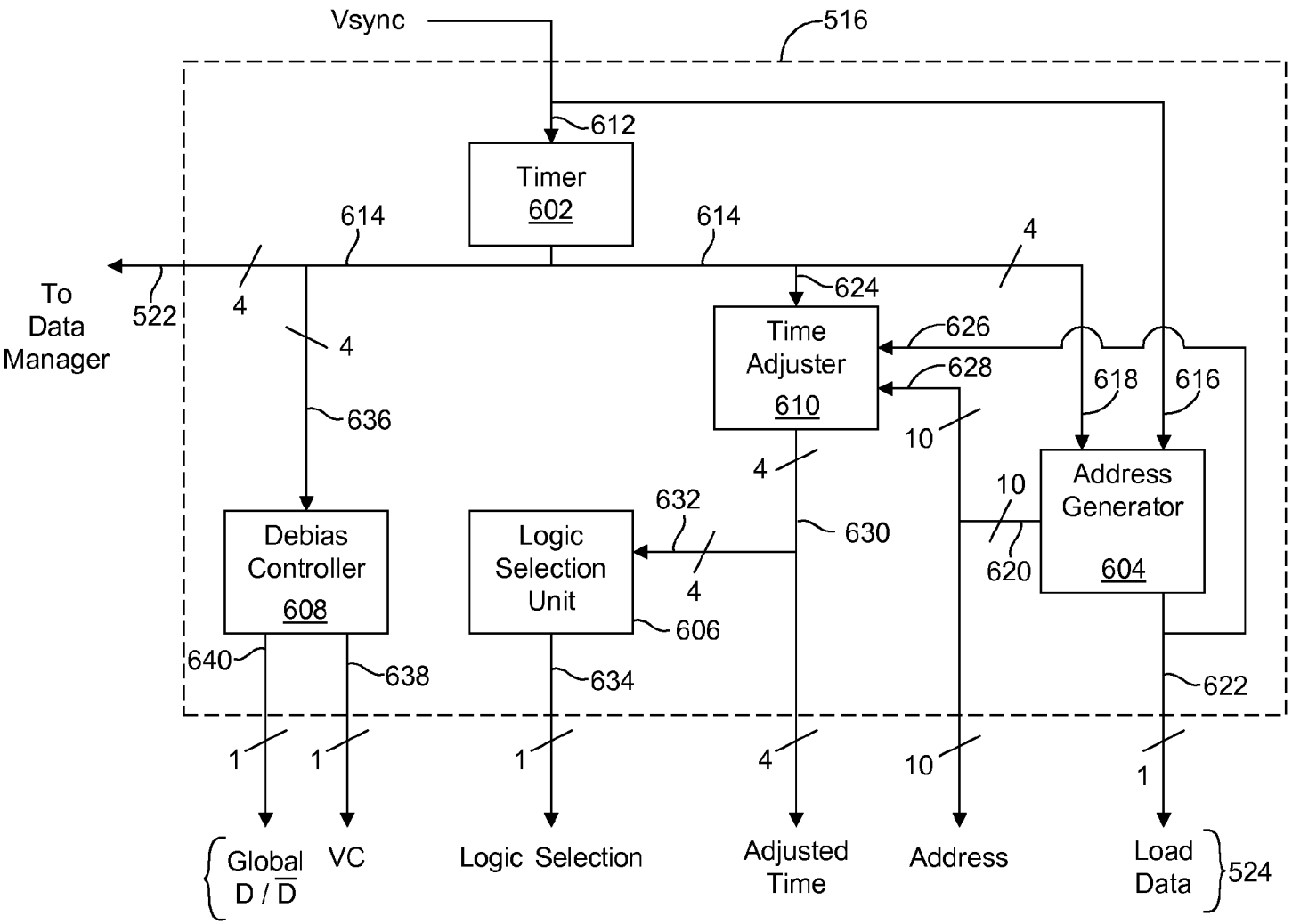
FIG. 6 is a block diagram showing the imager control unit of FIG. 5 in greater detail.

FIG. 6 is a block diagram showing imager control unit 516 in greater detail. Imager control unit 516 includes a timer 602, an address generator 604, a logic selection unit 606, a debias controller 608, and a time adjuster 610. Timer 602 coordinates the operations of the various components of imager control unit 516 by generating a sequence of time values that are used by the other components during operation. In the present embodiment, timer 602 is a simple counter that includes a synchronization input 612 for receiving the Vsync signal and a time value output bus 614 for outputting the timing signals generated thereby. The number of timing signals generated by timer 602 is determined by the formula:

$$\text{Timing signals}=(2^n-1),$$

where n equals the number of bits of display data used to determine the grayscale values produced by the displays of imagers 504(*r, g, b*). In the present 4-bit embodiment, timer 602 counts consecutively from 1 to 15. Once timer 602 reaches a value of 15, timer 602 loops back such that the next timing signal output has a value of 1. Each timing value is provided as a timing signal on time value output bus 614. Time value output bus 614 provides the timing signals to address generator 604, time adjuster 610, debias controller 608, and coordination line 522.

At initial startup or after a video reset operation caused by the system (not shown), timer 602 is operative to start generating timing signals after receiving a first Vsync signal on synchronization input 612. In this manner, timer 602 is synchronized with data manager 514. Thereafter, timer 602 provides timing signals to data manager 514 via timing output 614(4) and coordination line 522, such that data manager 514 remains synchronized with imager control unit 516. Once data manager 514 receives the first synchronization signal via synchronization input 508 and the first timing signal via coordination line 522, data manager 514 begins transferring video data as described above.

Address generator 604 provides row addresses to each of imagers 504(*r, g, b*) and to time adjuster 610. Address generator 604 has a plurality of inputs including a synchronization input 616 and a timing input 618, and a plurality of outputs including 10-bit address output bus 620, and a single bit load data output 622. Synchronization input 616 is coupled to receive the Vsync signal from synchronization input 508 of display driver 502, and timing input 618 is coupled to time value output bus 614 of timer 602 to receive timing signals therefrom. Responsive to receiving timing values via timing input 618, address generator 604 is operative to generate row addresses and to consecutively assert the row addresses on address output bus 620. Address generator 604 generates 10-bit row addresses and asserts each bit of the generated row addresses on a respective line of address output bus 620. Furthermore, depending on whether the row address generated by address generator 604 is a "write" address (e.g., to write data into display memory) or a "read" address (e.g., to read data from display memory), address generator 604 will assert a load data signal on load data output 622. In the present embodiment, a digital HIGH value asserted on load data output 622 indicates that address generator 604 is asserting a write address on address output bus 620, while a digital LOW value indicates a read address. The reading and writing of data from/to memory of the display will be described in greater detail below.

Time adjuster 610 adjusts the time value output by timer 602 based on the row address received from address generator 604. Time adjuster 610 includes a 4-bit timing input 624 coupled to time value output bus 614, a disable adjustment input 626 coupled to load data output 622 of address generator 604, a 10-bit address input 628 coupled to address output bus 620 of address generator 604, and a 4-bit adjusted timing output bus 630.

Responsive to the signal asserted on disable adjustment input 626 and the row address asserted on address input 628, time adjuster 610 adjusts a time value asserted on timing input 624 and asserts the adjusted time value on adjusted timing output bus 630. The signal received on disable adjustment input 626 indicates to time adjuster 610 whether the row address asserted on address input 628 is a write address (e.g., a digital HIGH signal) or a read address (e.g., a digital LOW signal). Time adjuster 610 adjusts the time value asserted on timing input 624 only for read row addresses that are asserted on address input 628. Accordingly, when the signal asserted on disable adjustment input 626 is HIGH, indicating that a write address is being output by address generator 604, time adjuster 610 ignores the row address and does not update the adjusted timing signal output on adjusted timing output bus 630.

Time adjuster 610 can be created from a variety of different components, however in the present embodiment, timing adjuster 610 is a subtraction unit that decrements the time value output by timer 602 based upon the row address asserted on address input 628. In another embodiment, time adjuster 610 is a look-up table that returns an adjusted time value depending on the time value received on timing input 624 and the row address received on address input 628.

Logic selection unit 606 provides logic selection signals to each of imagers 504(*r, g, b*). Logic selection unit 606 includes an adjusted timing input 632 coupled to adjusted timing output bus 630 and a logic selection output 634. Depending on the adjusted timing signal received on adjusted timing input 632, logic selection unit 606 is operative to generate a logic selection signal and assert the logic selection signal on logic selection output 634. For example, if the adjusted time value asserted on adjusted timing input 632 is one of a first predetermined plurality time values (e.g., time values 1 through 3), then logic selection unit 606 is operative to assert a digital HIGH value on logic selection output 634. Alternately, if the adjusted time value is one of a second predetermined plurality of time values (e.g., 4 through 15), then logic selection unit 606 is operative to assert a digital LOW value on logic selection output 634.

In the present embodiment, logic selection unit 606 is a look-up table for looking up the value of the logic selection signal based upon the value of the adjusted timing signal received via timing input 632. However, any device/logic that provides the appropriate logic signal responsive to the available inputs can be substituted for logic selection unit 606. For example, logic selection unit 606 could receive a row address and load data signal from address generator 604 and a timing signal from timer 602, and generate the appropriate logic selection signals based on the unadjusted time value and the particular row address.

Debias controller 608 controls the debiasing process of each of imagers 504(*r, g, b*) in order to prevent deterioration of the liquid crystal material therein. Debias controller 608 includes a timing input 636, coupled to time value output bus 614, and a pair of outputs including a common voltage output 638 and a global data invert output 640. Debias controller 608 receives timing signals from timer 602 via timing input 636, and depending on the value of the timing signal, debias controller 608 asserts one of a plurality of predetermined voltages on common voltage output 638 and a HIGH or LOW global data invert signal on global data invert output 640. The voltage asserted by debias controller 608 on common voltage output 638 is asserted on the common electrode (e.g., an Indium-Tin Oxide (ITO) layer) of the pixel array of each of imagers 504(*r, g, b*). In addition, the global data invert signals asserted on global data invert output 640 determine whether data asserted on each of the electrodes of the pixel cells of imagers 504(*r, g, b*) is asserted in a normal or inverted state.

Finally, imager control lines 524 convey the outputs of the various elements of imager control unit 516 to each of imagers 504(*r, g, b*). In particular, imager control lines 524 include adjusted timing output bus 630 (4 lines), address output bus 620 (10 lines), load data output 622 (1 line), logic selection output 634 (1 line), common voltage output 638 (1 line), and global data invert output 640 (1 line). Accordingly, imager control lines 524 are composed of 18 control lines, each providing signals from a particular element of imager control unit 516 to each imager 504(*r, g, b*). Each of imagers 504(*r, g, b*) receive the same signals from imager control unit 516 such that imagers 504(*r, g, b*) remain synchronized.

Figure 7:
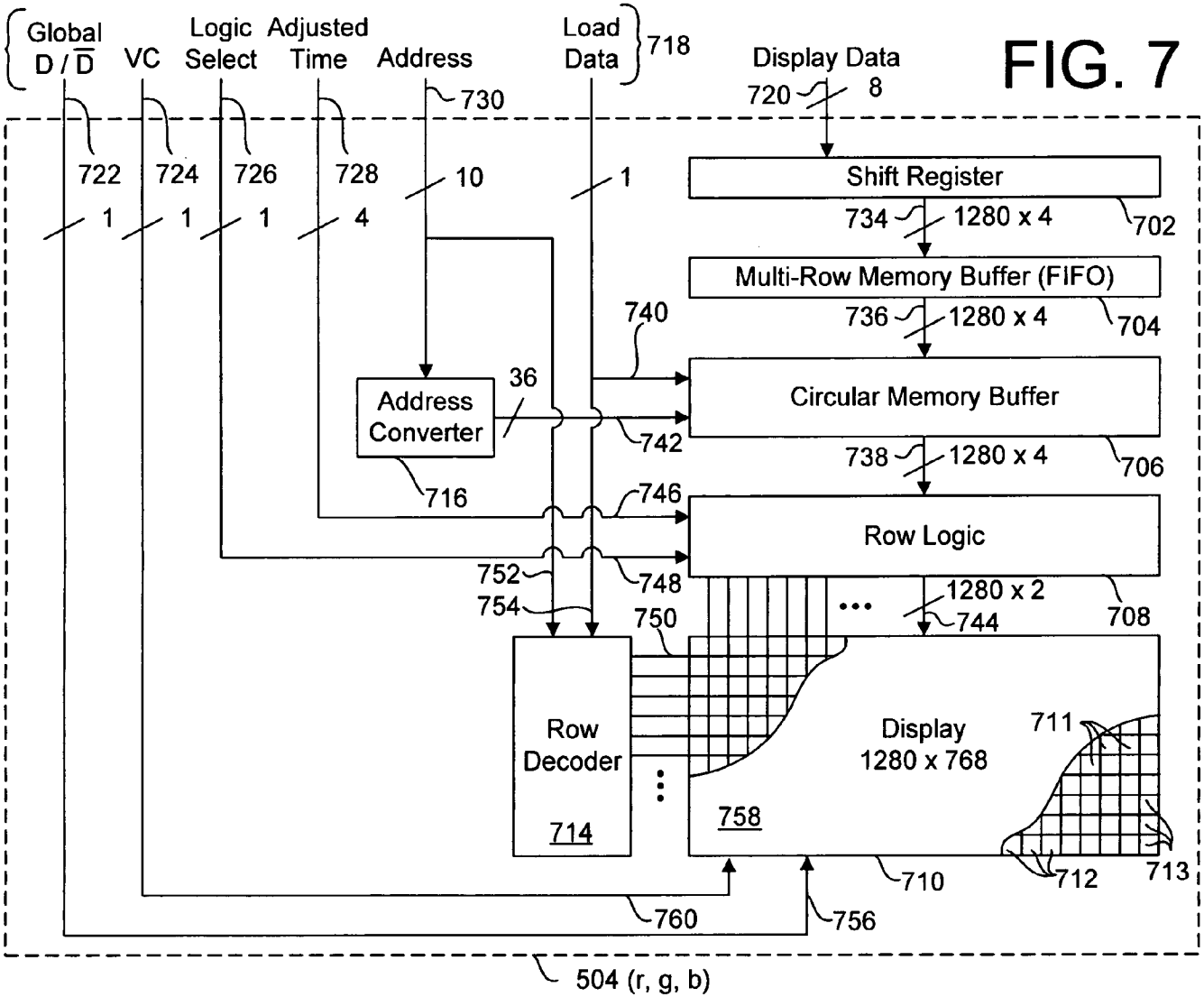
FIG. 7 is a block diagram showing one of the imagers of FIG. 5 in greater detail.

FIG. 7 is a block diagram showing one of imagers 504(*r, g, b*) in greater detail. Imager 504(*r, g, b*) includes a shift register 702, a multi-row first-in-first-out (FIFO) buffer 704, a circular memory buffer 706, row logic 708, a display 710 including an array of pixel cells 711 arranged in 1280 columns 712 and 768 rows 713, a row decoder 714, an address converter 716, a plurality of imager control inputs 718, and a display data input 720. Imager control inputs 718 include a global data invert input 722, a common voltage input 724, a logic selection input 726, an adjusted timing input 728, an address input 730, and a load data input 732. Global data invert input 722, common voltage input 724, logic selection input 726, and load data input 732 are all single line inputs and are coupled to global data invert line 640, common voltage line 638, logic selection line 634, and load data line 622, respectively, of imager control lines 524. Similarly, adjusted timing input 728 is a 4 line input coupled to adjusted timing output bus 630 of imager control lines 524, and address input 730 is a 10 line input coupled to address output bus 620 of imager control lines 524. Finally, display data input 720 is an 8 line input coupled to the respective 8 imager data lines 520(*r, b, g*), for receiving red, green or blue display data thereby.

Note that because display data input 720 includes 8 lines, 2 pixels worth of the 4-bit data can be received simultaneously. It should be understood, however, that in practice, many more data lines will be provided to increase the amount of data that can be transferred at one time. The numbers have been kept relatively low in this example, for the sake of clear explanation.

Shift register 702 receives and temporarily stores display data for a single row 713 of pixel cells 711 of display 710. Display data is written into shift register 702 eight bits at a time via data input 720 until display data for a complete row 713 has been received and stored. In the present embodiment, shift register 702 is large enough to store four bits of video data for each pixel cell 711 in a row 713. In other words, shift register 702 is able to store 5,120 bits (e.g., 1280 pixels/row×4 bits/pixel) of video data. Once shift register 702 contains data for a complete row 713 of pixel cells 711, the data transferred from shift register 702 into FIFO 704 via data lines 734 (1280×4).

FIFO 704 provides temporary storage for a plurality of complete rows of video data received from shift register 702. A row 713 of display data is stored in memory buffer 704 only as long as is required to write the row of display data (and any previously stored rows) into circular memory buffer 706. As will be described in further detail below, multi-row memory buffer 704 must be sufficiently large to contain CIELING $$\left(\frac{r}{2^n - 1}\right)$$

rows of display data, where r represents the number of rows 713 in display 710, n represents the number of bits used to define the grayscale of each pixel 711 in display 710, and CEILING is a function that rounds a decimal result up to the nearest integer. Accordingly, in the present embodiment where r=768 and n=4, FIFO 704 has the capacity (i.e., approximately 266 Kilobits) to store 52 complete rows 713 of 4-bit display data.

Circular memory buffer 706 receives rows of 4-bit display data output by FIFO 704 on data lines 736 (1280×4), and stores the video data for an amount of time sufficient for a signal corresponding to grayscale value of the data to be asserted on an appropriate pixel 711 of display 710. Responsive to control signals, circular memory buffer 706 asserts the 4-bit display data associated with each pixel 711 of a row 713 of display 710 onto data lines 738.

To control the input and output of data, circular memory buffer 706 includes a single bit load input 740 and a 10-bit address input 742. Depending on the signals asserted on load input 740 and address input 742, circular memory buffer 706 is operative to either load the row 713 of 4-bit display data being asserted on data lines 736 from FIFO 704, or to provide a row of previously stored 4-bit display data to row logic 708 via data lines 738 (1280×4). For example, if a signal asserted on load input 740 was HIGH indicating a write address was output by address generator 604, then circular memory buffer 706 loads the bits of video data asserted on data lines 736 into memory. The memory locations into which the bits are loaded are determined by address converter 716, which asserts converted memory addresses onto address inputs 742. If on the other hand, the signal asserted on load input 740 was LOW, indicating a read row address output by address generator 604, then circular memory buffer 706 retrieves a row of 4-bit display data from memory, and asserts the data onto data lines 738. The memory locations from which the previously stored display data are obtained are also determined by address converter 716, which asserts converted read memory addresses onto address inputs 742.

Row logic 708 writes single bit data to the pixels 711 of display 710, depending on the value of the 4-bit data on lines 738, the adjusted time value on input 746, the logic select signal on input 748, and in some cases, the data currently stored in the pixels 711. Row logic 708 receives an entire row of 4-bit display data via data lines 738, and based on the display data updates the single bits asserted on pixels 711 of the particular row 713, via display data lines 744. Note that a first set of 1280 data lines 744 is used to read data from pixels 711, while a second set of 1280 data lines 744 is used to write data to pixels 711. Row logic 708 writes appropriate single-bit data to initialize and terminate an electrical pulse on each pixel 711, such that the duration of the pulse corresponds to the grayscale value of the 4-bit video data for the particular pixel.

It should be noted that row logic 708 updates each row 713 of display 710 a plurality of times during the row's modulation period in order to assert the electrical pulse on each pixel 711 of the row 713 for the proper duration. Row logic 708 utilizes different logic elements (FIG. 8) to update the electrical signal asserted on the pixel 711 at different times, depending on the logic selection signals provided on logic selection input 748.

It should also be noted that in the present embodiment row logic 708 is a "blind" standalone logic element. In other words, row logic 708 does not need to know which row 713 of display 710 it is processing. Rather, row logic 708 receives a 4-bit data word for each pixel 711 of a particular row 713, a value currently stored in each pixel 711 in row 713 via one of data lines 744, an adjusted time value on adjusted timing input 746, and a logic selection signal on logic selection input 748. Based on the display data, adjusted time value, logic selection signal, and in some cases the value currently stored in pixel 711, row logic 708 determines whether pixel 711 should be changed to "ON" or "OFF" at a particular adjusted time, and asserts a digital HIGH or digital LOW value, respectively, onto the corresponding one of display data lines 744.

Display 710 is a typical reflective or transmissive liquid crystal display (LCD), having 1280 columns 712 and 768 rows 713 of pixel cells 711. Each row 713 of display 710 is enabled by an associated one of a plurality of row lines 750. Because display 710 includes 768 rows of pixels 711, there are 768 row lines 750. In addition, 2560 (1280×2) data lines 744 communicate data between row logic 708 and display 710. In particular, there are two data lines 744 connecting each column 712 of display 710 with row logic 708. One data line 744 provides single bit data from row logic 708 to a pixel 711 in a particular column 712 when the pixel 711 is enabled, while the other data line 744 provides previously written data from the pixel 711 to row logic 708, also when the pixel 711 is enabled. Although two separate data lines are shown in order to facilitate a clear understanding of the invention, it should be understood that each read/write pair of data lines 744 could be replaced with a single line that could be used to both read and write data from/to pixels 711.

Display 710 also includes a common electrode (e.g., an Indium-Tin-Oxide layer, not shown) overlying all of pixels 711. Voltages can be asserted on the common electrode via common voltage input 724. In addition, the voltage asserted on each pixel 711 by the single bit stored therein can be inverted (i.e., switched between normal and inverted values)

depending upon the signal asserted on global data invert input 722. The signal asserted on global data invert input 722 is provided to each pixel cell 711 of display 710.

The signals asserted on global data invert terminal 722 and the voltages asserted on common voltage input 724 are used to debias display 710. As is well known in the art, liquid crystal displays will degrade due to ionic migration in the liquid crystal material when the net DC bias across the liquid crystal is not zero. Such ionic migration degrades the quality of the image produced by the display. By debiasing display 710, the net DC bias across the liquid crystal layer is retained at or near zero and the quality of images produced by display 710 is kept high.

Row decoder 714 asserts a signal on one of word lines 750 at a time, such that the previously stored data in the row of pixels is communicated back to row logic 708 via the one half of display data lines 744 and the single bit data asserted by row logic 708 on the other half of display lines 744 is latched into the enabled row 713 of pixels 711 of display 710. Row decoder 714 includes a 10-bit address input 752, a disable input 754, and 768 word lines 750 as outputs. Depending upon the row address received on address input 752 and the signal asserted on disable input 754, row decoder 714 is operative to enable one of word lines 750 (e.g., by asserting a digital HIGH value). Disable input 754 receives the single bit load data signal output by address generator 604 on load data output 622. A digital HIGH value asserted on disable input 754 indicates that the row address received by row decoder 714 on address input 752 is a "write" address, and that data is being loaded into circular memory buffer 706. Accordingly, when the signal asserted on disable input 754 is a digital HIGH, then row decoder 714 ignores the address asserted on address input 752 and does not enable a new one of word lines 750. On the other hand, if the signal on disable input 754 is a digital LOW, then row decoder 714 enables one of word lines 750 associated with the row address asserted on address input 752. Row decoder 714 receives 10-bit row addresses on address input 752. A 10-bit row address is required to uniquely define each of the 768 rows 713 of display 710.

Address converter 716 receives the 10-bit row addresses via address input 730, converts each row address into a plurality of memory addresses, and provides the memory addresses to address input 742 of circular memory buffer 706. In particular, address converter 716 provides a memory address for each bit of display data, which are stored independently in circular memory buffer 706. For example, in the present 4-bit driving scheme, address converter 716 converts a row address received on address input 730 into four different memory addresses, the first memory address associated with a least significant bit ($B_0$) section of circular memory buffer 706, the second memory address associated with a next least significant bit ($B_1$) section of circular memory buffer 706, the third memory address associated with a most significant bit ($B_3$) section of circular memory buffer 706, and the fourth memory address associated with a next most significant bit ($B_2$) section of circular memory buffer 706. Depending upon the load data signal asserted load data input 740, circular memory buffer 706 loads data into or retrieves data from the particular locations in circular memory buffer 706 identified by the memory addresses output by address converter 716 for each bit of display data.

Figure 8:
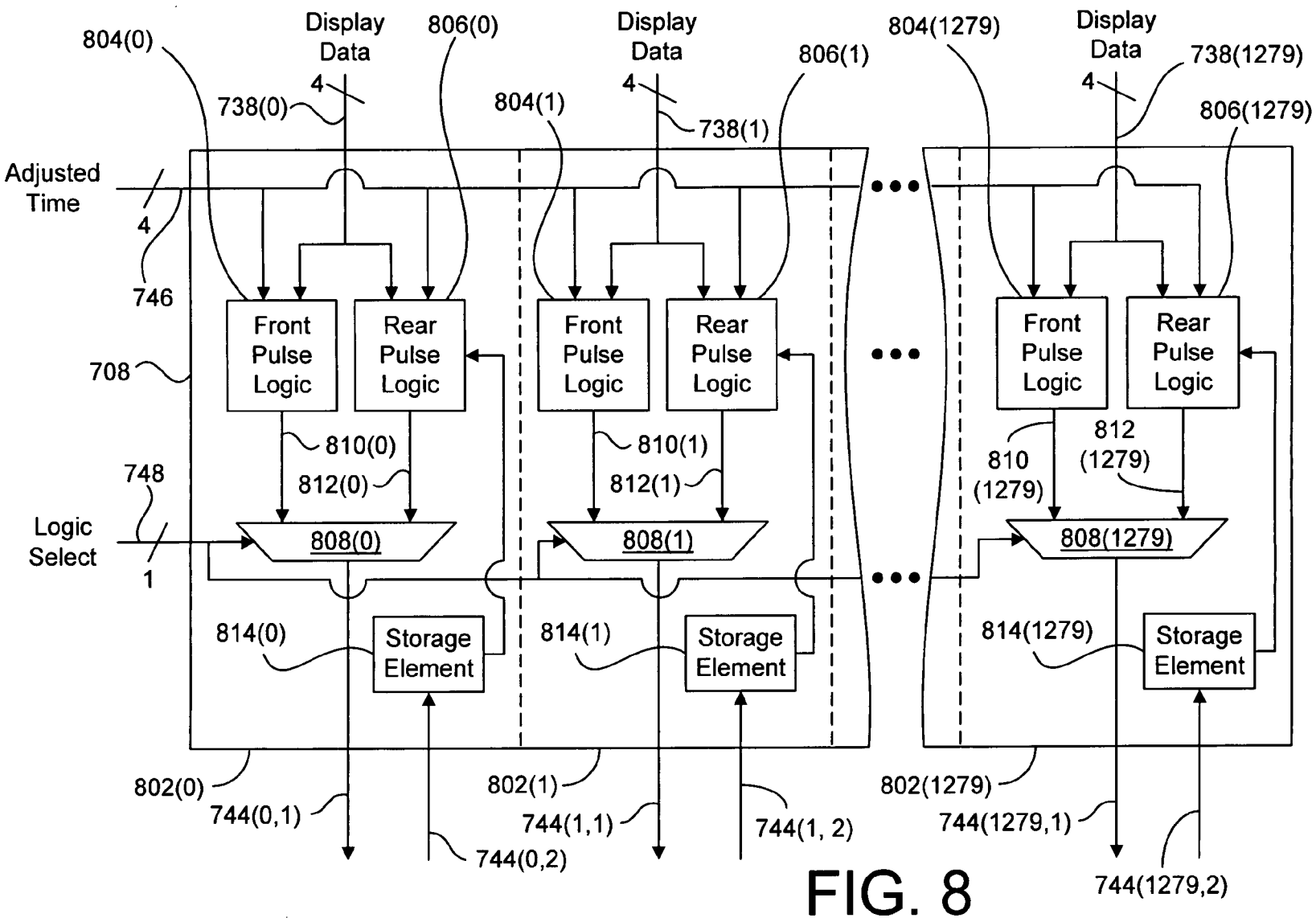
FIG. 8 is a block diagram showing the row logic of the imager of FIG. 7 in greater detail.

FIG. 8 is a block diagram showing row logic 708 in greater detail. Row logic 708 includes a plurality of logic units 802 (0-1279), each of which is responsible for updating the electrical signals asserted on the pixels 711 of an associated one of columns 712 via a respective one of display data lines 744(0-1279, 1). Each logic unit 802(0-1279) includes front pulse logic 804(0-1279), rear pulse logic 806(0-1279), and a multiplexer 808(0-1279). Front pulse logics 804(0-1279) and rear pulse logics 806(0-1279) each include a single bit signal output 810(0-1279) and 812(0-1279), respectively. Signal outputs 810(0-1279) and 812(0-1279) associated with each logic unit 802(0-1279) provide two single bit inputs to a respective one of multiplexers 808(0-1279). Additionally, each logic unit 802(0-1279) includes a storage element 814 (0-1279), respectively, for receiving and storing a data value previously written to the latch of a pixel 711 in an associated column 712 of display 710 via an associated one of data lines 744(0-1279, 2). Storage elements 814(0-1279) receive a new data value each time a row 713 of display 710 is enabled by row decoder 714, and provide the previously written data to a respective rear pulse logic 806(0-1279). Note that the indices for display data lines 744 follow the convention 744 (column number, data line number).

Front pulse logics 804(0-1279) and rear pulse logics 806 (0-1279) both receive 4-bit data words, via a respective set of data lines 738(0-1279), from circular memory buffer 706. Front pulse logics 804(0-1279) and rear pulse logics 806(0-1279) also each receive 4-bit adjusted time values, via adjusted timing input 746. In this particular embodiment, only rear pulse logic 806(0-1279) receives the data value previously written to each pixel 711 of the enabled row 713 of display 710. Depending on the adjusted time value asserted on adjusted timing input 746 and the display data received via data lines 738(0-1279), both front pulse logic 804 and rear pulse logic 806 of each logic unit 802(0-1279) output an electrical signal on signal outputs 810(0-1279) and 812(0-1279), respectively. Note that rear pulse logic 806 uses the output from associated storage element 814 to generate the output asserted on output 810. Thus, the output of rear logic 806 depends on the value of the bit currently being asserted on the associated pixel 711. The electrical signals output by front pulse logics 804(0-1279) and rear pulse logics 806(0-1279) represent either a digital "ON" (e.g., a digital HIGH value) or a digital "OFF" (e.g., a digital low value).

Each of multiplexers 808(0-1279) receives a logic selection signal via logic selection input 748. Logic selection input 748 is coupled to the control terminals of each of multiplexers 808(0-1279) and causes multiplexers 808(0-1279) to assert either the output of front pulse logic 804 or the output of rear pulse logic 806 onto the respective display data lines 744(0-1279, 1). For example, if the logic selection signal received on logic selection input 748 is a digital HIGH value, then each of multiplexers 808(0-1279) couple signal outputs 810(0-1279) of front pulse logics 804(0-1279) with display data lines 744(0-1279). If on the other hand, the logic selection signal received on logic selection input 748 is a digital LOW value, then each of multiplexers 808(0-1279) couple signal outputs 812(0-1279) of rear pulse logics 806(0-1279) with display data lines 744(0-1279).

As stated above, the logic selection signal asserted by logic selection unit 606 (FIG. 6) on logic selection input 748 will be HIGH for a first plurality of predetermined times, and LOW for a second plurality of predetermined times. In the present embodiment, the logic selection signal is HIGH for adjusted time values one through three, and is LOW for any other adjusted time value. Accordingly, multiplexers 808(0-1279) couple signal outputs 810(0-1279) of front pulse logics 804 (0-1279) with display data lines 744(0-1279) during each of the first plurality of predetermined times, and couple signal outputs 812(0-1279) of rear pulse logics 806(0-1279) with display data lines 744(0-1279) for the second plurality of predetermined times.

Figure 9:
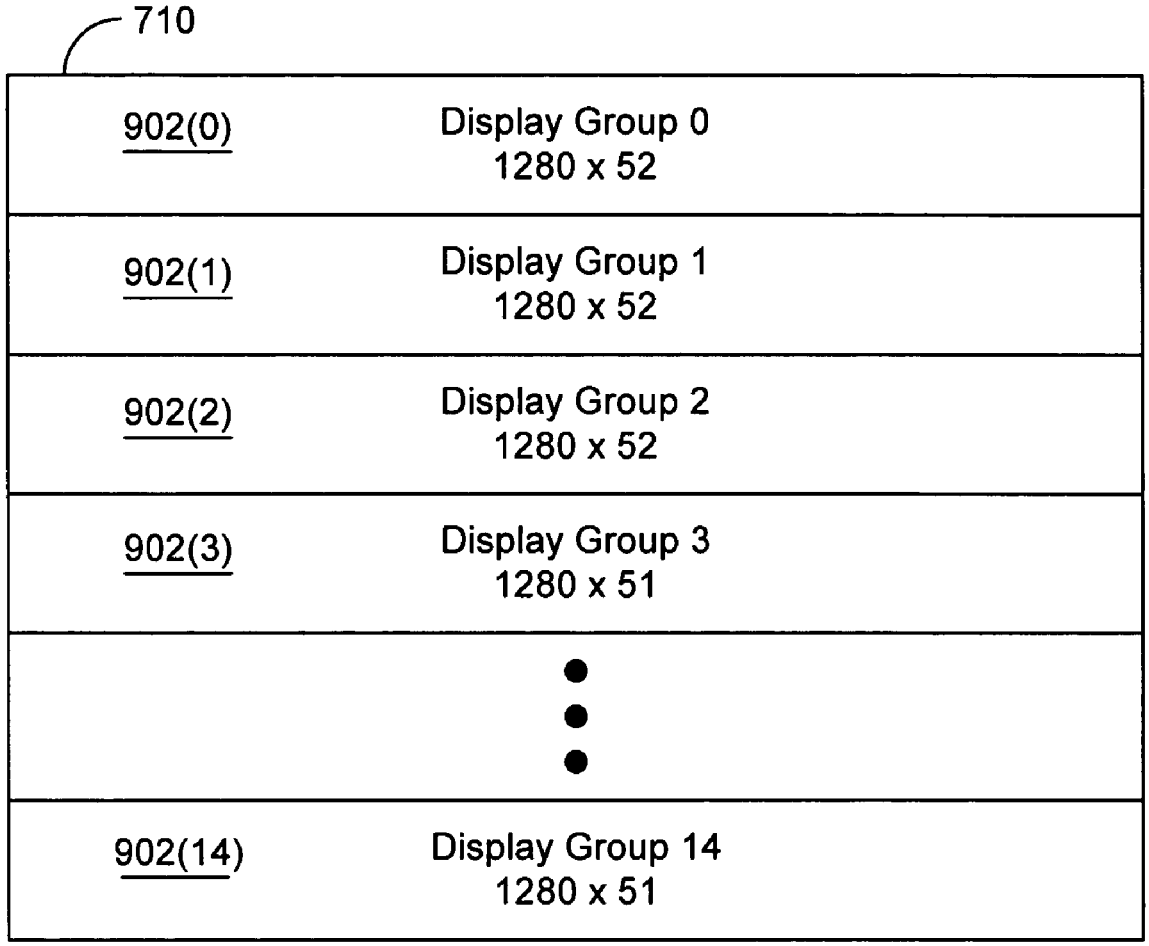
FIG. 9 is a diagram showing a method of grouping rows of pixels of each of the imagers of FIG. 5 according to the present invention.

FIG. 9 is a block diagram showing one method of grouping the rows 713 of display 710 according to the present invention. The number of groups 902 which the rows 713 are divided into is determined by the formula:

$$\text{Groups}=(2^n-1),$$

where n equals the number of bits in the data words that define the grayscale values of the pixels 711 of display 710. In the present embodiment, n=4, so there will be 15 groups. The number of groups also determines the number of time values produced by timer 602. As will be described later, having an equal number of time values and groups 902 ensures that modulation of display 710 remains substantially uniform, but it is not an essential requirement of the invention.

As shown in the present embodiment, display 710 is divided into fifteen groups 902(0-14). Groups 902(0-2) contain fifty-two (52) rows each, while the remaining groups 902(3-14) contain 51 rows. In the present embodiment, the rows 713 of display 710 are divided into groups in order starting from the top of display 710 to the bottom of display 710, such that the groups 902(0-14) contain the following rows 713:

Group 0: Row 0 through Row 51
Group 1: Row 52 through Row 103
Group 2: Row 104 through Row 155
Group 3: Row 156 through Row 206
Group 4: Row 207 through Row 257
Group 5: Row 258 through Row 308
Group 6: Row 309 through Row 359
Group 7: Row 360 through Row 410
Group 8: Row 411 through Row 461
Group 9: Row 462 through Row 512
Group 10: Row 513 through Row 563
Group 11: Row 564 through Row 614
Group 12: Row 615 through Row 665
Group 13: Row 666 through Row 716
Group 14: Row 717 through Row 767

It should be noted that the rows 713 of display 710 do not necessarily have to be grouped in the order provided above. For example, group 902(0) could include row 713(0) and every fifteenth row thereafter. In such a case, group 902(1) would include row 713(1) and every fifteenth row thereafter. In this particular example, the rows 713 of display 710 would be assigned to groups 902(0-14) according to (r MOD $2^n$), where r represents the row 713(0-767) and MOD is the remainder function. The particular rows 713 that are assigned to each group 902(0-14) can change, however the rows 713 of display 710 should be dispersed as evenly as possible between the groups 902(0-15), although this is not an essential requirement. In addition, no matter how rows 713 are allocated among groups 902(0-14), data manager 514 provides data to imagers 504(*r, g, b*) in the same order as the rows 713 are updated by row logic 708.

Several general formulas can be used to ensure that each group 902(0-14) contains approximately the same number of rows. For example, the minimum number of rows contained in each group 902 is given by the formula:

$$INT\left(\frac{r}{2^n-1}\right),$$

where r equals the number of rows 713 in display 710, n equals the number of bits in the data words that define the grayscale value of the pixels 711 of display 710, and INT is the integer function which rounds a decimal result down to the nearest integer.

In the case that the rows 713 of display 710 are not evenly divisible by the number of groups 902 (as is the case in FIG. 9), then the following formula can be used to determine a first number of groups 902 that will contain an additional row 713:

$$\text{first number of groups}=r\text{MOD}(2^n-1),$$

where MOD is the remainder function.

Accordingly, the first number of groups 902 will have a number of rows given by the formula:

$$INT\left(\frac{r}{2^n-1}\right)+1,$$

and a second number of groups (i.e., the remaining groups) will have a number of rows given by the formula above. The second number of groups can be determined by the formula:

$$((2^n-1)-r\text{MOD}(2^n-1)).$$

Finally, although groups 902(0-2) (i.e., the first number of groups) are shown consecutively in the present embodiment, it should be noted that groups 902(0-2) could be evenly dispersed throughout the groups 902(0-14). For example, groups 902(0), 902(5) and 902(10) could contain 52 rows, while the remaining groups 902(1-4), 902(6-9), and 902(11-14) could have 51 rows.

Figure 10:
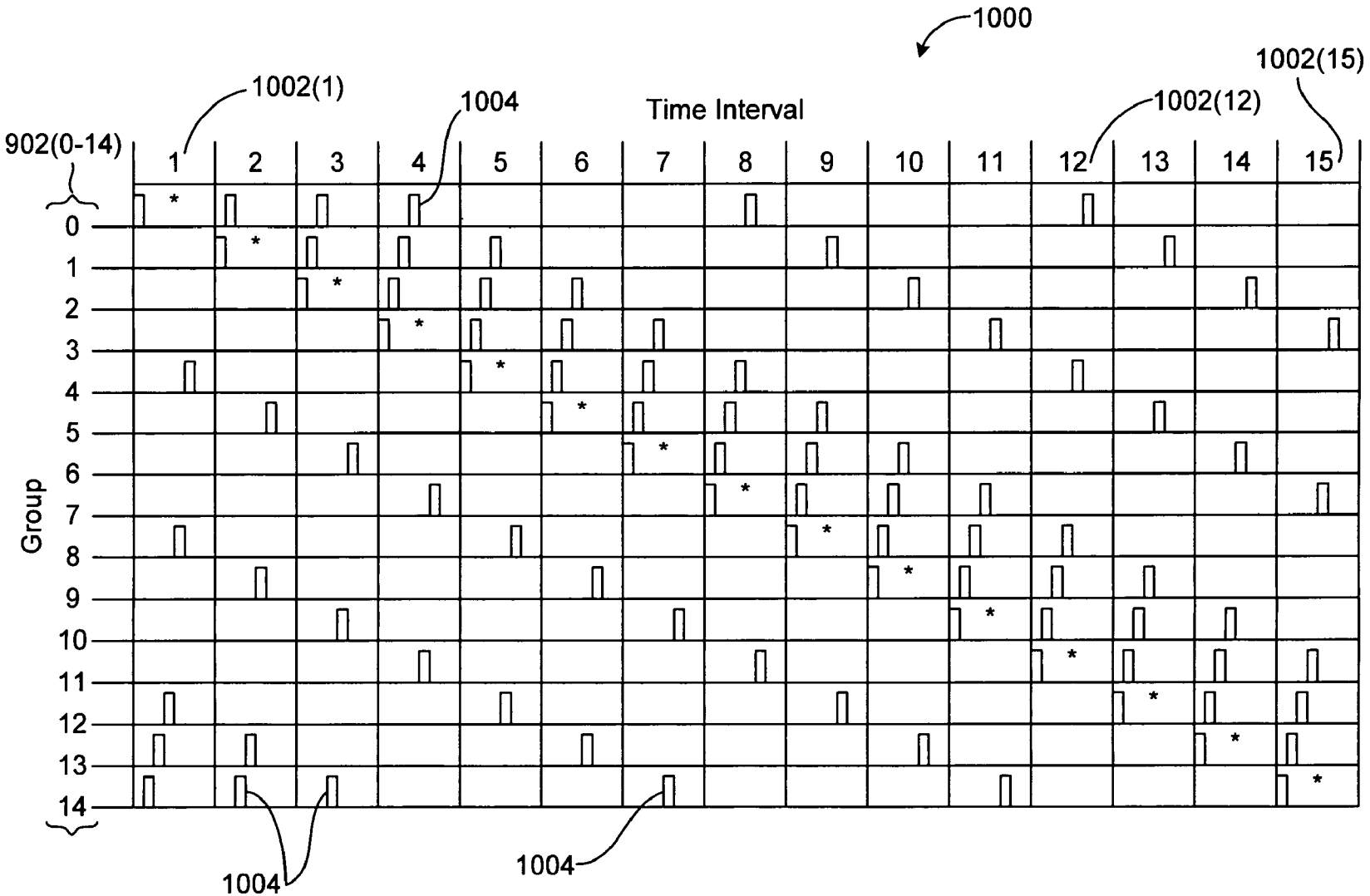
FIG. 10 is a timing chart showing a modulation scheme according to the present invention.

FIG. 10 is a timing chart 1000 showing a modulation scheme according to the present invention. Timing chart 1000 shows the modulation period of each group 902(0-14) divided into a plurality of time intervals 1002(1-15). Groups 902(0-14) are arranged vertically in diagram 1000, while time intervals 1002(1-15) are arranged horizontally across chart 1000. The modulation period of each group 902(0-14) is a time period that is divided into ($2^n$−1) coequal time intervals, which in the present embodiment amounts to ($2^4$−1) or fifteen intervals. Each time interval 1002(1-15) corresponds to a respective time value (1-15) generated by timer 602.

Electrical signals corresponding to particular grayscale values are written to each group 902(0-14) by row logic 708 within the group's respective modulation period. Because the number of groups 902(0-14) is equal to the number of time intervals 1002(1-15), each group 902(0-14) has a modulation period that begins at the beginning of one of time intervals 1002(1-15) and ends after the lapse of fifteen time intervals 1002(1-15) from the start of the modulation period. Accordingly, the modulation periods of groups 902(0-14) are coequal. For example, group 902(0) has a modulation period that begins at the beginning of time interval 1002(1) and end after the lapse of time interval 1002(15). Group 902(1) has a modulation period that begins at the beginning of time interval 1002(2) and ends after the lapse of time interval 1002(1). Group 902(2) has a modulation period that begins at the beginning of time interval 1002(3) and ends after the lapse of time interval 1002(2). This trend continues for the modulation periods for groups 902(3-13), ending with the group 902(14), which has a modulation period starting at the beginning of time interval 1002(15) and ending after the lapse of time interval 1002(14). The beginning of each group 902's modulation period is indicated in FIG. 10 by an asterisk (*).

In general, the modulation period of each group 902(0-14) is temporally offset with respect to every other group 902(0-14) in display 710. For example, the modulation period of the rows 713 of group 902(1) is temporally offset with respect to the modulation period of the rows 713 of group 902(0) by an amount equal to $$\frac{T_1}{(2^n-1)},$$

where $T_1$ represents the duration of the modulation period of group 902(0). Similarly, the modulation period of the rows 713 of group 902(2) is temporally offset with respect to the modulation period of the rows 713 of group 902(0) by an amount equal to $$\frac{2T_1}{(2^n-1)},$$

and is temporally offset with respect to modulation period of the rows 713 of group 902(1) by an amount equal to $$\frac{T_1}{(2^n-1)}.$$

Thus, the rows of the display are driven asynchronously. Stated yet another way, signals corresponding to gray scale values of one frame of data will be asserted on the pixels of some rows at the same time signals corresponding to gray-scale values from a preceding or subsequent frame of data are asserted on other rows. According to this scheme, the system begins to assert image signals for one frame of data on some rows of display 710 before the previous frame of data is completely asserted on other rows.

Row logic 708 and row decoder 714, under the control of signals provided by imager control unit 516 (FIG. 5), update each group 902(0-14) six times during the group's respective modulation period. The process of updating a group 902(0-14) involves row logic 708 sequentially updating the electrical signals on each row 713 of pixels 711 within a particular group 902. Therefore, the phrase "updating a group" is intended to mean row logic 708 sequentially updating the single bit data stored in and asserted on the pixels 711 of each particular row 713 of the particular group(s) 902(0-14).

Chart 1000 includes a plurality of update indicia 1004, each indicating that a particular group 902(0-14) is being updated during a particular time interval 1002(1-15). Using group 902(0) as an example, row logic 708 updates group 902(0) during time intervals 1002(1), 1002(2), 1002(3) 1002(4), 1002(8), and 1008(12). Each time group 902(0) is updated, row logic 708 consecutively processes rows 713(0-51) of display 710 by loading either a digital "ON" or digital "OFF" value into each pixel 711 of the respective one of rows 713(0-51). As shown, row logic 708 is operative to update the electrical signal on each row 713(0-51) of group 902(0) during each of a plurality of consecutive time intervals 1002(1-4) and then update the signal every fourth time interval thereafter (e.g., during intervals 1002(8) and 1002(12)), until the start of the next modulation period. In the present embodiment, row logic 708 utilizes front pulse logic 804(0-1279) to update group 902(0) during time intervals 1002(1-3) and rear pulse logic 806(0-1279) to update group 902(0) for time intervals 1002(4), 1002(8) and 1002(12).

The remaining groups 902(1-14) are updated during the same ones of time intervals 1002(1-15) as group 902(0) when the time intervals 1002(1-15) are adjusted for a particular group's modulation period. For example, with the time intervals 1002(1-15) numbered as shown, group 902(1) is updated during time intervals 1002(2), 1002(3), 1002(4), 1002(5), 1002(9), and 1002(13). However, group 902(1) has a modulation period beginning one time interval later than group 902(0). If the time intervals 1002(1-15) were adjusted (i.e., by subtracting one from each time interval) such that group 902(1) became the reference group, then group 902(1) would be updated during time intervals 1002(1), 1002(2), 1002(3), 1002(4), 1002(8), and 1002(12). Therefore each group 902(0-14) is processed at different times when viewed with respect to one particular group's (i.e., group 902(0)) modulation period, however each group 902(0-14) is updated according to the same algorithm. The algorithm just starts at a different time for each group of rows 902(1-14).

Time adjuster 610 of imager control unit 516 ensures that the timing signal generated by timer 602 is adjusted for the rows 713 of each group 902(0-14), such that row logic 708 receives the proper adjusted timing signal for each group 902(0-14). For example, for row addresses associated with group 902(0), time adjuster 610 does not adjust the timing signal received from timer 602. For row addresses associated with group 902(1), time adjuster 610 decrements the timing signal received from timer 602 by one. For row addresses associated with group 902(2), time adjuster 610 decrements the timing signal received from timer 602 by two. This trend continues for all groups 902, until finally for row addresses associated with group 902(14), time adjuster 610 decrements the timing signal received from timer 602 by fourteen (14).

It should be noted that time adjuster 610 does not produce negative time values, but rather loops the count back to fifteen to finish the time adjustment if the adjustment value needs to be decremented below a value of one. For example, if timer 602 generated a value of eleven and time adjuster 610 received a row address associated with group 902(14), then time adjuster 610 would output an adjusted time value of twelve.

Because each group 902(1-14) is updated during the same time intervals in a group's respective modulation period, time adjuster 610 need only output six different adjusted time values. In the present embodiment, the adjusted time values are one, two, three, four, eight, and twelve. As stated previously, logic selection unit 606 produces a digital HIGH selection signal on logic selection output 634 for adjusted time values one through three, and produces a digital LOW for all remaining adjusted time values. Therefore, logic selection unit produces a digital HIGH logic selection signal for adjusted time values of one, two, and three and produces a digital LOW logic selection signal for adjusted time values of four, eight, and twelve. Accordingly, multiplexers 808(0-1279) couple signal outputs 810(0-1279) of front pulse logics 804(0-1279) with display data lines 744(0-1279, 1) for adjusted time values of one, two, and three, and couple signal outputs 812(0-1279) of rear pulse logics 806(0-1279) with display data lines 744(0-1279, 1) for adjusted time values of four, eight, and twelve.

In addition to showing the number of times a group 902 is updated within its modulation period, chart 1000 also shows which groups 902(0-14) are updated by row logic 708 during each time interval 1002(1-15). The relative location of the update indicia 1004 within the time intervals 1002(1-15) indicates when in the time interval 1002(1-15) a particular group 902(0-14) is updated. For example, in the first time interval, group 902(0) is updated first, group 902(14) is updated second, group 902(13) is updated third, group 902(12) is updated fourth, group 902(8) is updated fifth, and group 902(4) is updated sixth. As another example, in time interval 1002(2), groups are updated in the order 902(1), 902(0), 902(14), 902(13), 902(9), and 902(5). Each of the six groups 902 that are processed within a time interval are processed at different times because row logic 708 takes a finite amount of time to update each one of the six groups 902. In other words, each one of the six particular groups 902 that are to be updated in a particular time interval 1002 must be updated in an amount of time less than or equal to one-sixth of a time interval 1002. Because the number of groups 902(0-14) into which display 710 is divided is equal to the number of time intervals 1002(1-15), the number of groups (e.g., six) processed is the same during each time interval 1002(1-15). This provides the advantage that the power requirements of imagers 504(*r, g, b*) and display driver 502 remain approximately uniform during operation.

It should be noted that in the present embodiment the modulation period associated with each group 902(0-14) forms a frame time for the group 902(0-14). Accordingly, signals corresponding to a complete grayscale value are written to each group 902(0-14) once during its own frame time. However, data can be written to pixels 711 more than once per frame. For example, a group's frame time may include a multiple (e.g., two, three, four, etc.) of modulation periods, such that data is written to each pixel 711 of the group repeatedly during the frame time of that group 902. Writing data multiple times during each group's frame time significantly reduces flicker in the image produced by display 710.

Note also that FIG. 10 is directed to an embodiment of the present invention wherein the number of rows 713 of display 710 is greater than the number of time intervals 1002(1-15) (i.e., $2^n-1$). It should be noted that embodiments are also possible wherein the number of rows 713 of display 710 is less than the number of time intervals 1002(1-15). In such a case, each row's modulation period can be temporally offset from the previous row's modulation period by more than one time interval. For example, the modulation periods can be offset by an integral multiple of the time intervals 1002, as given by the ratio:

$$\text{offset} = INT\frac{(2^n-1)}{r},$$

where $(2^n-1)$ equals the number of time intervals 1002, and r equals the number of rows 713 in display 710. In such a case, a row 713 of display 710 will be temporally offset from a preceding row 713 by an amount equal to $$\frac{\theta T_1}{(2^n-1)},$$

where $T_1$ represents the duration of the modulation period of the row 713, θ is an integer greater than or equal to one, and n equals the number of bits of video data (e.g., 4 bits). In the case that the value $$\frac{(2^n-1)}{r}$$

yields an integer result, then θ=

$$\frac{(2^n-1)}{r}.$$

If the value $$\frac{(2^n-1)}{r}$$

yields a decimal result, then θ may have different values for different rows. For example, the temporal offset between the modulation periods for a first row and a second row may be one time interval 1002, while the temporal offset between the modulation periods for the second row and a third row may be two time intervals 1002. This alternate embodiment can also be employed if it becomes desirable to have a number of groups 902 less than the number of time intervals 1002, even if the number of rows 713 in display 710 exceeds the number of time intervals 1002. In most cases, it is desirable to even out the modulation of the rows over time, so as to reduce the memory and peak bandwidth requirements.

Figure 11:
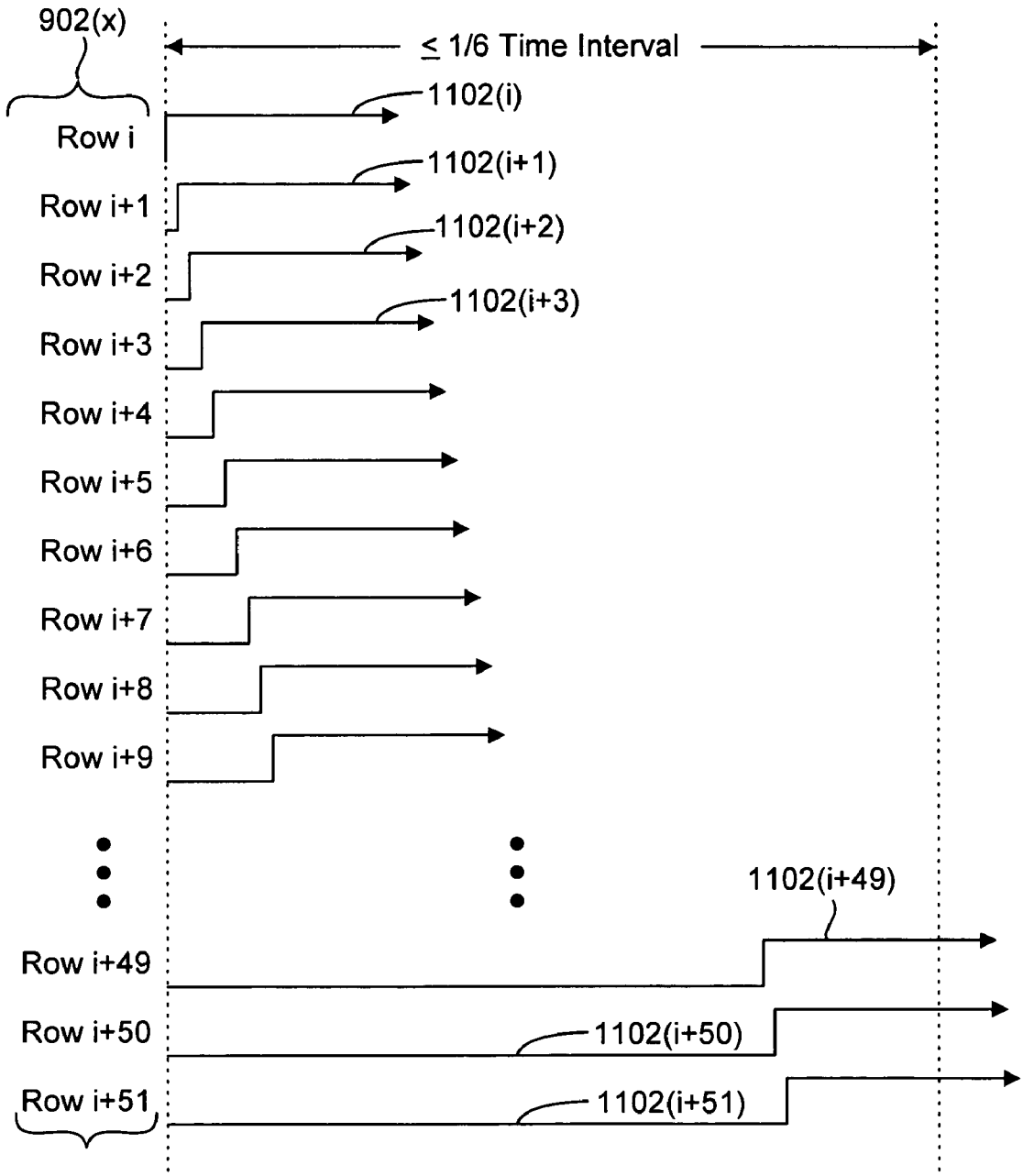
FIG. 11 is a timing diagram illustrating the manner in which rows of a particular group of FIG. 9 are updated according to the modulation scheme of FIG. 10.

FIG. 11 is a timing diagram showing the rows 713(*i*–*i*+51) of a particular group 902(*x*) being updated during a time interval 1002. Each row 713(*i*–*i*+51) within the group 902(*x*) is updated by row logic 708 at a different time within one-sixth of time interval 1002. Update indicators 1102(*i*–*i*+51) are provided in FIG. 11 to qualitatively indicate when a particular row 713(*i*–*i*+51) is updated. A low update indicator 1102(*i*–*i*+51) indicates that a corresponding row 713(*i*–*i*+51) has not yet been updated within the time interval 1002. On the other hand, a HIGH update indicator 1102(*i*–*i*+51) indicates that a row 713(*i*–*i*+51) has been updated. Within the group 902(*x*), row logic 708 updates the data bits latched into the pixels of a first row 713(*i*) at a first time, and then a short time later after row 713(*i*) has been updated, row logic 708 updates a next row 713(*i*+1). Each row 713(*i*–*i*+51) is successively updated a short time after the preceding row, until all rows (e.g., fifty-one or fifty-two) in the group 902(*x*) have been updated. It should be noted that for groups 902(3-14) that have only fifty-one rows, Row i+51 shown in FIG. 11 would not be updated because no such row would exist.

Because row logic 708 updates all rows 713(*i*–*i*+51) of a particular group 902(*x*) at a different time, each row of display 710 is updated throughout its own sub-modulation period. In other words, because each group 902(0-14) is processed by row logic 708 over a modulation period that is temporally offset with respect to the modulation period of every other group 902(0-14), and every row 713(*i*–*i*+51) within a group 902(*x*) is updated by row logic 708 at a different time, each row 713 of display 710 is updated during its own modulation period that depends on the modulation period of the group 902(0-14) that a particular row is in.

Figure 12:
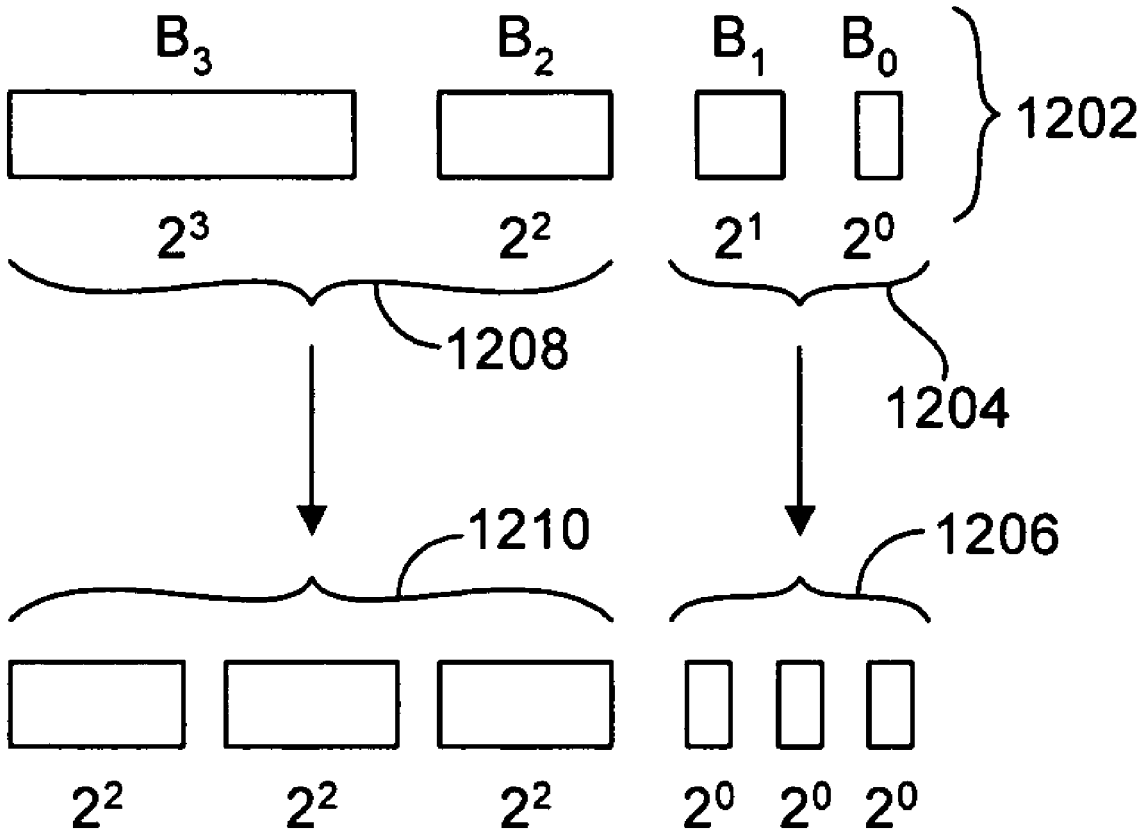
FIG. 12 is a diagram illustrating one method of evaluating a four-bit binary weighted data word according to the present invention.

FIG. 12 illustrates how the number of time intervals during which a group 902(0-14) is updated is determined. Each logic unit 802(0-1279) of row logic 708 receives a binary weighted data word 1202 indicative of a grayscale value to be asserted on each pixel 711 in a row 713. In the present embodiment, data word 1202 is a 4-bit data word, which includes a most significant bit $B_3$ having a weight ($2^3$) equal to eight of time intervals 1002(1-15), a second most significant bit $B_2$ having a weight ($2^2$) equal to four of time intervals 1002(1-15), a third most significant bit $B_1$ having a weight ($2^1$) equal to two of time intervals 1002(1-15), and a least significant bit $B_0$ having a weight ($2^0$) equal to one of time interval 1002(1-15).

A predetermined number of bits of binary weighted data word 1202 are selected to determine the number of time intervals during which a group 902(0-14) will be updated during its respective modulation period. For example, in the present embodiment, a first group of bits 1204 including $B_0$ and $B_1$ is selected. $B_0$ and $B_1$ have a combined weight equal to three time intervals, and can be thought of as a first group (i.e., three) of single-weight thermometer bits 1206, each having a weighted value of $2^0$, which is equal to one time slice. In the present embodiment, the first group of bits 1204 includes one or more consecutive bits of binary weighted data word 1202, including the least significant bit $B_0$.

The remaining bits $B_2$ and $B_3$ of binary weighted data word 1202 form a second group of bits 1208 having a combined weight equal to twelve (i.e., 4+8) of time intervals 1002 (1-15). The combined significance of bits $B_2$ and $B_3$ can be thought of as a second group of thermometer bits 1210 (i.e., equally weighted bits), each having a weight equal to $2^x$, where x equals the number of bits in the first group of bits. In this case, the second group of thermometer bits 1210 includes 3 thermometer bits each having a weight of four time intervals 1002(1-15).

By evaluating the bits in the above described manner, row logic 708 need only update a group 902(0-14) of display 710 six times to account for each thermometer bit in the first group of thermometer bits 1206 (i.e., three, single-weight bits) and each bit in the second group of thermometer bits 1210 (i.e., three, four-weight bits). In general, the total number of times that row logic 708 must update a given group 902(0-14) within its modulation period is given by the formula:

$$\text{Updates} = \left((2^x - 1) + \left(\frac{2^n - 2^x}{2^x}\right)\right), \text{ which can be reduced to}$$

$$\text{Updates} = \left(2^x + \frac{2^n}{2^x} - 2\right),$$

where x equals the number of bits in the first group of bits 1204 of binary weighted data word 1202, and n represents the total number of bits in binary weighted data word 1202.

By evaluating the bits of data word 1202 in the above manner, row logic 708 can assert any grayscale value on a pixel 711 with a single pulse by revisiting and updating pixel 711 a plurality of times during the pixel's modulation period. During each of the first three time intervals 1002(1-3) of the pixel's 711 modulation period, row logic 708 utilizes front pulse logic 804 of a particular logic unit 802 to evaluate the first group of bits 1204. Depending on the values of bits $B_0$ and $B_1$, front pulse logic 804 asserts a digital ON value or a digital OFF value to pixel 711. Then, during time intervals 1002(4), 1002(8) and 1002(12) remaining in pixel 711's modulation period, row logic 708 utilizes rear pulse logic 806 to evaluate at least one of the second group of bits 1208 of data word 1202 as well as the current digital ON or digital OFF value of pixel 711 stored in storage element 814 and to write a digital ON value or digital OFF value to pixel 711.

Furthermore, the electrical signal asserted on a pixel 711 will transition from a digital OFF value to a digital ON and from a digital ON value to a digital OFF value no more than once during the pixel 711's modulation period. The electrical signal asserted on pixel 711 will be initialized (i.e., a digital OFF to a digital ON transition) during one of the first four time intervals 1002(1-4) and will be terminated (i.e., a digital ON to a digital OFF transition) during one of time intervals 1002(4), 1002(8), and 1002(12).

It should be noted that the particular time intervals 1002(1), 1002(2), 1002(3), 1002(4), 1002(8), 1002(12) discussed above for pixel 711 are the adjusted time intervals associated with the group 902(0-14) in which pixel 711 is located. Row logic 708 updates the electrical signal asserted on each pixel 711 during the same time intervals 1002(1), 1002(2), 1002 (3), 1002(4), 1002(8), and 1002(12) based on the group 902 (0-14)'s respective modulation period.

Figure 13:
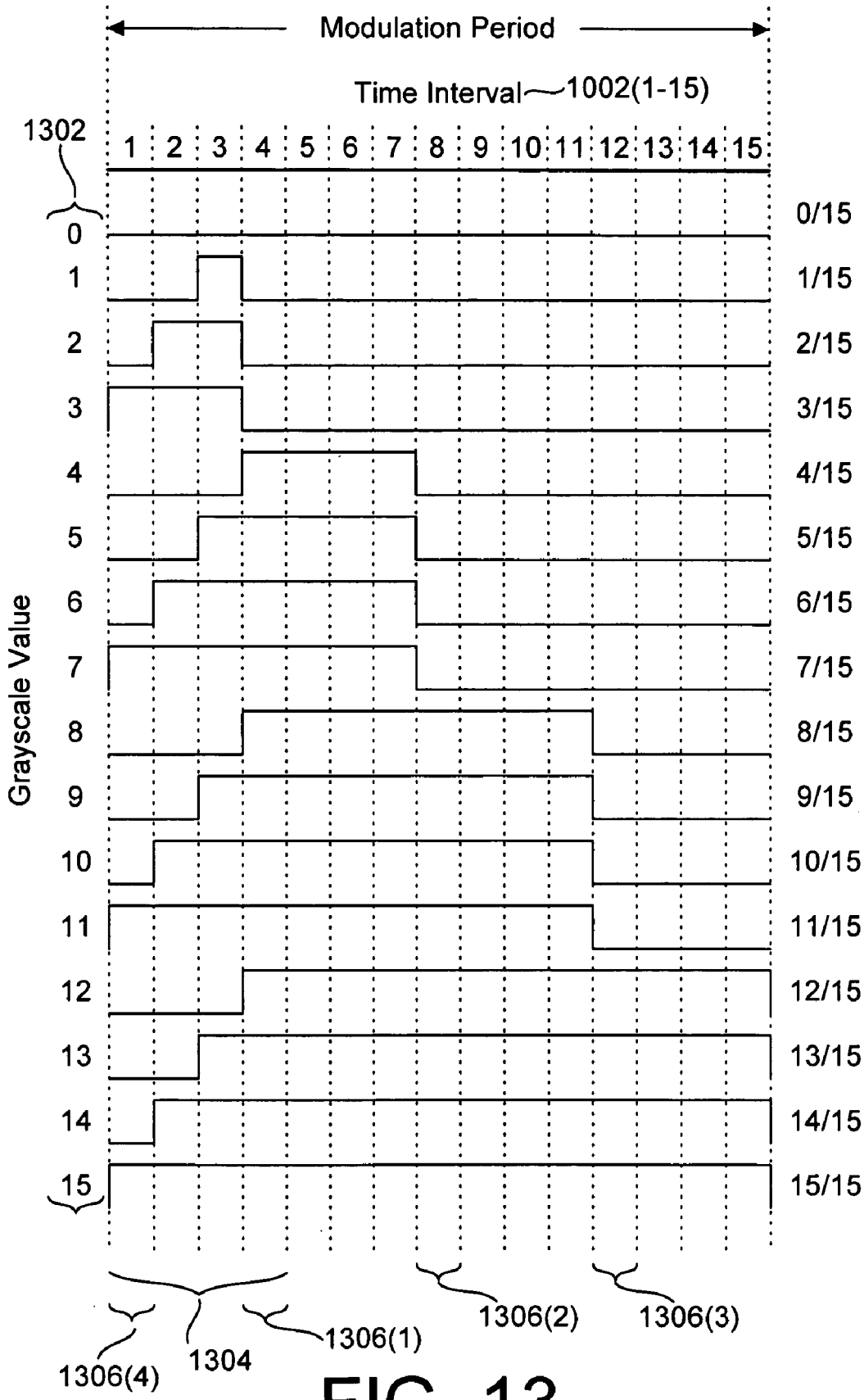
FIG. 13 shows waveforms for particular grayscale values that can be asserted by the row logic of FIG. 8 onto pixels of the imagers of FIG. 5.

FIG. 13 shows the sixteen (i.e., $2^4$) grayscale waveforms 1302(0-15) that row logic 708 can assert on each pixel 711 based on the value of a binary weighted data word 1202 to produce the respective grayscale value. An electrical signal corresponding to the waveform for each grayscale value 1302 is initialized during one of a first plurality of consecutive predetermined time intervals 1304, and is terminated during one of a second plurality of predetermined time intervals 1306(1-4). In the present embodiment, the consecutive predetermined time intervals 1304 consist of time intervals 1002 (1), 1002(2), 1002(3), and 1002(4), and the second plurality of predetermined time intervals 1306(1-4) correspond to time intervals 1002(4), 1002(8), 1002(12) and 1002(1) (time interval 1306(4) corresponds to the first time interval 1002 of the pixel's next modulation period). In other words, the initialization of the signal for the next grayscale value terminates the signal for the preceding grayscale value.

To initialize an electrical signal on a pixel 711, row logic 708 writes a digital ON value to pixel 711 where the previous value asserted on pixel 711 was a digital OFF (i.e., a low to high transition as shown in FIG. 13). On the other hand, to terminate an electrical signal on a pixel 711, row logic writes a digital OFF value to pixel 711 where a digital ON value was previously asserted (i.e., a high to low transition). As shown in FIG. 13, only one initialization and termination of an electrical signal occur within a modulation period. Therefore, a single pulse can be used to write all sixteen grayscale values to a pixel 711.

By evaluating the values of the first group of bits 1204 (e.g., $B_0$ and $B_1$) of binary weighted data word 1202, a front pulse logic 804 of row logic 708 driving a pixel 711 can determine when to initialize the pulse on pixel 711. In particular, based solely on the value of the first group of bits 1204, front pulse logic 804 can initialize the pulse during any of the first three consecutive predetermined time intervals 1304. For example if $B_0$=1 and $B_1$=0, then front pulse logic 804 would initialize the pulse on pixel 711 during the third time interval 1002(3), as indicated by grayscale waveforms 1302(1), 1302(5), 1302 (9), and 1302(13). If $B_0$=0 and $B_1$=1, then front pulse logic 804 would initialize the pulse on pixel 711 during the second time interval 1002(2), as indicated by grayscale waveforms 1302(2), 1302(6), 1302(10), and 1302(14). If $B_0$=1 and $B_1$=1, then front pulse logic 804 would initialize the pulse on pixel 711 during the first time interval 1002(1), as indicated by grayscale waveforms 1302(3), 1302(7), 1302(11), and 1302 (15). Finally, if $B_0$=0 and $B_1$=0, then front pulse logic 804 does not initialize the pulse on pixel 711 during any of the first three consecutive time intervals 1304.

Rear pulse logic 806 of row logic 708 is operative to initialize the pulse on pixel 711 during time interval 1002(4) of the consecutive predetermined time intervals 1304 (depending on the grayscale value), and to maintain or terminate the pulse on pixel 711 during the second plurality of predetermined time intervals 1002(4), 1002(8), and 1002(12), based on the value(s) of one or both of bits $B_2$ and $B_3$ of the binary weighted data word 1202, and in some cases the current digital ON or digital OFF value of pixel 711. Rear pulse logic 806 is operative to initialize the pulse on pixel 711 during time interval 1002(4) if the pulse has not been previously initialized and if either of bits $B_2$ and/or $B_3$ have a value of one. In such an instance, rear pulse logic 806 would initialize the pulse on pixel 711, as indicated by grayscale waveforms 1302(4), 1302(8) and 1302(12). If, on the other hand, no pulse has been previously initialized on pixel 711 (i.e., the first group of bits 1204 are all zero) and both of bits $B_2$ and $B_3$ are zero, then rear pulse logic 806 maintains the low value on pixel 711 for the given modulation period.

If the pulse has been previously initialized on pixel 711, then one of rear pulse logic 806 or front pulse logic 804 is operative to terminate the pulse during one of the second plurality of predetermined time intervals 1306(1-4). For example, if $B_2$=0 and $B_3$=0, then rear pulse logic 806 is operative to terminate the pulse on pixel 711 during time interval 1002(4), as indicated by grayscale waveforms 1302(1), 1302(2), and 1302(3). If $B_2$=1 and $B_3$=0, then rear pulse logic 806 is operative to terminate the pulse on pixel 711 during time interval 1002(8), as indicated by grayscale waveforms 1302(4), 1302(5), 1302(6), and 1302(7). If $B_2$=0 and $B_3$=1, then rear pulse logic 806 is operative to terminate the pulse on pixel 711 during time interval 1002(12) as indicated by grayscale waveforms 1302(8), 1302(9), 1302(10), and 1302(11). If $B_2$=1 and $B_3$=1, then rear pulse logic 806 does not terminate the pulse on pixel 711. Rather, front pulse logic 804 will terminate the pulse on pixel 711 during time interval 1002(1) of pixel 711's next modulation period, depending on the next grayscale value. This is situation is illustrated by grayscale waveforms 1302(12), 1302(13), 1302(14), and 1302(15). It should be noted that rear pulse logic 806 may or may not need both of bits $B_2$ and $B_3$ to determine when to terminate the pulse on pixel 711, as will be described below.

In the case where $B_2$=1 and $B_3$=1, front pulse logic 804 does not always terminate the pulse on pixel 711 during time interval 1002(1). For example, if for the next modulation period, $B_0$=1 and $B_1$=1, then row logic 708 is operative to initialize a new pulse on pixel 711 without terminating the pulse asserted on pixel 711 during the previous modulation period. Not terminating the pulse in such a case prevents an unnecessary transition of the electrical signal on pixel 711 between a digital ON and digital OFF value. This instance arises if one of grayscale waveforms 1302(12), 1302(13), 1302(14) and 1302(15), were followed in a subsequent modulation period by one of grayscale waveforms 1302(3), 1302(7), 1302(11), and 1302(15).

Another way to describe the present modulation scheme is as follows. Row logic 708 initializes an electrical signal on pixel 711 during one of the first (m) consecutive time intervals 1002(1-4) based on the value of binary weighted data word 1202. Then row logic 708 terminates the electrical signal on pixel 711 during an ($m^{th}$) one of time intervals 1002(1-15). The ($m^{th}$) time intervals correspond to time intervals 1002(4), 1002(8), 1002(12), and 1002(1).

In general, the number (m) can be determined from the following equation:

$$m=2^x,$$

where x equals the number of bits in the first group of bits 1204 of the binary weighted data word 1202. In the present example, the x bits include at least the least significant bit ($B_0$) of the binary weighted data word 1202, and optionally, a selected number of consecutive bits (e.g., $B_1$, $B_1$ and $B_2$, etc.). Accordingly, the first plurality of predetermined times intervals 1304 correspond to the first consecutive (m) time intervals 1002.

Once x is defined, the second plurality of predetermined time intervals 1306(1-4) are determined by the equation:

$$\text{Interval}=y2^x \text{ MOD}(2^n-1),$$

where MOD is the remainder function and y is an integer greater than 0 and less than or equal to $$\left(\frac{2^n}{2^x}\right).$$

For the case $$\left(y=\frac{2^n}{2^x}\right),$$

the resulting time interval will be the first time interval 1002(1) in pixel 711's modulation period. Following the above equation, for the 4-bit binary weighted data word 1202 and the first group of bits 1204, where x=2, the above equation yields a second plurality of time intervals 1306(1-4) corresponding to time intervals 1002(4), 1002(8), 1002(12), and 1002(1).

According to the above-described driving scheme, row logic 708 need only evaluate particular bits of pixel data, depending on the time interval 1002. For example, row logic 708 updates the electrical signal asserted on a pixel 711 based on the values of bits $B_0$ and $B_1$ of a binary weighted data word 1202 during (adjusted) time intervals 1002(1-3) of that pixel's modulation period. Because front pulse logic 804 of row logic 708 updates the electrical signal asserted on pixel 711 during time intervals 1002(1-3), front pulse logic 804 need only evaluate the bits (B0 , B1) in the first group of bits 1204 of multi-bit data word 1202. Although front pulse logic 804 is coupled to receive the full 4-bit data word 1202 in FIG. 8, front pulse logic 804 may indeed only receive the first group of bits 1204 (e.g., $B_0$ and $B_1$).

Similarly, during the remaining (adjusted) time intervals 1002(4), 1002(8), and 1002(12) row logic 708 utilizes rear pulse logic 806 to update the electrical signal asserted on pixel 711. Rear pulse logic requires one or both of bits $B_2$ and $B_3$, and in some cases the current value of pixel 711 stored in storage element 814, to properly update the electrical signal 1302 on pixel 711 during these time intervals. For example, row logic 708 requires both of bits $B_2$ and $B_3$ to update the electrical signal on pixel 711 during time interval 1002(4). Row logic 708 updates the electrical signal asserted on pixel 711 to a digital ON value during time interval 1002(4) if either of bits $B_2$ and $B_3$ have a value of 1.

The next time the pixel 711 is updated at time interval 1002(8), row logic 708 requires only bit $B_3$ to update the electrical signal. Note from FIG. 13 that for all grayscale values where $B_3$=1, the pulse is maintained ON during time interval 1002(8), and for all grayscale values where $B_3$=0, the pulse is OFF during time interval 1002(8). Therefore, if $B_3$ has a value of 1, rear pulse logic 806 will assert a digital ON value onto pixel 711 during time interval 1002(8).

Next, at time interval 1002(12), rear pulse logic 806 requires only bit $B_2$ and the previous value written to pixel 711, to properly update the electrical signal asserted on pixel 711. Rear pulse logic 806 accesses the previous value written to pixel 711 via storage element 814, which stores the previous value of pixel 711 when pixel 711 is enabled for update by row decoder 714. Responsive to the value of bit $B_2$ and the previous pixel value, rear pulse logic 806 asserts a digital ON value or digital OFF value onto output 812.

During time interval 1002(12), if bit $B_2$=0, then rear pulse logic 806 asserts a digital OFF value on output 812, such that pixel 711 is turned off. Such a case is shown by grayscale waveforms 1302(0-3) and 1302(8-11). However, if bit $B_2$=1, then rear pulse logic 806 must consider the previous value of pixel 711, prior to asserting a digital ON or digital OFF value on output 812. If the previous value stored in storage element 814 is a digital ON value (e.g., a digital high), then rear pulse logic 806 asserts a digital ON value onto output 812 and onto pixel 711. On the other hand, if the previous value stored in storage element 814 is a digital OFF value (e.g., a digital low) indicating that the pulse on pixel 711 has already been terminated, then rear pulse logic 806 writes a digital OFF value to output 812 and onto pixel 711. In other words, if bit B2=1, then rear pulse logic 806 does not change the value previously stored in pixel 711.

Thus, row logic 708 can be considered to perform a set/clear function. During the first three time intervals, front pulse logic 804 either performs a set operation (asserts ON) or does nothing. During subsequent time intervals, rear pulse logic 806 either performs a clear operation (asserts OFF) or does nothing.

Finally, it should be noted that although rear pulse logic 806 is coupled to receive the full 4-bit data word 1202 in FIG. 8, rear pulse logic 806 may indeed only receive the second group of bits 1208 (e.g., $B_2$ and $B_3$).

In summary, row logic 708 updates the electrical signal asserted on pixel 711 during particular time intervals 1002 based on the value(s) of the following bit(s):

| Time Interval 1002 | Bit(s) Evaluated |
|---|---|
| 1-3 | $B_0$ and $B_1$ |
| 4 | $B_3$ and $B_2$ |
| 8 | $B_3$ |
| 12 | $B_2$ |

The realization that all of the bits of a grayscale value are not required to determine whether or not to terminate the pulse on a particular pixel during various time intervals of the modulation period facilitates a significant reduction in the memory requirement of imagers 504, as will be described in greater detail below.

A general description of the operation of display driving system 500 will now be provided with reference to FIGS. 1-13 as described thus far.

Initially, at startup or upon a video reset, data manager 514 receives a first Vsync signal via synchronization input terminal 508 and a first timing signal via coordination line 522 from timer 602, and begins supplying display data to imagers 504(*r, g, b*). To provide display data to imagers 504(*r, g, b*), data manager 514 receives video data from video data input terminal 510, temporarily stores the video data in frame buffer 506A, subsequently retrieves the video data from frame buffer 506A (while writing the next frame of data to frame buffer 506B), divides the video data based on color (e.g., red, green, and blue), and provides the appropriate colored video data to each of imagers 504(*r, g, b*) via the respective imager data lines 520(*r, g, b*). Accordingly, before or during a particular timing signal value (e.g., 1-15), data manager 514 supplies display data to each of imagers 504(*r, g, b*) for each pixel 711 of the rows 713 of a particular group 902(*x*) associated with the particular time interval 1002. Because in the present embodiment, up to 52 rows 713 are contained in some groups 902(0-14), data manager 514 provides colored display data to imagers 504(*r, g, b*) at a rate that is sufficient to provide 52 rows of video data to imagers 504(*r, g, b*) within the duration of one of time intervals 1002(1-15).

Colored video data is received by each imager 504(*r, g, b*) via data input 720 and is loaded into shift register 702 eight bits at a time. When enough video data is accumulated for an entire row 713 of pixels 711, shift register 702 outputs four bits of video data for each pixel 711 on a respective one of the 1280×4 data lines 734. The video data output from shift register 702 is loaded into FIFO 704 where it is temporarily stored, before it is output onto data lines 736 in a first-in-first-out manner.

Circular memory buffer 706 loads the data asserted on data lines 736 when a HIGH "load data" signal is generated by address generator 604 of imager control unit 516 and asserted on load input 740. A row address associated with the video data asserted on data lines 736 is simultaneously generated by address generator 604 and is asserted on address input 730. The address is converted by address converter 716 into a memory address associated with circular memory buffer 706. A memory address associated with each bit of the 4-bit video data for each pixel 711 is asserted on address input 742 of circular memory buffer 706 such that the 4-bit video data is sequentially stored in associated memory locations within circular memory buffer 706.

When circular memory buffer 706 receives a sequence of memory addresses from address converter 716 and the signal on load input 740 is LOW, then circular memory buffer 706 consecutively outputs video data for each pixel 711 in a row 713 associated with the converted row address to row logic 708 via data lines 738. Each logic unit 802(0-1279) of row logic 708 receives and temporarily stores the 4-bit video data associated with one of pixels 711 in both of its respective front pulse logic 804(0-1279) and rear pulse logic 806(0-1279). Row logic 708 simultaneously receives a 4-bit adjusted time value on adjusted timing input 746 and a logic selection signal on logic selection input 748.

The same row address provided to address converter 716 is also provided to time adjuster 610. Based on the row address, time adjuster adjusts the timing signal provided by timer 602 and asserts the adjusted timing signal on adjusted timing output bus 630, which provides the adjusted time value to adjusted timing input 632 of logic selection unit 606, and to adjusted timing input 728 of imagers 504(*r, g, b*). Based on the adjusted time value received from time adjuster 610, logic selection unit 606 provides a HIGH or LOW logic selection signal on logic selection output 634. The logic selection signal is provided to logic selection input 726 of each of imagers 504(*r, g, b*). In the present embodiment, the logic selection signal output by logic selection unit 606 is HIGH for adjusted time values 1 through 3, and LOW for adjusted time values of 4, 8 and 12.

Multiplexers 808(0-1279) of row logic 708 couple the outputs 810(0-1279) of front pulse logic 804(0-1279) with the respective display data lines 744(0-1279, 1) when a HIGH signal is asserted on logic selection input 748. Therefore, when a HIGH logic selection signal is asserted on logic selection input 748, the output of front pulse logic 804(0-1279) is used to update the pixels 711 of a row 713 during a particular time interval 1002(1-3). Similarly, multiplexers 808(0-1279) couple the outputs 812(0-1279) of rear pulse logic 806(0-1279) with the respective display data lines 744(0-1279, 1) when a LOW signal is asserted on logic selection input 748. Therefore, when a LOW logic selection signal is asserted on logic selection input 748, rear pulse logic 806(0-1279) is used to update the electrical signal asserted on each pixel 711 of a row 713 during time intervals 1002(4), 1002(8) and 1002(12).

In other words, row logic 708 is operative to update an electrical signal asserted on each pixel 711 of a row 713 during each of a plurality of consecutive time intervals (e.g., time intervals 1002(1-4)) during a first portion of a row 713's modulation period. Row logic 708 is also operative to update an electrical signal asserted on the pixels 711 every $m^{th}$ time interval 1002 after the lapse of the final consecutive time interval 1002 during a second portion of a row 713's modulation period, where m is defined as above.

Row decoder 714 also receives the row addresses from address generator 604 on address input 752, as well as disable signals via disable input 754. When the disable signal asserted on disable input 754 is LOW, row decoder 714 enables one of word lines 750 corresponding to the row address asserted on address input 752. When a row 713 of pixels 711 is enabled by one of word lines 750, the value of the pulse asserted on each pixel 711 is latched into the associated storage element 814(0-1279) of row logic 708 via display data lines 744(0-1279, 2). If a HIGH disable signal is asserted on disable input 754, row decoder 714 ignores the address asserted on address input 752, because the address received thereon corresponds to a row address of data being loaded into circular memory buffer 706.

Based on the display data received via data lines 738, the previous value asserted on each pixel 711, the adjusted timing signal received via adjusted timing input 746, and the logic selection signal asserted on logic selection input 748, row logic 708 updates an electrical signal asserted on each pixel 711 of a particular row 713 of display 710. When the corresponding row 713 of pixels 711 are enabled by row decoder 714, the digital ON or digital OFF values produced by row logic 708 are latched into pixels 711. Depending on the adjusted time value and the display data, row logic 708 is operative to initialize and terminate an electrical signal (e.g., a single pulse) on each pixel 711 during its modulation period to produce one of grayscale values 1302(0-15). As shown in FIG. 13, the electrical signal asserted on each of pixels 711 is initialized and terminated at most once during each pixel 711's modulation period. Accordingly, the present invention advantageously reduces the number of transitions of the electrical signal asserted on each pixel 711, thereby improving the electro-optical response of each pixel 711.

As shown in FIG. 13, a pulse corresponding to each grayscale value 1302(1-15) (a grayscale value of 0 requires no pulse) is initialized during one of a first plurality of times corresponding to time intervals 1002(1-4), and is terminated during one a second plurality of times corresponding to time intervals 1002(4), 1002(8), 1002(12), and 1002(1).

It should be noted that for each timing signal output by timer 602, data manager 514, imager control unit 516, and imagers 504(*r, g, b*) process (i.e., update electrical signals on) six entire groups of rows 713 of display 710. For example, as shown in FIG. 10, when timer 602 outputs a timing signal having a value of one, identifying time interval 1002(1), imager control unit 516, and imagers 504(*r, g, b*) must process all rows 713 in groups 902(0), 902(14), 902(13), 902(12), 902(8), and 902(4). Accordingly, address generator 604 sequentially outputs the row addresses of each row 713 contained in each group 902(0), 902(14), 902(13), 902(12), 902(8), and 902(4). For the groupings shown in FIG. 9, address generator would output row addresses for rows 713(0-51), then addresses for rows 713(717-767), then addresses for rows 713(666-716), then addresses for rows 713(615-665), then addresses for rows 713(411-461), and finally addresses for rows 713(207-257).

Responsive to receiving a timing signal and row addresses, time adjuster 610 adjusts the time value output by timer 602 for the modulation period associated with each row 713 of each of groups 902(0), 902(14), 902(13), 902(12), 902(8), and 902(4). For example, in the first time intervals 1002(1), time adjuster 610 does not adjust the time value output by timer 602 for the row addresses associated with group 902(0). For the row addresses associated with group 902(14), time adjuster 610 decrements the time value by 14, and outputs an adjusted time value of 2. For the row addresses associated with group 902(13), time adjuster 610 decrements the time value by 13, and outputs an adjusted time value of 3. For the row addresses associated with group 902(12), time adjuster 610 decrements the time value by 12, and outputs an adjusted time value of 4. For the row addresses associated with group 902(8), time adjuster 610 decrements the time value by 8, and outputs an adjusted time value of 8. Finally, for the row addresses associated with group 902(4), time adjuster 610 decrements the time value by 4, and outputs an adjusted time value of 12.

It should be noted that a timing signal output by timer 602 having a value of 1 marks the beginning of a new modulation period for the rows 713 contained in group 902(0). Accordingly, data manager 514 must provide new display data for rows 713(0-51) to each imager 504(*r, g, b*) before row logic 708 can update rows 713(0-51). Accordingly, data manager 514 can provide data for group 902(0) to imagers 504(*r, g, b*) at a variety of different times. For example, data manager 514 could provide the display data all at the beginning of time interval 1002(1) before group 902(0) is processed by imager control unit 516 and imagers 504(*r, g, b*). Alternately, data manager 514 could transfer the display data for group 902(0) to imagers 504(*r, g, b*) during the previous time interval 1002(15). In either case, display data for one of groups 902(0-14) must be transferred to imagers 504(*r,g,b*) during each time interval 1002(1-15). In the present embodiment, it will be assumed that data manager 514 loads display data for group 902(0) during time interval 1002(15) after groups 902(11-14), 902(7), and 902(3) are updated.

Because FIFO 704 contains enough memory to store display data for an entire group of rows 713, data manager 514 can load display data for a group 902 of rows 713 to imagers 504(*r, g, b*) without being synchronized with address generator 604. Thus, the data storage provided by multi-row memory buffer 704 advantageously decouples the processes of providing display data to imagers 504(*r, g, b*) and the loading of the display data into circular memory buffer 706 by address generator 604.

No matter what scheme for providing display data to imagers 504(*r, g, b*) is used, address generator 604 will assert a "write" address for each row 713 of display data provided to imagers 504(*r, g, b*) by data manager 514 at an appropriate time. For example, address generator 604 might sequentially assert a write address for each row 713 of display data associated with group 902(0) stored in FIFO 704 after each group 902(11-14), 902(7), and 902(3) is processed during time interval 1002(15). Alternately, address generator could assert each write address for group 902(0) at the beginning of time interval 1002(1). In either case, it is important to note that display data must be supplied to each of imagers 504(*r, g, b*) in the same order as the rows are processed. In the present embodiment, because rows 713 of display are sequentially grouped into groups 902(0-14), data is supplied to imagers 504(*r, g, b*) in order for row 713(0) through row 713(767).

When a "write" address is asserted on address output bus 620, address generator 604 will also assert a HIGH load data signal on load data output 622, causing circular memory buffer 706 to store the display data being asserted on data lines 736 by FIFO 704. In addition, the HIGH load data signal asserted on load data output 622 also temporarily disables row decoder 714 from enabling a new word line 750 associated with the write address, and prevents time adjuster 610 from altering the adjusted timing signal asserted on adjusted timing outputs 630(1-2).

While the displays 710 of imagers 504(*r, g, b*) are being modulated, debias controller 608 is coordinating the debiasing process of display 710 of each imager 504(*r, g, b*) by asserting data invert signals on global data invert output 640 and a plurality of common voltages on common voltage output 638. Debias controller 608 debiases display 710 of each imager 504(*r, g, b*) to prevent deterioration of the displays 710. Particular debias schemes will be described below.

Because the operation of data manager 514, the components of imager control unit 516, and each of imagers 504(*r, g, b*) is either directly or indirectly dependent upon the timing signals produced by timer 602, the modulation of display 710 of each imager 504(*r, g, b*) remains synchronized during the display driving process. Therefore, a coherent, full color image is formed when the images produced by displays 710 of imagers 504(*r, g, b*) are superimposed.

Figure 14:
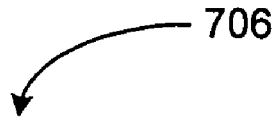
FIG. 14 is a block diagram showing the capacities of portions of the circular memory buffer of FIG. 7 needed for each bit of the 4-bit display data shown in FIG. 12.

FIG. 14 is a representational block diagram showing circular memory buffer 706 having a predetermined amount of memory allocated for storing each bit of multi-bit data words 1202. Circular memory buffer 706 includes a $B_0$ memory section 1402, a $B_1$ memory section 1404, a $B_3$ memory section 1406, and a $B_2$ memory section 1408. In the present embodiment, circular memory buffer 706 includes (1280×156) bits of memory in $B_0$ memory section 1402, (1280×156) bits of memory in $B_1$ memory section 1404, (1280×411) bits of memory in $B_3$ memory section 1406, and (1280×615) bits of memory in $B_2$ memory section 1408. Accordingly, for each column 712 of pixels 711, 156 bits of memory are needed for bits $B_0$, 156 bits of memory are needed for bits $B_1$, 411 bits of memory are needed for bits $B_3$, and 615 bits of video memory are needed for bits $B_2$. These memory capacities are significantly lower than similar systems of the prior art, which require enough memory to store an entire frame of data.

The present invention is able to provide this memory savings advantage, because each bit of display data is stored in circular memory buffer 706 only as long as it is needed for row logic 708 to assert the appropriate electrical signal 1302 on an associated pixel 711. Recall from above, that row logic 708 updates the electrical signal on pixel 711 during particular time intervals 1002 based on the value(s) of the following bit(s):

| Time Interval 1002 | Bit(s) Evaluated |
|---|---|
| 1-3 | $B_0$ and $B_1$ |
| 4 | $B_3$ and $B_2$ |
| 8 | $B_3$ |
| 12 | $B_2$ |

Therefore, because bits $B_0$ and $B_1$ associated with the pixel 711 are no longer required after time interval 1002(3), bits $B_0$ and $B_1$ can be discarded after the lapse of time interval 1002 (3). Similarly, bit $B_3$ can be discarded any time after the lapse of time interval 1002(8). Finally, bit $B_2$ can be discarded any time after the lapse of time interval 1002(12). If the second group of bits 1208 contained more than two bits, the bits would be discarded in order of most to least significance.

In general, the bits of binary weighted data word 1202 can be discarded after the lapse of a particular time interval 1002 ($T_D$) according to the following equations. For each bit in the first group of bits 1204 of binary weighted data word 1202, $T_D$ is given according by the equation:

$$T_D=(2^x-1),$$

where x equals the number of bits in the first group of bits.

For the second group of bits 1208 of binary weighted data word 1202, $T_D$ is given by the set of equations:

$$T_D=(2^n-2^{n-b}),\ 1\leqq b\leqq(n-x)$$

where b is an integer from 1 to (n−x) representing a $b^{th}$ most significant bit of the second group of bits 1208.

The size of each memory section of circular memory buffer 706 is dependent upon the number of columns 712 in display 710, the minimum number of rows 713 in each group 902, the number of time intervals 1002 a particular bit is needed in a modulation period (e.g., $T_D$), and the number of groups containing an extra row 713. As stated above, the minimum number of rows 713 in each group 902 is given by the equation:

$$\text{Minimum Rows} = INT\left(\frac{r}{2^n-1}\right),$$

where r equals the number of rows 713 in display 710, n equals the number of bits contained in multi-bit data word 1202, and INT is the integer function rounding a decimal result down to the nearest integer.

The number of groups having an extra row is given by the equation:

$$\text{Groups with Extra Row}=r\text{MOD}(2^n-1),$$

where MOD is the remainder function.

Based on the above equations, the amount of memory required in a section of circular memory buffer 706 is given by the equation:

$$\text{Memory Section} = c\times\left[\left(INT\left(\frac{r}{2^n-1}\right)\times T_D\right)+rMOD(2^n-1)\right],$$

where c equals the number of columns 712 in display 710.

Thus, each memory section must be large enough to accommodate a bit of video data for the minimum number of rows in each group 902 for $T_D$ time intervals 1002 from the beginning of the modulation period. In addition, if the number of rows 713 in display 710 does not divide equally among groups 902, then each memory section must include enough memory to accommodate a bit associated with an extra row in all the groups 902 with an extra row. For example, in the present embodiment, each group has a minimum of 51 rows 713 and three groups 902(0-2) have an extra row. Bits $B_0$ and $B_1$ are needed for the first three time intervals 1002(1-3) (i.e., $T_D$=3), and therefore $B_0$ memory section 1402 and $B_1$ memory section 1404 are 156 bits large (i.e., (51×3)+3) for each column 712 of display 710. Similarly, bit $B_3$ is needed for the first eight time intervals 1002(1-8) (i.e., $T_D$=8), and therefore $B_3$ memory section 1406 is 411 bits large (i.e., (51×8)+3) for each column 712. Finally, bit $B_2$ is needed for twelve time intervals 1002(1-12) (i.e., $T_D$=12), and therefore $B_2$ memory section 1406 is 615 bits large (i.e., (51×12)+3) for each column 712.

Based on the above equation, the memory requirements of circular memory buffer 706 will be a minimum when the number of rows 712 of display 710 divides equally among groups 902. However, in the case that the number of rows 713 does not divide equally among groups 902, then it should be noted that the memory requirements of circular memory buffer 706 can be reduced further based on which of groups 902 contain an extra row. In particular, the memory requirement of a particular memory section (e.g., $B_0$ memory section 1402, $B_1$ memory section 1404, etc.) can be reduced if the groups 902 containing an extra row are $T_D$ groups apart. For example, in the present embodiment three of groups 902 contain an extra row. If each group 902 containing an extra row were three or more groups 902 apart (e.g., groups 902(0), 902(4), and 902(8) contained an extra row), then the memory requirements for $B_0$ memory section 1402 and $B_1$ memory section 1404 could be reduced by 2 bits each.

It is readily apparent that the present invention significantly reduces the amount of memory required to drive displays 710 over the prior art input buffer 110. As discussed above, the prior art input buffer 110 contained 1280×768×4 bits (3.93 Megabits) of memory storage. In contrast, circular memory buffer 706 contains only 1.71 Megabits of memory storage. Accordingly, circular memory buffer 706 is only about 43.5% as large as prior art input buffer 110, and therefore requires substantially less area on imager 504(*r, g, b*) than does input buffer 110 on prior art imager 102.

It should be noted that additional memory-saving alterations can be made to the present invention. For example, the size of circular memory buffer 706 can be reduced if different bits of particular data words 1202 are written to circular memory buffer 706 at different times. In such an embodiment, data manager 514 planarizes the data by dividing the video data according to bit planes (e.g., $B_0$, $B_1$, $B_2$, etc.), prior to storing the video data in frame buffers 506(A-B). Because the first group of bits 1204 of data word 1202 are utilized during the first three time intervals 1002(1-3), $B_0$ and $B_1$ bits are written to circular memory buffer 706 according to the methods described above. The bits of the second group of bits 1208 of data word 1202, however, are not needed by row logic 708 until time interval 1002(4). Therefore, the second group of bits 1208 can be written to circular memory buffer 706 three time intervals 1002 later than the corresponding first group of bits 1204 (e.g., before time interval 1002(4)).

If bits $B_2$ and $B_3$ (i.e., the second group of bits 1208) are written to circular memory buffer 706 separately, then the value of $T_D$ for each bit in the second group of bits 1208 can be reduced by three (i.e., $2^x-1$) time intervals 1002. Therefore, when adjusted in the present embodiment, $B_3$ is needed during only five time intervals 1002 total and $B_2$ is needed during only nine time intervals 1002 total. Therefore, $B_3$ memory section 1406 would only need to store 258 bits (i.e., (51×5)+3) of memory for each column 712 of display 710, and $B_2$ memory section 1408 would only need to store 462 (i.e., (51×9)+3) bits of memory space. As a result, circular memory buffer 706 would be approximately 1.32 Megabits large, or 25.4% the size of prior art input buffer 110. In addition, the size of memory buffer 706 would be reduced by approximately 22.8% over the embodiment discussed above.

Those skilled in the art will realize that the specific amounts of memory associated with each section of circular memory buffer 706 can be modified as necessary. For example, the amount of memory in each memory section might be increased to conform with a standard memory size and/or standard counters, or to account for data transfer timing requirements. As another example, the size of one memory section could be increased while the size of another memory section could be reduced. Indeed, many modifications are possible.

Figure 15A:
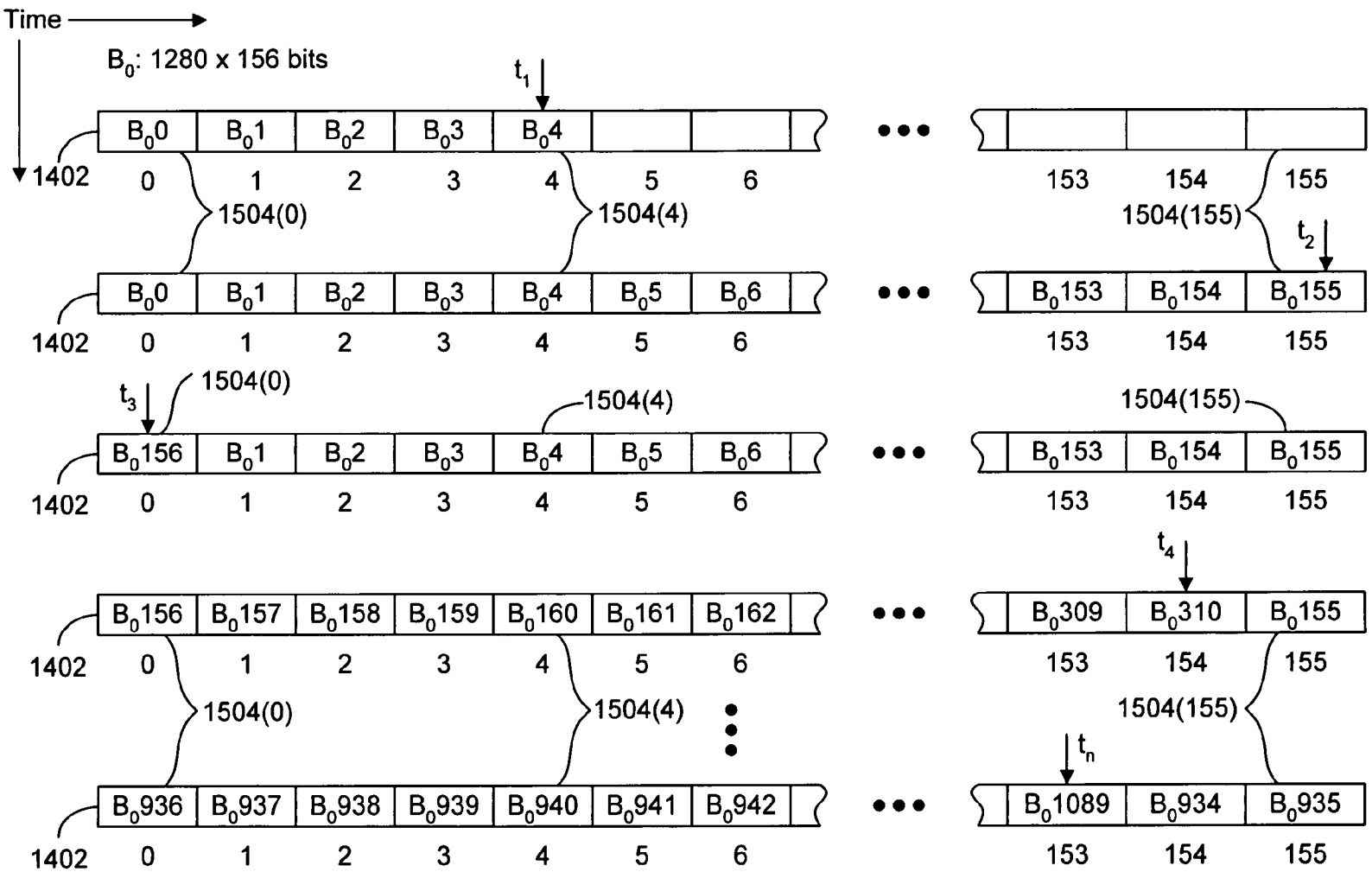
FIG. 15A is a memory allocation diagram indicating how video data is written into the circular memory buffer of FIG. 7 for bit $B_0$.

FIG. 15A illustrates the circular order in which data is written to $B_0$ memory section 1402. The memory space shown represents the memory space for storing bits $B_0$ of data intended for the pixels 711 of a single column 712 of display 710. The memory space shown in FIG. 15A is replicated for all 1280 columns 712 within $B_0$ memory section 1402.

Memory space 1402 includes 156 memory locations 1504 (0-155), each storing a least significant bit (i.e., bit $B_0$) of display data for an associated pixel 711. $B_0$ bits are written into memory locations 1504(0-155) in the order that rows 713 of display 710 are driven. In the present embodiment, rows 713(0-767) of display 710 are driven in order from row 713(0) to row 713(767). During each time interval 1002, bits $B_0$ for each row 713 of a particular group 902 are written into $B_0$ memory section 1402.

In FIG. 15A, memory section 1402 is shown five times, in order to illustrate the contents of memory section 1402 at various times. As $B_0$ bits are written into $B_0$ memory section 1402, the individual memory locations 1504 begin to fill in order. At a time $t_1$, a fifth $B_0$ bit ($B_0$4) is written into a fifth memory location 1504(4) of $B_0$ memory section 1402. Prior to time $t_1$, bits $B_0$0-$B_0$4 were sequentially written into memory locations 1504(0-3). $B_0$ bits (e.g., bits $B_0$5-$B_0$154) continue to be loaded until, at a later time $t_2$, $B_0$ memory section 1402 becomes full for a first time as a $156^{th}$ bit $B_0$155 is written into the last memory location 1504(155).

Because $B_0$ memory section 1402 is loaded in a "circular" fashion, the next bit written to $B_0$ memory section 1402 after $B_0$155 will be written to the first memory location 1504(0). Accordingly, at time $t_3$ a $157^{th}$ bit $B_0$156 is written into memory location 1504(0), thereby overwriting bit $B_0$. As additional $B_0$ bits continue to be written into $B_0$ memory section 1402, memory locations 1504(1-155) are over-written with new bits $B_0$156-$B_0$311. For example, at a time $t_4$ a $311^{th}$ bit $B_0$310 is written into memory location 1504(154), thereby over-writing bit $B_0$154. The overwriting of $B_0$ bits is acceptable, and the resulting reduction in memory requirement achieved, because for a particular $B_0$ bit the first three time intervals 1002 of the modulation period will have already passed. Thus, the overwritten $B_0$ bits are no longer required to properly modulate the associated pixel.

This circular process of writing $B_0$ bits to $B_0$ memory section 1402 continues while display 710 is being modulated. For example, at an arbitrary time $t_n$ a $1089^{th}$ bit $B_0$1089 is written into memory location 1504(153), thereby overwriting a previously stored bit $B_0$933. At time $t_n$, $B_0$ memory section 1402 will have been circled through almost seven times, storing $B_0$ display data for each column 712. Note that the nomenclature (i.e., $B_0$X) used to identify a particular $B_0$ bit is used only to denote the sequence of $B_0$ bits that have passed through $B_0$ memory section 1402, and that the X does not correspond to any particular row 713 of display 710.

The $B_0$ bits of display data for rows 713 of display 710 are written into $B_0$ memory section 1402 in the same order as they are grouped in groups 902(0-14). Writing the $B_0$ bits into $B_0$ memory section 1402 in this manner ensures that a $B_0$ bit associated with a particular row 713 is always stored in the same one of memory locations 1504(0-155) during each modulation period. The memory location 1504 at which a $B_0$ bit associated with a particular row 713 is stored is determined according to:

$$\text{Memory Location}=(\text{Row Address})\text{MOD}(B_0\ \text{Memory Size}),$$

where "Row Address" is the numerical row address of a row 713, $B_0$ Memory Size is the size of each memory section 1402 for a single column 712 of pixels 711 (e.g., 156 bits), and MOD is the remainder function. A $B_0$ bit of display data can be retrieved from a memory location 1504 using the same formula.

Figure 15B:
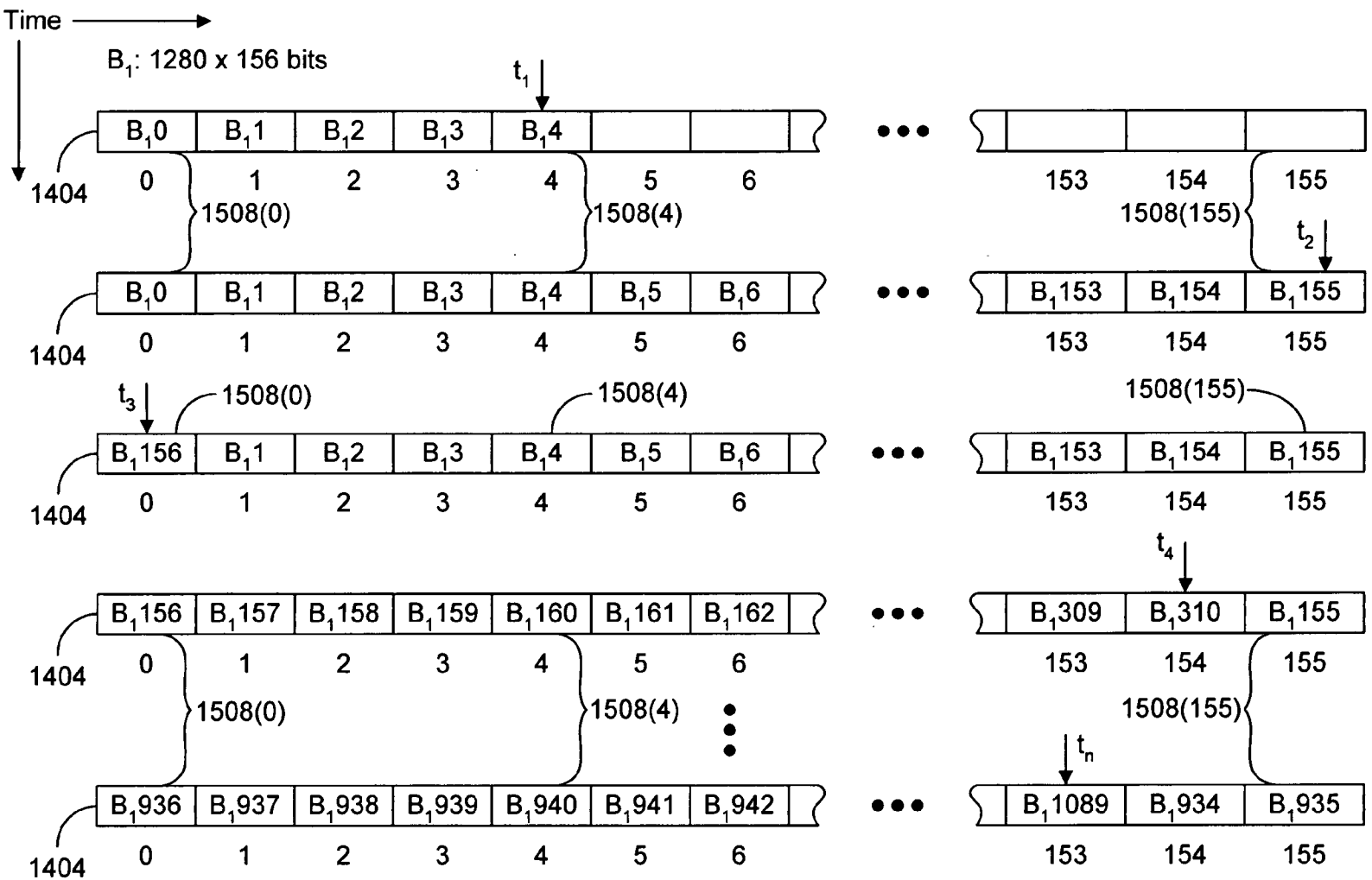
FIG. 15B is a memory allocation diagram indicating how video data is written into the circular memory buffer of FIG. 7 for bit $B_1$.

FIG. 15B shows the order in which bits $B_1$ are written to memory section 1404. The memory space shown represents the memory space for storing bits $B_1$ of data intended for the pixels 711 of a single column 712 of display 710. The memory space shown in FIG. 15B is replicated for all 1280 columns 712 within $B_1$ memory section 1404. Memory section 1404 includes 156 memory locations 1508(0-155), each storing a next least significant bit (i.e., bit $B_1$) of display data for an associated pixel 711. $B_1$ bits are written into memory locations 1508(0-155) in substantially the same manner as the $B_0$ bits are written to memory section 1402 as shown in FIG. 15A.

The $B_1$ bits of display data for rows 713 of display 710 are also written into $B_1$ memory section 1404 in the same order as they are grouped in groups 902(0-14). Writing the $B_1$ bits into $B_1$ memory section 1404 in this manner ensures that a $B_1$ bit associated with a particular row 713 is always stored in the same one of memory locations 1508(0-155) during each modulation period. The memory location at which a $B_1$ bit associated with a particular row 713 is stored is determined according to:

$$\text{(Row Address)MOD}(B_1\text{ Memory Size}),$$

where "Row Address" is the numerical row address of a row 713, $B_1$, Memory Size is the size of each memory section 1404 for a single column 712 of display 710 (e.g., 156 bits), and MOD is the remainder function. A $B_1$ bit of display data can be retrieved from a memory location 1508 using the same formula.

Figure 15C:
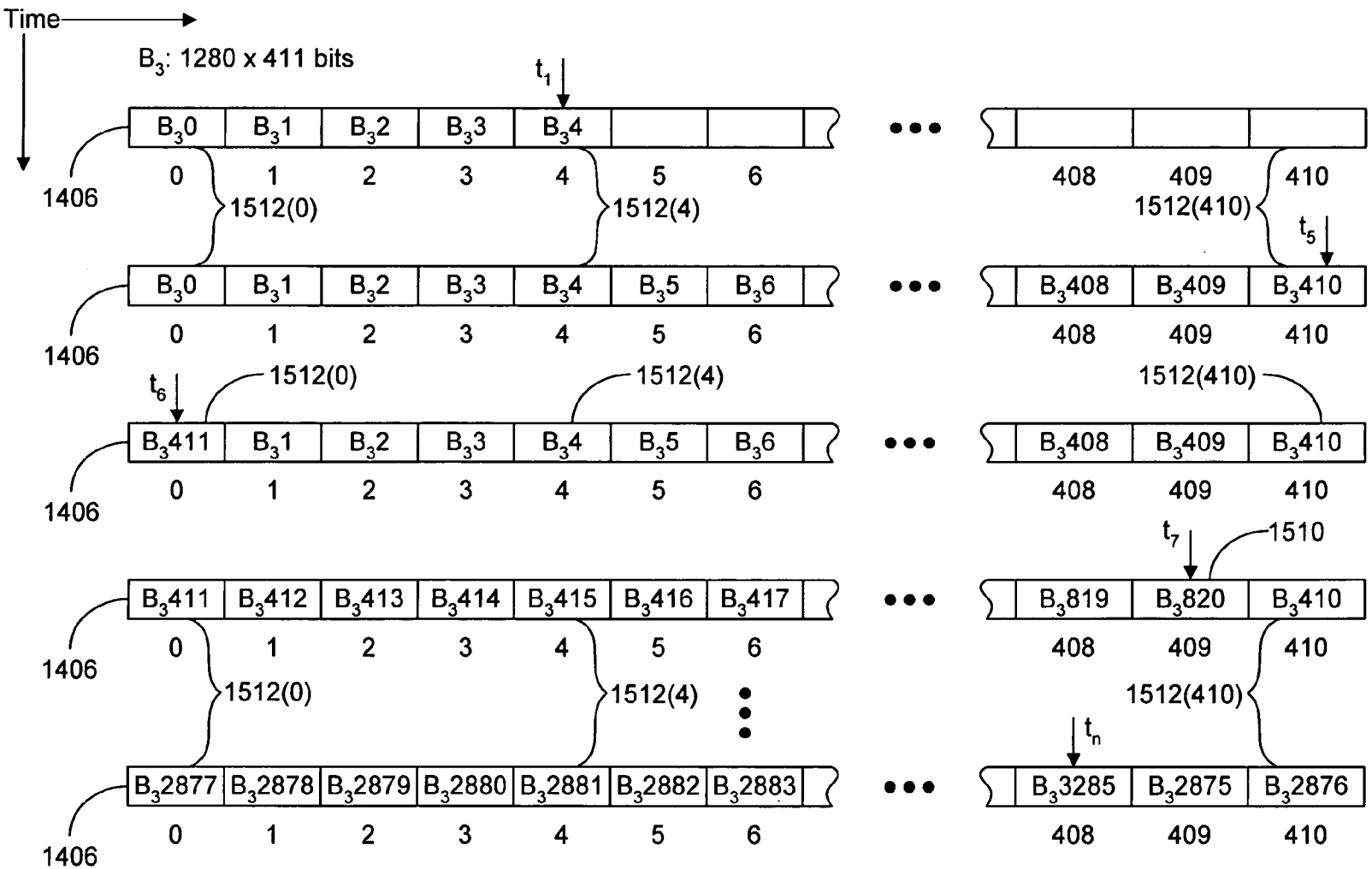
FIG. 15C is a memory allocation diagram indicating how video data is written into the circular memory buffer of FIG. 7 for bit $B_3$.

FIG. 15C shows the order in which bits $B_3$ are written to memory section 1406. The memory space shown represents the memory space for storing bits $B_3$ of data intended for the pixels 711 of a single column 712 of display 710. The memory space shown in FIG. 15C is replicated for all 1280 columns 712 within $B_3$ memory section 1406.

Memory space 1406 includes 411 memory locations 1512 (0-410), each storing a most significant bit (i.e., bit $B_3$) of display data for an associated pixel 711. $B_3$ bits are written into memory locations 1512(0-410) in the order that rows 713 of display 710 are driven. In the present embodiment, rows 713(0-767) of display 710 are driven in order from row 713(0) to row 713(767). During each time interval 1002, bits $B_3$ for each row 713 of a particular group 902 are written into $B_3$ memory section 1406.

As $B_3$ bits are written into $B_3$ memory section 1406, the memory locations 1512(0-410) begin to fill. At a time $t_1$, a fifth $B_3$ bit ($B_3$4) is written into a fifth memory location 1512(4) of $B_3$ memory section 1406 at approximately the same time as bits $B_0$4 and $B_1$4 are written into $B_0$ memory section 1402 and $B_1$ memory section 1404, respectively. Prior to time $t_1$, bits $B_3$0-$B_3$3 were written into memory locations 1512(0-3). $B_3$ bits (e.g., bits $B_3$5-$B_3$409) continue to be loaded until, at a later time $t_5$, $B_3$ memory section 1406 becomes full for a first time as a 411$^{th}$ bit $B_3$410 is written into the last memory location 1512(410).

Because $B_3$ memory section 1406 is circular, the next bit written to $B_3$ memory section 1406 after bit $B_3$410 will be written to the first memory location 1512(0). Accordingly, at time to a 412$^{th}$ bit $B_3$411 is written into memory location 1512(0), thereby overwriting bit $B_3$0. Again, as $B_3$ bits are written into $B_3$ memory section 1406, memory locations 1512 (1-410) are over-written with new bits $B_3$412-$B_3$821. For example, at a time $t_7$ an 821$^{st}$ bit $B_3$820 is written into memory location 1512(409), thereby over-writing bit $B_3$409.

This circular process of writing $B_3$ bits to $B_3$ memory section 1406 continues while display 710 is being modulated. For example, at an arbitrary time $t_n$ a 3,286$^{th}$ bit $B_3$3285 is written into memory location 1512(408), thereby overwriting a previously stored bit $B_3$2874. At time $t_n$, $B_3$ memory section 1406 will have been circled through almost eight times, storing $B_3$ display data for each column 712. Again, the nomenclature (i.e., $B_3$X) used to identify a particular $B_3$ bit indicates the sequencing of bits and not any particular row 713 associated with the particular bit.

The $B_3$ bits of display data for rows 713 of display 710 are written into $B_3$ memory section 1406 in the same order as they are grouped in groups 902(0-14). Writing the $B_3$ bits into $B_3$ memory section 1406 in this manner ensures that a $B_3$ bit associated with a particular row 713 is always stored in the same one of memory locations 1512(0-410) during each modulation period. The memory location 1512 at which a $B_3$ bit associated with a particular row 713 is stored is determined according to:

$$\text{Memory Location}=\text{(Row Address)MOD}(B_3\text{ Memory Size}),$$

where "Row Address" is the numerical row address of a row 713, $B_3$ Memory Size is the size of each memory section 1406 for a single column 712 for each pixel 711 (e.g., 411 bits), and MOD is the remainder function. A $B_3$ bit of display data can be retrieved from a memory location 1512 using the same formula.

Figure 15D:
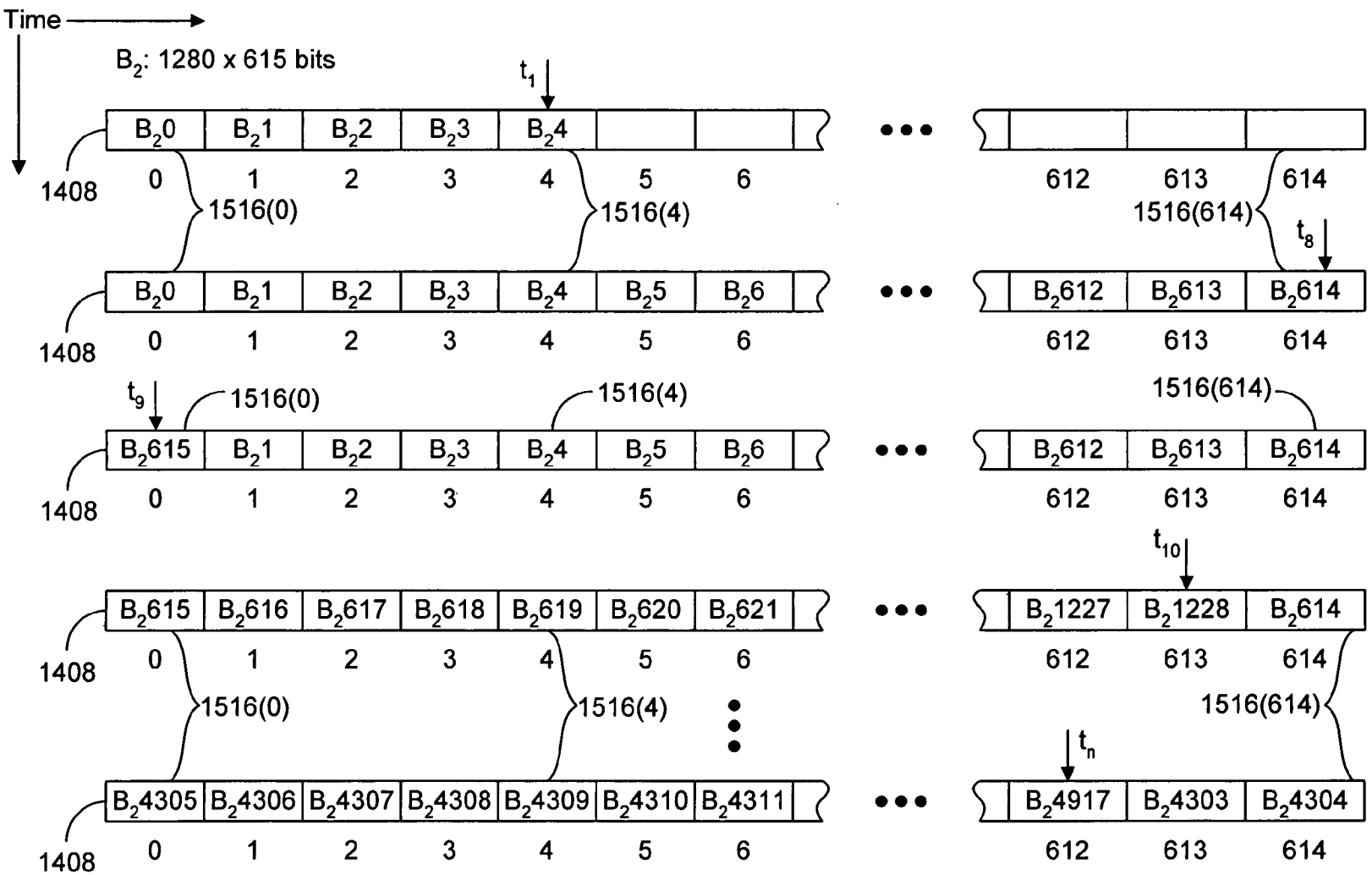
FIG. 15D is a memory allocation diagram indicating how video data is written into the circular memory buffer of FIG. 7 for bit $B_2$.

FIG. 15D shows the order in which bits $B_2$ are written to memory section 1408. The memory space shown represents the memory space for storing bits $B_2$ of data intended for the pixels 711 of a single column 712 of display 710. The memory space shown in FIG. 15D is replicated for all 1280 columns 712 within $B_2$ memory section 1408.

Memory space 1408 includes 615 memory locations 1516 (0-614), each storing a second most significant bit (i.e., bit $B_2$) of display data for an associated pixel 711. $B_2$ bits are written into memory locations 1516(0-614) in the order that rows 713 of display 710 are driven. In the present embodiment, rows 713(0-767) of display 710 are driven in order from row 713(0) to row 713(767). During each time interval 1002, bits $B_2$ for each row 713 of a particular group 902 are written into $B_2$ memory section 1408.

As $B_2$ bits are written into $B_2$ memory section 1408, the memory locations 1516(0-614) begin to fill. At a time $t_1$, a fifth $B_2$ bit ($B_{24}$) is written into a fifth memory location 1516(4) of $B_2$ memory section 1408 at approximately the same time as bits $B_0$4, $B_1$4, and $B_3$4 are written into $B_0$ memory section 1402, $B_1$ memory section 1404, and $B_3$ memory section 1406, respectively. Prior to time $t_1$, bits $B_2$0-$B_2$3 were written into memory locations 1516(0-3). $B_2$ bits (e.g., bits $B_2$5-$B_2$613) continue to be loaded until, at a later time $t_8$, $B_2$ memory section 1408 becomes full for a first time as a 615$^{th}$ bit $B_2$614 is written into the last memory location 1516(614).

Because $B_2$ memory section 1408 is circular, the next bit written to $B_2$ memory section 1408 after bit $B_2$614 will be written to the first memory location 1516(0). Accordingly, at time $t_9$ a 616$^{th}$ bit $B_2$615 is written into memory location 1516(0), thereby overwriting bit $B_2$0. Again, as $B_2$ bits are written into $B_2$ memory section 1408, memory locations 1516 (1-614) are over-written with new bits $B_2$615-$B_2$1229. For example, at a time $t_{10}$ a $1{,}229^{th}$ bit $B_2$1228 is written into memory location 1516(613), thereby over-writing bit $B_2$613.

This circular process of writing $B_2$ bits to $B_2$ memory section 1408 continues while display 710 is being modulated. For example, at an arbitrary time $t_n$ a $4{,}918^{th}$ bit $B_2$4917 is written into memory location 1516(612), thereby overwriting a previously stored bit $B_2$4302. At time $t_n$, $B_2$ memory section 1408 will have been circled through almost eight times, storing $B_2$ display data for each column 712. Again, the nomenclature (i.e., $B_2$X) used to identify a particular $B_2$ bit in no way denotes a row 713 associated with the particular bit.

The $B_2$ bits of display data for rows 713 of display 710 are written into $B_2$ memory section 1408 in the same order as they are grouped in groups 902(0-14). Writing the $B_2$ bits into $B_2$ memory section 1408 in this manner ensures that a $B_2$ bit associated with a particular row 713 is always stored in the same one of memory locations 1516(0-614) during each modulation period. The memory location 1516 at which a $B_2$ bit associated with a particular row 713 is stored is determined according to:

$$\text{Memory Location}=(\text{Row Address})\text{MOD}(B_2\text{Memory Size}),$$

where "Row Address" is the numerical row address of a row 713, $B_2$ Memory Size is the size of each memory section 1408 for a single column 712 for each pixel 711 (e.g., 615 bits), and MOD is the remainder function. A $B_2$ bit of display data can be retrieved from a memory location 1516 using the same formula.

As is apparent from the description of FIG. 14 and FIGS. 15A-15D, new bits of display data are written over bits of display data that are no longer needed by row logic 708. However, each time a pixel 711 is updated, row logic 708 receives four bits of display data from circular memory buffer 706. Therefore, because some of the display data received by row logic 708 will be erroneous for a particular pixel 711 during a particular time interval, row logic 708 is operative to ignore particular bits of display data received for the pixel depending upon the time interval. For example, in the present embodiment, row logic 708 is operative to ignore bits $B_0$ and $B_1$ after the lapse of (adjusted) time interval 1002(3) within the pixel's modulation period. In this manner row logic 708 discards invalid bits of display data by ignoring them based on the time interval.

Figure 16:
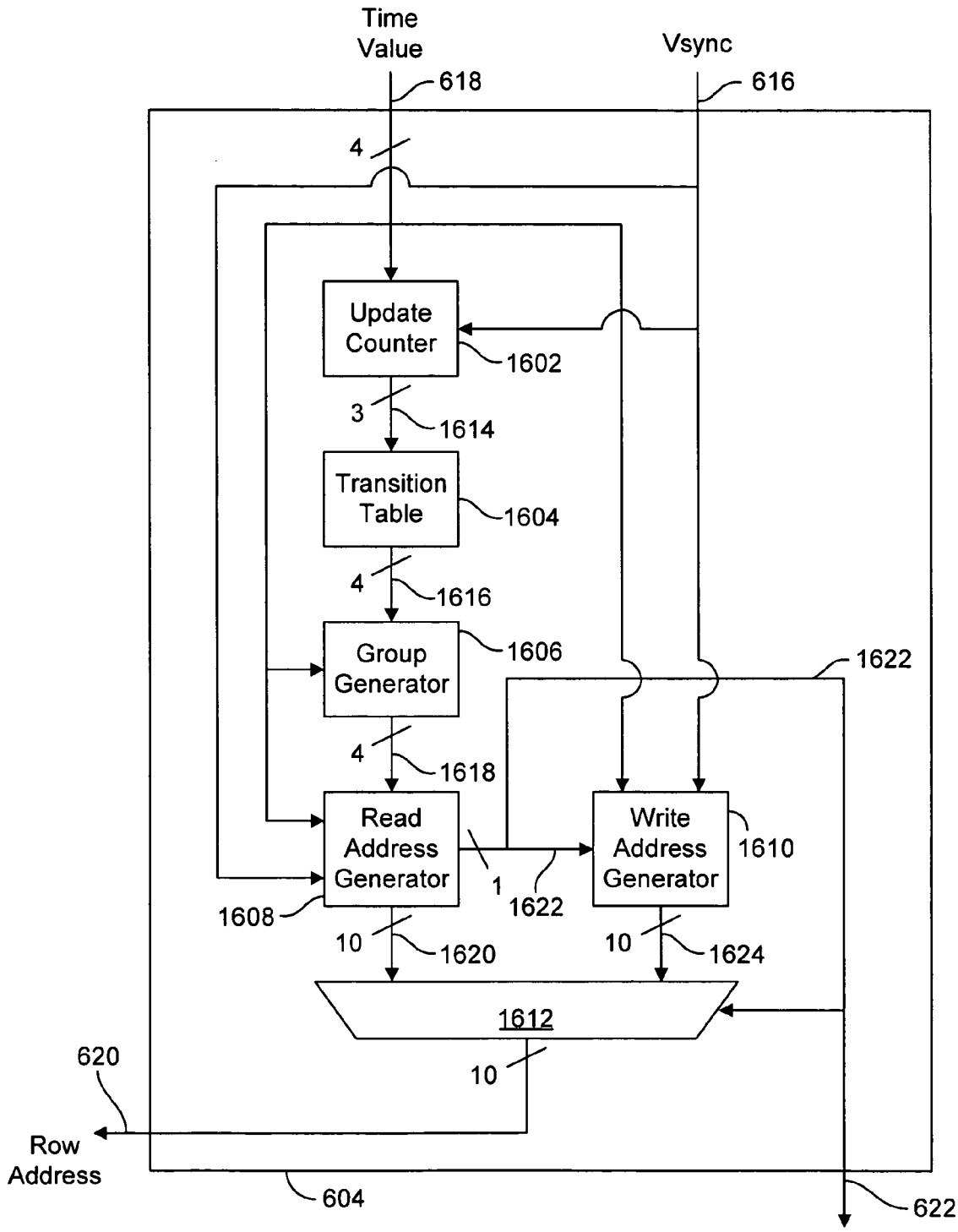
FIG. 16 is a block diagram showing the address generator of FIG. 6 in greater detail.

FIG. 16 is a block diagram showing address generator 604 in greater detail. Address generator 604 includes an update counter 1602, a transition table 1604, a group generator 1606, a read address generator 1608, a write address generator 1610, and a multiplexer 1612.

Update counter 1602 receives 4-bit timing signals from timer 602 via timing input 618 and the Vsync signal via synchronization input 616, and provides a plurality of 3-bit count values to transition table 1604 via an update count line 1614. The number of update count values that update counter 1602 generates is equal to the number of groups 902(0-14) that are updated during each time interval 1002. Therefore, in the present embodiment, update counter 1602 sequentially outputs six different count values 0 to five in response to receiving a timing signal on timing input 618.

Transition table 1604 receives each 3-bit update count value from update counter 1602, converts the update count value to a respective transition value, and outputs the transition value onto a 4-bit transition value line 1616. Accordingly, because update counter 1602 provides six update count values per time interval 1002, transition table 1604 will also output six transition values per time interval. In the present embodiment, transition table 1604 is a simple look-up table that looks up a particular transition value associated with each update count value received from update counter 1602. As indicated previously, each group 902 is updated during one of six time intervals 1002 during its "adjusted" modulation period. These six time intervals corresponded to time intervals 1002(1), 1002(2), 1002(3), 1002(4), 1002(8) and 1002(12). Accordingly, each transition value corresponds to one of time intervals 1002(1), 1002(2), 1002(3), 1002(4), 1002(8), and 1002(12). In particular, transition table 1604 converts update count values 0-5 into transition values 1-4, 8, and 12, respectively.

Group generator 1606 receives the 4-bit transition values from transition table 1604 and time values from timing input 618, and depending on the time value and transition value, outputs a group value indicative of one groups 902(0-14) to be updated within a particular time interval 1002 associated with the time value. Because, transition table 1604 outputs six transition values per time interval, group generator 1606 generates six group values per time interval 1002 and asserts the group values onto 4-bit group value line 1618. Each group value is determined according to the following process:

```
Group Value = Time Value − Transition Value
    if Group Value < 0
        then Group Value = Group Value + (Time Value)max
    end if,
```

where $(\text{Time Value})_{max}$ represents the maximum time value generated by timer 602, which in the present embodiment, is 15.

Read address generator 1608, receives each group value via group value line 1618, time values via timing input 618, and synchronization signals via synchronization input 616. Read address generator 1608 receives a group value from group generator 1606 and sequentially outputs the row addresses associated with the group value in ascending order onto 10-bit read address lines 1620.

Read address generator 1608 also counts the number of group values received from group generator 1606 in between subsequent timing signals received on timing input 618. While the number of group values received in a time interval 1002 is less than or equal to six and read address generator 1608 is generating row addresses, read address generator 1608 also generates a LOW write enable signal on write enable line 1622. Write enable line 1622 is coupled to write address generator 1610, to the control terminal of multiplexer 1612, and to load data output 622. A LOW write enable signal disables write address generator 1610, and instructs multiplexer 1612 to couple read address lines 1620 with address output bus 620, such that "read" row addresses are delivered to time adjuster 610 and to imagers 504(*r, g, b*).

A LOW write enable signal asserted on load data output 622 serves as a LOW load data signal for time adjuster 610, circular memory buffer 706, and row decoder 714. Accordingly, while write enable signal remains LOW, time adjuster 610 adjusts the time value generated by timer 602 for each read row address generated by read address generator 1608, circular memory 706 outputs bits of display data associated with each read row address, and row decoder 714 enables word lines 750 corresponding to each read row address.

When the number of received group values within a time interval is equal to six and a short time after read address generator 1608 has generated a final read row address for the sixth group value, read address generator 1608 asserts a HIGH write enable signal on write enable line 1622. In response, write address generator 1610 begins generating "write" row addresses on write address lines 1624 such that new rows of data can be written into circular memory buffer 706. In addition, when a HIGH write enable signal is asserted on write enable line 1622, multiplexer 1612 is operative to couple write address lines 1624 with address output bus 620, thereby delivering write addresses to time adjuster 610 and imagers 504(*r, g, b*). A HIGH write enable signal (i.e., a HIGH load data signal) also disables time adjuster 610 and row decoder 714, and causes circular memory buffer 706 to load display data from multi-row memory buffer 704 into memory locations associated with the generated write row addresses.

Write address generator 1610 also receives timing signals indicative of a time interval 1002 via timing input 618, and Vsync signals via synchronization input 616. When the write enable signal is HIGH, write address generator 1610 outputs row addresses for the rows 713 whose modulation period is beginning in the subsequent time interval 1002. For example, if the timing signal received via timing input 618 had a value of 1 corresponding to time interval 1002(1), then write address generator 1610 would generate row addresses for the rows 713 associated with the second group 902(1). Similarly, if the timing signal had a value of 2, then write address generator 1610 would generate row addresses for the rows 713 associated with the third group 902(2). As another example, if the timing signal had a value of 15, then write address generator 1610 would output the row addresses for the rows 713 associated with the first group 902(0). In this manner, rows of display data stored in FIFO 704 can be written into circular memory buffer 706 before they are needed by row logic 708 to modulate display 710.

Figure 17A:
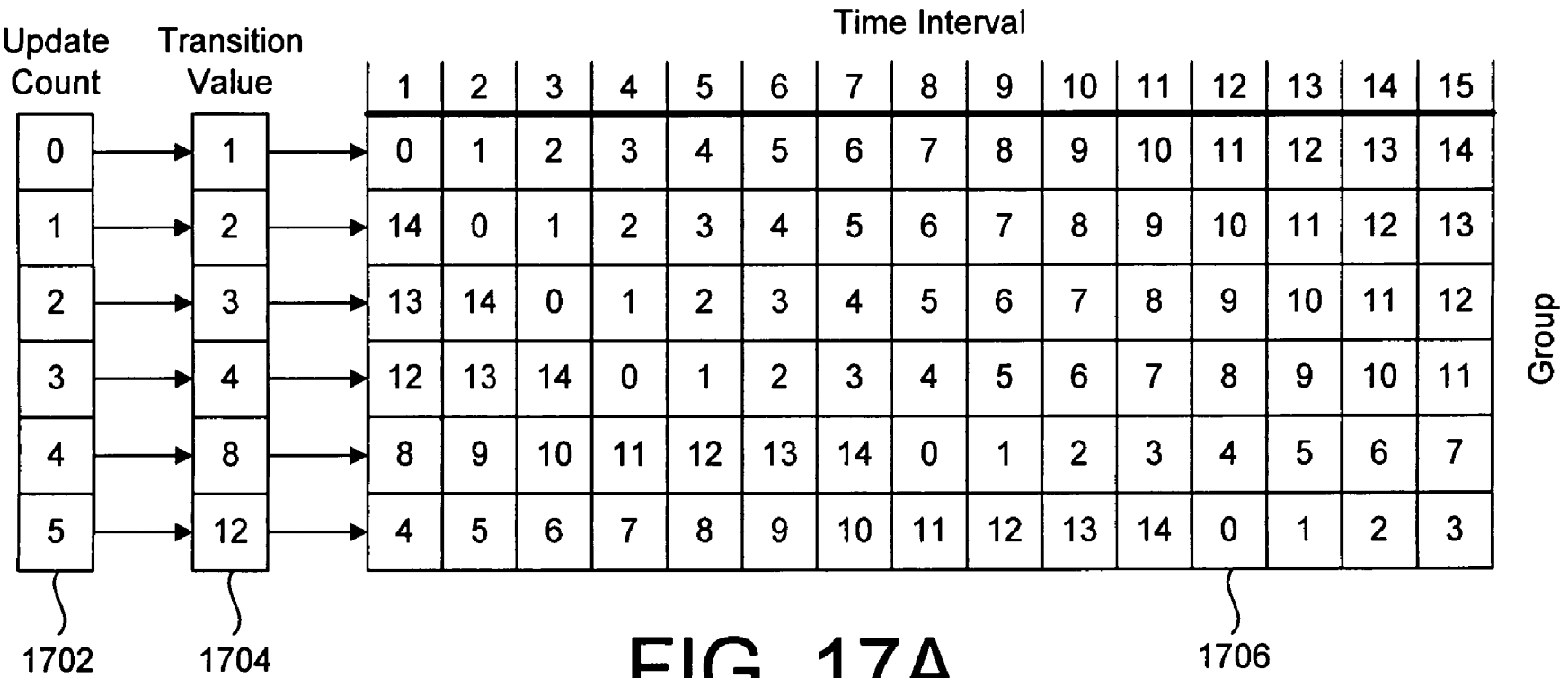
FIG. 17A is a table showing input and output values of the address counter, transition table and group generator of FIG. 16.

FIG. 17A shows three interlinked tables displaying the outputs of some of the components of FIG. 16. FIG. 17A includes an update count value table 1702, a transition value table 1704, and a group value table 1706. Update count value table 1702 is displays the six count values 0-5 consecutively output by update counter 1602. Transition value table 1704 indicates the particular transition value output by transition table 1604 for a particular update count value received from update counter 1602. For example, if transition table 1604 receives a count value of 0, then transition table 1704 outputs a value of 1. Likewise, if update counter 1602 outputs count values of 1, 2, 3, 4, and 5, transition table 1604 outputs transition values of 2, 3, 4, 8, and 12, respectively. As stated above, the transition values of transition table 1704 correspond to the time values/time intervals 1002 during which a group 902 is updated in it's modulation period.

Upon receiving a particular transition value and time value (shown in top row), group generator 1606 generates the particular group values shown in group value table 1706. Again, group generator 1606 calculates group values according to the logical process:

```
Group Value = Time Value − Transition Value
If Group Value < 0
    then Group Value = Group Value + (Time Value)max
end if,
```

where $(\text{Time Value})_{max}$ represents the maximum time value generated by timer 602, which in the present embodiment, is 15. For example, for time interval 1002(1) indicated by a time value of 1 generated by timer 602, group generator 1606 generates group values of 0, 14, 13, 12, 8, and 4, responsive to receiving transition values of 1, 2, 3, 4, 8, 12, respectively. Indeed, as shown in FIG. 10, groups 902(0), 902(14), 902(13), 902(12), 902(8), and 902(4) are updated in that order during the first time interval 1002(1). As another example, for time interval 1002(2) indicated by a time value of 2, group generator 1606 generates group values of 1, 0, 14, 13, 9, and 5 responsive to receiving transition values of 1, 2, 3, 4, 8, 12, respectively. Indeed, as shown in FIG. 10, groups 902(1), 902(0), 902(14), 902(13), 902(9), and 902(5) are updated in that order during the second time interval 1002(2).

Figure 17B:
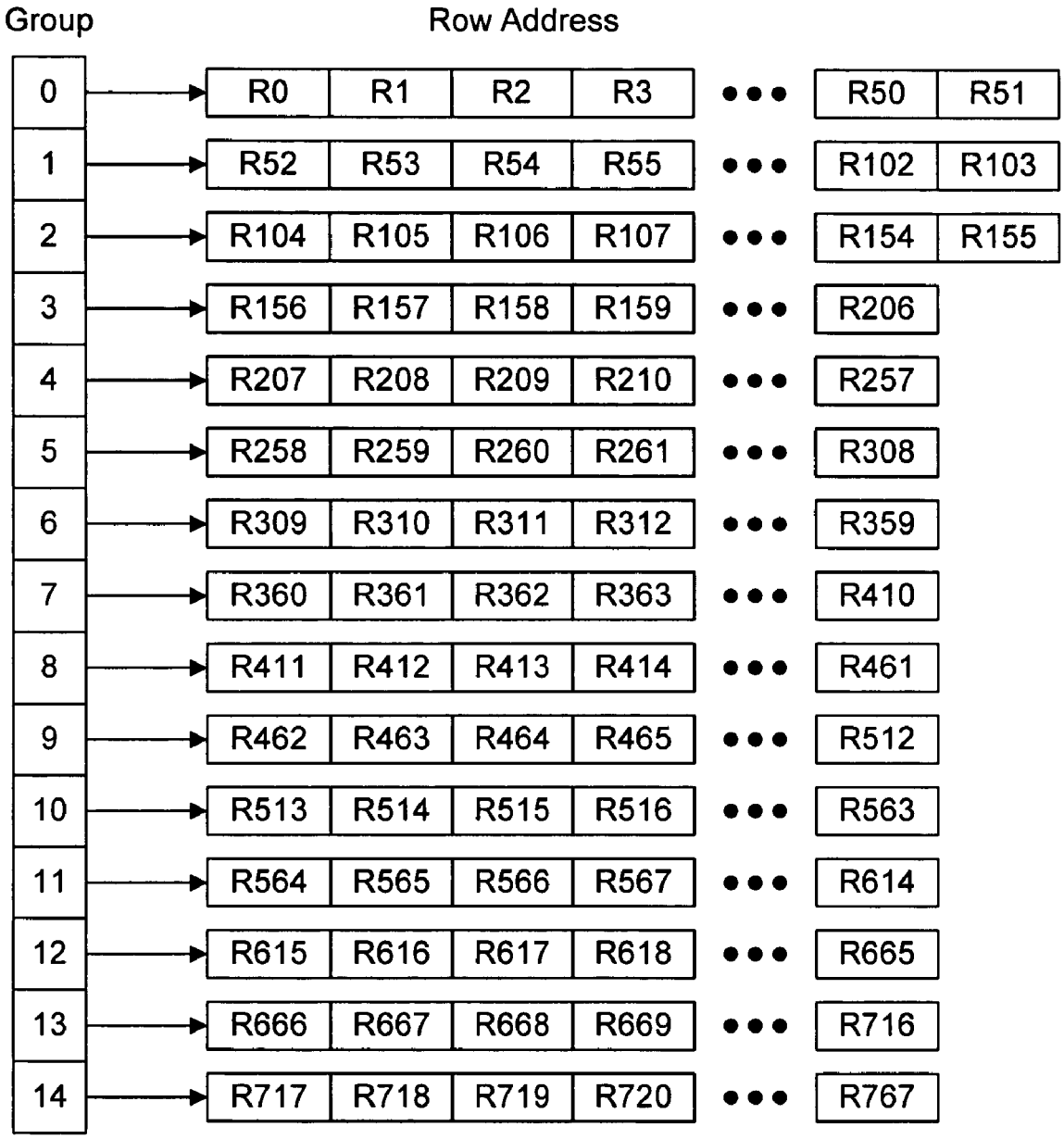
FIG. 17B is a table showing input and output values of the read address generator of FIG. 16.

FIG. 17B is a table 1708 indicating the row addresses output by read address generator 1608 for each particular group value received from group generator 1606. As shown in FIG. 17B, for a particular group 902, read address generator 1608 outputs row addresses for the following rows 713 of display 710 as follows:

Group 0: Row 0 through Row 51 (R0-R51)
Group 1: Row 52 through Row 103 (R52-R103)
Group 2: Row 104 through Row 155 (R104-R155)
Group 3: Row 156 through Row 206 (R156-R206)
Group 4: Row 207 through Row 257 (R207-R257)
Group 5: Row 258 through Row 308 (R258-R308)
Group 6: Row 309 through Row 359 (R309-R359)
Group 7: Row 360 through Row 410 (R360-R410)
Group 8: Row 411 through Row 461 (R411-R461)
Group 9: Row 462 through Row 512 (R462-R512)
Group 10: Row 513 through Row 563 (R513-R563)
Group 11: Row 564 through Row 614 (R564-R614)
Group 12: Row 615 through Row 665 (R615-R655)
Group 13: Row 666 through Row 716 (R666-R716)
Group 14: Row 717 through Row 767 (R717-R767).

Figure 17C:
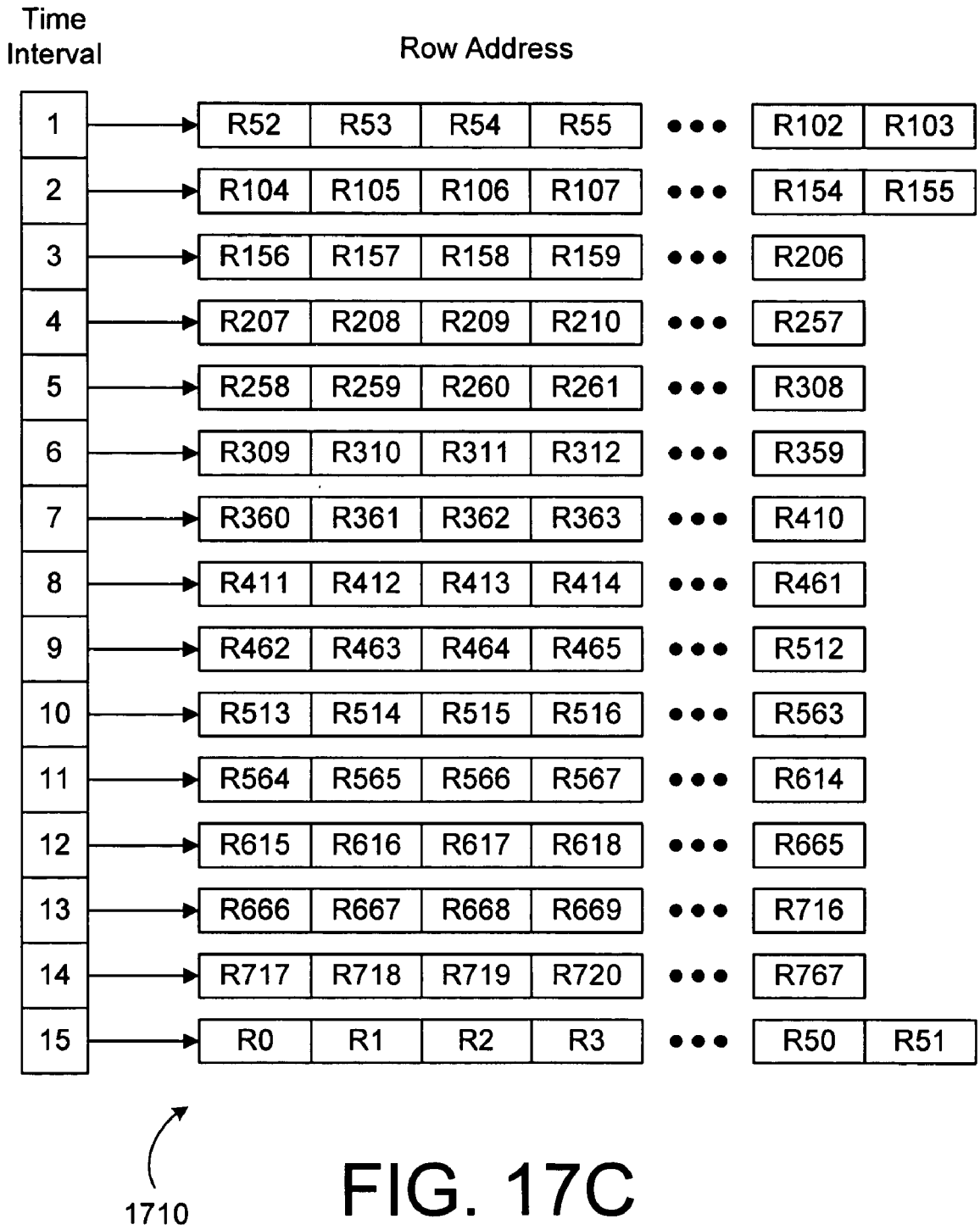
FIG. 17C is a table showing input and output values of the write address generator of FIG. 16.

FIG. 17C is a table 1710 indicating the row addresses output by write address generator 1610 for each particular time value received from timer 602 via timing input 618. As shown in FIG. 17C, for a particular time value indicative of a time interval 1002, write address generator 1610 outputs row addresses for the following rows 713 of display 710:

Time Value/Interval 1002(1): Row 52 through Row 103 (R52-R103)
Time Value/Interval 1002(2): Row 104 through Row 155 (R104-R155)
Time Value/Interval 1002(3): Row 156 through Row 206 (R156-R206)
Time Value/Interval 1002(4): Row 207 through Row 257 (R207-R257)
Time Value/Interval 1002(5): Row 258 through Row 308 (R258-R308)
Time Value/Interval 1002(6): Row 309 through Row 359 (R309-R359)
Time Value/Interval 1002(7): Row 360 through Row 410 (R360-R410)
Time Value/Interval 1002(8): Row 411 through Row 461 (R41-R461)
Time Value/Interval 1002(9): Row 462 through Row 512 (R462-R512)
Time Value/Interval 1002(10): Row 513 through Row 563 (R513-R563)
Time Value/Interval 1002(11): Row 564 through Row 614 (R564-R614)
Time Value/Interval 1002(12): Row 615 through Row 665 (R615-R655)
Time Value/Interval 1002(13): Row 666 through Row 716 (R666-R716)
Time Value/Interval 1002(14): Row 717 through Row 767 (R717-R767)
Time Value/Interval 1002(15): Row 0 through Row 51 (R0-R51).

Figure 18:
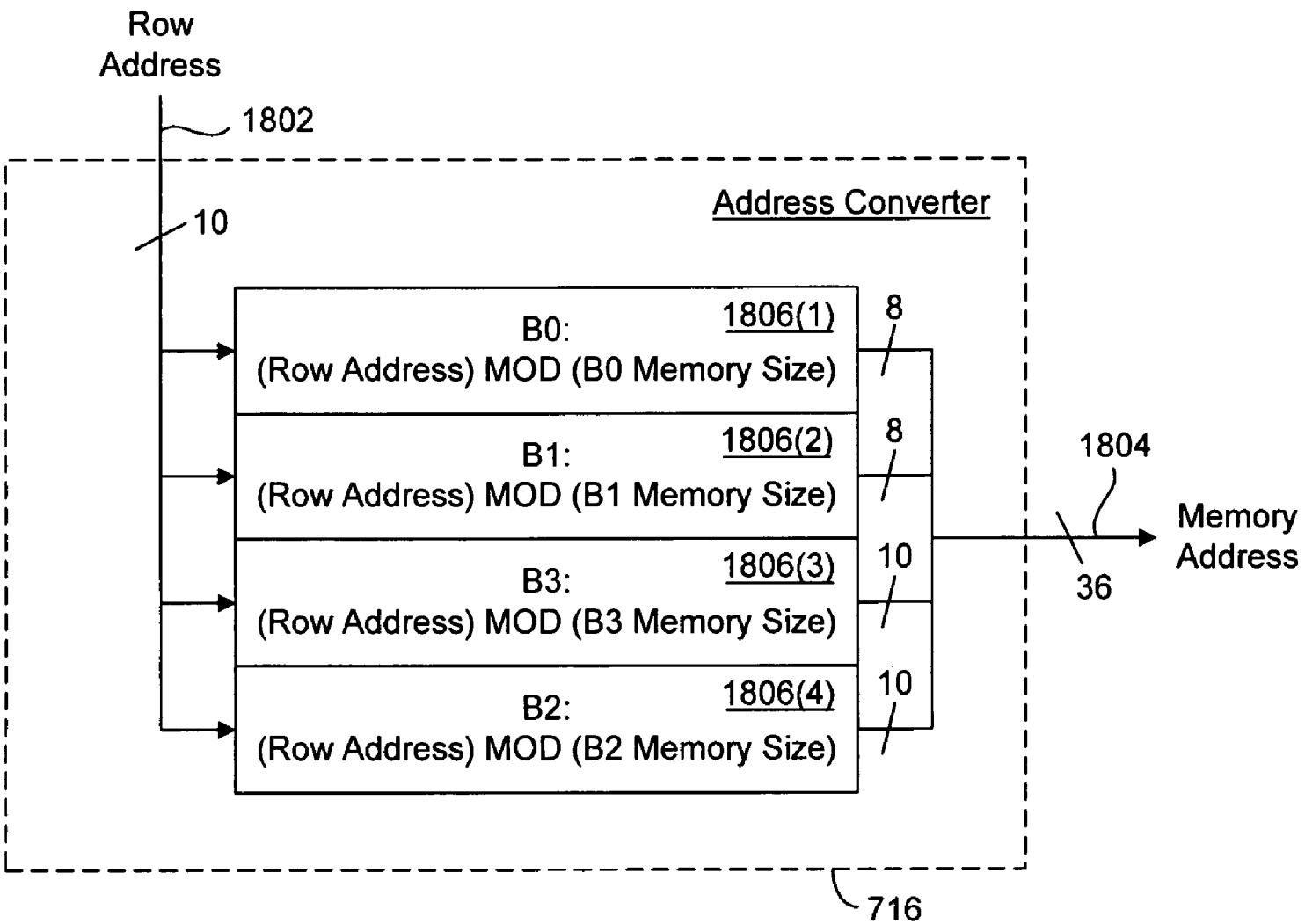
FIG. 18 is a block diagram showing the address converter of FIG. 7 in greater detail.

FIG. 18 shows address converter 716 in greater detail. Address converter 716 includes a 10-bit row address input 1802, a 10-bit memory address output 1804, and a plurality of address conversion modules 1806(1-4) each associated with a particular bit (e.g., B0-B3) of an n-bit binary weighted data word, such as binary weighted data word 1202. Conversion module 1806(1) transforms a row address into a memory address associated with a $B_0$ memory location 1504 located in $B_0$ memory section 1402 of circular memory buffer 706. Conversion module 1806(2) transforms the same row address into a memory address associated with a $B_1$ memory location 1508 located in $B_1$ memory section 1404 of circular memory buffer 706. Conversion module 1806(3) transforms the same row address into a memory address associated with a $B_3$ memory location 1512 located in $B_3$ memory section 1406 of circular memory buffer 706. Finally, conversion module 1806 (4) transforms the same row address into a memory address associated with a $B_2$ memory location 1516 located in $B_2$ memory section 1408 of circular memory buffer 706. The converted memory addresses are then asserted onto memory address output 1804 such that circular memory buffer 706 either loads data into or reads data from the associated memory locations within circular memory buffer 706.

Conversion modules 1806(1-4) utilize the following algorithms to convert a row address into a memory address for each memory section 1402, 1404, 1406, and 1408 of circular memory buffer 706.

Bit $B_0$: (Row Address) MOD ($B_0$ Memory Size)
Bit $B_1$: (Row Address) MOD ($B_1$ Memory Size)
Bit $B_3$: (Row Address) MOD ($B_3$ Memory Size)
Bit $B_2$: (Row Address) MOD ($B_2$Memory Size), where MOD is the remainder function.

It should also be noted that because $B_0$ memory section 1402 and $B_1$ memory section 1404 are the same size, that one of conversion modules 1806(1) or 1806(2) can be eliminated from address converter 716. However, separate conversion modules 1806 are shown for generality of explanation.

Figure 19:
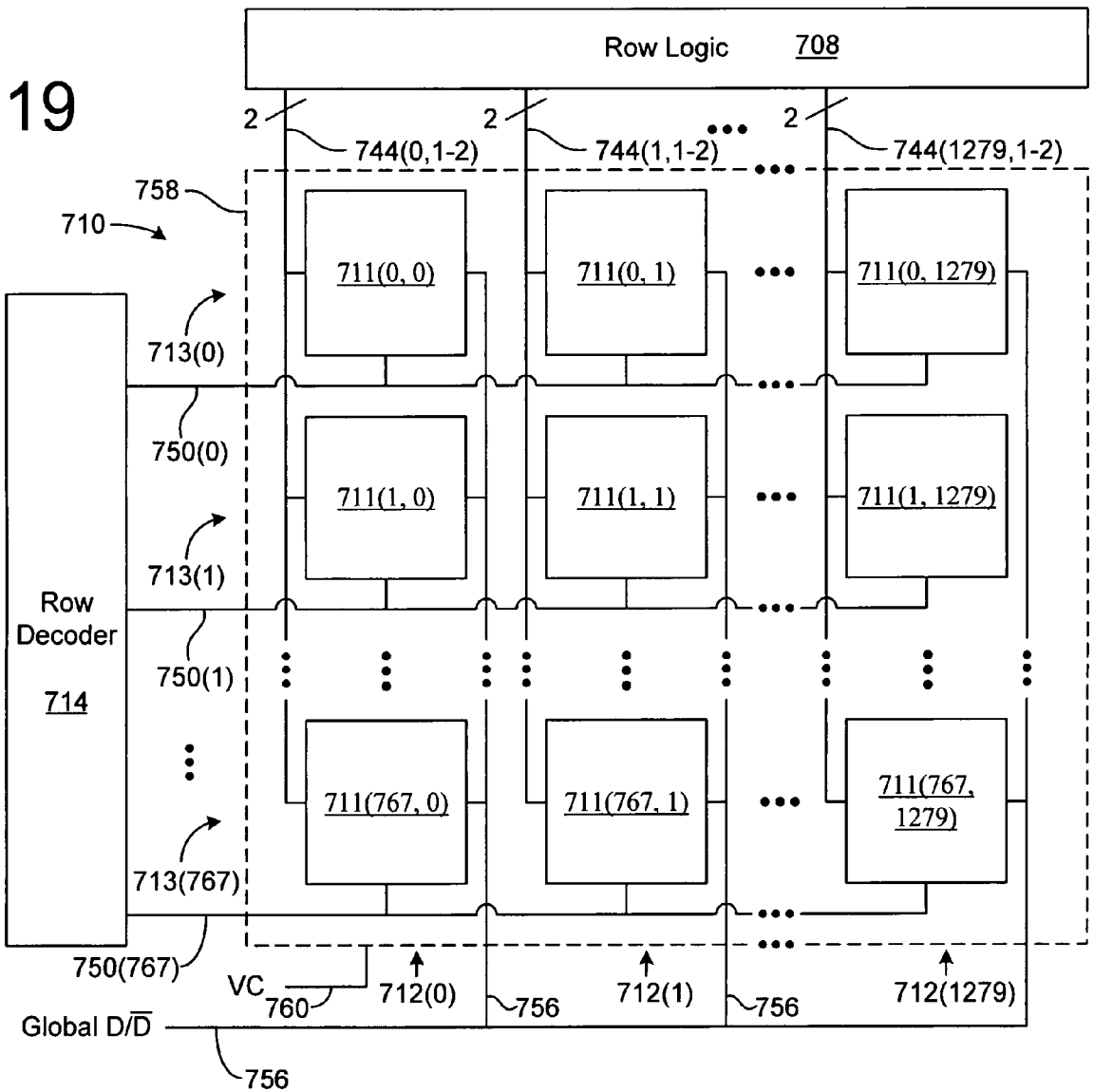
FIG. 19 is a block diagram showing a portion of the imager of FIG. 7 in greater detail.

FIG. 19 is a block diagram showing a portion of imager 504(*r, g, b*) in greater detail. In particular, display 710 includes an array of pixel cells 711 (r, c) arranged in a plurality of columns 712(0-1279) and a plurality of rows 713(0-767), where r denotes a particular row and c denotes a particular column. In addition, data is written to every pixel 711(0-767, c) in a respective one of columns 712(0-1279) via a respective one of display data lines 744(0-1279, 1), and previous values of every pixel 711(0-797, c) are provided to row logic 708 via a respective one of display data lines 744 (0-1279, 2). Therefore, each column 712(0-767) of pixels 711 is coupled to row logic 708 via two respective data lines 744(0-1279, 1-2) (shown as a single two-bit line for simplicity). Similarly, every pixel 7111(*r*, 0-1279) in a respective one of rows 713(0-767) is enabled via a respective one of word lines 750(0-767). In addition, display 710 includes a global data invert line 756 coupled to the circuitry (not shown) of each pixel 711. Global data invert line 756 receives data invert signals from global data invert input 722 and simultaneously provides the data invert signals to each pixel 711. Display 710 also includes a common electrode 758 overlying the entire array of pixels 711(*r*, c). In the present embodiment, common electrode 758 is an Indium-Tin-Oxide (ITO) layer. Finally, voltage is asserted on common electrode 758 via a common voltage supply terminal 760, which receives a common voltage from common voltage input 724 (FIG. 7).

The voltages asserted on common voltage supply terminal 760 and the data invert signals asserted on global data invert line 756 are controlled and coordinated by debias controller 608 (FIG. 6). Debias controller 608 asserts either a normal or inverted common electrode voltage (VCn or VCi) onto common voltage supply terminal 760 via common voltage output 638 of imager control unit 516 and common voltage input 724 of imager 504(*r, g, b*). Debias controller 608 also asserts either a digital HIGH or digital LOW voltage onto global data invert line 756. Debias controller 608 performs the debiasing of display 710 as described hereinafter.

Figure 20A:
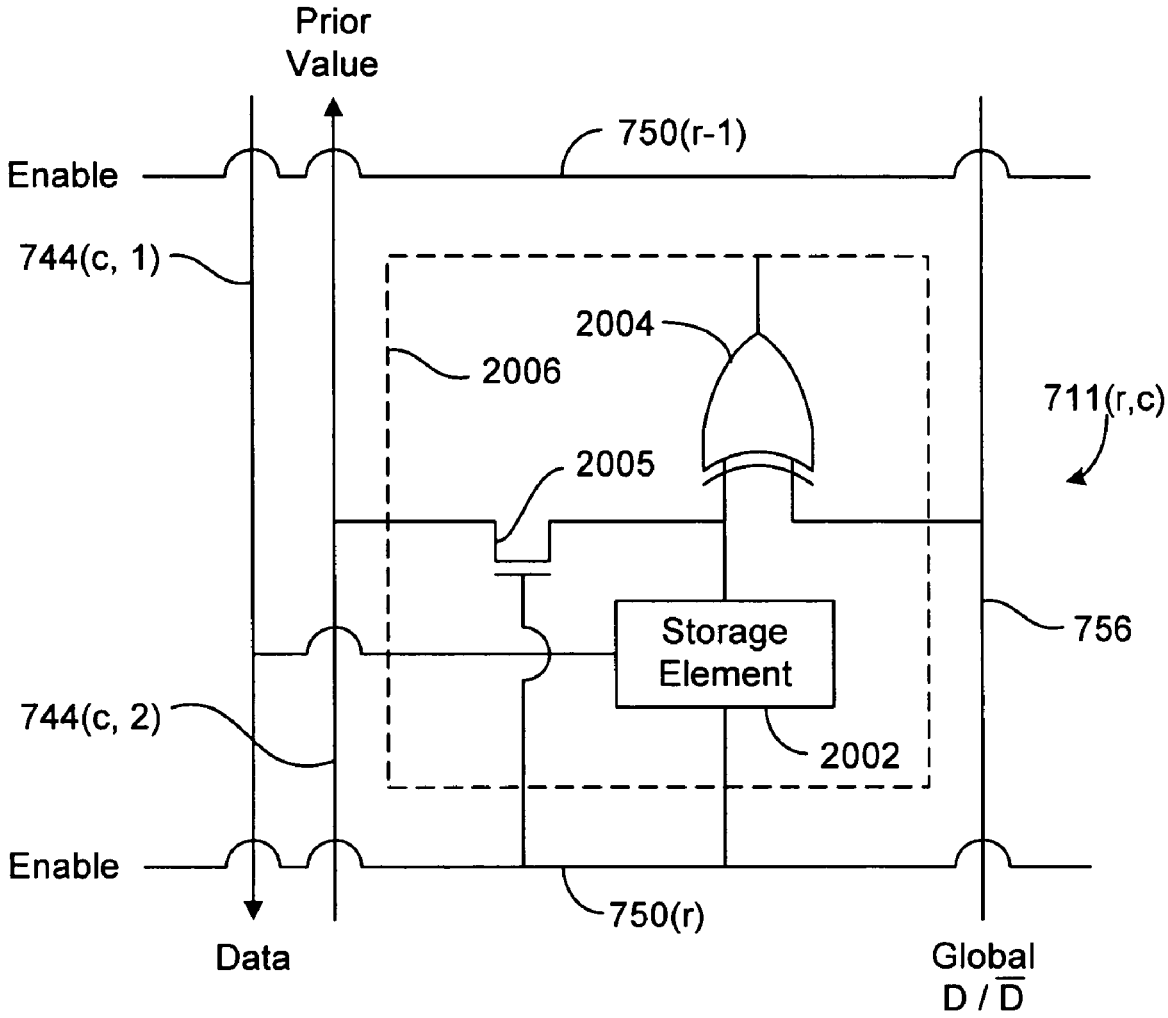
FIG. 20A is a block diagram of one pixel cell according one embodiment of the present invention.

FIG. 20A shows a first embodiment of a pixel 711 (r, c) in greater detail, where (r) and (c) represent the intersection of a row and column in which pixel 711 is located. In the embodiment shown in FIG. 20A, pixel 711 includes a storage element 2002, an exclusive or (XOR) gate 2004, a transistor 2005, and a pixel electrode 2006. Storage element 2002 is a static random access memory (SRAM) latch. A control terminal of storage element 2002 is coupled to a word line 750(*r*) associated with the row 713(*r*) in which pixel 711 is located, and a data input terminal of storage element 2002 is coupled to display data line 744(*c*, 1) associated with the column 712(*c*) in which pixel 711 is located. An output of storage element 2002 is coupled to one input of XOR gate 2004. The other input of XOR gate 2004 is coupled to global data invert line 756. A write signal on word line 750(*r*) causes the value of an update signal (e.g., a digital ON or OFF voltage) asserted on data line 744(*c*, 1) from row logic 708 to be latched into storage element 2002.

Depending on the signals asserted on the inputs of XOR gate 2004 by storage element 2002 and global data invert line 756, XOR gate is operative to assert either a HIGH or a LOW driving voltage onto pixel electrode 2006. For example, if the signal asserted on data invert line 756 is a digital HIGH, then voltage inverter 2004 asserts the inverted value of the voltage output by storage element 2002 onto pixel electrode 2006. On the other hand, if the signal asserted on data invert line 756 is a digital LOW, then voltage inverter 2004 asserts the value of the voltage output by storage element 2002 onto pixel electrode 2006. Thus, either the data bit latched in storage element 2002 will be asserted on pixel electrode 2006 (normal state) or the inverse of the latched bit will be asserted on pixel electrode 2006 (inverted stated), depending on the signal asserted on global data invert line 756.

Transistor 2005 selectively couples the output of storage element 2002 with display data line 744(*c*, 2), responsive to the signal on word line 750(*r*). When row decoder 714 asserts a write signal on word line 750(*r*), transistor 2005 conducts, thereby asserting the output of storage element 2002 onto display data line 744(*c*, 2). Data line 744(*c*, 2) then communicates the output of storage element 2002 to row logic 708, such that the current value on pixel electrode 2006 can be used to determine the next value to be written to storage element 2002.

Figure 20B:
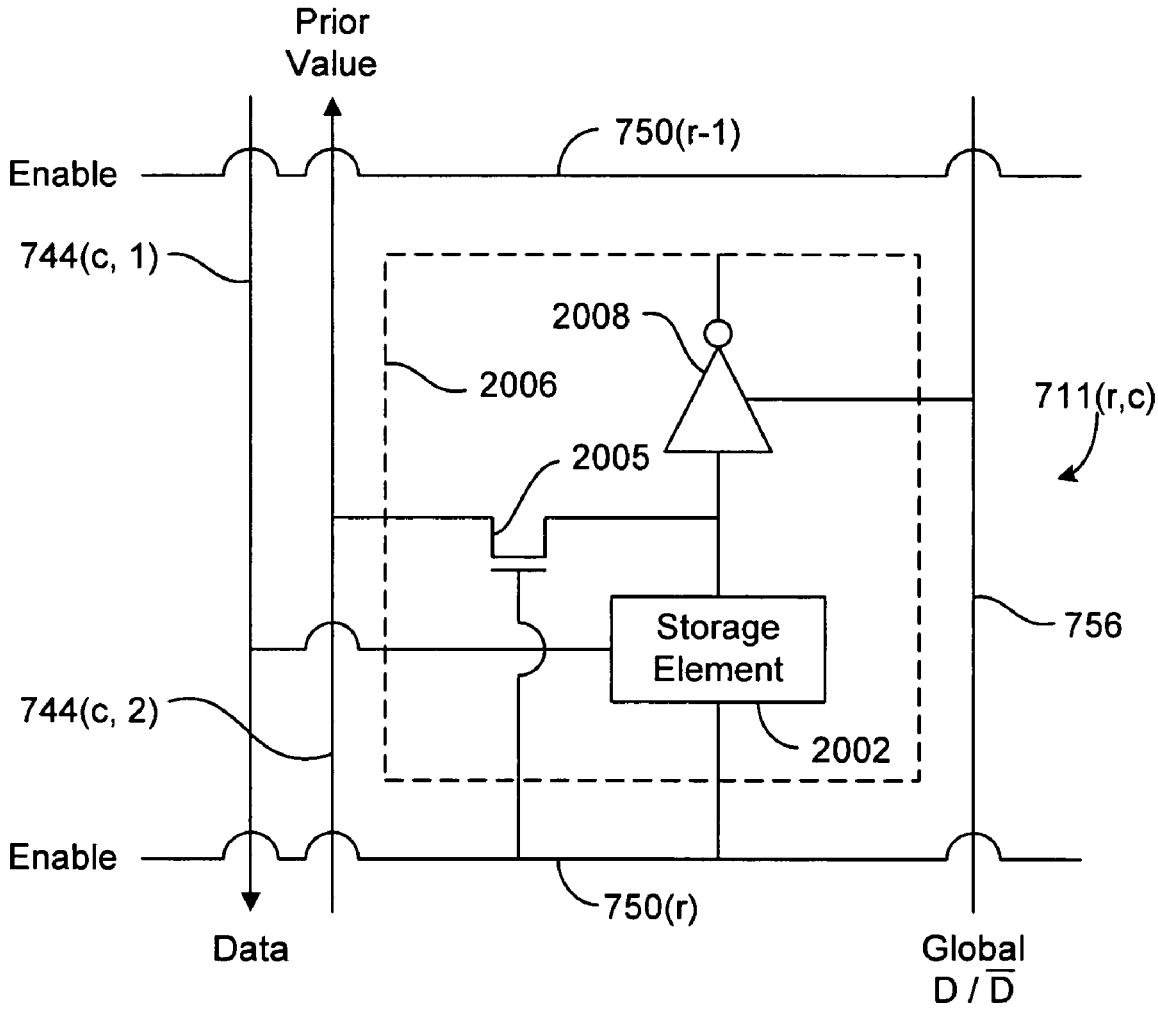
FIG. 20B is a block diagram of one pixel cell according to another embodiment of the present invention.

FIG. 20B shows an alternate embodiment of pixel 711(*r*, c) according to the present invention. In the alternate embodiment, pixel 711 (r, c) is the same as the embodiment shown in FIG. 20A, except that XOR gate 2004 is replaced with a controlled voltage inverter 2008. Voltage inverter 2008 receives the voltage output by storage element 2002 on its input terminal, has a control terminal coupled to global data invert line 756, and asserts its output onto pixel electrode 2006. Controlled inverter 2008 provides the same output responsive to the same inputs as XOR gate 2004 of FIG. 20A. Indeed, any equivalent logic may be substituted for XOR gate 2004 or inverter 2008.

Note that pixel cells 711 are advantageously single latch cells. In addition, because the voltages applied to pixel electrodes 2006 can be inverted simply by switching the output of voltage inverter 2004 or 2008, debiasing of display 710 can be performed easily without rewriting data to pixels 711, thereby decreasing the required bandwidth as compared to the prior art.

In the embodiments shown in FIGS. 20A and 20B, pixels 711 are reflective. Accordingly, pixel electrodes 2006 are reflective pixel mirrors. However, it should be noted that the present invention can be used with other light modulating devices including, but not limited to, transmissive displays and deformable mirror devices (DMDs).

Figures 21, 22:
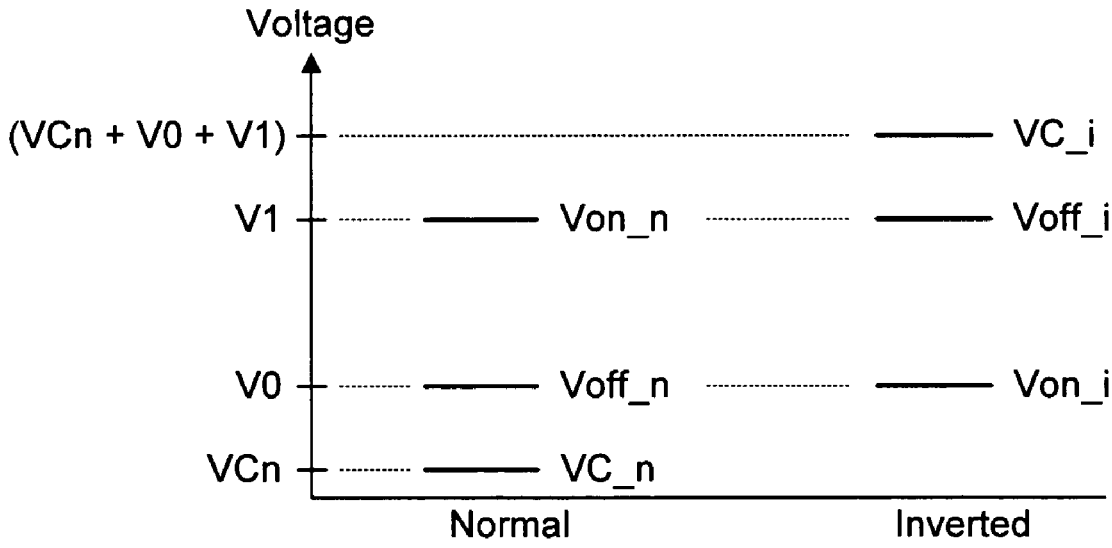
FIG. 21 is a truth table summarizing various input and output values of the pixel cells of FIGS. 20A and 20B.
FIG. 22 is a voltage chart showing a modulation scheme and debias scheme suitable for use with the present invention.

FIG. 21 is a truth table showing the input and output values for each of XOR gate 2004 and voltage inverter 2008 for this particular embodiment of the invention. The column labeled "Storage Element" indicates the digital logic values output by storage element 2002, the column labeled "Global D/D-bar" indicates the digital logic values asserted on global data invert line 756 by debias controller 608, and the column labeled "Pixel Voltage" indicates the digital logic value asserted onto pixel electrode 2006 by XOR gate 2004 or inverter 2008. In the present embodiment, a "1" in any column indicates a digital HIGH voltage (e.g., 5V), and a "0" in any column indicates a digital LOW voltage (e.g., 0.3V). When a digital HIGH (i.e., a digital 1) is asserted on data invert line 756, pixels 711 are in an inverted state, and when a digital LOW (i.e., a digital 0) is asserted on data invert line 756, pixels 711 are in a normal state.

If the output of storage element 2002 is HIGH, and the invert signal asserted on data invert line 756 is LOW, voltage inverter 2004, 2008 asserts a digital HIGH voltage onto pixel electrode 2006. If the output of storage element 2002 is HIGH, and the invert signal asserted on data invert line 756 is HIGH, voltage inverter 2004, 2008 asserts a digital LOW voltage onto pixel electrode 2006. If the output of storage element 2002 is LOW, and the invert signal asserted on data invert line 756 is LOW, voltage inverter 2004, 2008 asserts a digital LOW voltage onto pixel electrode 2006. Finally, if the output of storage element 2002 is LOW, and the invert signal asserted on data invert line 756 is HIGH, voltage inverter 2004, 2008 asserts a digital HIGH voltage onto pixel electrode 2006.

FIG. 22 is a voltage chart indicating the voltages asserted on pixel electrode 2006 of each pixel 711 and common electrode 758. In particular, voltage chart includes a first predetermined voltage VC_n, a second predetermined voltage Von_n, a third predetermined voltage Von_i, a fourth predetermined voltage Voff_n, a fifth predetermined voltage Voff_i, and a sixth predetermined voltage VC_i. When pixels 711 are driven in a normal state (e.g., the signal asserted on global data invert line 756 is a digital 0), debias controller 608 asserts a "normal" common voltage VCn on common electrode 758, and voltage inverter 2004, 2008 asserts one of either a "normal" ON voltage Von_n having a voltage value of V1 or a "normal" OFF voltage Voff_n having a voltage value of V0 onto pixel electrode 2006. When pixels 711 are driven in an inverted state, debias controller 608 asserts an "inverted" common voltage VCi on common electrode 758, and voltage inverter 2004, 2008 asserts one of either an "inverted" ON voltage Von_i having a voltage value of V0 or an "inverted" OFF voltage Voff_i having a voltage value of V1 onto pixel electrode 2006.

The voltage difference between Von_n and VC_n results in a bright or "ON" pixel. The voltage difference between Voff_n and VC_n results in a dark or "OFF" pixel. Note that the magnitudes of the inverted ON and OFF voltages (i.e., Von_i and Voff_i, respectively) across the liquid crystal material are the same as the magnitude of the normal ON and OFF voltages (i.e., Von_n and Voff_n, respectively), however are opposite in direction. Because the optical response of the liquid crystal depends on the RMS voltage, the optical response will be the same for the normal and inverted voltages.

Debias controller 608 asserts either VCn or VCi onto common voltage supply terminal 760 of display 710. In addition, depending upon which voltage is asserted on common voltage supply terminal 760, debias controller 608 asserts either a digital high or digital low data invert signal onto global data invert line 756, such that the voltages asserted onto the pixel electrodes 2006 of each pixel 711 are in the same normal or inverted state as the common voltage asserted on common electrode 758 of display 710. By switching the direction of the voltage between the pixel electrode 2006 of each pixel 711 and the common electrode 758, debias controller 608 can effectively debias display 710. The pixels 711 are debiased when the net DC voltage over time is approximately 0.

It should be noted that the voltage scheme indicated in FIG. 22 is exemplary in nature, and many different voltages could be used to create an "ON" pixel and an "OFF" pixel. For example, VCn, VCi, Voff_n, and Voff_i could all be the same voltage, VC, thereby reducing the number of different voltages that are applied across pixel 711. Then, Von_n and Von_i would have the same voltage magnitudes with respect to VC, but opposite polarities. In such a case, VC, Von_n, and Von_i could have values of 0V, 3.3V and −3.3V, respectively. As another example, VC_n and VC_i could be the same voltage VC, such that Von_n would be in excess of VC, Von_i would be less than VC, Voff_n would be greater than VC, but less than Von_n, and Voff_i would be less than VC, but greater than Von_i. Indeed, there are many possible voltage schemes that could be used to drive pixel 711 of the present invention.

Figure 23A:
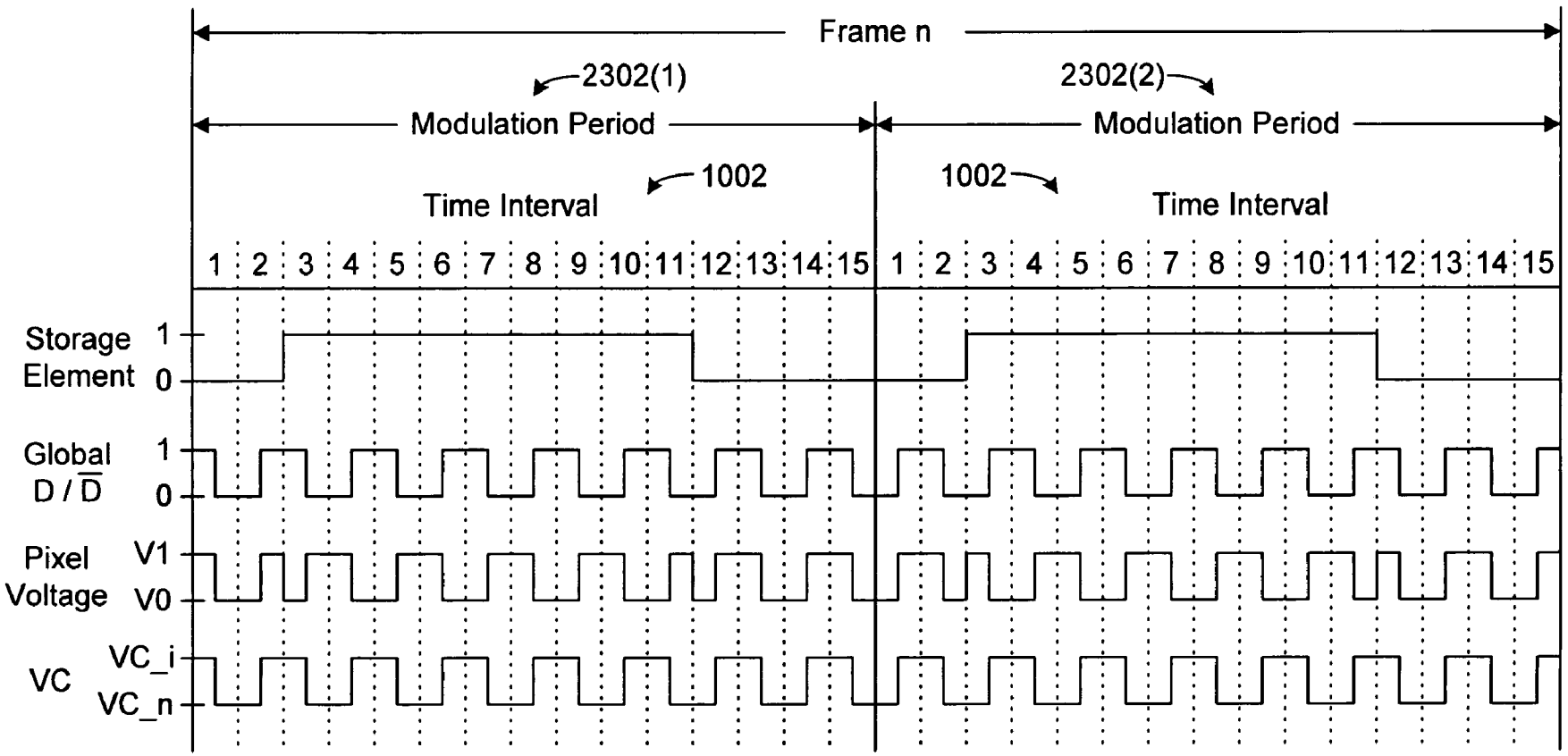
FIG. 23A shows a debiasing scheme according to the present invention.

FIG. 23A shows a debiasing scheme 2300A for debiasing display 710 according to one embodiment of the present invention. The waveforms shown in FIG. 23A are for group 902(0) for an arbitrary frame (e.g., frame n) of video data. In the present embodiment, the frame time of group 902(0) (and every other group 902(1-14)) is divided into two complete modulation periods 2302(1) and 2302(2) within their respective frame times, such that the same display data is written twice to display 710 within a group's frame time. As shown in each of modulation periods 2302(1) and 2302(2), a grayscale value of nine (9) is written to the storage element 2002 (labeled "Storage Element") to pixel 711 as an example. During time intervals 1002(1-2), the output of storage element 2002 is a digital LOW, for time intervals 1002(3-11), the output of storage element 2002 is a digital HIGH, and during time intervals 1002(12-15), the output of storage element 2002 returns to a digital LOW value. Accordingly, pixel 711 should be ON during time intervals 1002(3-11) and should be OFF during time intervals 1002(1-2) and 1002(12-15) during each modulation period 2302(1) and 2302(2).

When the voltage between common electrode 758 and pixel electrode 2006 is a digital OFF value, a small DC bias is placed across the liquid crystal layer due to the voltage difference between VC_n and Voff_n or VC_i and Voff_i. In addition, when the voltage drop between common electrode 758 and pixel electrode 2006 is a digital ON value, a larger DC bias is placed across the liquid crystal layer of pixel 711 due to the voltage difference between VC_n and Von_n or VC_i and Von_i. As indicated above, a DC bias can cause ionic migration which results in degradation of the liquid crystal display.

To debias display 710, debias controller 608 switches the voltages applied to common electrode 758 (labeled VC) and global data invert line 756 (labeled Global D/D-bar) between their respective normal (first bias direction) and inverted (second bias direction) states every time interval 1002. Accordingly, debias controller 608 asserts a digital LOW value on global data invert line 756 when a normal voltage VC_n is applied to common electrode 758 and asserts a digital HIGH value on global data invert line 756 when an inverted voltage (VC_i) is applied to common electrode 758. Finally, debias controller 608 switches the waveforms applied to common electrode 758 and global data invert line 756 between their respective normal and inverted at the midpoint of each time interval 1002. Note that because the grayscale value is written to the display twice, the global data invert signal and the common electrode could be toggled at the boundaries between the time intervals 1002 and still achieve effective debiasing.

Responsive to the signal on global data invert line 756, voltage inverter 2008 switches the voltage asserted on pixel electrode 2006, to maintain the correct ON or OFF state of the liquid crystal cell as the voltage on common electrode 758 is also switched. For example, when storage element 2002 has a digital LOW value latched therein, then the voltage applied to pixel electrode 2006 should be an OFF voltage. In such a case, the voltage applied to pixel electrode 2006 will switch between Voff_n and Voff_i in synchrony with the switching of the voltage applied to common electrode 758 between VC_n and VC_i, respectively, such that pixel 711 remains OFF. In contrast, when storage element 2002 has a digital HIGH value latched therein, then the voltage applied to pixel electrode 2006 should be an ON voltage. The voltage applied to pixel electrode 2006 will switch between Von_n and Von_i in synchrony with the switching of the voltage applied to common electrode between VC_n and VC_i, respectively, such that pixel 711 remains ON.

To summarize, even though the voltage asserted on pixel electrode 2006 is changed during the times that pixel 711 is ON or OFF, the magnitude of the voltage across the liquid crystal of pixel 711 remains the same, because the voltage on common electrode 758 is also switched. Therefore, pixel 711 remains in an ON state or an OFF state depending on the value of the bit latched into storage element 2002.

As is apparent from viewing FIG. 23A, although pixel 711 is OFF during time intervals 1002(1-2) and 1002(12-15), there is a net DC bias of 0 volts, because a normal OFF voltage and an inverted OFF voltage are asserted for equal durations. Similarly, although pixel 711 is ON during time intervals 1002(3-11), there is a net DC bias of 0 volts, because there is a normal ON voltage and an inverted ON voltage are asserted for equal durations. This is the case during both modulation periods 2302(1) and 2302(2).

Because pixel 711 is debiased every time interval 1002, debiasing scheme 2300A provides the added advantage that display data does not have to be written to each pixel 711 twice during a frame time. Accordingly, display 710 will be perfectly debiased regardless of how many modulation periods comprise each frame. As shown in FIG. 23A, the frame time is divided into two modulation periods 2302(1) and 2302(2) and the data is written twice to reduce flicker in the display image, but the second modulation period is not necessary because the net DC bias across each pixel 711 of display 710 is zero volts during each of modulation periods 2302(1) and 2302(2).

Although the debiasing scheme shown in FIG. 23A is for group 902(0), each of the other groups 902(1-14) is effectively debiased by the present modulation scheme, even though each group 902(1-14) is associated with a frame time (i.e., a modulation period) that is temporally offset from the frame time of every other group 902. Effective debiasing results regardless of the frame time because the voltage asserted across pixel 711 is normal (i.e., first bias direction) for half of a time interval 1002 and inverted (i.e., second bias direction) for half of a time interval 1002 during each time interval 1002. Accordingly, a net DC bias of zero volts results across the liquid crystal material of each pixel 711 during each time interval 1002 regardless of the group 902 in which a pixel 711 is located.

The frequent switching of the voltages across the liquid crystal does not adversely affect the electro-optical response of the liquid crystal cell, as was described as a disadvantage of the prior art. This is because the above-described debias switching does not change the state (i.e., ON or OFF) of the liquid crystal and does not allow the liquid crystal to relax during the transitions. In contrast, the state of the liquid crystal can change many times in each modulation period in the binary-weighted PWM scheme of the prior art. In contrast, according to the single-pulse modulation scheme of the present invention, the actual state of pixel 711 changes only twice.

Finally, it should be noted that because the waveforms asserted on global data invert line 756 and common voltage supply terminal 760 of display 710 transition between digital HIGH and digital LOW values in unison, global data invert line 756 and common voltage supply terminal 760 could be combined into a single input for display 710. For example, voltage inverters 2004, 2008 of pixels 711 might be coupled to common electrode 758 such that an inverted voltage applied on common voltage supply terminal 760 and common electrode 758 would cause voltage inverters 2004, 2008 to invert the voltage applied on each pixel electrode 2006.

Figure 23B:
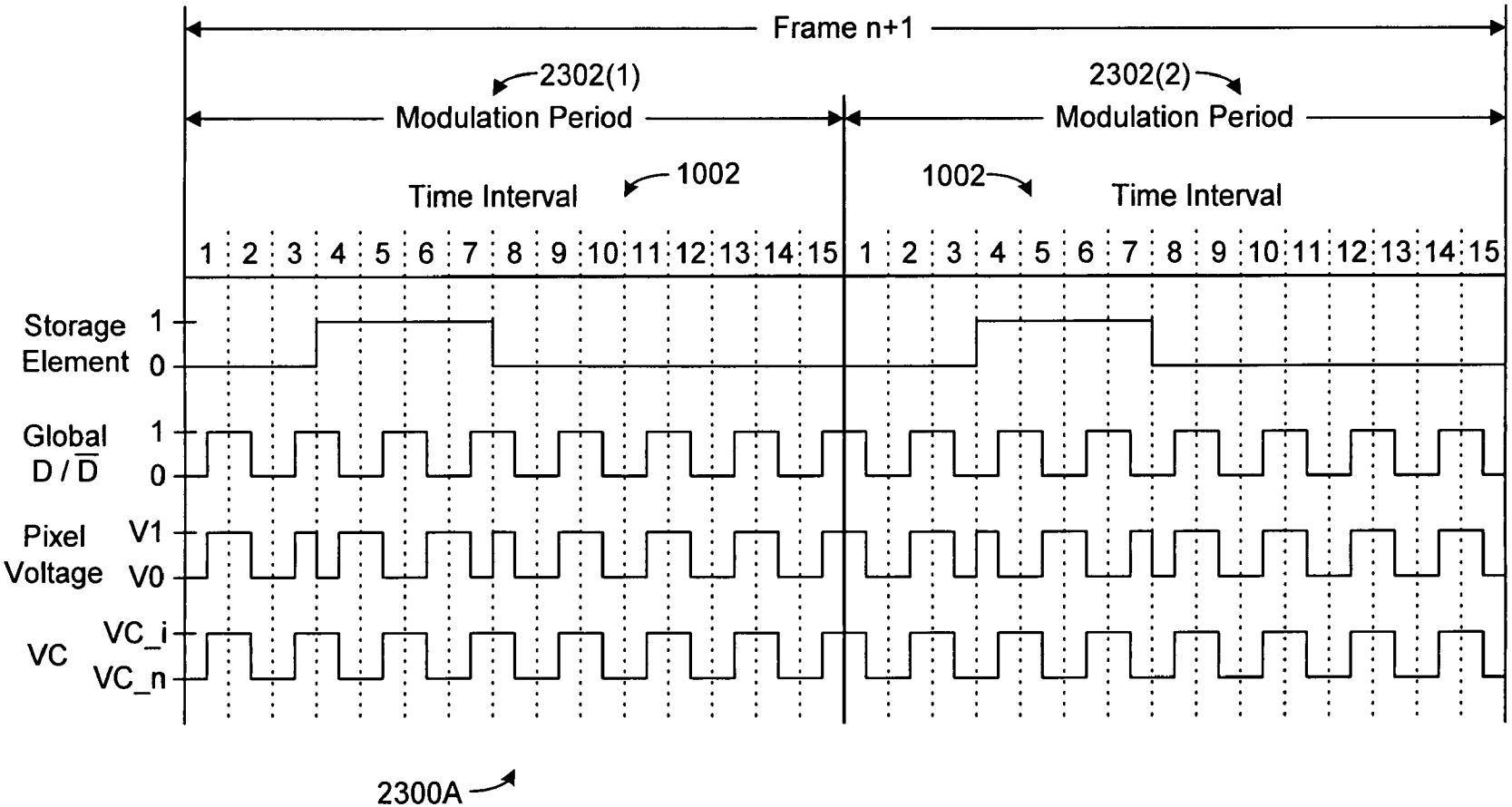
FIG. 23B shows a second frame of the debiasing scheme of FIG. 23A.

FIG. 23B shows an even grayscale value of four (4) written to storage element 2002 of pixel 711 during a subsequent frame (i.e., frame n+1), as opposed to the odd grayscale value of nine (9) shown in FIG. 23A. By employing debiasing scheme 2300A, debias controller 608 is able to perfectly debias pixel 711 for all even (as well as odd) grayscale values because the voltage asserted across pixel 711 is normal for half of a time interval 1002 and inverted for half of a time interval 1002 during each time interval 1002, regardless of whether a digital ON or OFF value is asserted on storage element 2002.

It should also be noted that the waveforms asserted by debias controller 608 are inverted every other frame. For example, during frame n+1 shown in FIG. 23B, the waveforms asserted on common electrode 758 and global data invert line 756 are the inverse of the waveforms asserted on common electrode 758 and global data invert line 756 during frame n in FIG. 23A. Inverting these signals every frame is not necessary in the present embodiment, however facilitates alternate embodiments of debiasing scheme 2300A, which are described below. Further, the signals are simple square waves, which are particularly easy to generate.

Figure 23C:
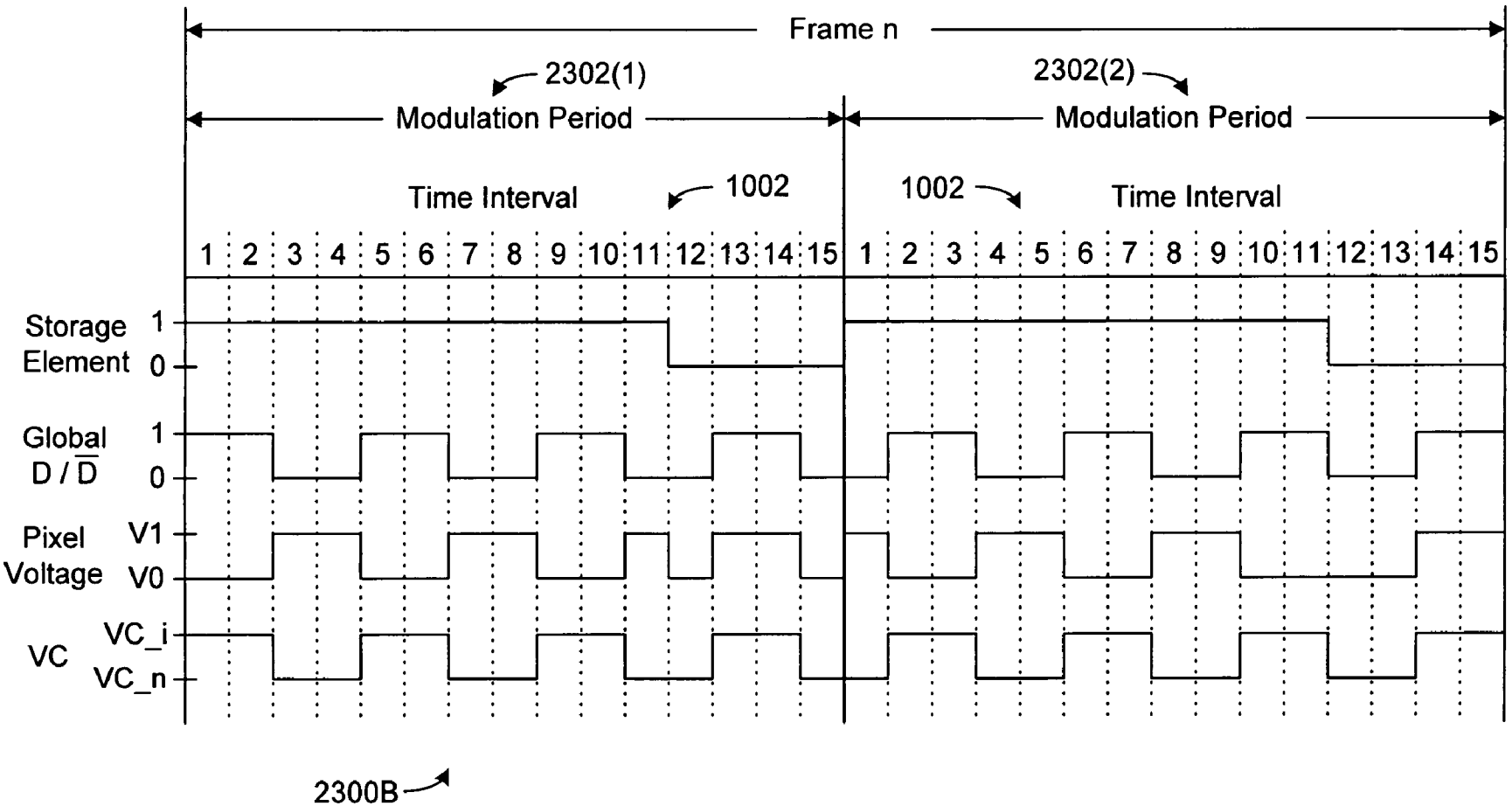
FIG. 23C shows an alternate embodiment of the debiasing scheme of FIG. 23A.

FIG. 23C shows an alternate debiasing scheme 2300B, which is a modified version of debiasing scheme 2300A. Instead of inverting the debiasing waveforms asserted on common electrode 758 and global data invert line 756 once every time interval 1002, debias controller 608 inverts the bias direction every (z) time intervals 1002. In the present embodiment, z equals two. By inverting the waveforms every other time interval 1002, debias controller 608 does not have to switch voltage values on common electrode 758 and global data invert line 756 as often, thereby reducing the power requirements of the system. Finally, note that FIG. 23C shows an odd grayscale value of eleven (11), being asserted on pixel 711 during each modulation period 2302(1) and 2302(2). During the entire frame, a net DC bias 2Von_i results.

Figure 23D:
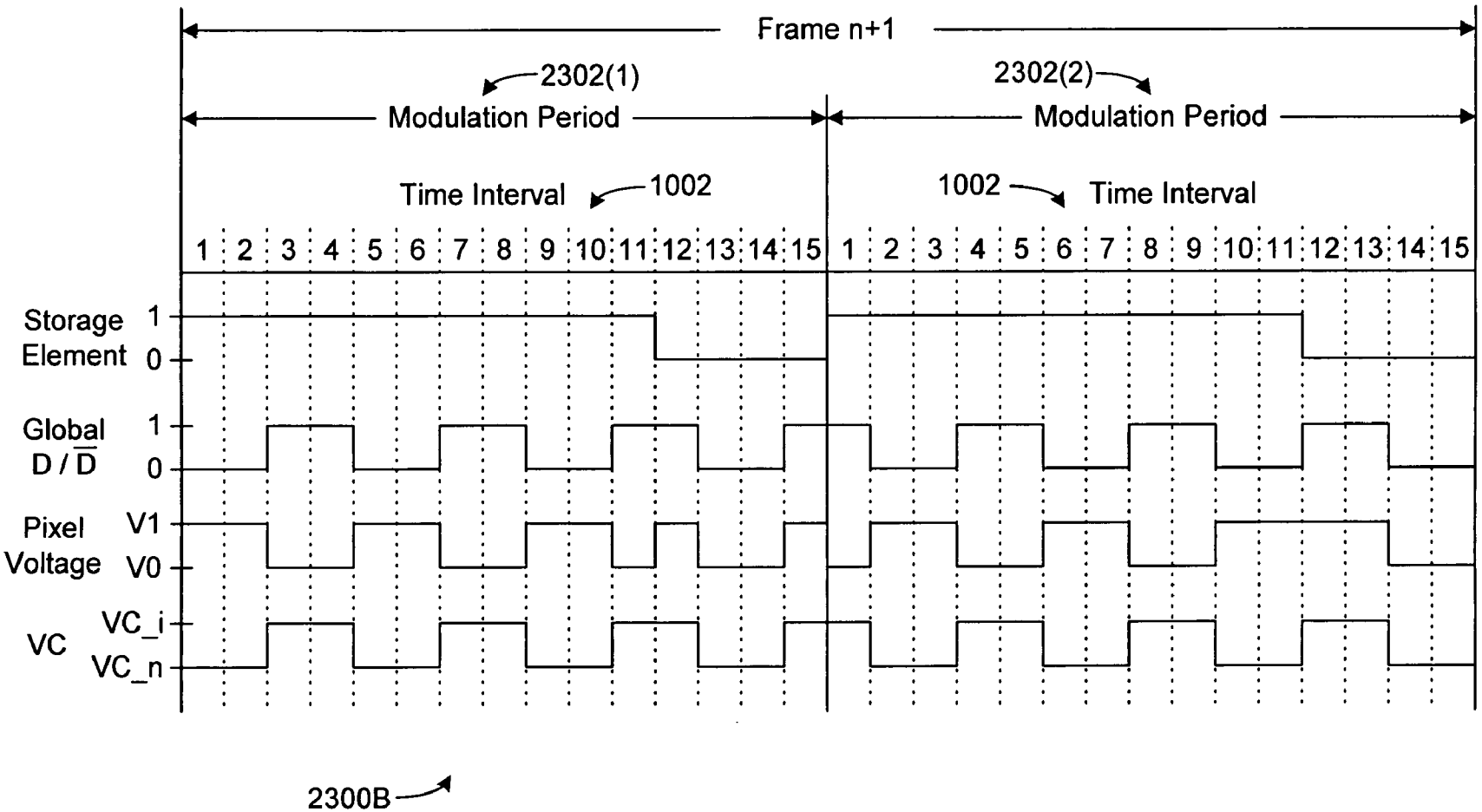
FIG. 23D shows a second frame of the alternate debiasing scheme of FIG. 23C.

FIG. 23D shows a second frame n+1 of debias scheme 2300B during which the grayscale value of eleven (11) is again written to storage element 2002 of pixel 711. During frame n+1, the waveforms applied to common electrode and global data invert line 756 are the inverse of frame n, shown in FIG. 23C. Therefore, a net DC bias equal to 2Von_n results during modulation periods 2302(1) and 2302(2) of frame n+1. When the DC bias of frames n and n+1 are added together, a net DC bias of zero results over the two frames.

Although the likelihood of asserting two grayscale values of equal value during two subsequent frames may initially seem slim, in actuality the same grayscale value is generally asserted on a pixel 711 over many frame times. This is due to the fact that many (e.g., 60 or more) frames of display data are written to pixel 711 every second. Further, if there is sufficient bandwidth available, it would be desirable to repeat the same data anyway, for example to reduce flicker in the displayed image.

Figure 23E:
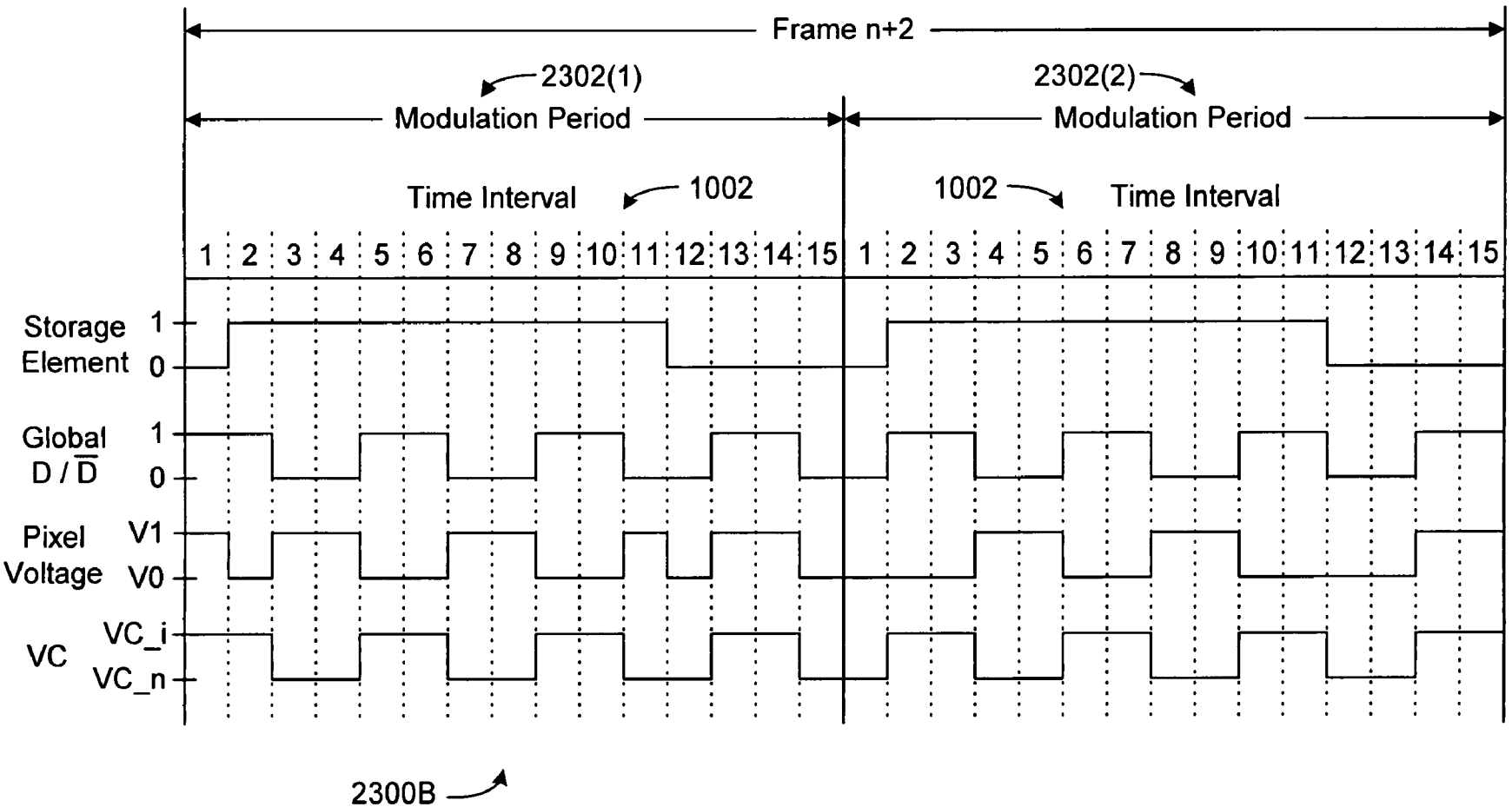
FIG. 23E shows a third frame of the alternate debiasing scheme of FIG. 23C.
Figure 23F:
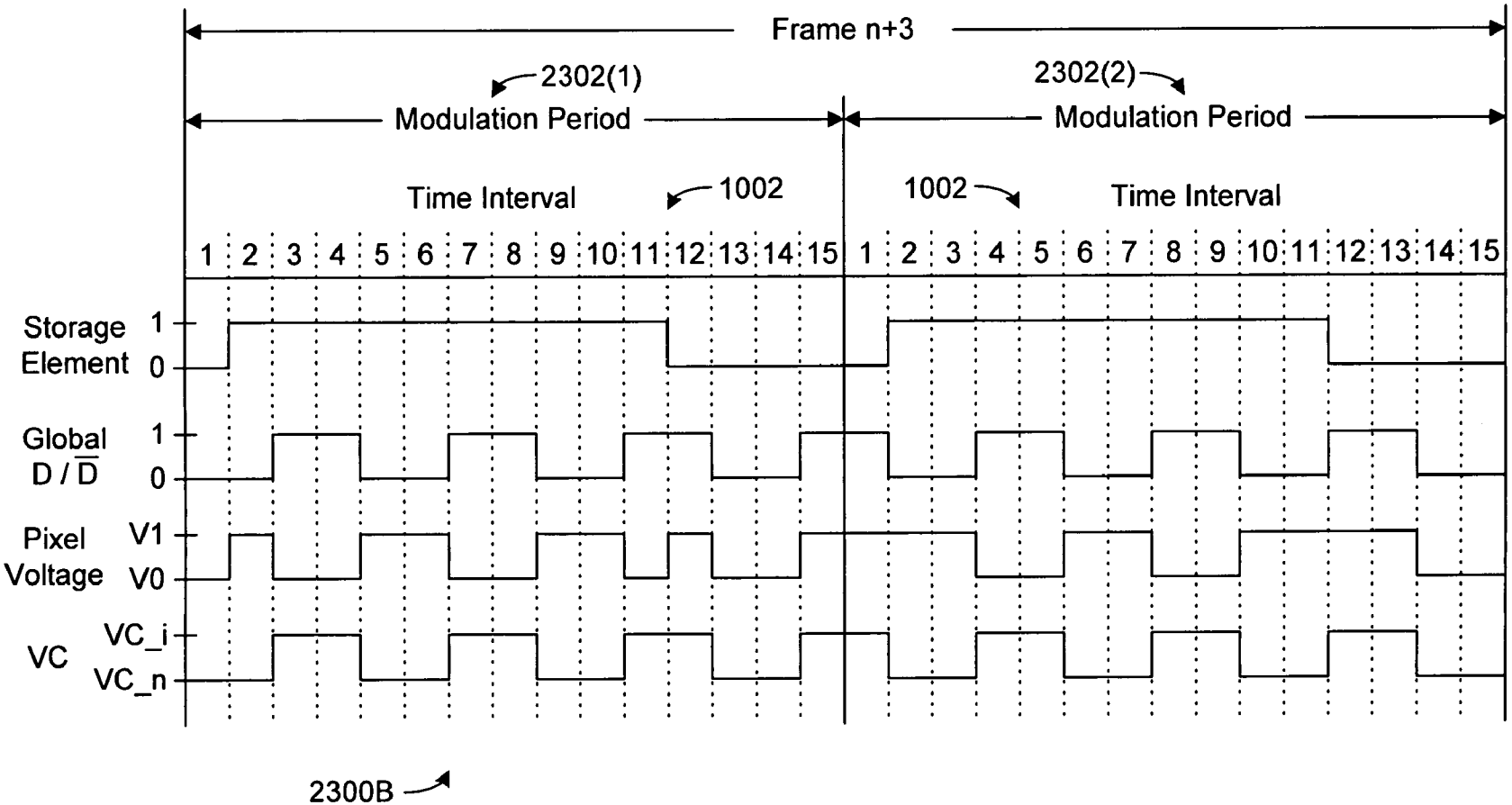
FIG. 23F shows a fourth frame of the alternate debiasing scheme of FIG. 23C.

FIGS. 23E-F show a grayscale value of ten (10) written to pixel 711 during frames n+2 and n+3. As shown in FIGS. 23E-F, pixel 711 is also debiased when even grayscale values are asserted thereon. The waveforms asserted by debias controller 608 during frame n+2 are the inverse of the waveforms asserted during the previous frame n+1. Similarly, the waveforms asserted by debias controller 608 during frame n+3 (FIG. 23F) are the inverse of the waveforms asserted during frame n+2. During frame n+2, a net DC bias results equal to 2Von_i. During frame n+3, a DC bias results equal to 2Von_n. Accordingly, over both frames n+2 and n+3, the net DC bias on pixel 711 is zero volts.

Note that particular grayscale values may result in a net DC bias of 0 volts each frame. For example, a grayscale value of four (4) results in a net DC bias of 0 volts each frame. In addition, as stated above, each group 902(0-14) is associated with a frame time that is temporally offset from every other group 902. Accordingly, if the waveforms shown in FIG. 23C are for group 902(0), then the modulation period for group 902(1) would start during time interval 1002(2) of modulation period 2302(1) associated with group 902(0). However, because the voltage waveforms asserted on common electrode 758 and global data invert line 756 have a normal value for 15 time intervals 1002 within the frame time and an inverted value for 15 intervals within the frame time, a pixel 711 can be debiased at least over two time frames no matter when the pixel's frame time begins. Finally, it should be noted that display data does not necessarily have to be written to a pixel 711 twice per frame. Display data could be written only once, however the waveforms produced by debias controller 608 would not be as uniform because the waveforms are inverted every frame.

Finally, in the event that pixel 711 is not completely debiased because a different grayscale value is written to storage element 2002 during a subsequent frame, pixel 711 will be approximately debiased over a long period of time. This results from an approximately equal number of excess Von_n biases and Von_i biases over an extended period of time. Accordingly, the inventor has found that debiasing scheme 2300B provides acceptable debiasing of display 710.

FIGS. 24A-24D show frames (n) through (n+3) of another debiasing scheme 2400 according to the present invention for debiasing a pixel 711. As with previous embodiments, the frame time of pixel 711 is equal to two modulation periods 2402(1) and 2402(2), each composed of 15 time intervals 1002(1-15).

In debiasing scheme 2400, debias controller 608 asserts the same voltage waveform on common electrode 758 and on global data invert line 756 during every frame, except that the waveform shifts left by one time interval 1002 each frame. For example, in FIG. 24B showing frame n+1, the waveforms are shifted left by one time interval 1002. In FIG. 24C showing frame n+2, the waveforms are shifted left by another time interval 1002, and in FIG. 24D showing frame n+3, the waveforms are shifted left by yet another time interval 1002. Frame n+4 has the same waveform as that shown in FIG. 24A.

The waveforms produced by debias controller 608 also switch between an inverted and normal state every two time intervals 1002. Depending upon how many time intervals the waveforms produced by debias controller 608 have been shifted, the waveforms may transition after only one time interval 1002 at the beginning of a frame. For example, because the waveforms have been shifted by one time interval 1002 in FIG. 24B, the first time the signals asserted on common electrode 758 and global data invert line 756 are inverted occurs after only one time interval 1002 in FIG. 24B.

Debias controller 608 shifts the waveforms asserted on common electrode 758 and global data invert line 756 by one time interval 1002 each frame time, such that some of groups 902(0-14) of display 710 are perfectly debiased, while others may not be. For each shift of one time interval 1002, the waveforms asserted by debias controller 608 are shifted (−90) degrees out of phase, such that a particular waveform is repeated every fourth frame. Because it takes four frames for the waveforms asserted by debias controller 608 to repeat, perfect debias of a pixel 711 will occur when the same display data is asserted on pixel 711 for four consecutive frames.

Figure 24A:
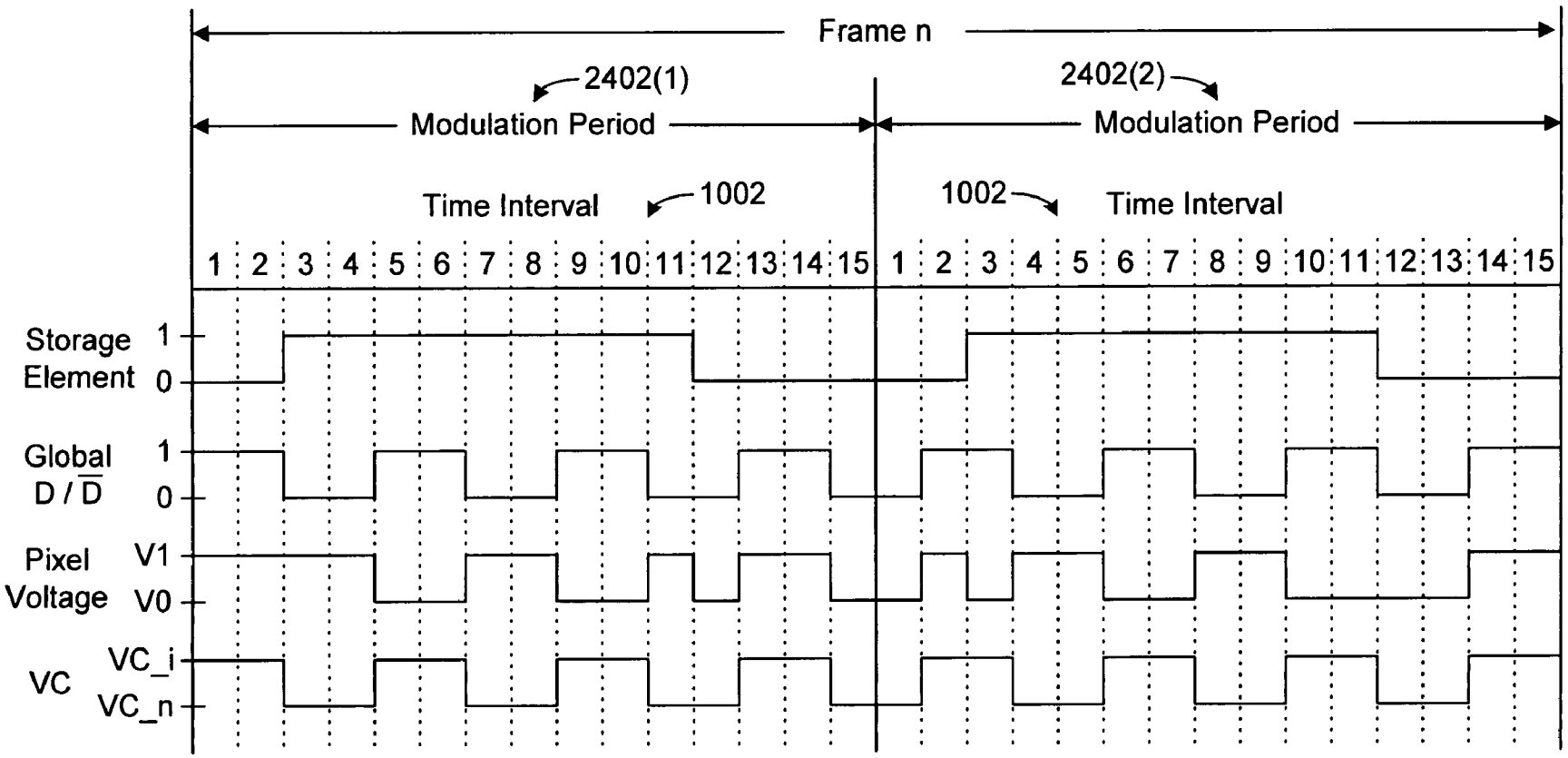
FIG. 24A shows another debiasing scheme according to the present invention.
Figure 24B:
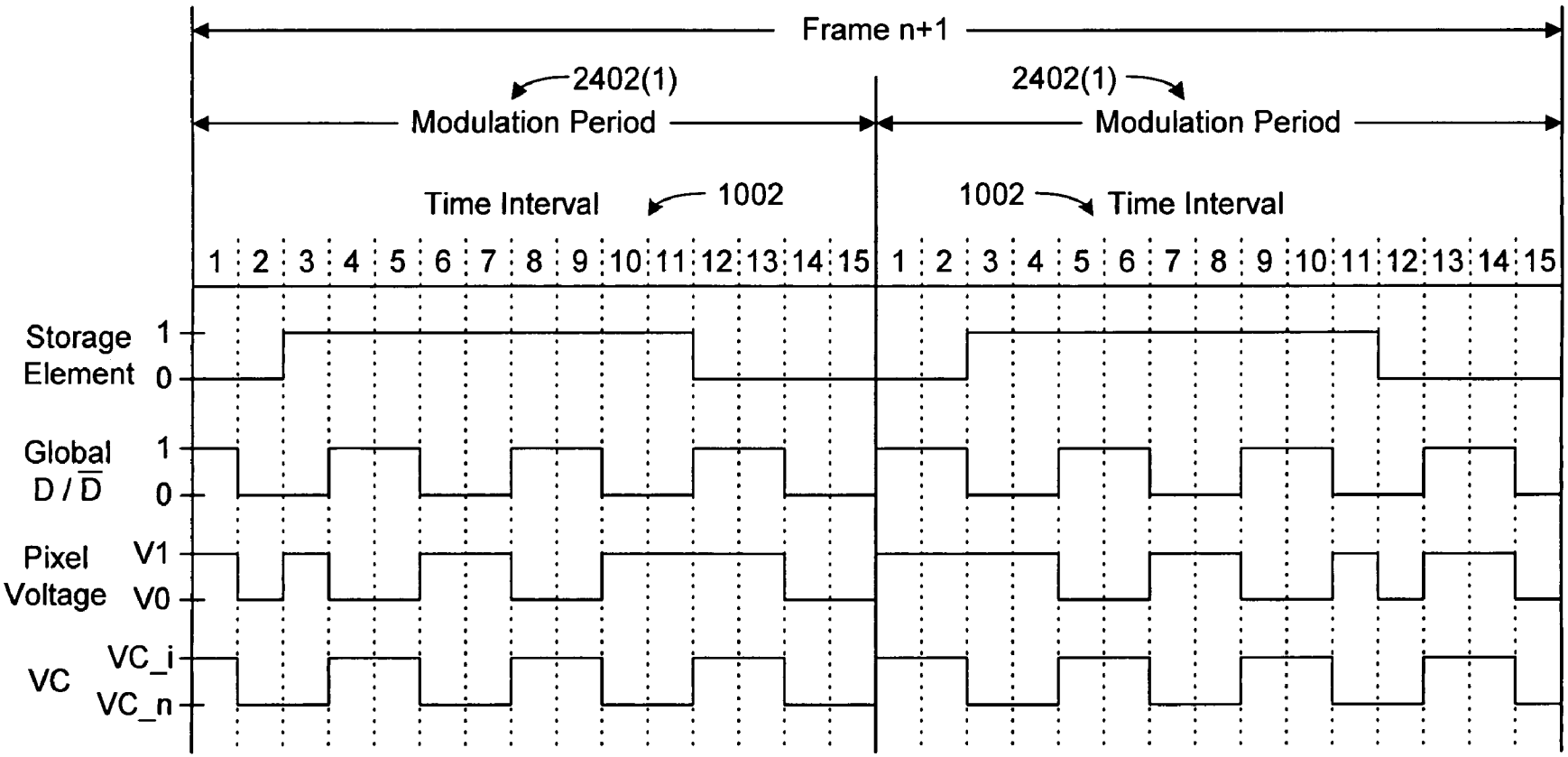
FIG. 24B shows a second frame of the debiasing scheme of FIG. 24A.
Figure 24C:
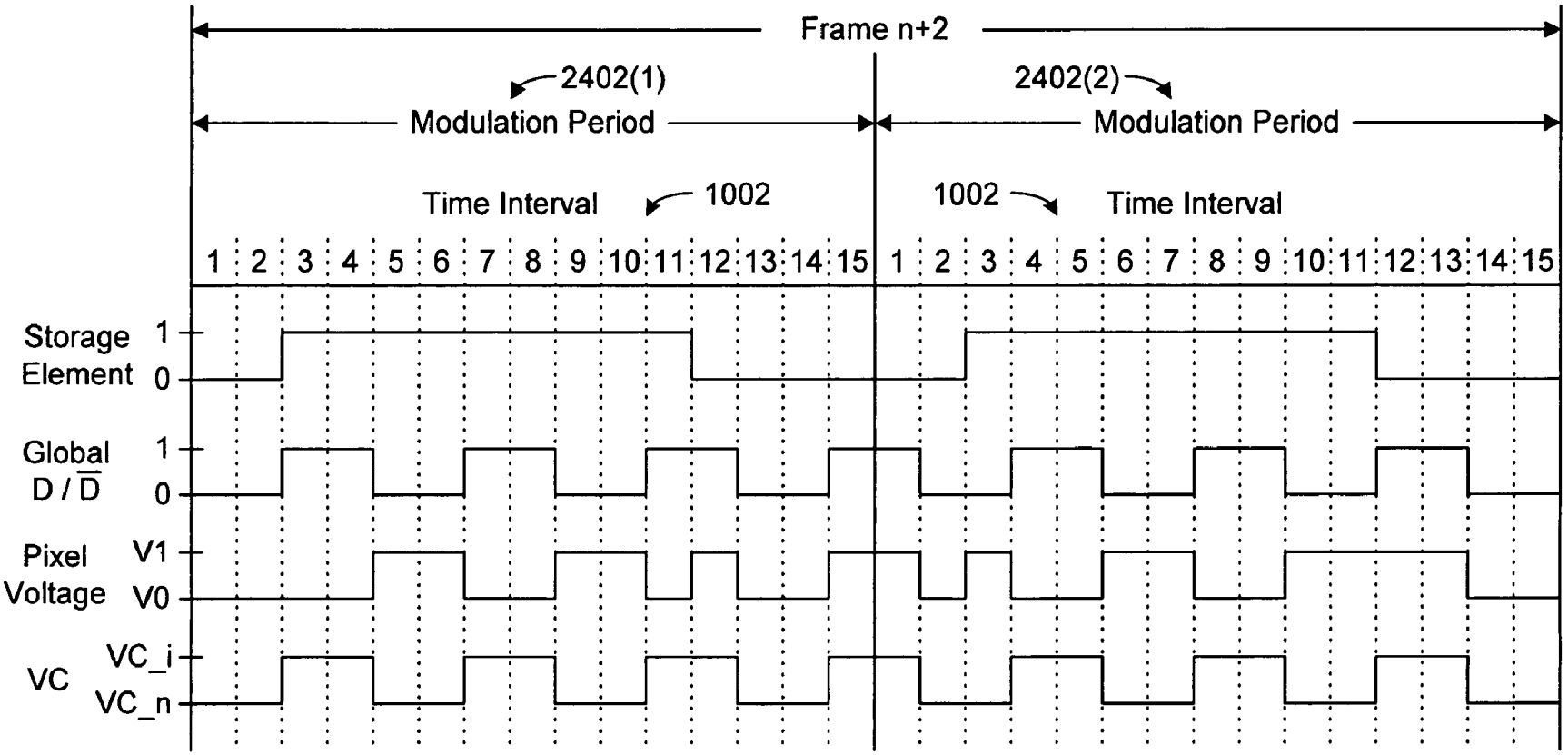
FIG. 24C shows a third frame of the debiasing scheme of FIG. 24A.
Figure 24D:
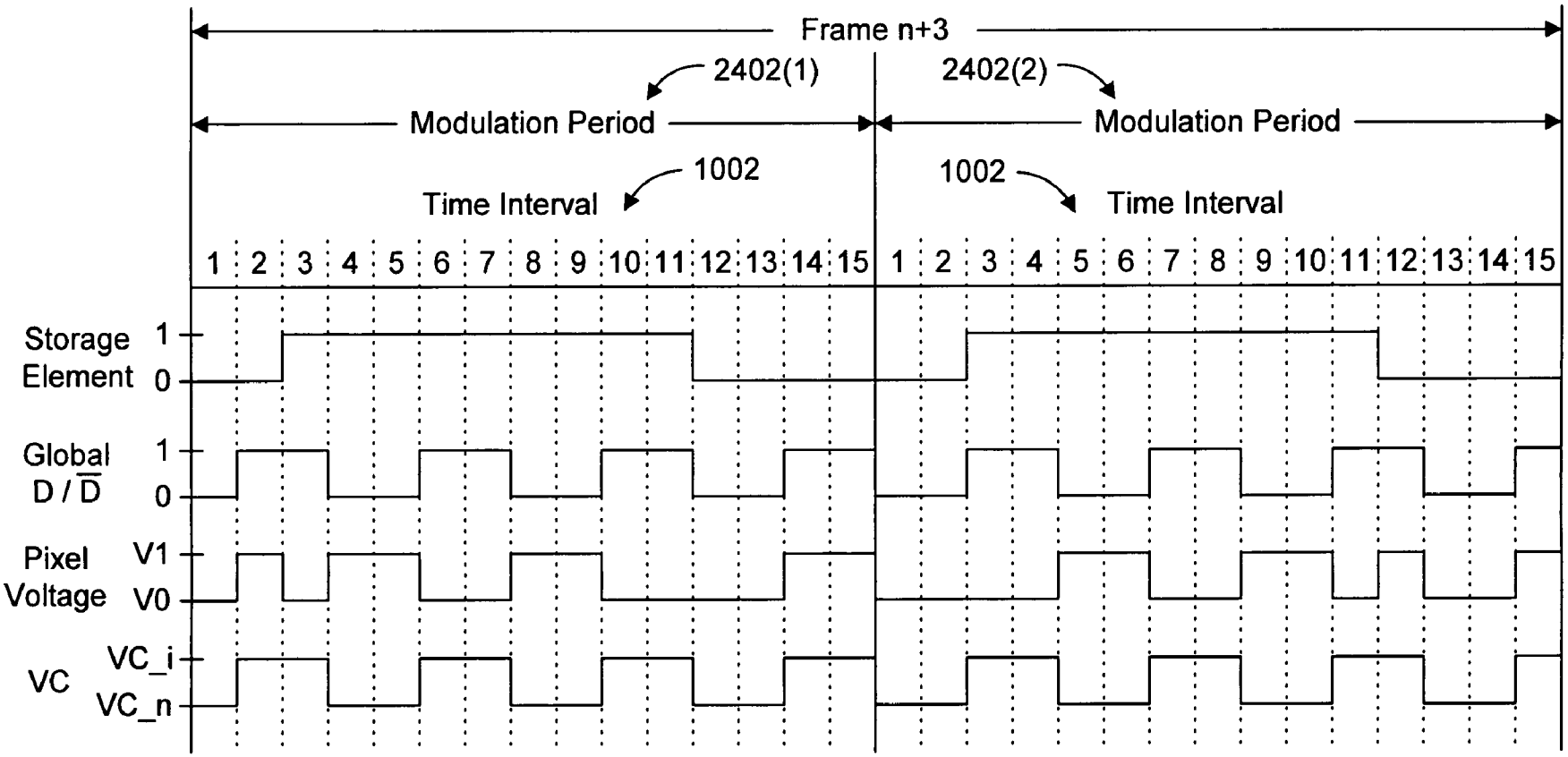
FIG. 24D shows a fourth frame of the debiasing scheme of FIG. 24A.

For example, in FIG. 24A a grayscale value of nine (9) is written to pixel 711 during a first frame n. Based on the state of the waveforms applied to common electrode 758 of display 710 and global data invert line 756, pixel 711 has a net DC bias of 2Voff_i during frame n. In FIG. 24B where the voltage waveforms produced by debias controller 608 have been shifted left by one time interval 1002, the resultant net DC bias for frame n+1 is equal to 2Von_n. Then, in FIG. 24C where the voltage waveforms produced by debias controller 608 have been shifted left by two time intervals 1002, the resultant DC bias for pixel 711 during frame n+2 is equal to 2Voff_n. Finally, in FIG. 24D where the voltage waveforms produced by debias controller 608 have been shifted left by three time intervals 1002, the resultant DC bias for frame n+3 is equal to 2Von_i. Accordingly, the net DC bias over the four frames is equal to 2Voff_i+2Von_n+2Voff_n+2Von_i, or zero volts. Therefore, pixel 711 is perfectly debiased after four frames. Although there may be some instances where a net DC bias remains (e.g., when display data is not constant on pixel 711 for four frames), the inventor has found that debiasing scheme 2400 satisfactorily debiases display 710.

It should be noted that the DC bias results could change if the voltages used were changed. For example, if a voltage scheme were employed where VC_n, VC_i, Voff_n, and Voff_i were all the same voltage, the pixel 711 would be perfectly debiased based on the waveforms shown in FIGS. 24A and 24C. Indeed, many variations of the present "shifting" debiasing scheme are possible.

The description of an embodiment of the present invention for displaying video data with four-bit grayscale values is now complete. The following description will be directed to an embodiment for driving an imager with 8-bit (per color) grayscale data. It should be understood that the present invention may be used with video data having a greater or lesser bit resolution.

Figure 25:
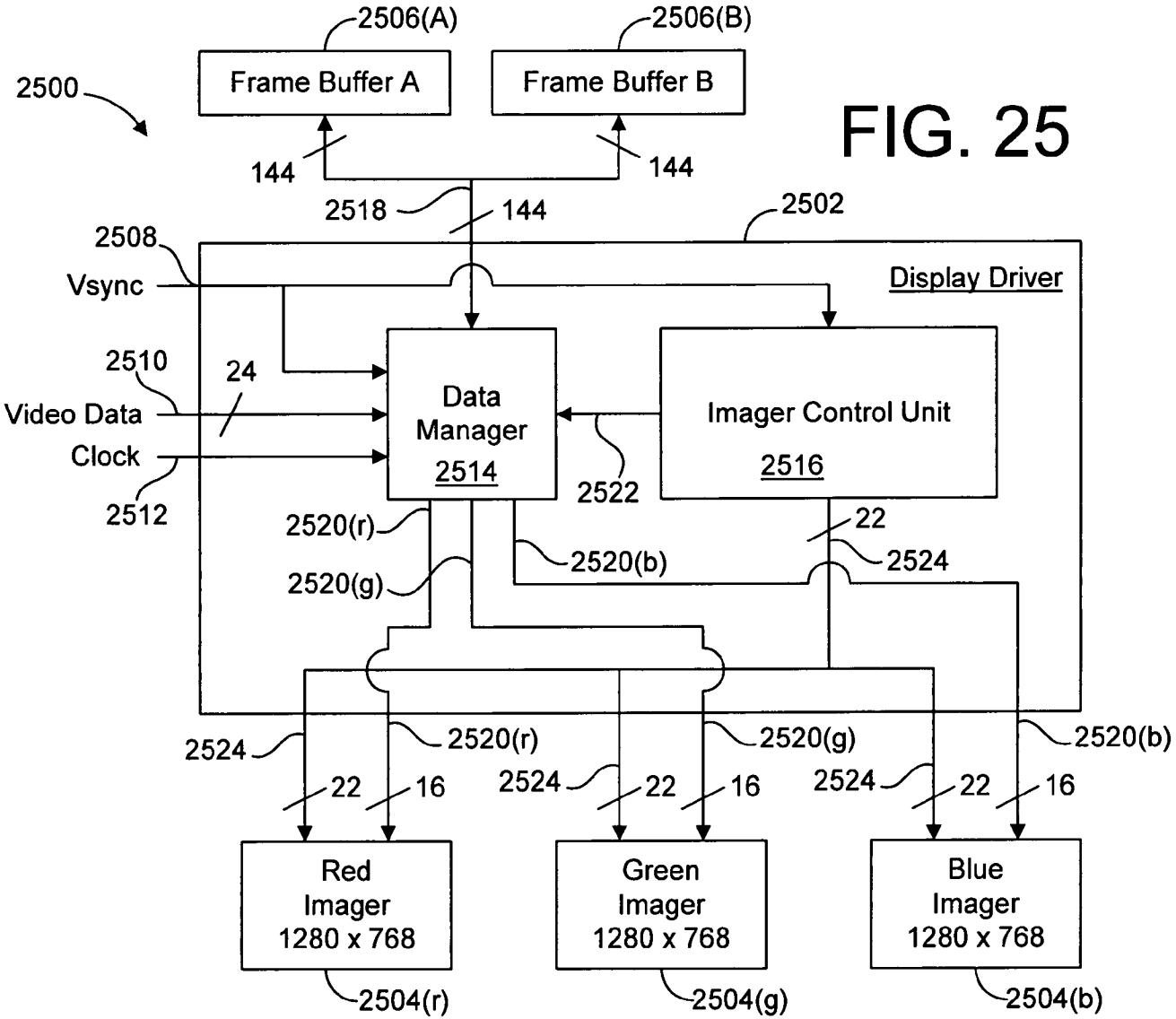
FIG. 25 is a block diagram of a display driving system according to another embodiment of the present invention.

FIG. 25 is a block diagram of an alternate display driving system 2500 according to another embodiment of the present invention. Display driving system 2500 includes a display driver 2502, a red imager 2504(*r*), a green imager 2504(*g*), a blue imager 2504(*b*), and a plurality of frame buffers 2506(A) and 2506(B). Display driver 2502 receives input from a video data source (not shown), including a Vsync signal via a synchronization input terminal 2508, 8-bit video data via a 24-bit video data input 2510, and a clock signal via a clock input terminal 2512. Each of imagers 2504(*r, g, b*) contain an array of pixel cells (not shown) arranged in 1280 columns and 768 rows for displaying an image.

Display driver 2502 includes a data manager 2514 and an imager control unit 2516. Data manager 2514 is coupled to receive input from Vsync input terminal 2508, video data input terminal 2510, and clock input terminal 2512. Data manager 2514 is coupled to each of frame buffers 2506(A) and 2506(B) via 144-bit buffer data bus 2518, and is also coupled to each imager 2504(*r, g, b*) via a plurality (sixteen in the present embodiment) of imager data lines 2520(*r, g, b*), respectively. Buffer data bus 2518 has three times as many lines as imager data lines 2520(*r, g, b*) combined, however other ratios (e.g., 2 times, 4 times, etc.) are possible. Finally, data manager 2514 is coupled to receive coordination signals from imager control unit 2516 via a coordination line 2522. Imager control unit 2516 is coupled to Vsync input 2508 and to coordination line 2522, and to each of imagers 2504(*r, g, b*) via a plurality (twenty-two in the present embodiment) of imager control lines 2524(*r, g, b*).

The components of display driving system 2500 perform substantially the same functions as display driving system 500 shown in FIG. 5, except that each component is adapted to handle 8-bit video data instead of 4-bit video data. For example, data manager 2514 receives 24 bits of video data (8 bits per color) via video data input terminal 2510. In addition, imagers 2504 (r, g, b) are adapted to manipulate and display the 8-bit video data, such that up to 256 different grayscale values (intensity levels) can be displayed. Imager control unit 2516 provides control signals to each of imagers 2504(*r, g, b*) based on an 8-bit modulation scheme, using twenty-two imager control lines 2524.

Figure 26:
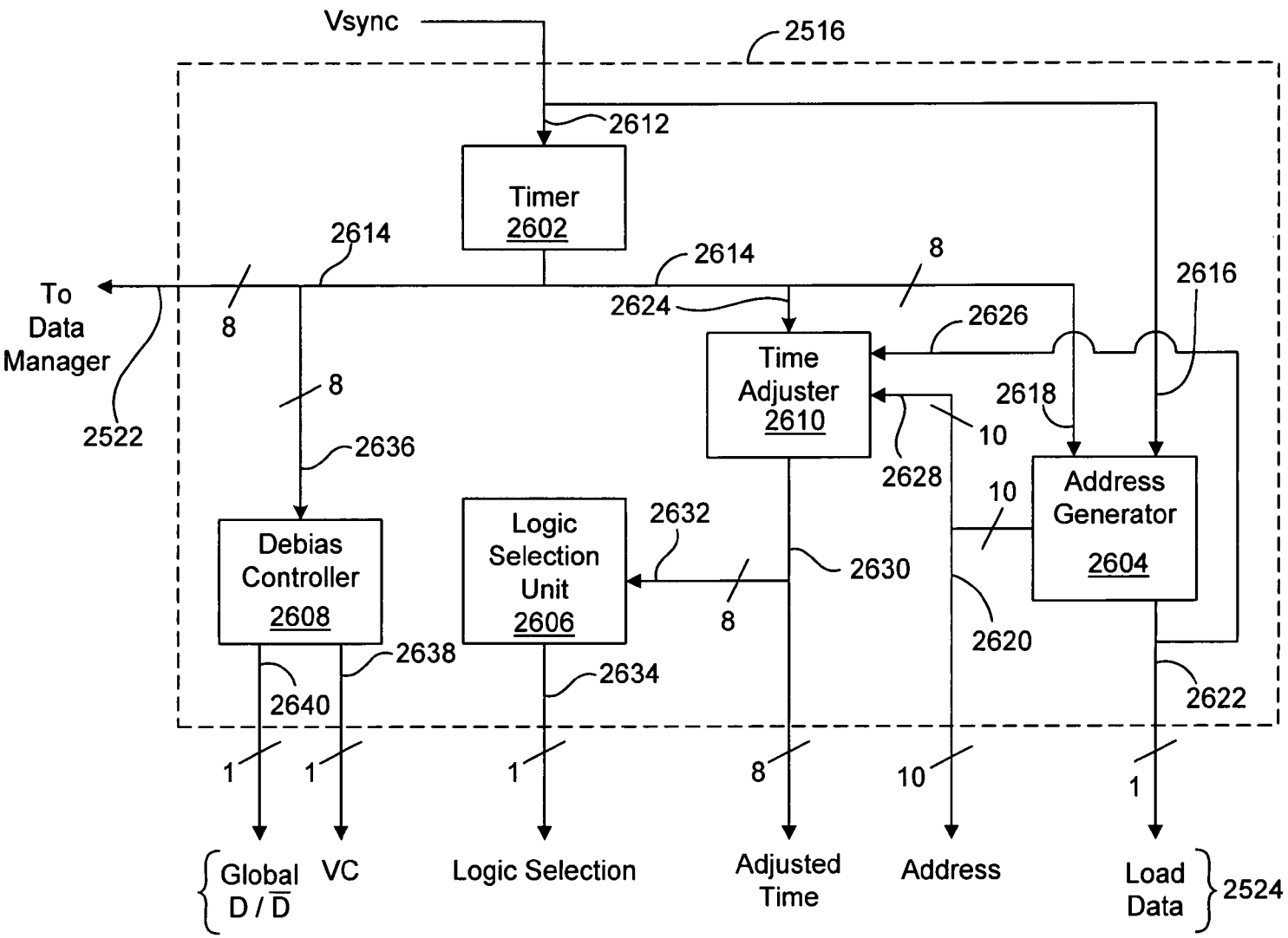
FIG. 26 is a block diagram showing the imager control unit of FIG. 25 in greater detail.

FIG. 26 is a block diagram showing imager control unit 2516 in greater detail. Imager control unit 2516 includes a timer 2602, an address generator 2604, a logic selection unit 2606, a debias controller 2608, and a time adjuster 2610. Timer 2602, address generator 2604, logic selection unit 2606, debias controller 2608, and time adjuster 2610 perform the same general functions as timer 602, address generator 604, logic selection unit 606, debias controller 608, and time adjuster 610, respectively, except that they are modified for an 8-bit data scheme, as will be described below.

Like timer 602, timer 2602 coordinates the operations of the various components of imager control unit 2516 by generating a sequence of timing signals. Timer 2602 functions the same as timer 602, except that timer 2602 generates 255 (i.e., $2^8-1$) timing signals. Accordingly, timer 2602 counts consecutively from 1 to 255, and outputs 8-bit time values onto 8-bit timer output bus 2614. Once timer 2602 reaches a value of 255, timer 2602 loops back such that the next time value output is 1. Timer 2602 provides time values to data manager 2514 via timer output bus 2614 and coordination line 2522, such that data manager 2514 remains synchronized with imager control unit 2516.

Address generator 2604 functions similarly to address generator 604, however address generator 2604 receives 8-bit timing signals from timer 2602, and provides row addresses to imagers 2504(*r, g, b*) and to time adjuster 2610 based on the 8-bit timing signals. Like address generator 604, address generator 2604 has a plurality of inputs including a Vsync input 2616 and a timing input 2618, and a plurality of outputs including 10-bit address output bus 2620 and a single bit load data output 2622.

Time adjuster 2610 functions similarly to time adjuster 610 by adjusting the time value output by timer 2602 based on the row address received from address generator 2604. However, time adjuster 2610 receives an 8-bit time value from timer 2602 via time value output bus 2614, a disable adjustment signal from address generator 2604 via input 2626, and a 10-bit address received from address generator 2604 via address output bus 2620. Responsive to these inputs time adjuster 2610 asserts an 8-bit adjusted time value on adjusted time value output bus 2630.

Like logic selection unit 606, logic selection unit 2606 provides logic selection signals to each of imagers 2504(*r, g, b*). Logic selection unit 2606 asserts a HIGH or LOW logic selection signal on logic selection output 2634 based on the 8-bit adjusted time value received from time adjuster 2610 on timing input 2632. For example, if the adjusted time value asserted on adjusted timing input 2632 is one of a first predetermined plurality time values (e.g., time values 1 through 3), then logic selection unit 606 is operative to assert a digital HIGH value on logic selection output 2634. Alternately, if the adjusted time value is one of a second predetermined plurality of time values (e.g., 4 through 255), then logic selection unit 2606 asserts a digital LOW value on logic selection output 2634.

Debias controller 2608 functions similarly to debias controller 608, but is responsive to 8-bit timing signals from timer 2602 instead of 4-bit timing signals. Debias controller 2608 controls the debiasing process for each of imagers 2504(*r, g, b*) in order to prevent deterioration of the liquid crystal material. Accordingly, debias controller 2608 receives time values via a timing input 2636 coupled to time value output bus 2614, and uses the time values to assert debiasing signals on a common voltage output 2638 and a global data invert output 2640. Debias controller 2608 can perform any of the general debiasing schemes detailed in FIGS. 23A-F and FIGS. 24A-D, provided that the debiasing scheme be modified to accommodate the 8-bit timing signal generated by timer 2602.

Finally, imager control lines 2524 convey the outputs of the various elements of imager control unit 2516 to each of imagers 2504(*r, g, b*). In particular, imager control lines 2524 include adjusted time value output bus 2630 (8 lines), address output bus 2620 (10 lines), load data output 2622 (1 line), logic selection output 2634 (1 line), common voltage output 2638 (1 line), and global data invert output 2640 (1 line). Accordingly, imager control lines 2524 include 22 control lines, each providing signals from a particular element of imager control unit 2516 to each imager 2504(*r, g, b*). Each of imagers 2504(*r, g, b*) receive the same signals from imager control unit 2516 such that imagers 2504(*r, g, b*) remain synchronized.

Figure 27:
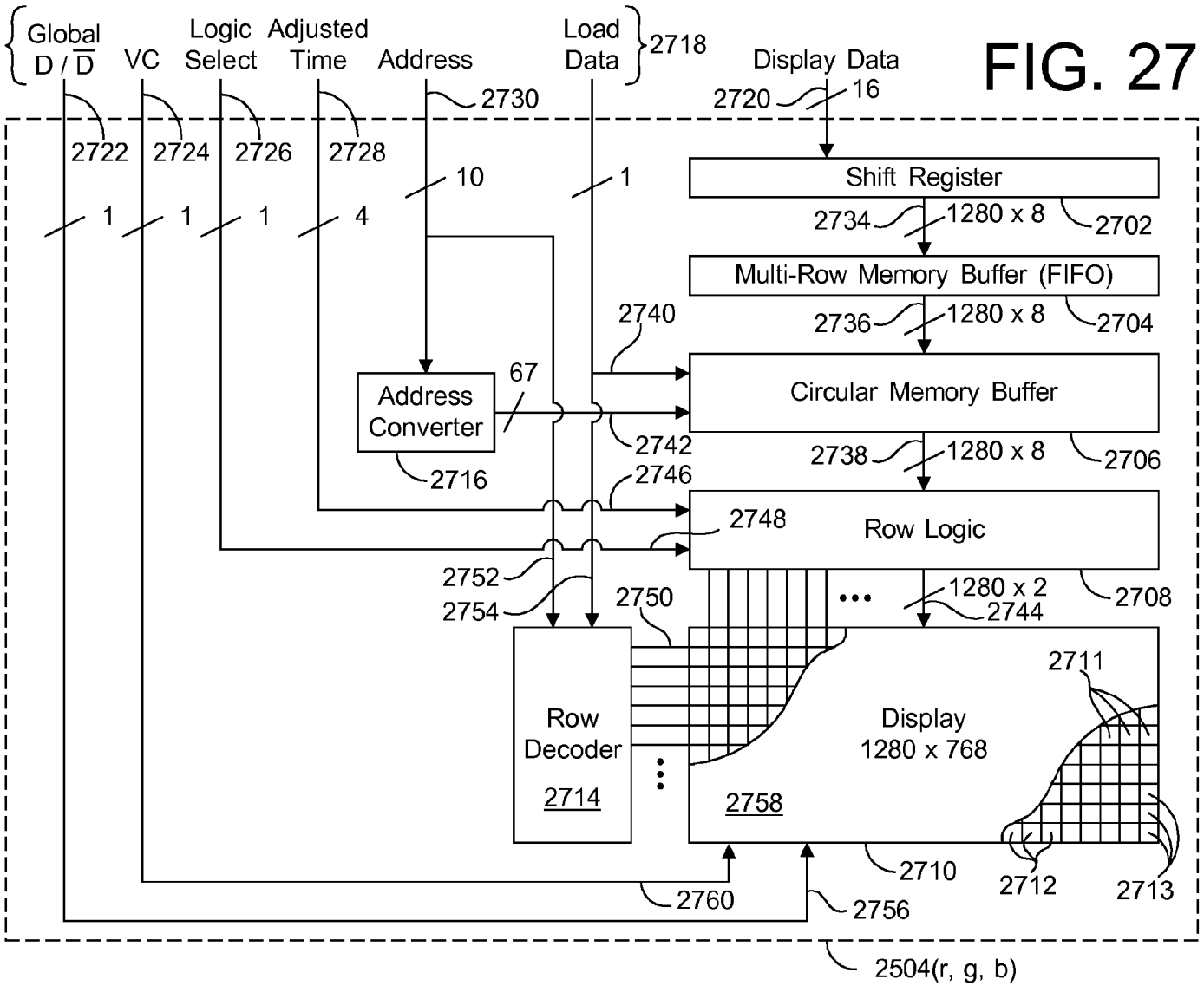
FIG. 27 is a block diagram showing one of the imagers of FIG. 25 in greater detail.

FIG. 27 is a block diagram showing one of imagers 2504(*r, g, b*) in greater detail. Imager 2504(*r, g, b*) includes a shift register 2702, a multi-row memory buffer 2704, a circular memory buffer 2706, a row logic 2708, a display 2710 including a plurality of pixels 2711 arranged in 1280 columns 2712 and 768 rows 2713, a row decoder 2714, an address converter 2716, a plurality of imager control inputs 2718, and a display data input 2720. Imager control inputs 2718 include a global data invert input 2722, a common voltage input 2724, a logic selection input 726, an adjusted timing input 2728, an address input 2730, and a load data input 2732. Global data invert input 2722, common voltage input 2724, logic selection input 2726, and load data input 2732 are all single line inputs and are coupled to global data invert line 2640, common voltage line 2638, logic selection line 2634, and load data line 2622, respectively, of imager control lines 2524. Similarly, adjusted timing input 2728 is an 8-line input coupled to adjusted time value output bus 2630 of imager control lines 2524, and address input 2730 is a 10-line input coupled address output bus 2620 of imager control lines 2524. Finally, display data input 2720 is a 16 line input coupled to a respective set of 16 imager data lines 2520(*r, b, g*) of display driver 2502, for receiving the respective red, green or blue display data for imager 2504(*r, g, b*). The elements of imager 2504 perform substantially the same functions as the corresponding elements of imager 504 (FIG. 7), but are modified to accommodate an 8-bit modulation scheme as will be described below.

Shift register 2702 receives and temporarily stores display data for a single row 2713 of pixels 2711. Display data is written into shift register 2702 sixteen bits (two 8-bit data words) at a time via data input 2720 until a complete row 2713 of display data has been received and stored. In the present embodiment, shift register 2702 is large enough to store eight bits of display data for each pixel 2711 in a row 2713. In other words, shift register 2702 is able to store 10,240 bits (e.g., 1280 pixels/row×8 bits/pixel) of display data. Once shift register 2702 receives data for a complete row 2713 of pixel cells 2711, the row of data is shifted, via data lines 2734, into multi-row memory buffer 2704.

Multi-row memory buffer 2704 is a first-in-first-out (FIFO) buffer that provides temporary storage for a plurality of complete rows of video data received from shift register 2702. In the present embodiment, multi-row memory buffer 2704 receives a complete row of 8-bit video data at one time, via data lines 2734, which include 1280×8 separate lines. When FIFO 2704 is full of data, the first received data is shifted onto data lines 2736, so the data can be transferred into circular memory buffer 2706. FIFO 2704 contains enough memory to store 4 (i.e., CIELING $$\left(\frac{768}{2^8-1}\right)\Bigg)$$

complete rows 2713 of 8-bit display data, or approximately 41 Kilobits.

Circular memory buffer 2706 receives rows of 8-bit display data asserted by FIFO 2704 on data lines 2736, and stores the video data for an amount of time sufficient for signals corresponding to the data to be asserted on an appropriate pixel 2711 of display 2710. Circular memory buffer 2706 loads and retrieves data responsive to adjusted addresses asserted on address input 2742 and load data signals asserted on load input 2740. Depending on the signals asserted on load input 2740 and address input 2742, circular memory buffer 2706 either loads a row of 8-bit display data asserted on data lines 2736 by FIFO 2704, or asserts a row of previously stored 8-bit display data onto data lines 2738, which also number 1280×8. The memory locations which the bits are loaded into or retrieved from are determined by address converter 2716.

Row logic 2708 loads single bits of data into pixels 2711 of display 2710 depending on the grayscale value defined by 8-bit display data associated with each pixel 2711. Row logic 2708 receives an entire row of 8-bit display data via data lines 2738, and based on the display data and in some cases the previous data loaded into pixels 2711, updates the bits latched into each pixel 2711 of the particular row 2713 via a plurality (1280×2) of display data lines 2744. As explained above with respect to the 4-bit embodiment, and as will be apparent in view of the following description of the 8-bit embodiment, one or more of the 8-bits of data received by row logic 2708 may be invalid depending on the particular update time, yet row logic 2708 is able to determine the proper value of the bit to be written to each pixel 2711 based on the remaining valid bits.

Row logic 2708 generates the bits to be latched into pixels 2711 from the data asserted on data lines 2738 based on an adjusted time value received from time adjuster 2610 (FIG. 26) via adjusted timing input 2746, a logic selection signal received from logic selection unit 2606 via logic selection input 2748, and optionally the previous data latched into pixels 2711 received via half of display data lines 2744. By latching bits of the proper value into pixels 2711, row logic 2708 initializes and terminates an electrical pulse on each pixel 2711, the width of the pulse corresponding to the grayscale value of the display data associated with each particular pixel 2711.

Like row logic 708, row logic 2708 is a "blind" logic element. In other words, row logic 2708 does not need to know which row 2713 of display 2710 it is processing. Rather, row logic 2708 receives an 8-bit data word for each pixel 2711 of a particular row 2713, previous data values for each pixel 2711 of the particular row, an adjusted time value on adjusted timing input 2746, and a logic selection signal on logic selection input 2748. Based on the display data, previous data values, adjusted time value, and logic selection signal, row logic 2708 determines whether a pixel 2711 should be "ON" or "OFF" at a particular adjusted time, and asserts a digital HIGH or digital LOW value, respectively, onto the corresponding one of display data lines 2744. Accordingly, each pixel 2711 is driven with a single pulse, advantageously reducing the number of times the liquid crystal charges and relaxes during the assertion of an 8-bit data value, as compared to the prior art.

Display 2710 is substantially identical to display 710. A pair of display data lines 2744 provides data to and receives previous data from a respective one of the 1280 columns 2712 of display 2710. Additionally, each row 2713 of display 2710 is enabled by one of a plurality (768, in this example) of word lines 2750. The structure of pixels 2711 can be as shown in FIG. 20A or 20B, or any suitable equivalent. In addition, common voltage supply terminal 2760 supplies either a normal or inverted common voltage to the common electrode 2758 of display 2710 overlying each pixel 2711. Likewise, global data invert line 2756 supplies data invert signals to each pixel 2711, such that the bias direction of the pixels 2711 can be switched from a normal direction to an inverted direction, and vice versa. Because the structure of pixels 2711 is similar to that shown in FIGS. 20A-20B, pixels 2711 are not shown in further detail.

Like row decoder 714, row decoder 2714 enables each of word lines 2750 in synchrony with row logic 2708 such that previous data latched into the pixels 2711 of the enabled row 2713 can be read back to row logic 2708 via one half of display data lines 2744, and the new data bits asserted by row logic 2708 on the other half of display data lines 2744 can be latched into each pixel 2711 of a correct row 2713 of display 2710. Row decoder 2714 includes a 10-bit address input 2752, a disable input 2754, and 768 word lines 2750 as outputs. Depending upon the row address received on address input 2752 and the signal asserted on disable input 2754, row decoder 2714 is operative to enable (e.g., by asserting a digital HIGH value) one of word lines 2750.

Address converter 2716 receives 10-bit row addresses from address input 2730, converts each row address into a plurality of memory addresses, and provides the memory addresses to address input 2742 of circular memory buffer 2706. In particular, address converter 2716 provides a separate memory address for each bit of display data. For example, in the present 8-bit driving scheme, address converter 2716 converts a row address received on address input 2730 into eight different memory addresses, the first memory address associated with a least significant bit ($B_0$) section of circular memory buffer 2706, the second memory address associated with a next least significant bit ($B_1$) section of circular memory buffer 2706, the third memory address associated with a most significant bit ($B_7$) section of circular memory buffer 2706, the fourth memory address associated with a next most significant bit ($B_6$) section of circular memory buffer 2706, the fifth memory address associated with a second next most significant bit ($B_5$) section of circular memory buffer 2706, the sixth memory address associated with a third next most significant bit ($B_4$) section of circular memory buffer 2706, the seventh memory address associated with a fourth next most significant bit ($B_3$) section of circular memory buffer 2706, and the eighth memory address associated with a fifth next most significant bit ($B_2$) section of circular memory buffer 2706.

Figure 28:
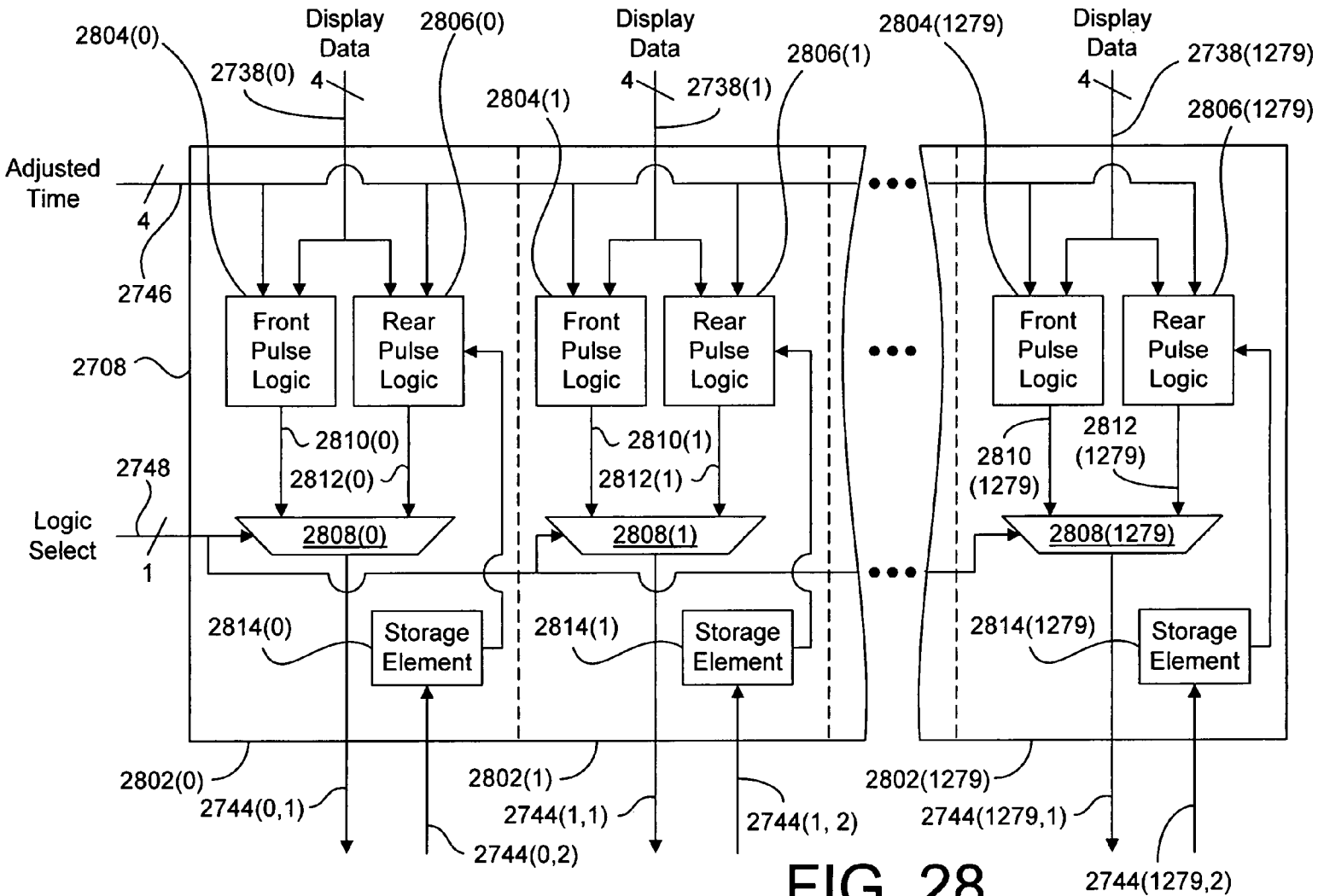
FIG. 28 is a block diagram showing the row logic of the imager of FIG. 27 in greater detail.

FIG. 28 is a block diagram showing row logic 2708 in greater detail. Row logic 2708 includes a plurality of logic units 2802(0-1279), each of which is responsible for asserting data bits on a respective one of display data lines 2744(0-1279, 1), and receiving previously asserted data bits from a respective one of display data lines 2744(0-1279, 2). Each logic unit 2802(0-1279) includes a front pulse logic 2804(0-1279), a rear pulse logic 2806(0-1279), and a multiplexer 2808(0-1279). Front pulse logics 2804(0-1279) and rear pulse logics 2806(0-1279) each include a single-bit output 2810(0-1279) and 2812(0-1279), respectively. Outputs 2810(0-1279) and 2812(0-1279) each provide a single-bit input to a respective multiplexer 2808(0-1279). Finally, each logic unit 2802(0-1279) includes a storage element 2814(0-1279), respectively, for receiving and storing a data bit previously written to the latch of a pixel 2711 in an associated column 2712 of display 2710. Storage elements 2814(0-1279) receive a new data value each time a row 713 of display 710 is enabled by row decoder 714, and provide the previously written data to a respective rear pulse logic 2806(0-1279). Note that the notation for display data lines 2744 again follows the notation 2744 (column number, data line number).

Row logic 2708 functions similarly to row logic 708, except that front pulse logics 2804(0-1279) and rear pulse logics 2806(0-1279) are configured to operate on all or part of 8-bit data words, instead of 4-bit data words. Front pulse logics 2804(0-1279) and rear pulse logics 2806(0-1279) also each receive 8-bit adjusted time values via adjusted timing input 2746. In addition, each of multiplexers 2808(0-1279) receives a logic selection signal via logic selection input 2748. The logic selection signal asserted on logic selection input 2748 is HIGH for a first plurality of predetermined adjusted time values, and is LOW for the remaining second plurality of predetermined adjusted time values. In the present embodiment, the logic selection signal is HIGH for adjusted time values one through three, and is LOW for any other adjusted time value.

Figure 29:
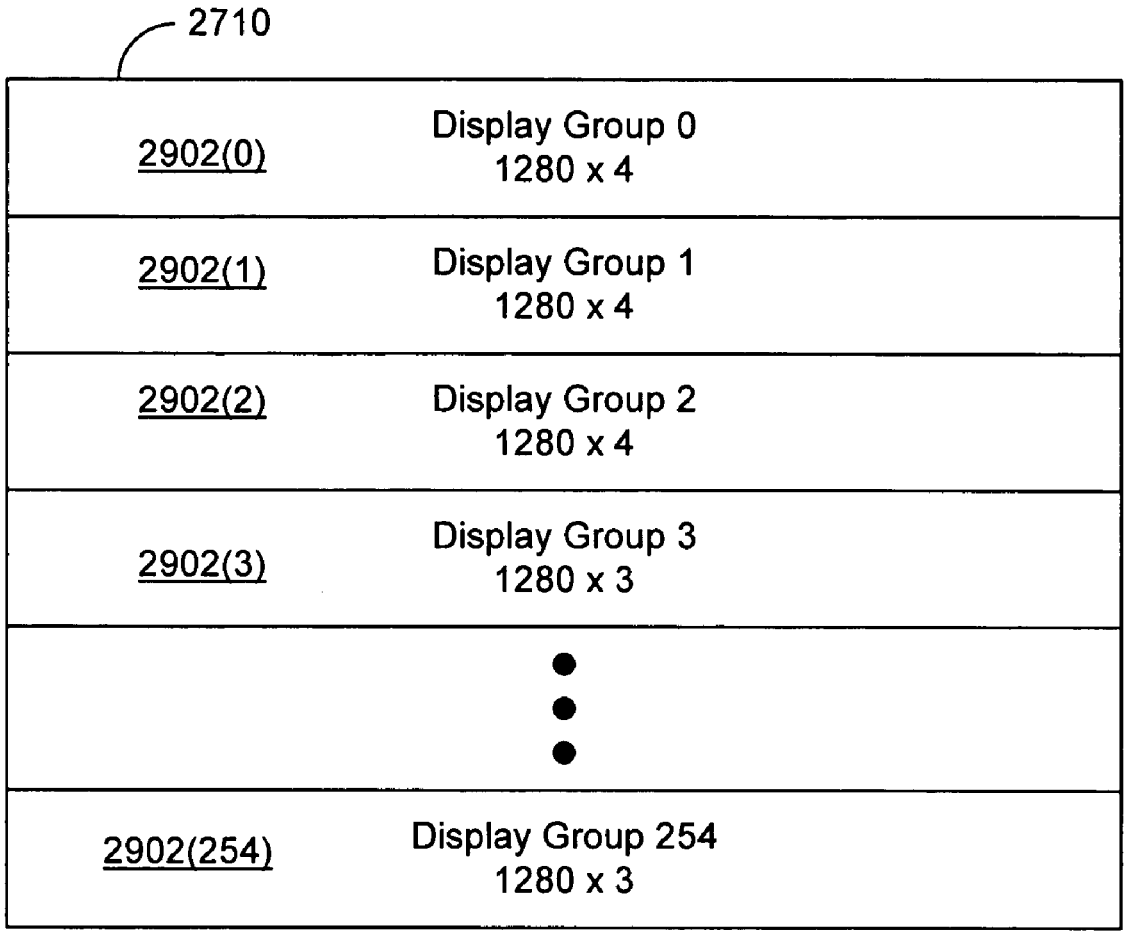
FIG. 29 is a diagram showing an example method of grouping rows of pixels of each of the imagers of FIG. 25 according to the present invention.

FIG. 29 is a block diagram showing another method of grouping the rows 2713 of display 2710 according to the present invention. In the present embodiment, rows 2713 of display 2710 are divided into 255 (i.e., $2^8-1$) groups 2902(0-254). Because the number of groups 2902 is equal to the number of time values produced by timer 2602, the power requirements and modulation of display driving system 2500 remain substantially uniform over time.

Of the groups 2902(0-254) that display 2710 is divided into, groups 2902(0-2) each contain four rows 2713, while the remaining groups 2902(3-255) each contain three rows 2713. In particular, the groups 2902(0-254) contain the following rows 2713:

Group 0: Row 0 through Row 3
Group 1: Row 4 through Row 7
Group 2: Row 8 through Row 11
Group 3: Row 12 through Row 14
Group 4: Row 15 through Row 17
Group 5: Row 18 through Row 20
Group 6: Row 21 through Row 23
Group 7: Row 24 through Row 26
Group 8: Row 27 through Row 29

. . .

Group 252: Row 759 through Row 761
Group 253: Row 762 through Row 764
Group 254: Row 765 through Row 767

Finally, it should be noted that the manner in which rows 2713 are grouped corresponds to the formulas for determining the minimum number of rows per group, the number of groups containing an extra row, and the number of groups containing the minimum number of rows explained above with reference to FIG. 9.

Figure 30:
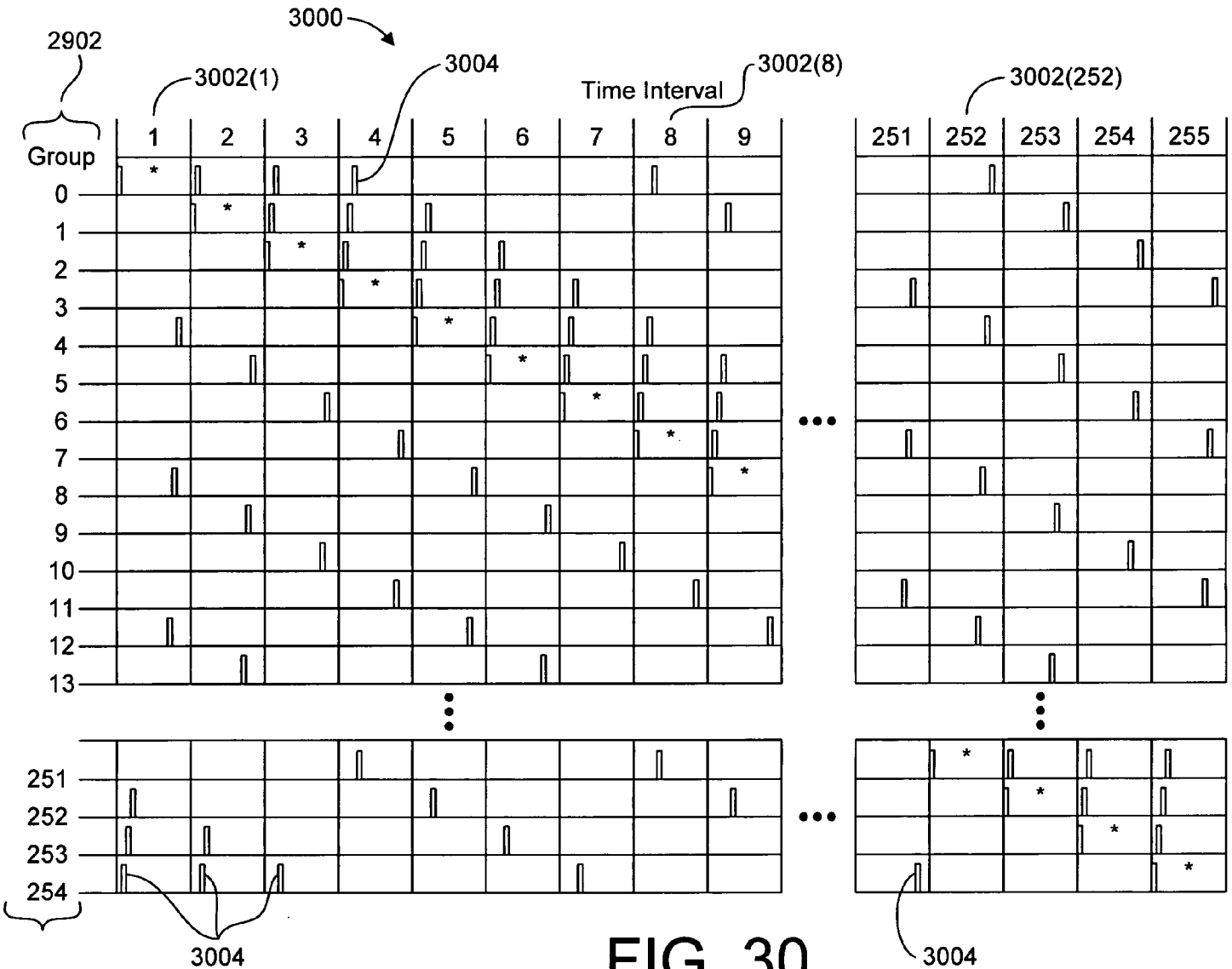
FIG. 30 is a timing chart showing another modulation scheme according to the present invention.

FIG. 30 is a timing chart 3000 showing a modulation scheme according to an alternate embodiment of the present invention. Timing chart 3000 shows the modulation period of each group 2902(0-254) divided into a plurality (i.e., $2^8-1$) of coequal time intervals 3002(1-255). Each time interval 3002(1-255) corresponds to a respective time value (1-255) generated by timer 2602.

Data bits calculated by row logic 2708 are written to the pixels rows 2713 of each group 2902(0-254) within the group's respective modulation period. Because the number of groups 2902(0-254) is equal to the number of time intervals 3002(1-255), each group 2902(0-254) has a modulation period that begins at the beginning of one of time intervals 3002(1-255) and ends after the lapse of 255 time intervals 3002(1-255) from the start of the modulation period. For example, group 2902(0) has a modulation period that begins at the beginning of time interval 3002(1) and ends after the lapse of time interval 3002(255). Group 2902(1) has a modulation period that begins at the beginning of time interval 3002(2) and ends after the lapse of time interval 3002(1). Group 2902(2) has a modulation period that begins at the beginning of time interval 3002(3) and ends after the lapse of time interval 3002(2). This trend continues for the modulation periods for groups 2902(3-253), ending with the group 2902(254), which has a modulation period starting at the beginning of time interval 3002(254) and ending after the lapse of time interval 3002(253). The first time interval 3002 of each group 2902's modulation period is indicated in FIG. 30 by an asterisk (*).

Row logic 2708 and row decoder 2714, according to control signals provided by image control unit 2516, update each group 2902(0-254) sixty-six times during the group's respective modulation period. For example, row logic 2708 updates group 2902(0) during time intervals 3002(1), 3002(2), 3002(3), 3002(4), 3002(8), 3002(12), 3002(16), 3002(20), 3002(24), 3002(28), 3002(32), 3002(36), 3002(40), 3002(44), 3002(48), 3002(52), 3002(56), 3002(60), 3002(64), 3002(68), 3002(72), 3002(76), 3002(80), 3002(84), 3002(88), 3002(92), 3002(96), 3002(100), 3002(104), 3002(108), 3002(112), 3002(116), 3002(120), 3002(124), 3002(128), 3002(132), 3002(136), 3002(140), 3002(144), 3002(148), 3002(152), 3002(156), 3002(160), 3002(164), 3002(168), 3002(172), 3002(176), 3002(180), 3002(184), 3002

(188), 3002(192), 3002(196), 3002(200), 3002(204), 3002(208), 3002(212), 3002(216), 3002(220), 3002(224), 3002(228), 3002(232), 3002(236), 3002(240), 3002(244), 3002(248), and 3002(252). Row logic 2708 utilizes front pulse logic 2804(0-1279) to generate data bits during time intervals 3002(1-3) and rear pulse logic 2806(0-1279) to generate data bits during time intervals 3002(4), 3002(8), 3002(12), . . . , 3002(248), and 3002(252).

The remaining groups 2902(1-254) are updated during the same ones of time intervals 3002(1-255) as group 2902(0) when the time intervals 3002(1-255) are adjusted for a particular group's modulation period. For example, for row addresses received that are associated with group 2902(0), time adjuster 2610 does not adjust the timing signal received from timer 2602. For row addresses associated with group 9202(1), time adjuster 2610 decrements the timing signal received from timer 2602 by one. For row addresses associated with group 2902(2), time adjuster 2610 decrements the timing signal received from timer 2602 by two. This trend continues for all groups 2902, until finally for row addresses associated with group 2902(254), time adjuster 2610 decrements the timing signal received from timer 602 by two-hundred fifty-four.

Because each group 2902(1-254) is updated during the same time intervals in a group's respective modulation period, time adjuster 2610 outputs sixty-six different adjusted time values. In particular time adjuster 2610 outputs adjusted time values of 1, 2, 3, 4, 8, 12, 16, 20, 24, 28, 32, 36, 40, 44, . . . , 232, 236, 240, 244, 248, and 252. As stated previously, logic selection unit 2606 asserts a digital HIGH selection signal on logic selection output 2634 for adjusted time values one through three, and produces a digital LOW for all remaining adjusted time values. Accordingly, multiplexers 2808(0-1279) couple outputs 2810(0-1279) of front pulse logics 2804(0-1279) with display data lines 2744(0-1279, 1) for adjusted time values of one, two, and three and couple outputs 2812(0-1279) of rear pulse logics 2806(0-1279) with display data lines 2744(0-1279, 1) for the remaining sixty-three adjusted time values.

In addition to showing the number of times a group 2902 is updated within its modulation period, chart 3000 also shows which groups 2902(0-254) are updated by row logic 2708 during each time interval 3002(1-255). Because the number of groups 2902(0-254) into which display 710 is divided is equal to the number of time intervals 3002(1-255), the number of groups updated (e.g., sixty-six) is the same during each time interval 3002(1-255). This provides the advantage that the power requirements of imagers 2504(*r, g, b*) and display driver 2502 remain approximately uniform during operation.

Figure 31:
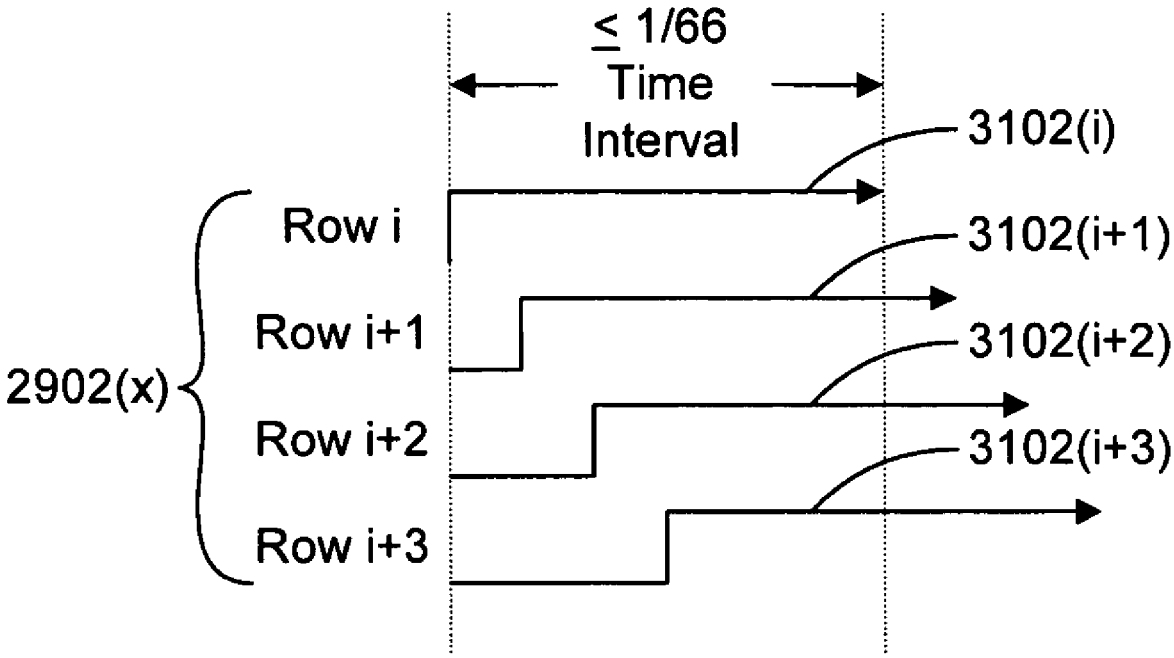
FIG. 31 is a timing diagram indicating the manner in which individual rows of a particular group of FIG. 29 are updated according to the modulation scheme of FIG. 30.

FIG. 31 is a timing diagram showing the rows 2713(*i*–*i*+3) of a particular group 2902(*x*) being updated during a particular time interval 3002. Each row 2713(*i*–*i*+3) within the group 2902(*x*) is updated by row logic 2708 at a different time within one sixty-sixth of time interval 3002. Update indicators 3102(*i*–*i*+3) are provided in FIG. 31 to qualitatively indicate when a particular row 2713(*i*–*i*+3) is updated relative to the other rows. A low update indicator 3102(*i*-*i*+3) indicates that a corresponding row 2713(*i*–*i*+3) has not yet been updated within the time interval 3002. On the other hand, a HIGH update indicator 3102(*i*–*i*+3) indicates that a row 2713 (*i*–*i*+3) has been updated. Within the group 2902(*x*), row logic 2708 updates an electrical signal asserted on a first row 2713 (*i*) at a first time, and then a short time later after row 2713(*i*) has been updated, row logic 2708 updates a next row 2713(*i*+1). Each row 2713(*i*–*i*+3) is successively updated a short time after the preceding row, until all rows (e.g., three or four) in the group 2902(*x*) have been updated. It should be noted that for groups 2902(3-254) that have only three rows, Row i+3 shown in FIG. 31 would not be updated because no such row would exist.

It should be understood that update indicators are intended to give a qualitative indication of the sequencing of the rows. Although it appears in FIG. 31 that approximately one-half of the time period shown is used to update rows i–i+3, in actuality, much less time will typically by required, depending on the speed of the particular circuitry employed.

Because row logic 2708 updates all rows 2713(*i*–*i*+3) of a particular group 2902(*x*) at a different time, each row of display 2710 is updated throughout its own sub-modulation period. In other words, because each group 2902(0-254) is processed by row logic 2708 over a modulation period that is temporally offset with respect to the modulation period of every other group 2902(0-254), and every row 2713(*i*–*i*+3) within a group 2902(*x*) is updated by row logic 2708 at a different time, each row 2713 of display 2710 is updated during its own modulation period that depends on the modulation period of the row's group 2902(0-254).

It should also be noted that although row logic 2708 must update more groups 2902(0-254) per time interval 3002 than does row logic 708 (FIG. 7), row logic 2708 updates fewer rows 2713 per time interval 3002. For example, the most number of rows 713 updated by row logic 708 within a time interval 1002 is 309 (e.g., in time intervals 1002(3) and 1002 (4)). In the present embodiment, the most number of rows 2713 updated by row logic 2708 within a time interval 3002 is 201 (e.g., in time intervals 3002(3) and 3002(4)). Therefore, in the present embodiment fewer rows 2713 are updated by row logic 2708 per time interval 3002. However, the number of time intervals 3002 during which each group 2902 is updated is increased.

Figure 32:
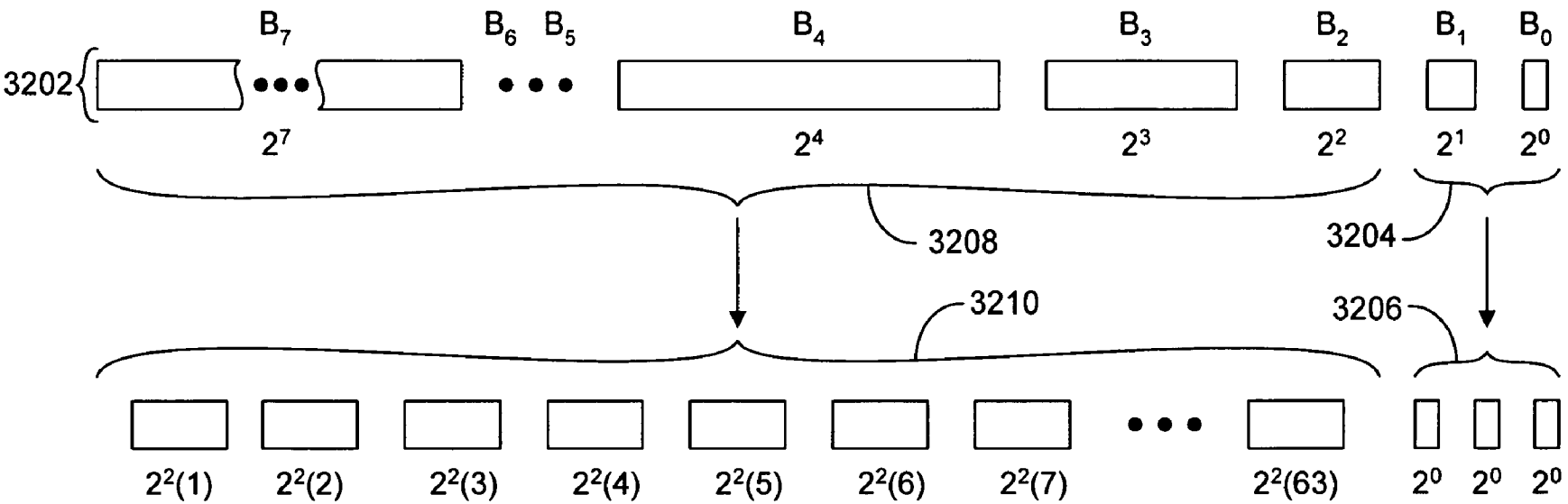
FIG. 32 is a diagram illustrating one method of evaluating an 8-bit binary weighted data word according to the present invention.

FIG. 32 illustrates how the number of time intervals 3002 during which a group 2902(0-254) is updated is determined. Each logic unit 2802(0-1279) of row logic 2708 receives a binary weighted data word 3202 indicative of a grayscale value to be asserted on a particular pixel 2711 in a row 2713. In the present embodiment, data word 3202 is an 8-bit data word, which includes a most significant bit $B_7$ having a weight ($2^7$) equal to 128 time intervals 3002(1-255), a second most significant bit $B_6$ (not shown) having a weight ($2^6$) equal to 64 time intervals 3002(1-255), a third most significant bit $B_5$ (not shown) having a weight ($2^5$) equal to 32 time intervals 3002(1-255), a fourth most significant bit $B_4$ having a weight ($2^4$) equal to 16 time intervals 3002(1-255), a fifth most significant bit $B_3$ having a weight ($2^3$) equal to 8 time intervals 3002(1-255), a sixth most significant bit $B_2$ having a weight ($2^2$) equal to 4 time intervals 3002(1-255), a seventh most significant bit $B_1$ having a weight ($2^1$) equal to 2 time intervals 3002(1-255), and a least significant bit $B_0$ having a weight ($2^0$) equal to 1 time interval 3002(1-255).

In the present embodiment, a first group of bits 3204, including a least significant bit $B_0$ and a next least significant bit $B_1$, is selected in order to determine the number of time intervals 3002 during which a group 2902(0-254) will be updated during its modulation period. $B_0$ and $B_1$ have a combined significance equal to three time intervals 3002, and can be thought of as a first group (i.e., three) of single-weight thermometer bits 3206, each having a weighted value of 20. Like first group of bits 1204, first group of bits 3204 also includes one or more consecutive bits of binary weighted data word 3202, including the least significant bit $B_0$.

The remaining bits $B_2$ through $B_7$ of binary weighted data word 3202 form a second group of bits 3208 having a combined significance equal to 252 (i.e., 4+8+16+32+64+128) of time intervals 3002. The combined significance of bits $B_2$ through $B_7$ can be thought of as a second group of thermometer bits 3210, each having a weight equal to $2^x$, where x equals the number of bits in the first group of bits 3204. In this case, the second group of thermometer bits 3210 includes 63 thermometer bits each having a weight of four time intervals 3002.

By evaluating the bits in the above described manner, row logic 2708 updates a group 2902(0-254) of display 2710 sixty-six times to account for each thermometer bit in the first group of thermometer bits 3206 (i.e., three, single-weight bits) and each bit in the second group of thermometer bits 3210 (i.e., sixty-three, four-weight bits). As stated above with respect to FIG. 12, the number of times a group must be updated within its modulation period is given by the formula:

$$\text{Updates} = \left(2^x + \frac{2^n}{2^x} - 2\right),$$

where x equals the number of bits in the first group of bits 3204 of binary weighted data word 3202, and n represents the total number of bits in binary weighted data word 3202.

By evaluating the bits of data word 3202 in the above manner, row logic 2708 can assert any grayscale value on a pixel 2711 with a single pulse by revisiting and updating pixel 2711 a plurality (i.e., 66) of times during the pixel's modulation period. During each of the first three time intervals 3002(1-3) of the pixel 2711's modulation period, row logic 2708 utilizes front pulse logic 2804 of a particular logic unit 2802 to generate a data bit from the first group of bits 3204. Depending on the values of bits $B_0$ and $B_1$, front pulse logic 2804 provides a digital ON value or a digital OFF value to pixel 2711. Then, during the remaining time intervals 3002(4), 3002(8), 3002(12), . . . , 3002(248), and 3002(252) of pixel 2711's modulation period, row logic 2708 utilizes rear pulse logic 2806 to evaluate at least one of the second group of bits 3208 of data word 3202, and optionally the previously asserted data bit on pixel 2711 to provide a digital ON value or digital OFF value to pixel 2711.

It should be noted that the particular time intervals 1002(1), 1002(2), 1002(3), 1002(4), 1002(8), 1002(12), . . . , 3002(248), and 3002(252) discussed above for pixel 2711 are the adjusted time intervals associated with the group 2902(0-254) in which pixel 2711 is located. Row logic 2708 provides updated data bits to each pixel 2711 during the same time intervals 3002(1), 3002(2), 3002(3), 3002(4), 3002(8), 3002(12), . . . , 3002(248), and 3002(252) based on the respective modulation period of the group 2902(0-254).

Figure 33:
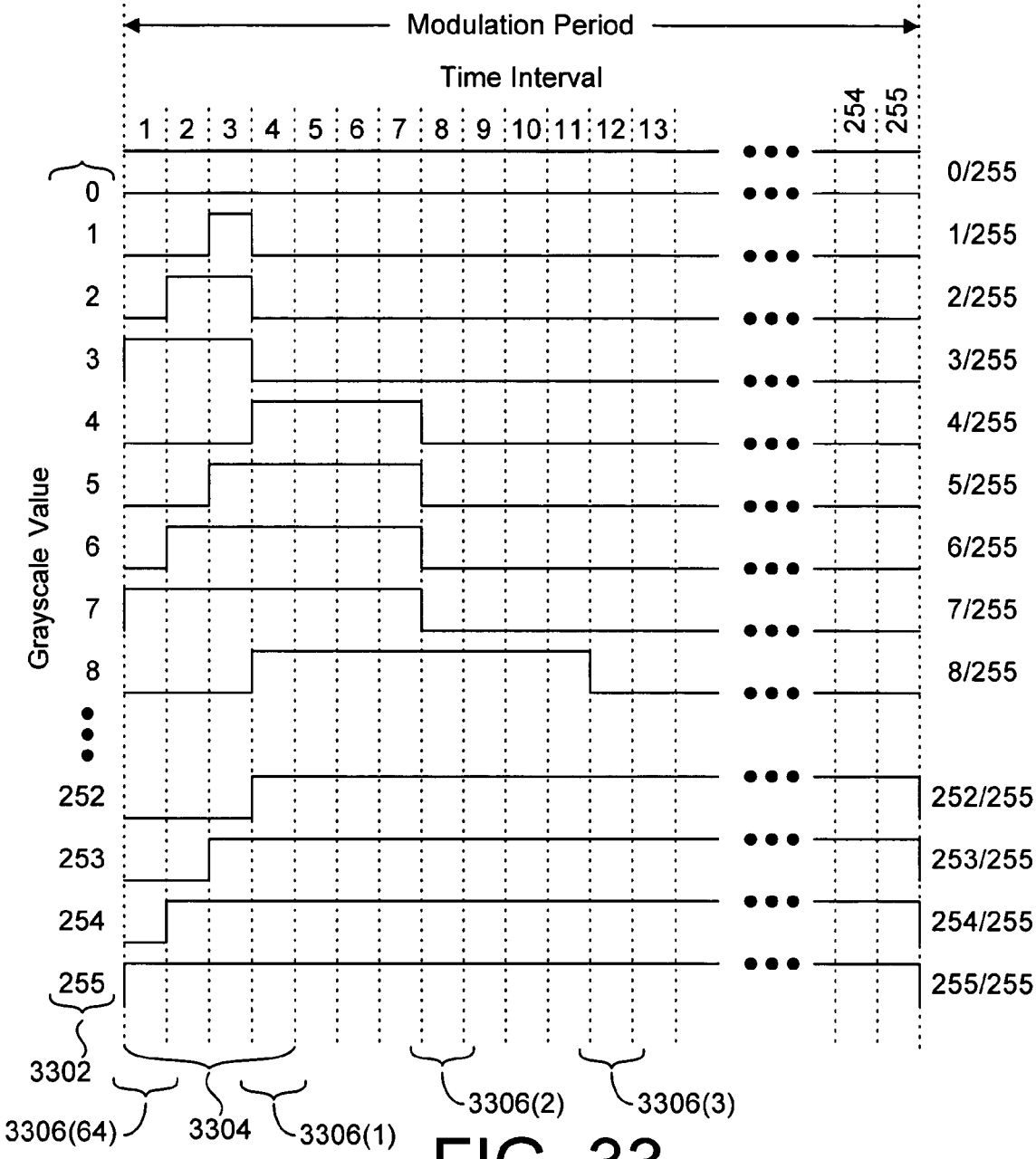
FIG. 33 shows waveforms for particular grayscale values that can be asserted by the row logic of FIG. 28 onto pixels of the imagers of FIG. 25.

FIG. 33 shows a portion of the 256 (i.e., 28) grayscale waveforms 3302(0-255) that row logic 2708 can write to each pixel 2711 based on the value of a binary weighted data word 3202 to produce the respective grayscale value. An electrical signal corresponding to the waveform for each grayscale value 3302 is initialized during one of a first plurality of consecutive predetermined time intervals 3304, and is terminated during one of a second plurality of predetermined time intervals 3306(1-64). In the present embodiment, the consecutive predetermined time intervals 3304 correspond to time intervals 3002(1), 3002(2), 3002(3), and 3002(4). In addition, the second plurality of predetermined time intervals 3306(1-64) correspond to every fourth time interval 3002(4), 3002(8), 3002(12), . . . , 3002(248), 3002(252), and 3002(1) (time interval 3306(64) corresponds to the first time interval 3002 of the pixel's next modulation period). As with the previous embodiment, all grayscale values can be generated as a single pulse (e.g., all digital ON bits written in adjacent time intervals).

To initialize the pulse on a pixel 2711, row logic 2708 writes a digital ON value to pixel 2711 where the previous value asserted on pixel 2711 was a digital OFF (i.e., a low to high transition as shown in FIG. 13). On the other hand, to terminate the pulse on a pixel 2711, row logic 2708 writes a digital OFF value to pixel 2711 where a digital ON value was previously asserted. As shown in FIG. 33, only one initialization and one termination of a pulse occur within a pixel's modulation period. As a result, a single pulse can be used to write all 256 grayscale values to a pixel 2711.

By evaluating the values of the first group of bits 3204 (e.g., $B_0$ and $B_1$) of binary weighted data word 3202, front pulse logic 2804 of row logic 2708 driving a pixel 2711 can determine when to initialize the pulse on pixel 2711. In particular, based solely on the value of the first group of bits 3204, front pulse logic 2804 can initialize the pulse during any of the first three consecutive predetermined time intervals 3304. For example if $B_0$=1 and $B_1$=0, then front pulse logic 2804 would initialize the pulse on pixel 2711 during the third time interval 3002(3). For example, grayscale values 3302(1), 3302(5), and 3302(253) are defined by pulses initialized during time interval 3002(3). If $B_0$=0 and $B_1$=1, then front pulse logic 2804 would initialize the pulse on pixel 2711 during the second time interval 3002(2). Grayscale values 3302(2), 3302(6), and 3302(254) are defined by pulses initialized during time interval 3002(2). If $B_0$=1 and $B_1$=1, then front pulse logic 2804 would initialize the pulse on pixel 2711 during the first time interval 3002(1). Grayscale values 3302(3), 3302(7), and 3302(255) are defined by pulses initialized during time interval 3002(1). Finally, if $B_0$=0 and $B_1$=0, then front pulse logic 2804 does not initialize a pulse on pixel 2711 during any of the first three of consecutive time intervals 3304. Grayscale values 3302(0), 3302(4), and 3302(252) are defined by waveforms where no pulse is initialized during any of the first three consecutive time intervals 3002(1-3). Those skilled in the art will understand that the remaining grayscale values not shown in FIG. 33 will fall into one of the groups described above.

Rear pulse logic 2806 of row logic 2708 is operative to initialize/maintain the pulse on pixel 2711 during time interval 3002(4) of the consecutive predetermined time intervals 3304, and to terminate an electrical signal on pixel 2711 during one of the second plurality of predetermined time intervals 3002(4), 3002(8), 3002(12), . . . , 3002(248), 3002(252), and 3002(1) based on the values of one or more of bits $B_2$ through $B_7$ of the binary weighted data word 3202, and when necessary, the previous data bit written to pixel 2711. Rear pulse logic 2806 is operative to initialize the pulse on pixel 2711 during time interval 3002(4) if the pulse has not been previously initialized and if any of bits $B_2$ through $B_7$ have a value of one. Grayscale values 3302(4), 3302(8), and 3302(253) illustrate such a case. If, on the other hand, no pulse has been previously initialized on pixel 2711 (i.e., the first group of bits 3204 are all zero) and all of bits $B_2$ through $B_7$ are zero, then rear pulse logic 2806 would not initialize a pulse on pixel 2711 for the given modulation period. In this case, the grayscale value is zero 3302(0).

If a pulse has been previously initialized on pixel 2711, then one of rear pulse logic 2806 or front pulse logic 2804 is operative to terminate the pulse during one of the second plurality of predetermined time intervals 3306(1-64). For example, if $B_2$ through $B_7$ all equal zero, then rear pulse logic 2806 is operative to terminate the pulse on pixel 2711 during time interval 3002(4). Grayscale values 3302(1), 3302(2), and 3302(3) illustrate this case. In any other case, depending on the values of one or more of bits $B_2$-$B_7$ and optionally the value of the previously asserted data bit, rear pulse logic 2806 is operative to terminate the pulse on pixel 2711 during one of time intervals 3002(8), 3002(12), 3002(16), . . . , 3002(248), and 3002(252). To illustrate a couple of different cases, for grayscale values 3302(4-7), rear pulse logic 2806 would terminate the pulse during time interval 3002(8), while for grayscale values of 3302(8-11), rear pulse logic 2806 would terminate the pulse during time interval 3002(12).

In the case where bits $B_2$ through $B_7$ all equal one, front pulse logic 2804 is operative to terminate the pulse on pixel 2711 during time interval 3002(1) (by asserting the data bit for the first interval of the next grayscale value). Grayscale values 3302(252), 3302(253), 3302(254), and 3302(255) illustrate such a case. In this case, there is only one transition (from OFF to ON) during the modulation period.

Another way to describe the present modulation scheme is as follows. Row logic 2708 can selectively initialize a pulse on pixel 2711 during one of the first (m) consecutive time intervals 3002(1-4) based on at least one bit (e.g., the two LSBs) of binary weighted data word 3202. If a pulse is initialized, then row logic 2708 can terminate the pulse on pixel 2711 during an ($m^{th}$) one of time intervals 3002(1-255). The ($m^{th}$) time intervals correspond to time intervals 3002(4), 3002(8), 3002(12), . . . , 3002(248), 3002(252), and 3002(1).

As described above with respect to FIG. 13, m can be defined by the equation:

$$m=2^x,$$

where x equals the number of bits in the first group of bits 3204 of the binary weighted data word 3202. Accordingly, the first plurality of predetermined times correspond to the first consecutive (m) time intervals 3002. Once x is defined, the second plurality of predetermined time intervals is given according to the equation:

$$\text{Interval}=y2^x \text{ MOD}(2^n-1),$$

where MOD is the remainder function and y is an integer greater than 0 and less than or equal to $$\left(\frac{2^n}{2^x}\right).$$

For the case $$\left(y=\frac{2^n}{2^x}\right),$$

the resulting time interval will be the first time interval 3002(1) of pixel 2711's next modulation period.

Due to the way the gray scale pulses are defined, row logic 2708 only needs to evaluate certain particular bits of multi-bit data word 3202 depending upon the time interval 3002. For example, front pulse logic 2804 of row logic 2708 updates the electrical signal asserted on a pixel 2711 based on the value of only bits $B_0$ and $B_1$ during (adjusted) time intervals 3002(1-3) of the pixel's modulation period. Similarly, rear pulse logic 2806 of row logic 2708 updates the electrical signal on the pixel 711 during (adjusted) time intervals 3002(4), 3002(8), 3002(12), . . . , 3002(248), and 3002(252) based on the value of one or more of bits $B_2$ through $B_7$. Accordingly, although front pulse logic 2804 and rear pulse logic 2806 are shown in FIG. 28 to receive the entire 8 bits of multi-bit data word 3202, it should be noted that front pulse logic 2804 and rear pulse logic 2806 may only evaluate portions of multi-bit data word 3202, for example, $B_0$-$B_1$ and $B_2$-$B_7$, respectively.

The following chart indicates which bits of multi-bit data word 3202 are evaluated by row logic 2708 during a particular (adjusted) time interval 3002 to update the pulse asserted on a pixel 711.

| Time Interval 3002 | Bit(s) Evaluated |
|---|---|
| 1-3 | $B_0$ and $B_1$ |
| 4, 8, 12, . . . , 128 | $B_7$-$B_2$ |
| 132, 136, 140, 144, . . . , 192 | $B_6$-$B_2$ |
| 196, 200, 204, 208, . . . , 224 | $B_5$-$B_2$ |
| 228, 232, 236, 240 | $B_4$-$B_2$ |
| 244, 248 | $B_3$-$B_2$ |
| 252 | $B_2$ |

Like rear pulse logic 806, rear pulse logic 2806 accesses the previous value written to a pixel 2711 via storage element 2814, such that it can properly update pixel 2711. For example, during time interval 3002(132) (bits $B_6$-$B_2$ available), if any of bits $B_6$ through $B_2$ have a value of one, then rear pulse logic 2806 needs to determine the previous value of the data bit stored in the latch of pixel 2711 before writing a new data bit to pixel 2711. If the previous value of pixel 2711 was a digital ON, then rear pulse logic 2806 knows that the intensity weight of any bits $B_6$-$B_2$ having a value of one have not been asserted on pixel 2711, because the total weights of bits $B_6$-$B_2$ are less than the weight of bit $B_7$. Therefore, the only way pixel 2711 would still be ON during time interval 3002(128) is if $B_7$ equaled one. In contrast, if the previous value of pixel 2711 was a digital OFF, then rear pulse logic 2806 would know that the intensity of any of bits $B_6$-$B_2$ having a value of one have already been asserted on pixel 2711, and rear pulse logic 2806 would keep pixel 2711 OFF, even though a number of bits $B_6$-$B_2$ have an ON value. In general, once a bit of the second group of bits 3208 of multibit data word 3202 is unavailable to rear pulse logic 2806, rear pulse logic 2806 may need to utilize the previous value stored in a pixel 2711 to properly update pixel 2711.

FIG. 34 is a representational block diagram showing circular memory buffer 2706 having a predetermined amount of memory allocated for storing each bit of multi-bit data words 3202. Circular memory buffer 2706 includes a $B_0$ memory section 3402, a $B_1$ memory section 3404, a $B_7$ memory section 3406, a $B_6$ memory section 3408, a $B_5$ memory section 3410, a $B_4$ memory section 3412, a $B_3$ memory section 3414, and a $B_2$ memory section 3416. In the present embodiment, circular memory buffer 2706 includes (1280×12) bits of memory in $B_0$ memory section 3402, (1280×12) bits of memory in $B_1$ memory section 3404, (1280×387) bits of memory in $B_7$ memory section 3406, (1280×579) bits of memory in $B_6$ memory section 3408, (1280×675) bits of memory in $B_5$ memory section 3410, (1280×723) bits of memory in $B_4$ memory section 3412, (1280×747) bits of memory in $B_3$ memory section 3414, and (1280×759) bits of memory in $B_2$ memory section 3416. Accordingly, for each column 2712 of pixels 2711, 12 bits of memory are needed for bits $B_0$, 12 bits of memory are needed for bits $B_1$, 387 bits of memory are needed for bits $B_7$, 579 bits of memory are needed for bits $B_6$, 675 bits of memory are needed for bits $B_5$, 723 bits of memory are needed for bits $B_4$, 747 bits of memory are needed for bits $B_3$, and 759 bits of memory are needed for bits $B_2$.

The present invention is able to provide this memory savings advantage because each bit of display data is stored in circular memory buffer 2706 only as long as it is needed by row logic 2708 to assert the appropriate electrical signal 3302 on an associated pixel 2711. Recall that row logic 2708 updates the electrical signal on pixel 2711 during particular time intervals 3002 based on the value(s) of the bit(s) set forth in the foregoing chart. Therefore, because row logic 2708 no longer needs bits $B_0$ and $B_1$ associated with the pixel 2711 after time interval 3002(3), bits $B_0$ and $B_1$ can be discarded (written over by subsequent data) after the lapse of time interval 3002(3). Similarly, bit $B_7$ can be discarded after the lapse of time interval 3002(128), bit $B_6$ can be discarded after the lapse of time interval 3002(192), bit $B_5$ can be discarded after the lapse of time interval 3002(224), bit $B_4$ can be discarded after the lapse of time interval 3002(240), bit B3 can be discarded after the lapse of time intervals 3002(248), and bit $B_2$ can be discarded after the lapse of time interval 3002(252). Accordingly, bits $B_7$-$B_2$ are discarded in order from most to least significance.

Like the embodiment shown in FIG. 14, the bits of binary weighted data word 3202 can be discarded after the lapse of a particular time interval 3002($T_D$). For each bit in the first group of bits 3204 of binary weighted data word 3202, $T_D$ is given according by the equation:

$$T_D=(2^x-1),$$

where x equals the number of bits in the first group of bits.

For the second group of bits 3208 of binary weighted data word 3202, $T_D$ is given by the set of equations:

$$T_D=(2^n-2^{n-b}),\ 1\leqq b\leqq(n-x);$$

where b is an integer from 1 to (n−x) representing a $b^{th}$ most significant bit of the second group of bits 3208. Based on the above equations, the two least significant bits of second group of bits 3208 are discarded after the lapse of the same time interval 3002.

Like circular memory buffer 706, the size of each memory section of circular memory buffer 2706 is dependent upon the number of columns 2712 in display 2710, the minimum number of rows 2713 in each group 2902, the number of time intervals 3002 a particular bit is needed in a modulation period (i.e., $T_D$), and the number of groups containing an extra row 2713. Accordingly, the amount of memory required in a section of circular memory buffer 2706 is given by the equation:

$$\text{Memory Section} = c\times\left[\left(INT\left(\frac{r}{2^n-1}\right)\times T_D\right)+rMOD(2^n-1)\right],$$

where c equals the number of columns 2712 in display 2710.

The present invention significantly reduces the amount of memory required in display 2710 over the prior art input buffer 110. If prior art input buffer 110 were modified for 8-bit display data, input buffer 110 would require 1280×768×8 bits (7.86 Megabits) of memory storage. In contrast, circular memory buffer 2706 contains only 4.98 Megabits of memory storage. Accordingly, circular memory buffer 706 is only 63.4% as large as prior art input buffer 110, and therefore requires substantially less circuit area on imager 2504(*r, g, b*) than does input buffer 110 on prior art imager 102, and has a similar reduction in the number of circuit elements.

It should be noted that bits of display data are written to and read from each section of circular memory buffer 2706 in the same manner as data is written into and read from circular memory buffer 706. In particular, address converter 2716 converts each "read" or "write" row address it receives into a plurality of memory addresses, each associated with one of memory sections 3402, 3404, 3406, 3408, 3410, 3412, 3414, and 3416. Address converter 2716 then provides the eight memory addresses to circular memory buffer 2706 such that each bit of display data can be written into or read from the particular memory location in each of memory sections 3402, 3404, 3406, 3408, 3410, 3412, 3414, and 3416. Similar to address converter 716, address converter 2716 utilizes the following methods to convert a read or write row address into eight different memory addresses:

$B_0$ Address=(Row Address) MOD ($B_0$ Memory Size),
$B_1$ Address=(Row Address) MOD ($B_1$ Memory Size),
$B_7$ Address=(Row Address) MOD ($B_7$ Memory Size),
$B_6$ Address=(Row Address) MOD ($B_6$ Memory Size),
$B_5$ Address=(Row Address) MOD ($B_5$ Memory Size),
$B_4$ Address=(Row Address) MOD ($B_4$ Memory Size),
$B_3$ Address=(Row Address) MOD ($B_3$ Memory Size), and
$B_2$ Address=(Row Address) MOD ($B_2$Memory Size).

The capacity of each memory section determines the number of bits required to address the memory locations of the section. The number of address bits required for each memory section is as follows:

B0 Section 3402: 04 bits
B1 Section 3404: 04 bits
B7 Section 3406: 09 bits
B6 Section 3408: 10 bits
B5 Section 3410: 10 bits
B4 Section 3412: 10 bits
B3 Section 3414: 10 bits
B2 Section 3416: 10 bits Thus, address input 2742 has 67 lines. It should be noted, however, that because bits $B_0$ and $B_1$ are stored and discarded at the same time, the same address/lines can be used for both of these bits as a pair.

Because some of the display data received by row logic 2708 will be erroneous (new data written over discarded bits) for pixel 2711 during a particular time interval, row logic 2708 is operative to ignore particular bits of display data received for the pixel depending upon the time interval. For example, in the present embodiment, row logic 2708 is operative to ignore bits $B_0$ and $B_1$ after the lapse of (adjusted) time interval 3002(3) within the pixel's modulation period. Similarly, row logic 2708 ignores bits $B_7$, $B_6$, $B_5$, $B_4$, $B_3$, and $B_2$ after the lapse of time intervals 3002(128), 3002(192), 3002(224), 3002(240), 3002(248), and 3002(252), respectively. In this manner row logic 2708 discards invalid bits of display data by ignoring them based on the time interval.

Figure 35:
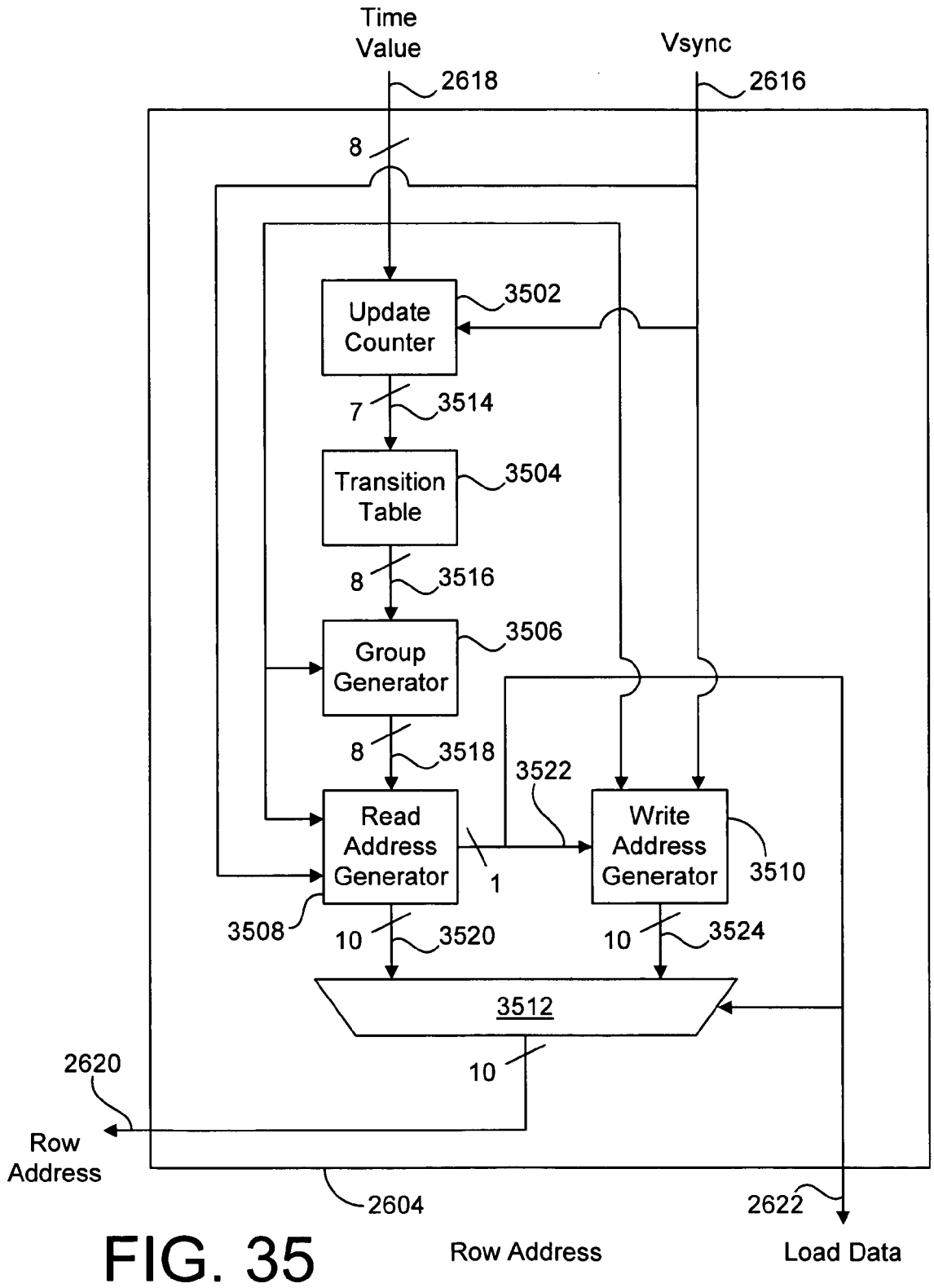
FIG. 35 is a block diagram showing the address generator of FIG. 26 in greater detail.

FIG. 35 is a block diagram showing address generator 2604 in greater detail. Address generator 2604 includes an update counter 3502, a transition table 3504, a group generator 3506, a read address generator 3508, a write address generator 3510, and a multiplexer 3512. The components of address generator 2604 function similarly to the components of address generator 604, however are modified for the 8-bit modulation scheme employed by display driving system 2500.

For example, update counter 3502 receives 8-bit timing signals via timing input 2618, receives the Vsync signal via synchronization input 2616, and provides a plurality of 7-bit count values to transition table 3504 via an update count line 3514. The number of update count values that update counter 3502 generates is equal to the number of groups 2902(0-254) that are updated during each time interval 3002. Accordingly, in the present embodiment, update counter 3502 sequentially outputs 66 different count values 0 to 65 in response to receiving a timing signal on timing input 2618.

Transition table 3504 receives each 7-bit update count value from update counter 3502, converts the update count value to a respective transition value, and outputs the transition value onto an 8-bit transition value line 3516. Because update counter 3502 provides 66 update count values per time interval 3002, transition table 3504 will also output 66 transition values per time interval. The 66 transition values corresponded to time intervals 3002 during which a row is updated in its respective modulation period. Therefore, transition table 3504 converts each update count values 0-66 into and associated one of transition values 1-4, 8, 12, 16, 20, . . . , 248, and 252, respectively.

Group generator 3506 receives the 8-bit transition values from transition table 3504 and time values from timing input 2618, and depending on the time value and transition value, outputs a group value indicative of one groups 2902(0-254) that is to be updated within a particular time interval 3002. Because, transition table 3504 outputs 66 transition values per time interval, group generator 3506 generates 66 group values per time interval 3002 and asserts the group values onto 8-bit group value lines 3518. Each group value is determined according to the following logical process:

```
Group Value = Time Value − Transition Value
    If Group Value < 0
        then Group Value = Group Value + (Time Value)max
    end if,
```

where $(\text{Time Value})_{max}$ represents the maximum time value generated by timer 2602, which in the present embodiment is 255.

Read address generator 3508, receives group values via group value lines 3518 and synchronization signals via synchronization input 2616. Read address generator 3508 receives each group value from group generator 3506 and sequentially outputs the row addresses associated with the group value onto 10-bit read address lines 3520. A short time after read address generator 3508 has generated a $66^{th}$ group value within a time interval 3002, read address generator 3508 asserts a HIGH write enable signal on write enable line 3522.

Write address generator 3510 generates "write" row addresses such that new rows of data can be written into circular memory buffer 2706. Write address generator 3510 is enabled while read address generator 3508 is generating a HIGH write enable signal on write enable line 3522. When write address generator 3510 is enabled, write address generator 3510 receives a time value via timing input 2618 and outputs a plurality of write addresses associated with the rows 2713 whose modulation period is beginning in a subsequent time interval 3002 from the time interval 3002 indicated by the timing signal received on timing input 2618. In this manner, rows of display data stored in multi-row memory buffer 2704 can be written into circular memory buffer 2706 before they are needed by row logic 2708.

FIG. 36A shows several tables displaying the outputs of some of the components of address generator 2604. FIG. 36A includes an update count value table 3602, a transition value table 3604, and a group value table 3606. Update count value table 3602 indicates the 66 count values 0-65 consecutively output by update counter 3502. Transition value table 3604 indicates the particular transition value output by transition table 3504 for a particular update count value received from update counter 3502. For update count values 0-65 (only 0-11 and 60-65 shown), transition table 3504 outputs transition values 1-4, 8, 12, 16, 20, 24, 28, 32, 36, . . . , 232, 236, 240, 244, 248, and 252, respectively. Upon receiving a particular transition value and time value, group generator 3506 generates the particular group values shown in group value table 3606.

Figure 36B:
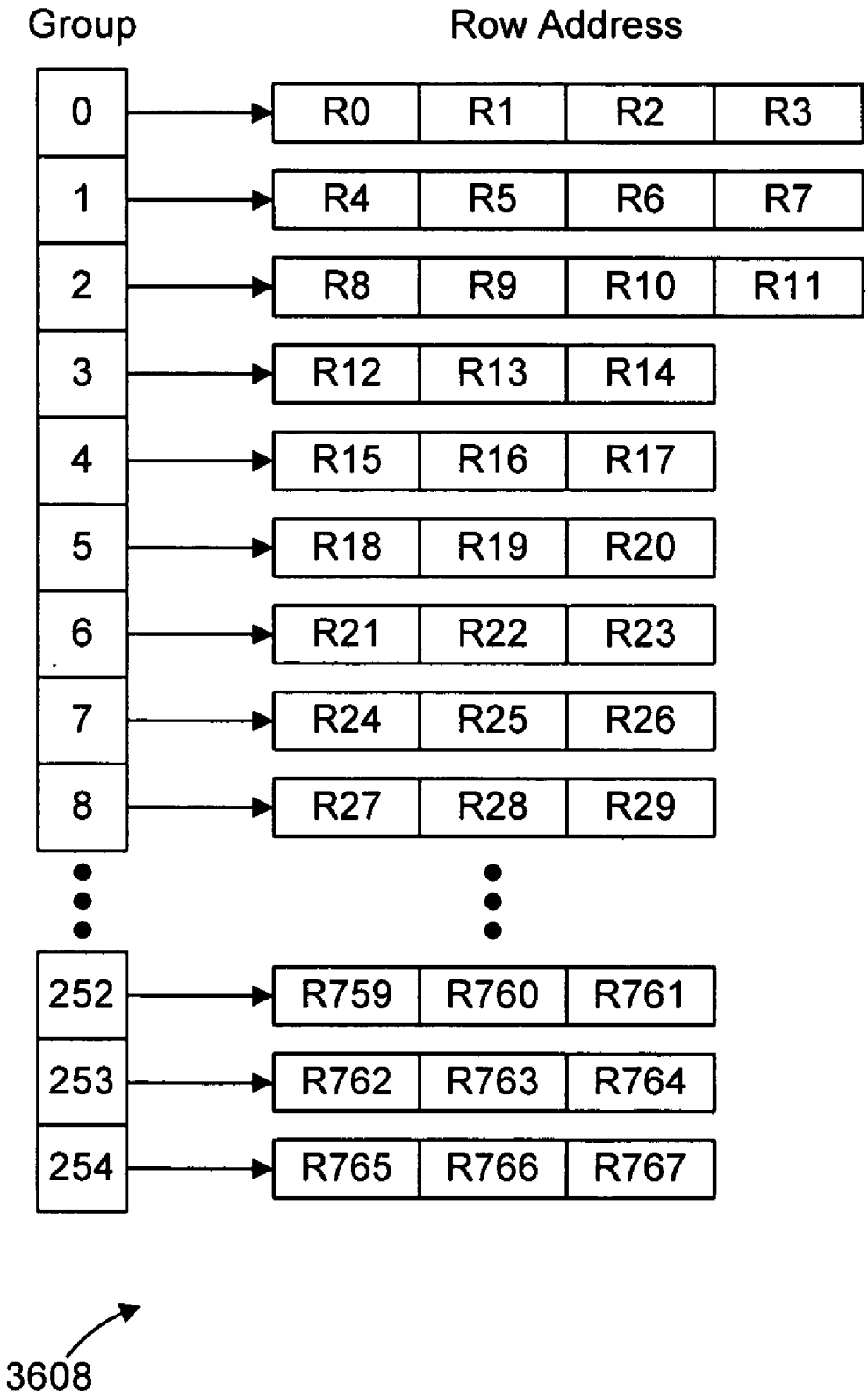
FIG. 36B is a table showing input and output values of the read address generator of FIG. 35.

FIG. 36B is a table 3608 indicating the row addresses output by read address generator 3508 for each particular group value received from group generator 3506. As shown in FIG. 36B, for a particular group 2902, read address generator 3508 outputs row addresses for either three or four of rows 2713. Because groups 2902(0-2) each include four rows 2713, read address generator 3508 outputs four row addresses for each of groups 2902(0-2). Similarly, because groups 2902 (3-254) each include three rows 2713, read address generator 3508 outputs three row address for each of groups 2902(3-254). For the groups 2902 shown as examples in FIG. 36B, read address generator 3508 outputs the following rows:

Group 0: Row 0 through Row 3 (R0-R4)
Group 1: Row 4 through Row 7 (R4-R7)
Group 2: Row 8 through Row 11 (R8-R11)
Group 3: Row 12 through Row 14 (R12-R14)
Group 4: Row 15 through Row 17 (R15-R17)
Group 5: Row 18 through. Row 20 (R18-20)
Group 6: Row 21 through Row 23 (R21-R23)
Group 7: Row 24 through Row 26 (R24-R26)
Group 8: Row 27 through Row 29 (R27-R29)

. . .

Group 252: Row 759 through Row 761 (R759-R761)
Group 253: Row 762 through Row 764 (R762-R764)
Group 254: Row 765 through Row 767 (R765-R767).

Figure 36C:
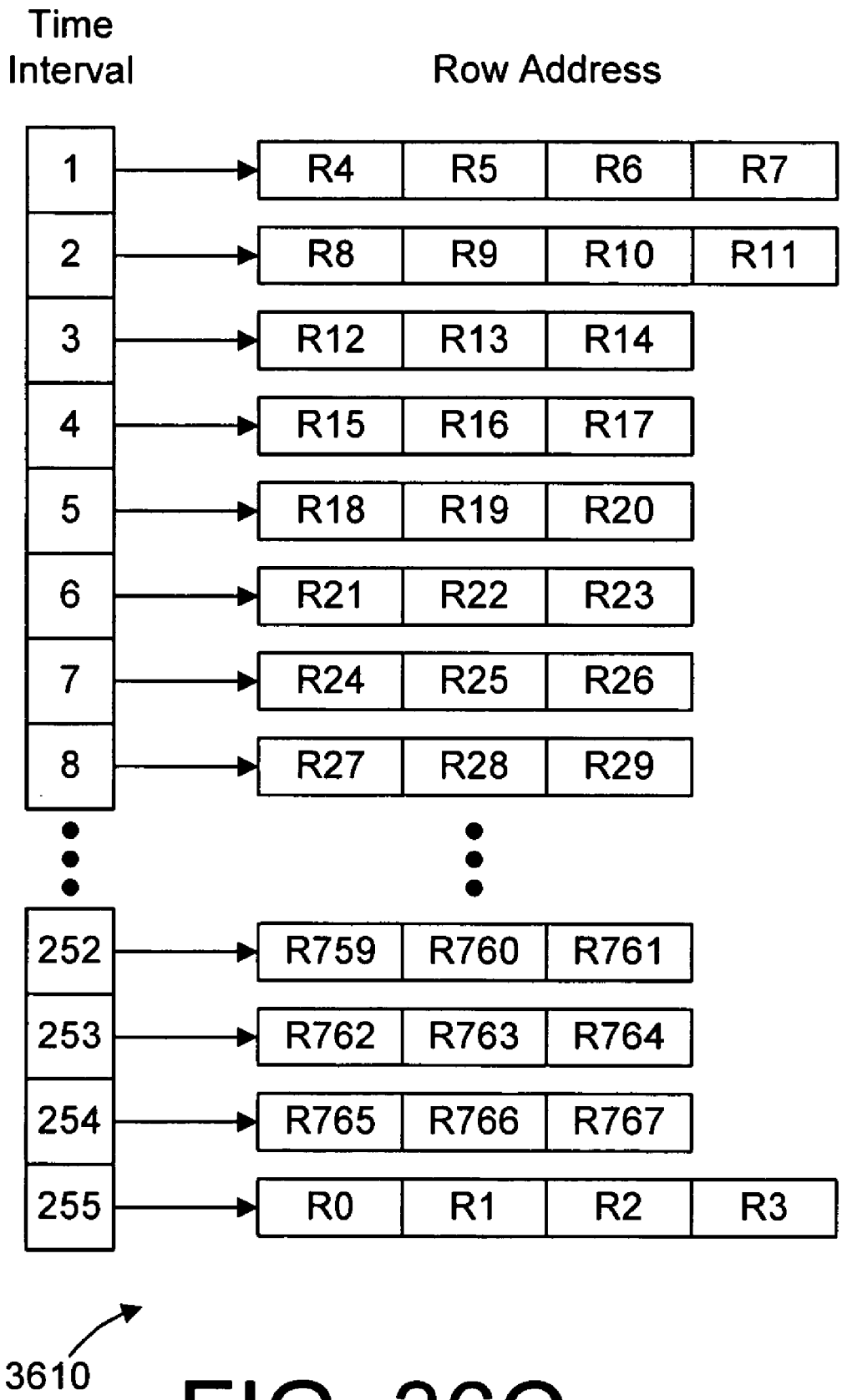
FIG. 36C is a table showing input and output values of the write address generator of FIG. 35.

FIG. 36C is a table 3610 indicating the row addresses output by write address generator 3510 for each particular time value received from timer 2602 via timing input 2618. For time intervals 3002(255), 3002(1), and 3002(2), write address generator 3510 outputs four row addresses because groups 2902(0-2) each include four rows 2713 of display 2710. For the remaining time intervals 3002(3-254), write address generator 3510 outputs three row addresses because groups 2902(3-254) each include three rows 2713. For the particular time intervals 3002 indicated in FIG. 36C, write address generator 3510 outputs row addresses for the following rows 2713 of display 2710:

Time Interval 1: Row 4 through Row 7 (R4-R7)
Time Interval 2: Row 8 through Row 11 (R8-R11)
Time Interval 3: Row 12 through Row 14 (R12-R14)
Time Interval 4: Row 15 through Row 17 (R15-R17)
Time Interval 5: Row 18 through Row 20 (R18-20)
Time Interval 6: Row 21 through Row 23 (R21-R23)
Time Interval 7: Row 24 through Row 26 (R24-R26)
Time Interval 8: Row 27 through Row 29 (R27-R29)

. . .

Time Interval 252: Row 759 through Row 761 (R759-R761)
Time Interval 253: Row 762 through Row 764 (R762-R764)
Time Interval 254: Row 765 through Row 767 (R765-R767)
Time Interval 255: Row 0 through Row 3 (R0-R3).

Figure 37:
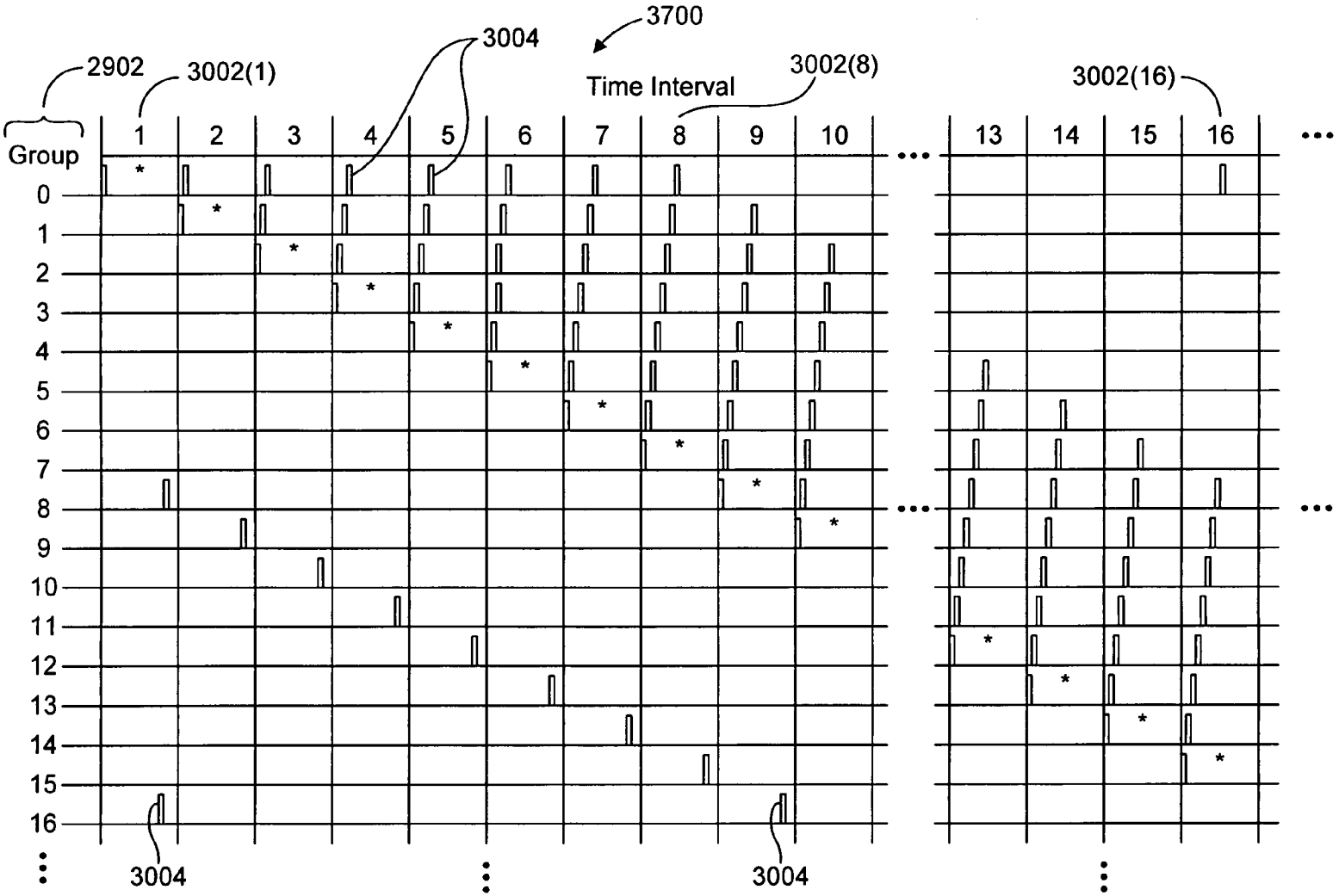
FIG. 37 is a timing chart showing another modulation scheme of the present invention.

FIG. 37 is a chart 3700 showing an alternate modulation scheme performed by display driving system 2500 on groups 2902(0-254) of display 2710. Groups 2902(0-254) (only groups 2902(0-16) shown) are arranged vertically in chart 3700, while time intervals 3002(1-255) (only time intervals 3002(1-10, 13-16) shown) are arranged horizontally across chart 3700. Like the modulation periods shown in FIG. 30, the modulation period of each group 2902 in the present embodiment is divided into ($2^8$−1), or 255, coequal time intervals 3002(1-255).

Also like the modulation periods of FIG. 30, the modulation period of each group 2902 in the present embodiment is temporally offset with respect to every other group 2902. Accordingly, each group 2902(0-254) has a modulation period that begins at the beginning of one of time intervals 3002(1-255). The beginning of each group 2902's modulation period is indicated in the appropriate one of time intervals 3002(1-255) by an asterisk (*)

In the modulation scheme shown in chart 3700, each group 2902(0-254) is updated thirty-eight times during the group's respective modulation period. For example, row logic 2708 updates group 2902(0) during time intervals 3002(1), 3002(2), 3002(3), 3002(4), 3002(5), 3002(6), 3002(7), 3002(8), 3002(16), 3002(24), 3002(32), 3002(40), 3002(48), 3002(56), 3002(64), 3002(72), 3002(80), 3002(88), 3002(96), 3002(104), 3002(112), 3002(120), 3002(128), 3002(136), 3002(144), 3002(152), 3002(160), 3002(168), 3002(176), 3002(184), 3002(192), 3002(200), 3002(208), 3002(216), 3002(224), 3002(232), 3002(240), and 3002(248). In the present embodiment, row logic 2708 utilizes front pulse logic 2804(0-1279) to update group 2902(0) during time intervals 3002(1-7) and rear pulse logic 2806(0-1279) to update group 2902(0) during time intervals 3002(8), 3002(16), 3002(24), . . . , 3002(240), and 3002(248). The remaining groups 2902(1-254) are updated during the same time intervals 3002(1-255) as group 2902(0) when the time intervals 3002(1-255) are adjusted for a particular group 2902's modulation period.

The adjusted time values output by time adjuster 2610 are also modified in the present embodiment. In particular, time adjuster 2610 outputs only 38 different adjusted time values, which are 1, 2, 3, 4, 5, 6, 7, 8, 16, 24, 32, 40, 48, 56, 64, 72, 80, 88, 96, 104, 112, 120, 128, 136, 144, 152, 160, 168, 176, 184, 192, 200, 208, 216, 224, 232, 240, and 248.

The logic selection values provided by logic selection unit 2606 must also be modified in the present embodiment. Accordingly, logic selection unit 2606 produces a digital HIGH logic selection signal on logic selection output 2634 for adjusted time values 1 through 7, and produces a digital LOW for all remaining adjusted time values. Accordingly, multiplexers 2808(0-1279) couple signal outputs 2810(0-1279) of front pulse logics 2804(0-1279) with display data lines 2744(0-1279, 1) for adjusted time values of 1 through 7 and couple signal outputs 2812(0-1279) of rear pulse logics 2806(0-1279) with display data lines 2744(0-1279, 1) for the remaining thirty-one adjusted time values.

Figure 38:
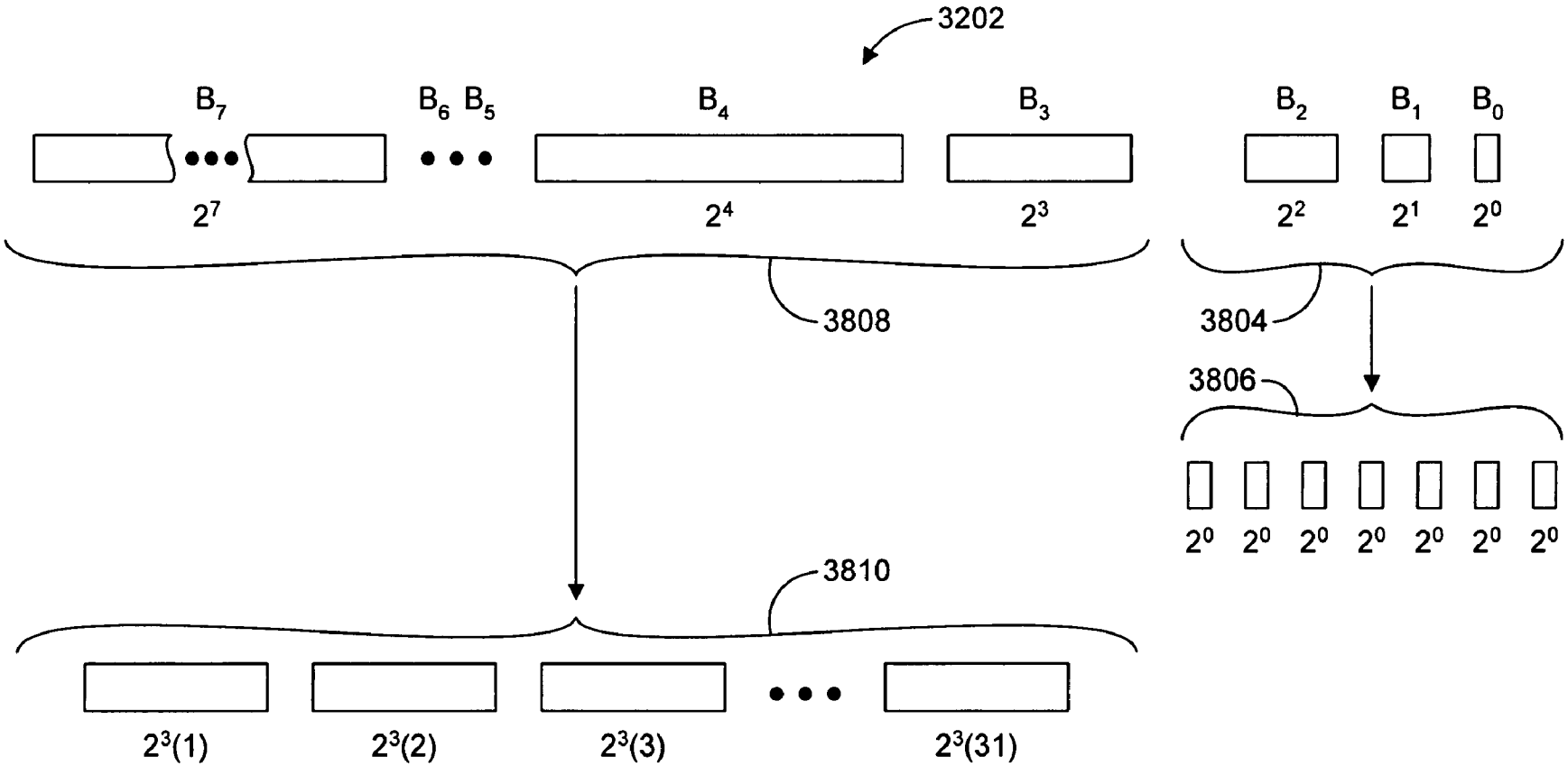
FIG. 38 is a diagram illustrating another method of evaluating an 8-bit binary weighted data word according to the present invention.

FIG. 38 illustrates how the number of time intervals during which a group 2902(0-254) is updated is determined according to the modulation scheme shown in FIG. 37. FIG. 38 shows data word 3202 having a different first group of bits 3804 selected to determine the number of time intervals during which a group 2902(0-254) will be updated during its modulation period. In the present embodiment, first group of bits 3804 includes $B_0$, $B_1$ and $B_2$. $B_0$, $B_1$, and $B_2$ have a combined significance equal to seven time intervals 3002, and can be thought of as a first group (i.e., seven) of single-weight thermometer bits 3806, each having a weighted value of $2^0$. In the present embodiment, the first group of bits 3804 includes three consecutive bits of binary weighted data word 3202, including the least significant bit $B_0$.

The remaining bits $B_3$ through $B_7$ of binary weighted data word 3202 form a second group of bits 3808 having a combined significance equal to 248 (i.e., 8+16+32+64+128) time intervals 3002. The combined significance of bits $B_3$ through $B_7$ can be thought of as a second group of thermometer bits 3810, each having a weight equal to $2^x$, where x equals the number of bits in the first group of bits 3804. In this case, where x=3, the second group of thermometer bits 3810 includes 31 coequal thermometer bits each having a weight of eight time intervals 3002.

By evaluating the bits in the above described manner, row logic 2708 must update a group 2902(0-254) of display 2710 thirty-eight times to account for each thermometer bit in the first group of thermometer bits 3806 (i.e., seven, single-weight bits) and each bit in the second group of thermometer bits 3810 (i.e., thirty-one, eight-weight bits). Because row logic 2708 must update a group 2902 only thirty eight times per modulation period, the present modulation scheme significantly reduces the number of groups 2902 that row logic 2708 must process during each time interval 3002.

As with the other modulation schemes, the total number of times that row logic 2708 must update a given group 2902(0-254) within its modulation period is given generally by the formula:

$$\text{Updates} = \left(2^x + \frac{2^n}{2^x} - 2\right),$$

where x equals the number of bits in the first group of bits 3804 of binary weighted data word 3202, and n represents the total number of bits in binary weighted data word 3202.

By evaluating the bits of data word 3202 in accordance with the present modulation scheme, row logic 2708 can assert any grayscale value on a pixel 2711 with a single pulse by revisiting and updating pixel 2711 a plurality (e.g., 38) of times during the pixel's modulation period. During each of the first seven time intervals 3002(1-7) of the pixel 2711's modulation period, row logic 2708 utilizes an alternate front pulse logic (not shown) to evaluate the first group of bits 3804. Depending on the values of bits $B_0$, $B_1$, and $B_2$, front pulse logic 2804 asserts a digital ON value or a digital OFF value to pixel 2711. Then, during the remaining time intervals 3002(8), 3002(16), 3002(24), . . . , 3002(240), and 3002(248) of pixel 2711's modulation period during which pixel 2711 is updated, row logic 2708 utilizes an alternate rear pulse logic (not shown) to evaluate one or more of the second group of bits 3808 of data word 3202 (and optionally the previous value asserted on pixel 2711) and to write a digital ON value or digital OFF value to pixel 2711. It should be noted that alternate front pulse logic and rear pulse logic are modified to process the different numbers of bits in each of the first group of bits 3804 and the second group of bits 3808, respectively.

Figure 39:
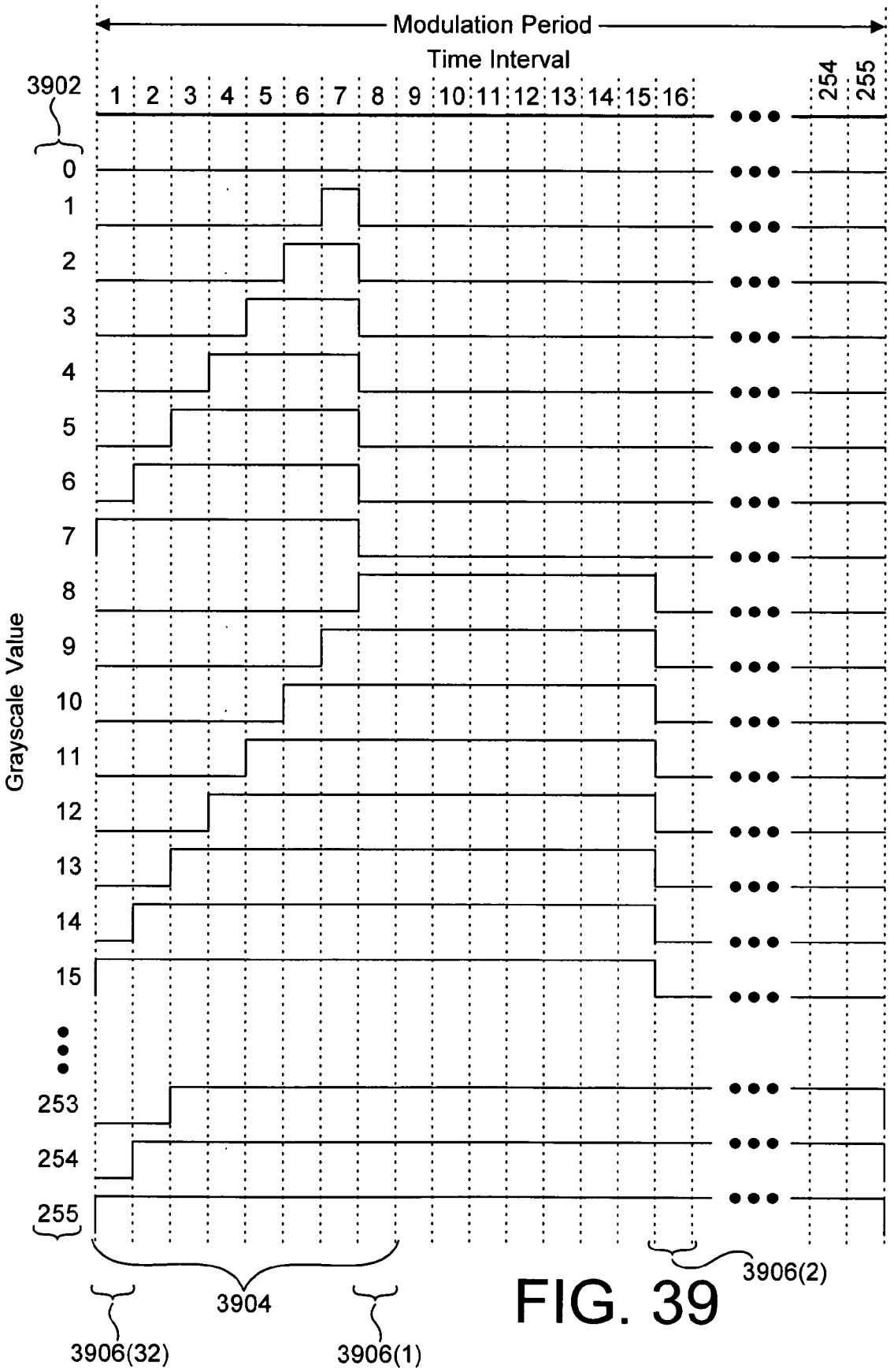
FIG. 39 shows waveforms for particular grayscale values that can be asserted by the row logic of FIG. 28 onto the pixels of the imagers of FIG. 25 using the modulation scheme of FIG. 37 and the evaluating method of FIG. 38.

FIG. 39 shows a portion of the 256 (i.e., $2^8$) grayscale waveforms 3902 that row logic 2708 can assert on each pixel 2711 based on the modulation scheme shown in FIG. 37. An electrical signal corresponding to the waveform for each grayscale value 3902 is initialized during one of a first plurality of consecutive predetermined time intervals 3904, and is terminated during one of a second plurality of predetermined time intervals 3906(1-32). In the present embodiment, the consecutive predetermined time intervals 3904 correspond to time intervals 3002(1-8), and the second plurality of predetermined time intervals 3906(1-32) correspond to every eighth time interval 3002(8), 3002(16), 3002(24), . . . , 3002(240), 3002(248), and 3002(1) (predetermined time 3906(32) corresponds to the first time interval 3002(1) of the pixel's next modulation period).

By evaluating the values of the first group of bits 3804 (e.g., $B_0$, $B_1$ and $B_2$) of binary weighted data word 3202, the front pulse logic can determine when to initialize the pulse on pixel 2711. In particular, based solely on the value of the first group of bits 3804, the front pulse logic can initialize the pulse during any of the first seven consecutive predetermined times 3904.

The rear pulse logic is operative to initialize/maintain the pulse on pixel 2711 during time interval 3002(8) of the consecutive predetermined time intervals 3904, and to terminate the pulse during one of the second plurality of predetermined time intervals 3002(8), 3002(16), 3002(24), . . . , 3002(240), 3002(248), 3002(1), based on the values of one or more of bits $B_3$ through $B_7$ of the binary weighted data word 3202, and optionally a previous value asserted on pixel 2711. The rear pulse logic is operative to initialize the pulse on pixel 2711 during time interval 3002(8) if an electrical signal has not been previously initialized and if any of bits $B_3$ through $B_7$ have a value of one. If, on the other hand, no pulse has been previously initialized on pixel 2711 (i.e., the first group of bits 3904 are all zero) and all of bits $B_3$ through $B_7$ are zero, then the rear pulse logic does not initialize an electrical signal on pixel 2711 for the given modulation period. Finally, if an electrical signal has been previously initialized on pixel 2711, then either the rear pulse logic or the front pulse logic 2804 (during the next modulation period) is operative to terminate the pulse during one of the second plurality of predetermined time intervals 3306(1-32).

Another way to describe the present modulation scheme is as follows. The row logic initializes the pulse on pixel 2711 during one of the first (m) consecutive time intervals 3002(1-8) based on the value of the three least significant bits of binary weighted data word 3202. Time intervals 3002(1-8) correspond to the predetermined plurality of consecutive time intervals 3904 described above. Then, row logic 2708 can terminate the electrical signal on pixel 2711 during an ($m^{th}$) one of time intervals 3002(8-255). The ($m^{th}$) time intervals correspond to the second plurality of predetermined time intervals 3906(1-32).

As discussed above, the number (m) can be determined from the following equation:

$$m=2^x,$$

where x equals the number of bits in the first group of bits 3204 of the binary weighted data word 3202. Accordingly, the first plurality of predetermined time intervals 3904 correspond to the first consecutive (m) time intervals 3002.

Once x is defined, the second plurality of predetermined time intervals 3906 is given according to the equation:

$$\text{Interval}=y2^x \text{ MOD}(2^n-1),$$

where MOD is the remainder function and y is an integer greater than 0 and less than or equal to $$\left(\frac{2^n}{2^x}\right).$$

For the case $$\left(y=\frac{2^n}{2^x}\right),$$

the resulting time interval will be the first time interval 3002(1) of pixel 2711's modulation period, where the signal is automatically terminated anyway, because the subsequent data will be asserted.

Similar to the previous embodiment, row logic 2708 evaluates only particular bits of multi-bit data word 3902 depending upon the time interval 3002. For example, the alternate front pulse logic updates the electrical signal asserted on a pixel 2711 based on the value of only bits $B_0$, $B_1$, and $B_2$ during (adjusted) time intervals 3002(1-7) of the pixel's modulation period. Then, the alternate rear pulse logic updates the electrical signal on the pixel 711 during (adjusted) time intervals 3002(8), 3002(16), 3002(24), . . . , 3002(240), and 3002(248) based on the value of one or more of bits $B_3$ through $B_7$, and optionally the previous value asserted on pixel 2711. The following chart indicates which bits of multi-bit data word 3902 are needed by row logic 2708 in a particular (adjusted) time interval 3002 to update the electrical signal asserted on a pixel 711.

| Time Interval 3002 | Bit(s) Evaluated |
|---|---|
| 1-7 | $B_0$-$B_2$ |
| 8, 16, 24, . . . , 128 | $B_7$-$B_3$ |
| 136, 144, 152, 160, . . . , 192 | $B_6$-$B_3$ |
| 200, 208, 216, 224, | $B_5$-$B_3$ |
| 232, 240 | $B_4$-$B_3$ |
| 248 | $B_3$ |

Again, rear pulse logic 2806 accesses the previous value written to a pixel 2711 via storage element 2814 when it is required to properly update pixel 2711. In general, once a bit of the second group of bits 3808 of multibit data word 3202 is unavailable to rear pulse logic 2806, rear pulse logic 2806 may need to evaluate the previous value written to pixel 2711 before updating pixel 2711.

FIG. 40 is a representational block diagram showing an alternate circular memory buffer 2706A having a predetermined amount of memory for storing each bit of multi-bit data words 3202 based on the modulation scheme of FIG. 37. Circular memory buffer 2706A includes a $B_0$ memory section 4002, a $B_1$ memory section 4004, a $B_2$ memory section 4006, a $B_7$ memory section 4008, a $B_6$ memory section 4010, a $B_5$ memory section 4012, a $B_4$ memory section 4014, and a $B_3$ memory section 4016. In the present embodiment, circular memory buffer 2706A includes (1280×24) bits of memory in $B_0$ memory section 4002, (1280×24) bits of memory in B1 memory section 4004, (1280×24) bits of memory in $B_2$ memory section 4006, (1280×387) bits of memory in $B_7$ memory section 4008, (1280×579) bits of memory in $B_6$ memory section 4010, (1280×675) bits of memory in $B_5$ memory section 4012, (1280×723) bits of memory in $B_4$ memory section 4014, and (1280×747) bits of memory in $B_3$ memory section 4016. Accordingly, for each column 2712 of pixels 2711, only 24 bits of memory are needed for each of bits $B_0$, $B_1$, and $B_2$, 387 bits of memory are needed for bit $B_7$, 579 bits of memory are needed for bit $B_6$, 675 bits of memory are needed for bit $B_5$, 723 bits of memory are needed for bit $B_4$, and 747 bits of memory are needed for bit $B_3$.

Because row logic 2708 no longer needs bits $B_0$, $B_1$, and $B_2$ associated with the pixel 2711 after time interval 3002(7), bits $B_0$, $B_1$, and $B_2$ can be discarded after the lapse of time interval 3002(7). Similarly, bit $B_7$ can be discarded after the lapse of time interval 3002(128), bit $B_6$ can be discarded after the lapse of time interval 3002(192), bit $B_5$ can be discarded after the lapse of time interval 3002(224), bit $B_4$ can be discarded after the lapse of time interval 3002(240), and bit $B_3$ can be discarded after the lapse of time interval 3002(248). Accordingly, bits $B_7$-$B_3$ are discarded in order from most to least significance.

Like the previous embodiments, the bits of binary weighted data word 3202 can be discarded after the lapse of a particular time interval 3002($T_D$). For each bit in the first group of bits 3204 of binary weighted data word 3202, $T_D$ is given according by the equation:

$$T_D=(2^x-1),$$

where x equals the number of bits in the first group of bits.

For the second group of bits 3208 of binary weighted data word 3202, $T_D$ is given by the set of equations:

$$T_D=(2^n-2^{n-b}),\ 1\leqq b\leqq(n-x);$$

where b is an integer from 1 to (n−x) representing a $b^{th}$ most significant bit of the second group of bits 3208.

Like circular memory buffers 706 and 2706, the size of each memory section of circular memory buffer 2706A is dependent upon the number of columns 2712 in display 2710, the minimum number of rows 2713 in each group 2902, the number of time intervals 3002 a particular bit is needed in a modulation period (i.e., $T_D$), and the number of groups containing an extra row 2713. Accordingly, the amount of memory required in a section of circular memory buffer 2706 is given by the equation:

$$\text{Memory Section} = c\times\left[\left(INT\left(\frac{r}{2^n-1}\right)\times T_D\right)+rMOD(2^n-1)\right],$$

where c equals the number of columns 2712 in display 2710.

The present modulation scheme further reduces the amount of memory required to drive display 2710 over the prior art input buffer 110. As stated above, if prior art input buffer 110 were modified for 8-bit display data, input buffer 110 would require 1280×768×8 bits (7.86 Megabits) of memory storage. In contrast, circular memory buffer 2706A contains only 4.07 Megabits of memory storage. Accordingly, circular memory buffer 2706A is only 51.8% as large as prior art input buffer 110, and approximately 81.7% as large as circular memory buffer 2706. Therefore, the memory saving advantages of the invention are provided.

Figure 41:
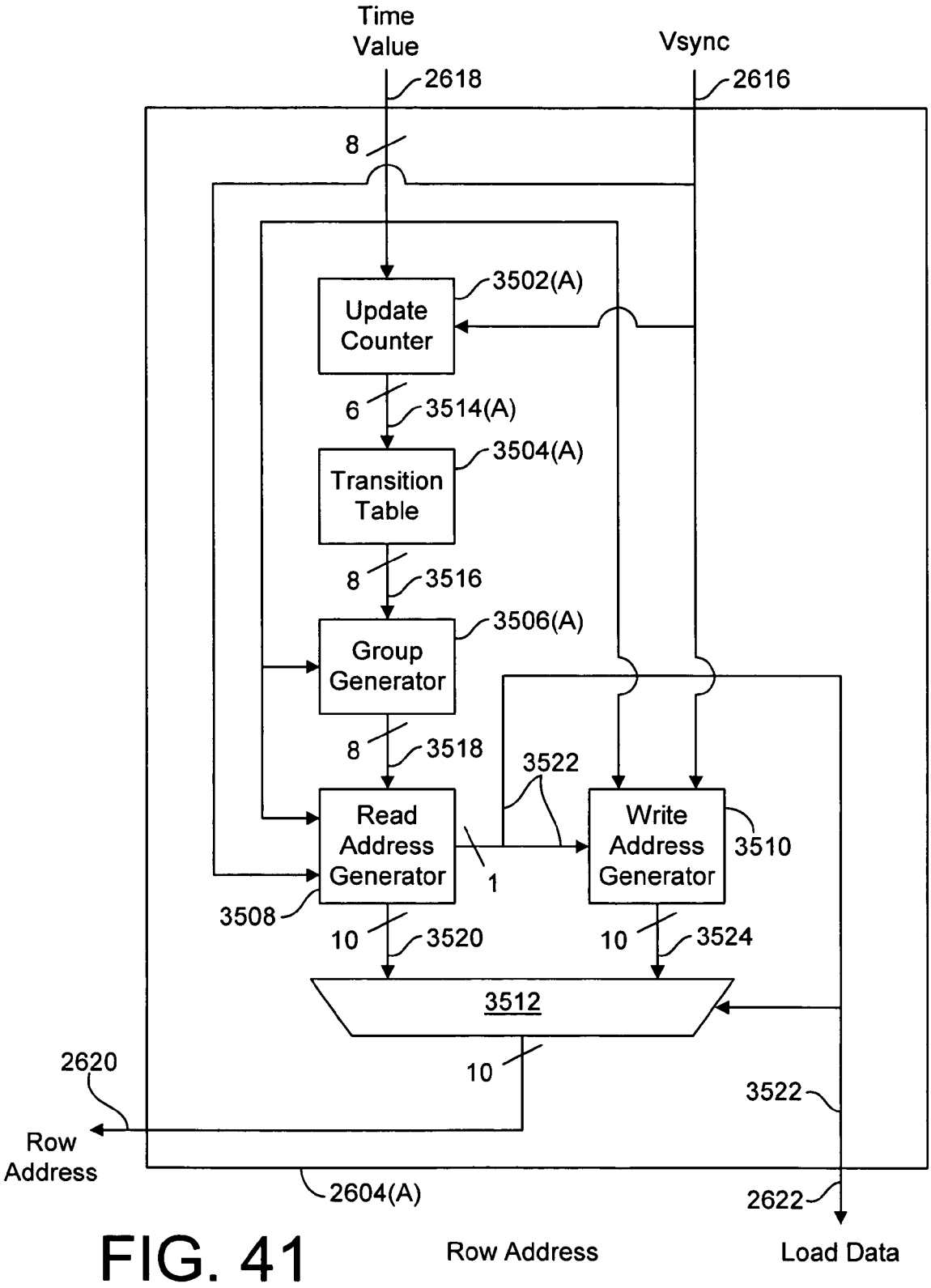
FIG. 41 is a block diagram showing an alternate embodiment of the address generator of FIG. 26 in greater detail.

FIG. 41 is a block diagram showing an alternate address generator 2604A for generating row addresses based on the modulation scheme of FIG. 37. Address generator 2604A includes an alternate update counter 3502A, an alternate transition table 3504A, and an alternate group generator 3506A.

Update counter 3502A, transition table 3504A, and group generator 3506A are modified to correspond to the modulation scheme shown in FIG. 37. For example, alternate update counter 3502A receives 8-bit time values via timing input 2618 and Vsync signals via synchronization input 2616, and provides a plurality of 6-bit count values to transition table 3504A via 6-bit update count line 3514A. The number of update count values that update counter 3502A generates is equal to the number of groups 2902(0-254) that are updated during each time interval 3002. Accordingly, in the present embodiment, update counter 3502A sequentially outputs 38 different count values from 0 to 37 in response to receiving a timing signal on timing input 2618.

Alternate transition table 3504A receives each 6-bit update count value from alternate update counter 3502A, converts the update count value to a respective transition value, and outputs the transition value onto 8-bit transition value line 3516. Because alternate update counter 3502A provides 38 update count values per time interval 3002, transition table 3504A also outputs 38 transition values per time interval. The 38 transition values corresponded to time intervals 3002 during which a row is updated in its respective modulation period. Therefore, alternate transition table 3504A converts each of update count values 0-37 into an associated one of transition values 1-8, 16, 24, 32, 40, . . . , 208, 216, 224, 232, 240, and 248, respectively.

Alternate group generator 3506A receives the 8-bit transition values from alternate transition table 3504A and time values from timing input 2618, and depending on the time value and transition value, outputs a group value indicative of one groups 2902(0-254) that is to be updated within a particular time interval. Because, alternate transition table 3504A outputs 38 transition values per time interval 3002, alternate group generator 3506A generates 38 group values per time interval 3002 and asserts the group values onto 8-bit group value lines 3518. Each group value is determined according to the following process:

```
Group Value = Time Value − Transition Value
    if Group Value < 0
        then Group Value = Group Value + (Time Value)max
    end if,
```

where $(\text{Time Value})_{max}$ represents the maximum time value generated by timer 2602, which in the present embodiment, is 255.

FIG. 42 shows several tables displaying the outputs of some of the components of FIG. 41. FIG. 42 includes an update count value table 4202, a transition value table 4204, and a group value table 4206. Update count value table 4202 lists the 38 count values 0-37 consecutively output by alternate update counter 3502A. Transition value table 4204 indicates the particular transition value output by alternate transition table 3504A responsive to each particular update count value received from alternate update counter 3502A. For update count values 0-37 (only 0-11 and 32-37 are shown), alternate transition table 3504A outputs transition values 1-8, 16, 24, 32, 40, . . . , 208, 216, 224, 232, 240, and 248, respectively. Upon receiving a particular transition value and time value, alternate group generator 3506A generates the particular group values shown in group value table 4206 based on the process described above with reference to FIG. 41. Finally, it should be noted that the outputs generated by read address generator 3508 and write address generator 3510 are the same as those shown in FIGS. 36B and 36C.

Figure 43:
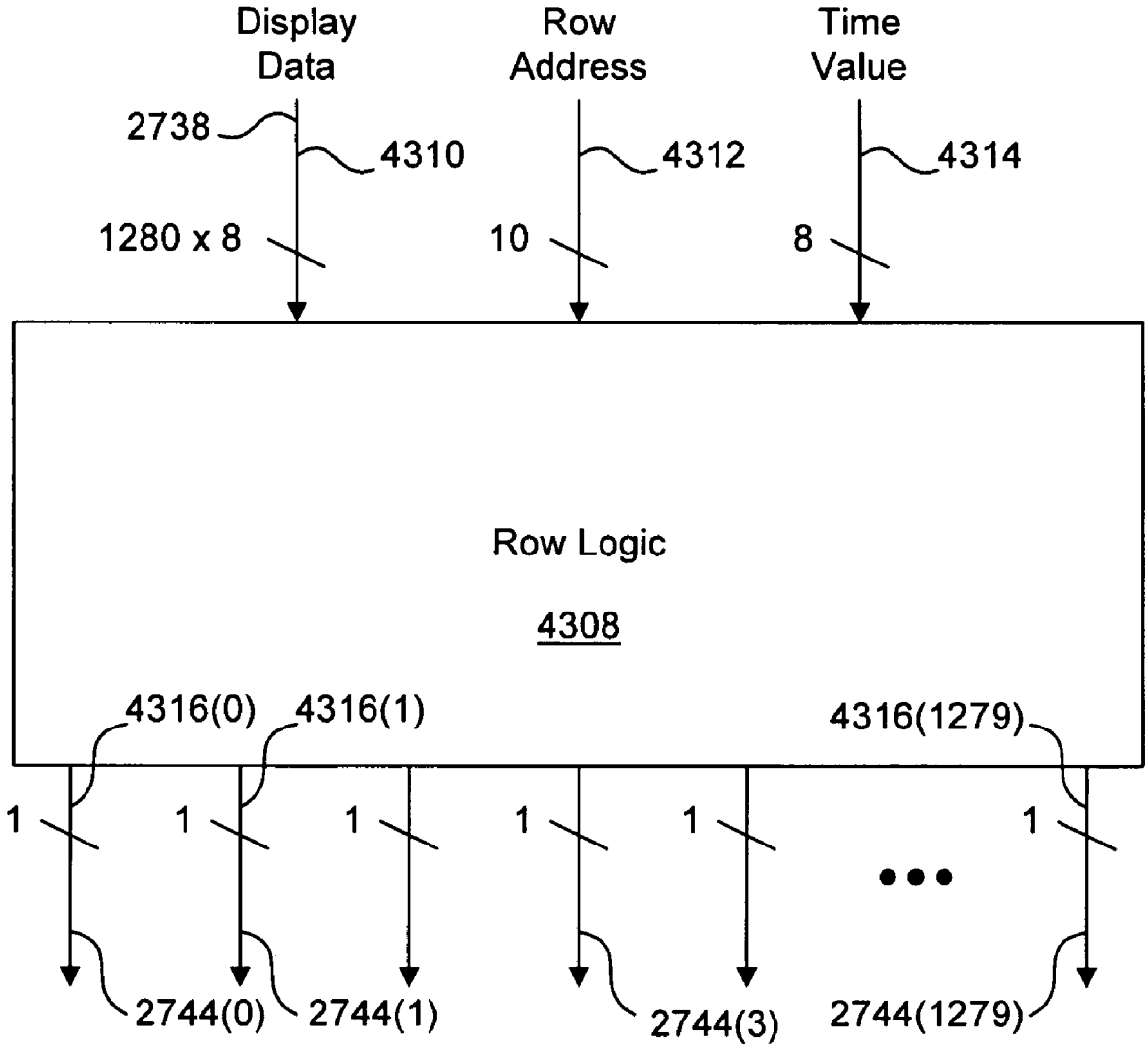
FIG. 43 is a block diagram showing an alternate embodiment of the row logic of FIGS. 5 and 25 according to an aspect the present invention.

FIG. 43 shows an alternate row logic 4308 according to another particular embodiment of the present invention. In the previous embodiment, row logic 2706 was a "blind" element, providing update signals onto display data lines 2744(0-1279, 1) based only on the display data received from circular memory buffer 2706, the previous values asserted on pixels 2711, an adjusted time value received from time adjuster 2610, and a logic selection signal received from logic selection unit 2606. However, it is possible that row logic 4308 combine the functions of each of these components. Accordingly, row logic 4308 combines the functions of row logic 2708, time adjuster 2610, and logic selection unit 2606.

Row logic 4308 includes a plurality (e.g., 1280×8) of data inputs 4310, each coupled to circular memory buffer 2706 via a respective one of data lines 2738, an address input 4312 for receiving a row address from address generator 2604, a timing input 4314 for receiving a time value from timer 2602, and a plurality of output terminals 4316(0-1279), each coupled to a respective one of display data lines 2744(0-1279). Based upon the row address received on address input 4312, the time value received on timing input 4314 and the display data received on data inputs 4310, row logic 4308 updates the electrical signals asserted on a row 2713 of pixels 2711 by providing either a digital ON or digital OFF value via each of output terminals 4316(0-1279), to each pixel 2711 of the particular row 1713.

Because row logic 4308 receives both the row address of a particular row it is updating and the unadjusted time value from timer 2602, row logic 4308 internally performs the functions of time adjuster 2610 and logic selection unit 2606. For example, based on the row address received via address input 4312, row logic 4308 determines which group 2902 a row 2713 was in and adjusts the time value received on timing input 4314 accordingly. Row logic 4308 performs this adjustment for each row address received on address input 4312 within a time interval 3002 (i.e., until a next time value was received on timing input 4314). Similarly, after adjusting the time value based on the row address, row logic 4308 determines whether to employ front pulse logic 2804 or rear pulse logic 2806. Accordingly, time adjuster 2610 and logic selection unit 2606 would no longer be needed and could be eliminated from imager control unit 2516.

Alternate row logic 4308 also eliminates the need for display data lines 2744(0-1279, 2) coupling storage elements 2814(0-1279) of row logic 4308 and storage elements 2002 (latches) of pixels 2711. Row logic 4308 reads data from and writes data to pixels 2711 via a single line 2744 per column 2712 of display 2710. Row logic 4308 includes tri-state logic to employ a "set" and "clear" driving scheme. As those skilled in the art will understand, employing such tri-state logic will enable row logic 4308 to "float" a display data line 2744, should row logic 4308 determine that the value of a pixel 2711 does not change during an update time interval 3002 and pixel 2711 should remain in a set or clear state.

According to another alternative embodiment, row logic 4308 can provide "set" or "clear" signals to the pixels without reading the previous value written to a pixel 2711. Instead, according to this alternate embodiment, each pixel 2711 includes logic to alter the value asserted on pixel 2711, based on the value of a data bit provided by row logic 4308 and the value of the previously asserted data bit on pixel 2711. In such a case, row logic 4308 would only evaluate one or more particular bits of a multibit data word based on the time interval.

Alternate row logic 4308 is presented to illustrate that the precise locations of the functional modules of display drivers 502, 2502 and imagers 504, 2504 are not essential features of the invention. Indeed, as the description of alternate row logic 4308 shows, components originally shown on display drivers 502, 2502 can be incorporated into imagers 504, 2504 and vice versa. For example, alternate row logic 4308 provides additional functions and eliminates the need for particular elements of imager control unit 2516. As another example, row logic 4308 could be directly integrated with imager control unit 2516. Thus, the present invention may be embodied in an imager device, a display driver circuit, or a combination of the two. Further, although the operative components of the embodiments shown are illustrated as discrete blocks, it should be understood that the present invention can be employed with programmable logic.

Several modulation schemes of the present invention have now been described in detail, wherein the modulation schemes are based on a predetermined number of consecutive bits of the data word, starting with the least significant bit. However, this aspect of the present invention should not be construed as limiting, because the present invention can be expanded such that pixels of the display are driven with a single pulse based on one or more non-consecutive bits of the data word.

If one or more non-consecutive bits of the data word are selected, the electrical signal can be initialized and terminated on the associated pixel based on the following equations. Once a group of non-consecutive bits has been defined, an electrical signal can be initialized on the pixel during one of the first $(W_{NCB}+1)$ time intervals, where $W_{NCB}$ represents the combined weight of the non-consecutive bits. In addition, the electrical signal asserted on the pixel can be terminated during a $[(W_{NCB}+1)+y(W_{RLSB})]^{th}$ time interval, where $W_{RLSB}$ equals the weight of a least significant bit of the bits of the multi-bit data word non included in the group of non-consecutive bits, and y is an integer greater than or equal to zero, and less than or equal to $$\left(\frac{2^n-(w_{NCB}+1)}{w_{RLSB}}\right).$$

In addition, based on the above modulation scheme, particular bits of the multi-bit data word can be discarded after the lapse of the following number of time intervals. In particular, each bit in the group of non-consecutive bits can be discarded after the lapse of $W_{NCB}$ time intervals. The remaining bits of the data word can each be discarded in order from most to least significance after the lapse of a number of time intervals equal to $(W_{NCB+1})$ plus the weight of the most significant remaining bit and the sum of any previously discarded remaining bits.

In addition to the above modification to the present invention, other modifications can be made as well. In one particular embodiment, display 710 or 2710 can be divided into sections, and each section driven by an additional iteration of the display driving components of imager 504(*r, g, b*) or imager 2504(*r, g, b*), respectively. For example, display 710 could be divided in half and driven from the top and bottom simultaneously. In such a case, display 710 would be driven from the top by row logic 708, and from the bottom by a second iteration of row logic 708. Other additional imager components might also be needed. For example, if an extra circular memory buffer 706 is needed, each circular memory buffer would only need to store approximately half as much display data as circular memory buffer 706, and therefore would not require substantially more space/components than circular memory buffer 706. Furthermore, display driver 502 might also need to be modified such that the appropriate data and display driving signals are provided to each iteration of the components of imager 504. By adding additional iterations of driving components to imager 504(*r, g, b*) the speed at which display 710 is driven can be significantly improved.

The methods of the present invention will now be described with respect to FIGS. 44-49. For the sake of clear explanation, these methods are described with reference to particular elements of the previously described embodiments that perform particular functions. However, it should be noted that other elements, whether explicitly described herein or created in view of the present disclosure, could be substituted for those cited without departing from the scope of the present invention. Therefore, it should be understood that the methods of the present invention are not limited to any particular element(s) that perform(s) any particular function(s). Further, some steps of the methods presented need not necessarily occur in the order shown. For example, in some cases two or more method steps may occur simultaneously. These and other variations of the methods disclosed herein will be readily apparent, especially in view of the description of the present invention provided previously herein, and are considered to be within the full scope of the invention.

Figure 44:
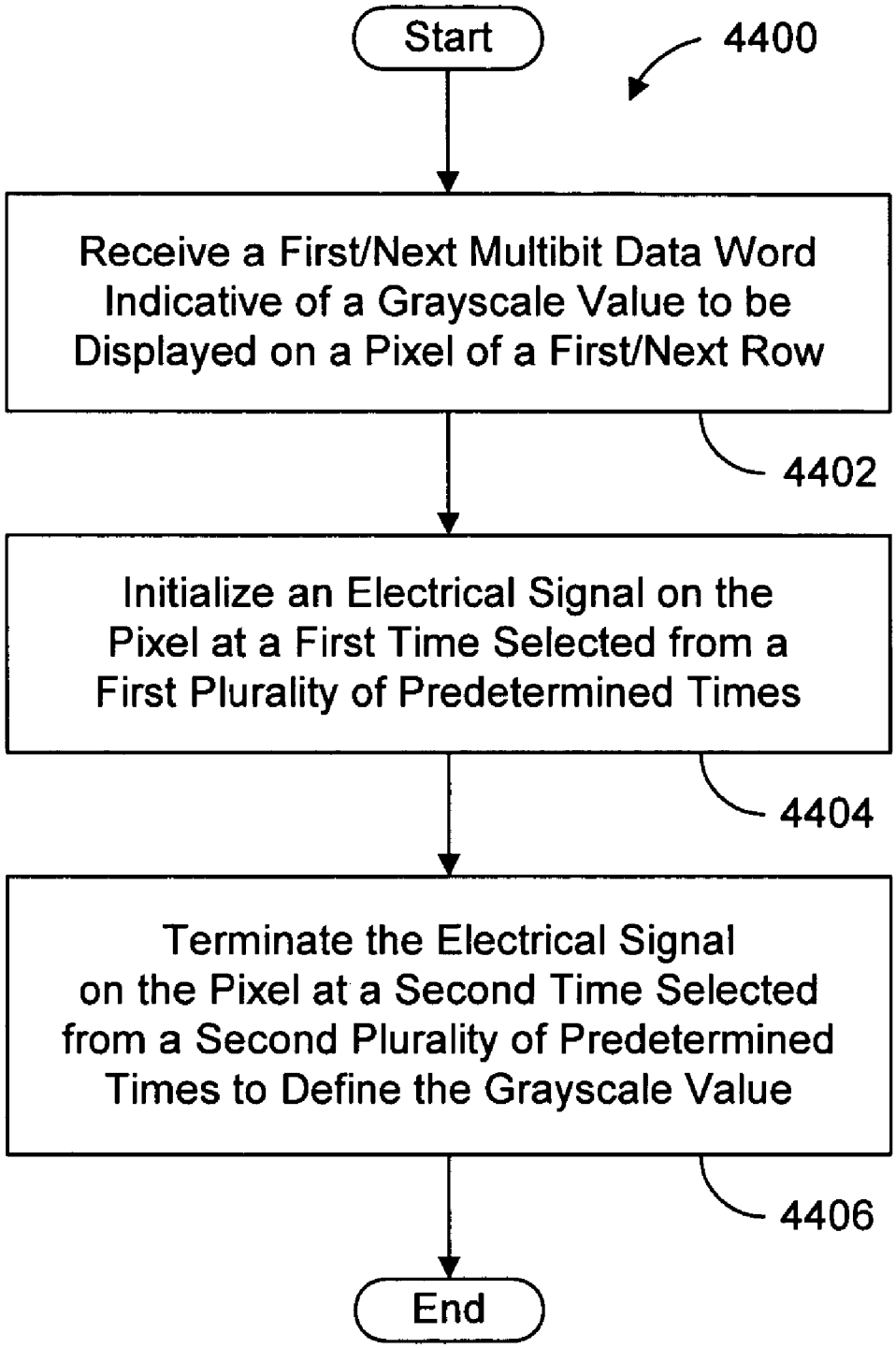
FIG. 44 is a flowchart summarizing a method of driving a pixel with a single on-off drive pulse according to an aspect the present invention.

FIG. 44 is a flowchart summarizing a method 4400 of driving a pixel 711 of display 710 with a single pulse according to one aspect of the present invention. In a first step 4402, row logic 708 receives a multi-bit data word 1202 indicative of a grayscale value to be displayed on pixel 711 in a row 713 from circular memory buffer 706. Next, in a second step 4404, row logic 708 (with the support of the other components) initializes an electrical signal on pixel 711 at a first time selected from one of a first plurality of predetermined times 1304, corresponding to time intervals 1002(1-4), depending on the value of at least one of the bits of the multi-bit data word 1202. Then, in a third step 4406, row logic 708 terminates the electrical signal on pixel 711 at a second time selected from a second plurality of predetermined times 3306 (1-4), corresponding to time intervals 1002(4), 1002(8), 1002 (12), and 1002(1), such that the duration from the first time to the second time during which the electrical signal is asserted on pixel 711 corresponds to the grayscale value defined by data word 1202.

Figure 45:
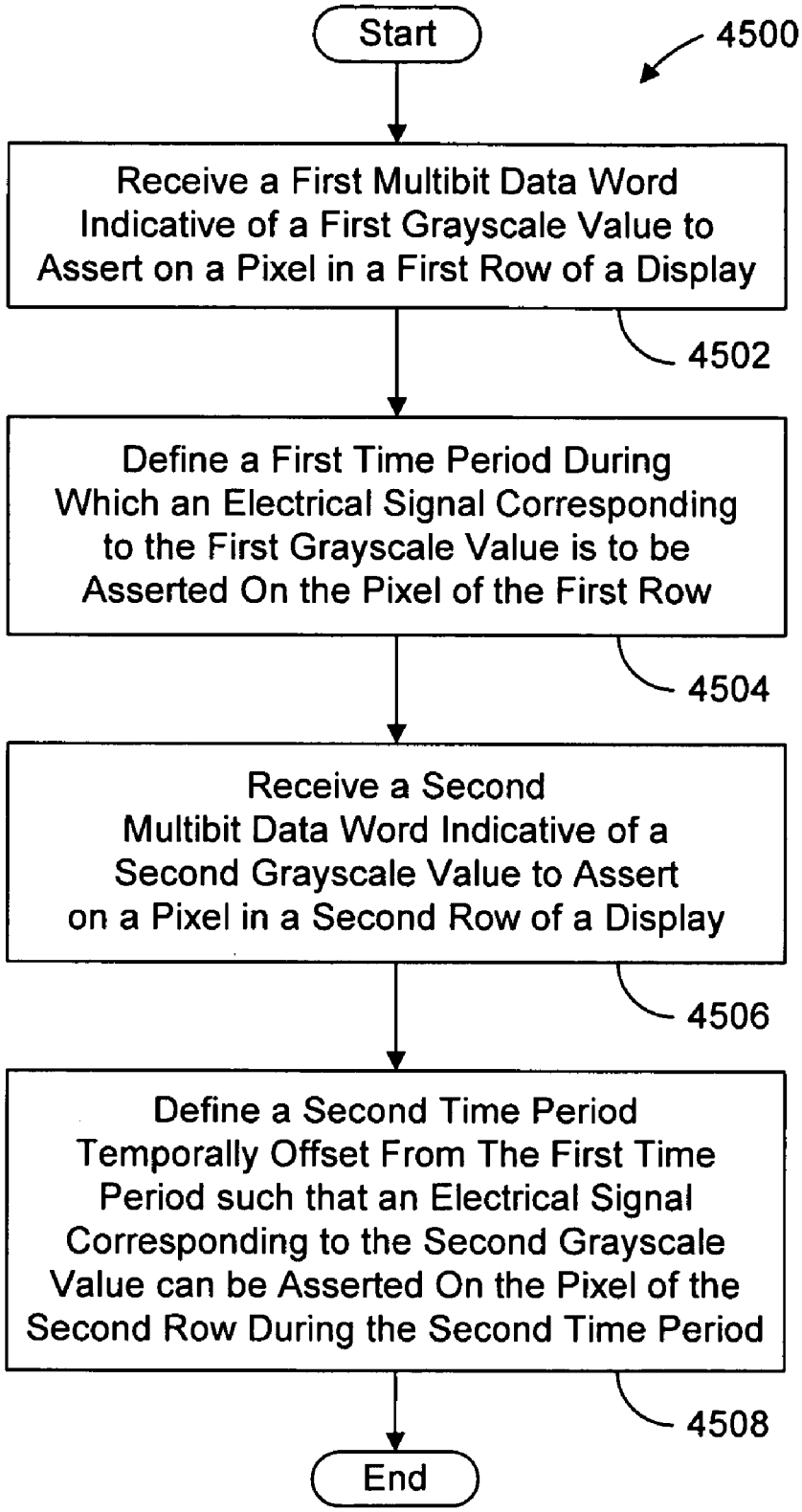
FIG. 45 is a flowchart summarizing a method of asynchronously driving the rows of a display according to an aspect of the present invention.

FIG. 45 is a flowchart summarizing a method 4500 of asynchronously driving display 710 according to another aspect of the present invention. In a first step 4502, display driver 502 receives a first multi-bit data word 1202 indicative of a first grayscale value to be asserted on a pixel 711 in a first row 713 of display 710. Then, in a second step 4504, imager control unit 516 defines a first time period during which an electrical signal corresponding to the first grayscale value is to be asserted on the pixel 711 of the first row 713. Next, in a third step 4506, display driver 502 receives a second multi-bit data word 1202 indicative of a second grayscale value to be asserted on a pixel 711 in a second row 713 of display 710. Finally, in a fourth step 4508, imager control unit defines a second time period that is temporally offset from the first time period, such that an electrical signal corresponding to the second grayscale value can be asserted on the pixel 711 of the second row 713 during the second time period. According to this method, data from one frame of data may be asserted on the display at the same time that data from a previous frame of data is still being asserted on the display.

Figure 46:
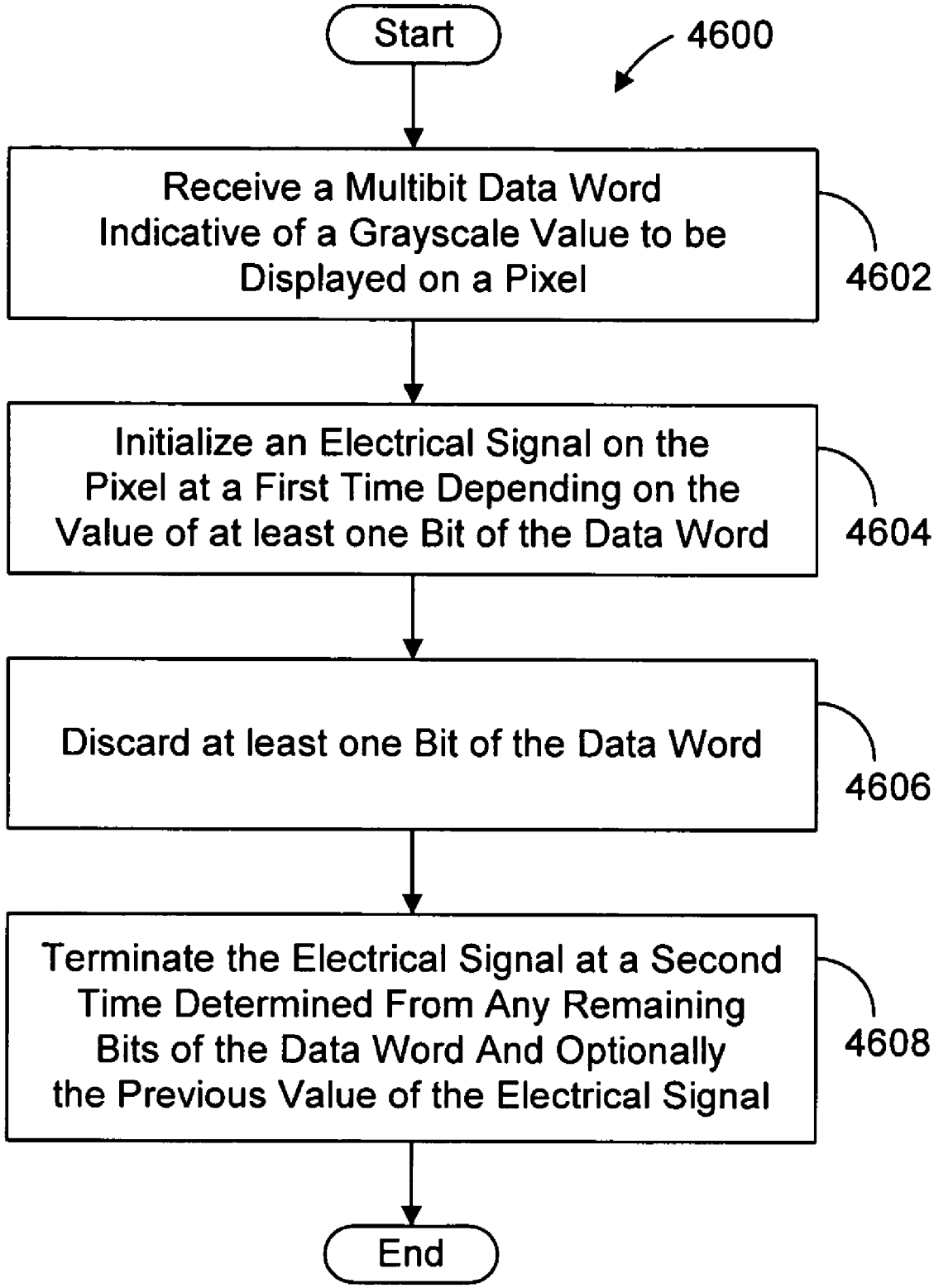
FIG. 46 is a flowchart summarizing a method of reducing the required capacity of an input buffer by discarding bits of display data according to an aspect of the present invention.

FIG. 46 is a flowchart summarizing a method 4600 for discarding bits while driving display 710 according to another aspect of the present invention. In a first step 4602, display driver 502 receives a multi-bit data word 1202 indicative of a grayscale value to be displayed on a pixel 711 of display 710. In a second step 4604, row logic 708 initializes an electrical signal on pixel 711 at a first time selected from one of a first plurality of predetermined times 1304, which correspond to time intervals 1002(1-4), depending on the value of at least one of the bits of the multi-bit data word 1202. Then in a third step 4606, row logic 708 discards at least one bit of the multi-bit data word 1202, for example, by overwriting the bit with subsequent display data in circular memory buffer 706. Finally, in a fourth step 4608, row logic 708 terminates the electrical signal asserted on the pixel 711 at a second time (e.g., one of times 1306(1-4)) determined from any remaining bits of the multi-bit data word 1202 and optionally the previous value of the electrical signal asserted on pixel 711 such that the duration from the first time to the second time that the electrical signal is asserted on the pixel 711 corresponds to the grayscale value.

Figure 47:
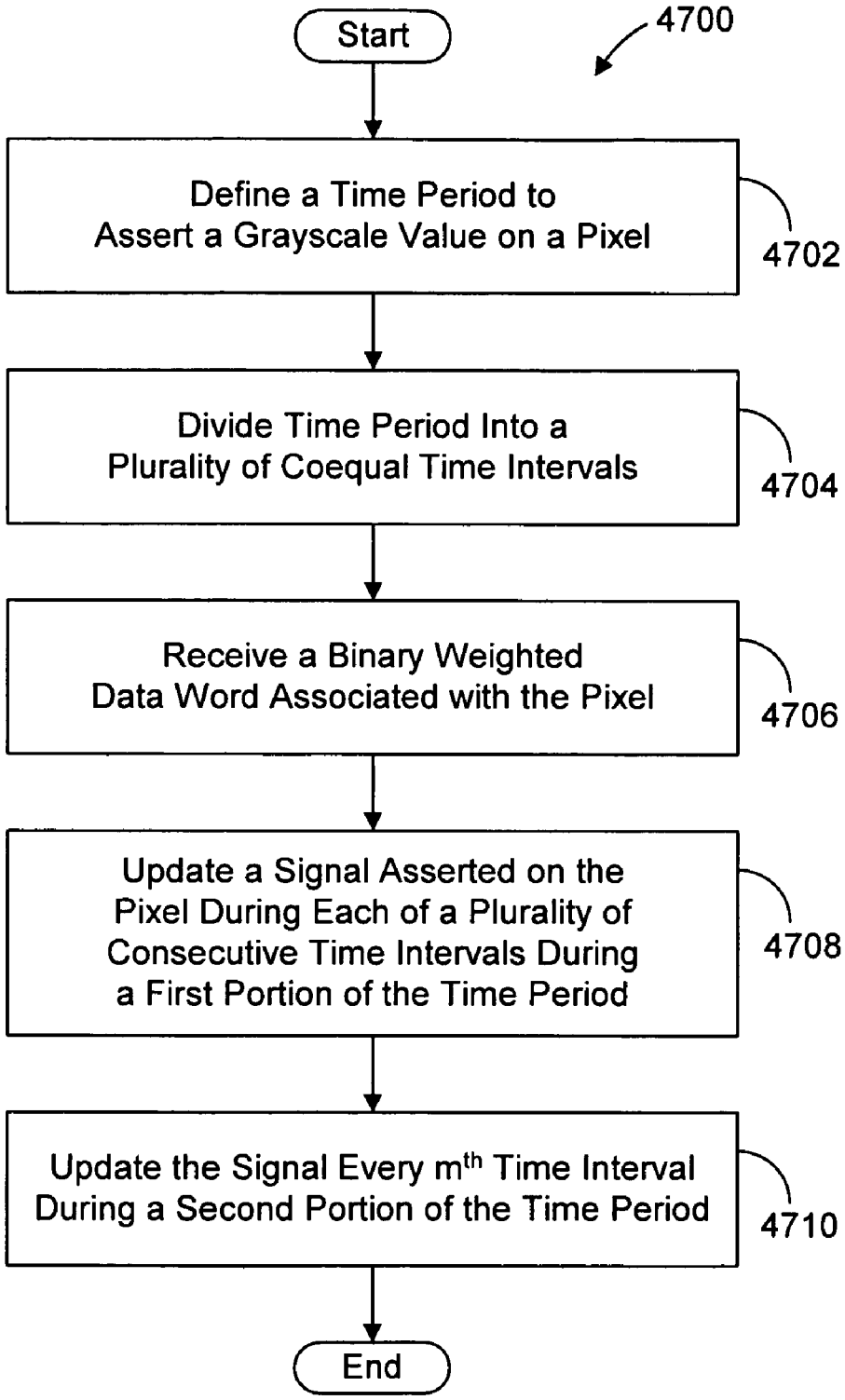
FIG. 47 is a flowchart summarizing a method of evaluating bits of a multi-bit data word according to an aspect of the present invention.

FIG. 47 is a flowchart summarizing a method 4700 of updating an electrical signal asserted on a pixel 711 according to another aspect the present invention. In a first step 4702, imager control unit 516 defines a time period (e.g., a modulation period) during which a grayscale value will be asserted on a pixel 711 of display 710, and in a second step 4704, divides the time period into a plurality of coequal time intervals 1002(1-15) Then, in a third step 4706, display driver 502 receives an n-bit (e.g., an 4-bit, 8-bit, etc.) binary weighted data word 1202 indicative of a grayscale value 1302 to be displayed by the pixel 711. Next, in a fourth step 4708, row logic 708 updates a signal asserted on the pixel 711 during each of a plurality of consecutive time intervals 1002 (e.g., time intervals 1002(1-4)) during a first portion of the time period. Finally, in a fifth step 4710, row logic 708 updates the signal asserted on the pixel 711 every $m^{th}$ time interval 1002 (e.g., every $4^{th}$ time interval 1002) during a second portion of the time period, wherein m is an integer greater than or equal to one.

Figure 48:
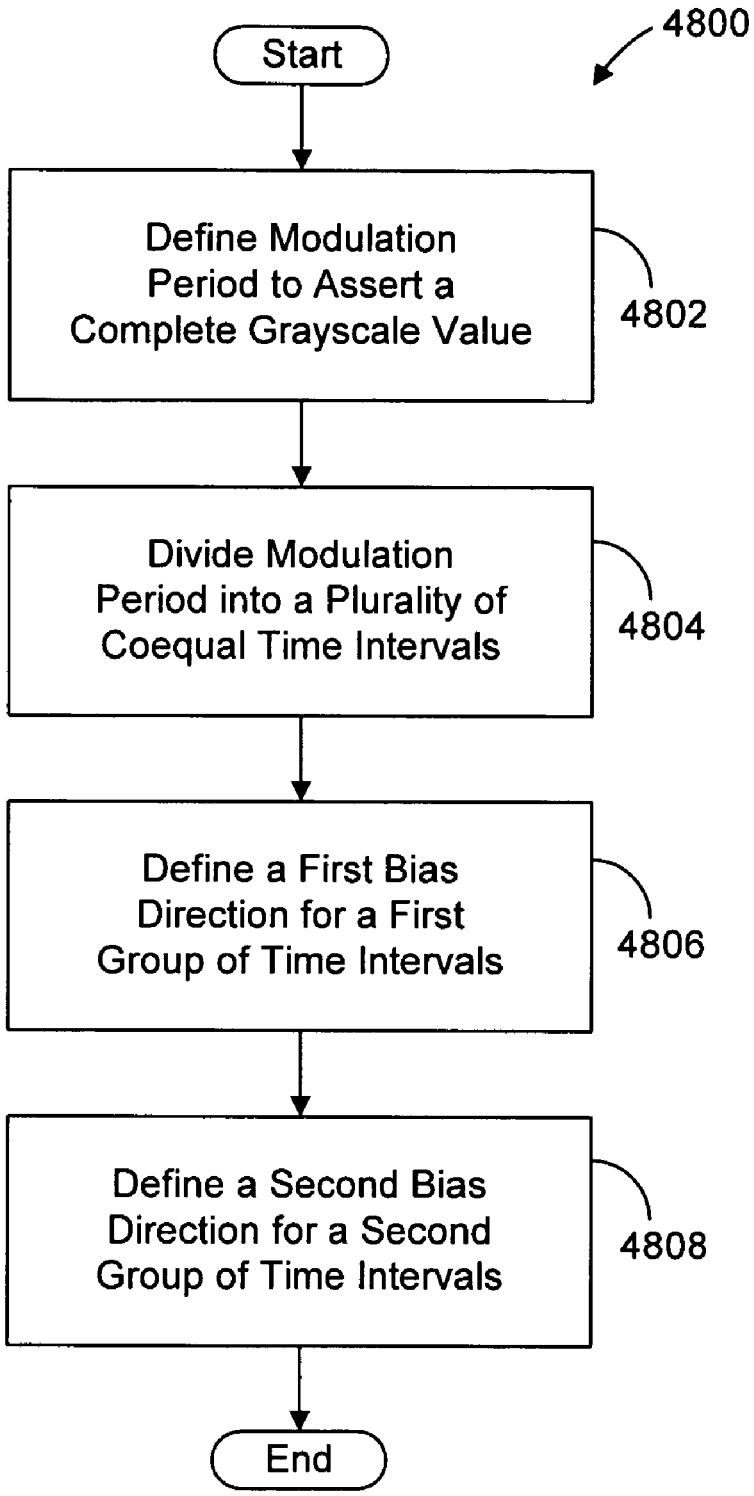
FIG. 48 is a flowchart summarizing a method of debiasing pixels of a display according to an aspect of the present invention.

FIG. 48 is a flowchart summarizing a method 4800 of debiasing a display according to the present invention. In a first step 4802, imager control unit 516 defines a modulation period during which a complete grayscale value 1302 is asserted on a pixel 711 of display 710. Then, in a second step 4804, imager control unit 516 divides the modulation period into a plurality of coequal time intervals 1002(1-15). Then, in a third step 4806, debias controller 608 defines a first bias direction (e.g., a normal direction) that is asserted for a first plurality of coequal time intervals 1002(1-15). Finally, in a fourth step 4808, debias controller 608 defines a second bias direction (e.g., an inverted direction) that is asserted for a second plurality of coequal time intervals 1002(1-15).

Figure 49:
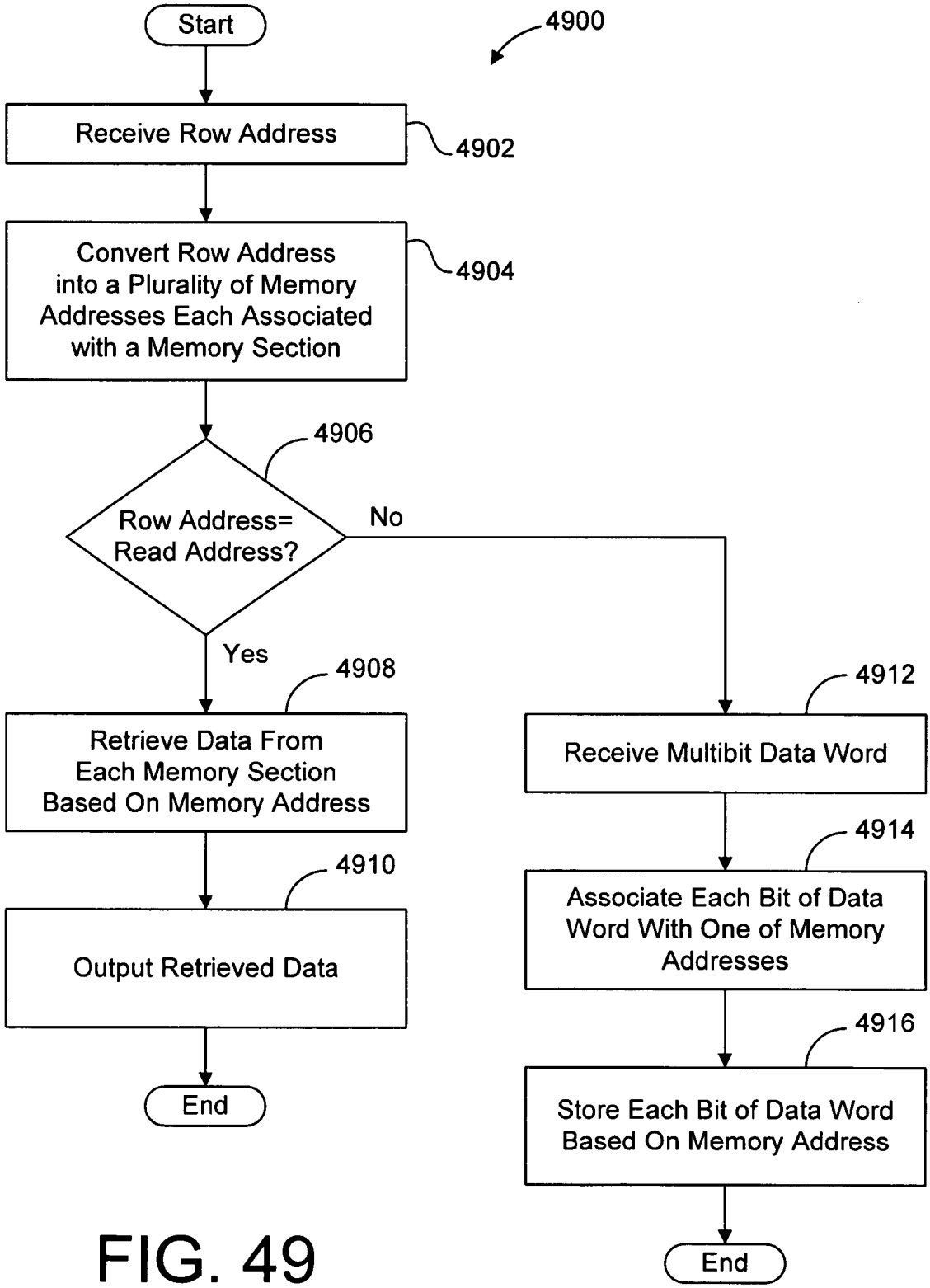
FIG. 49 is a flowchart summarizing a method of writing data into and reading data from a memory buffer according to an aspect of the present invention.

FIG. 49 is a flowchart summarizing a method 4900 of writing display data into and reading display data out of a memory buffer according to the present invention. In a first step 4902, address converter 716 receives a row address from imager control unit 516. Then, in a second step 4904, address converter 716 converts the row address into a plurality of memory addresses, each associated with a memory section (e.g., $B_0$ memory section 3402, $B_1$ memory section 3404, etc.). Then, in a third step 4906, circular memory buffer 706 determines, via the signal asserted on load input 740, whether the row address received by address converter 716 is a "read" address, indicating that data should be read out of circular memory buffer 706, or a "write" address indicating that data should be written into circular memory buffer 708. If the row address is a read address, then in a fourth step 4908, circular memory buffer 706 retrieves display data from each memory section based on the respective memory address, and in a fifth step 4910, circular memory buffer 706 outputs the retrieved display data onto data lines 738.

If instead, during third step 4906, circular memory buffer 706 determines that the row address is a write address, then method 4900 proceeds to a sixth step 4912. In sixth step 4912, circular memory buffer 706 receives a multi-bit data word 1202 (e.g., from multi-row memory buffer 704), and in a seventh step 4914, associates each bit of the multi-bit data word 1202 with one of the memory addresses generated in second step 4904. Then in an eighth step 4916, circular memory buffer 706 stores each bit of the multi-bit data word 1202 in an associated section of circular memory buffer 706 based on the associated memory address.

The description of particular embodiments of the present invention is now complete. Many of the described features may be substituted, altered or omitted without departing from the scope of the invention. For example, alternate voltage schemes (e.g., a 3 voltage scheme) for driving the pixels of the display, may be substituted for the six voltage scheme disclosed herein. As another example, electrical signals could be initialized on a pixel based on the values of four or more consecutive bits of the multi-bit data word. As yet another example, although the embodiment disclosed is primarily illustrated as a hardware implementation, the present invention can be implemented with hardware, software, firmware, or any combination thereof. These and other deviations from the particular embodiments shown will be apparent to those skilled in the art, particularly in view of the foregoing disclosure.

What is claimed is:

1. A method for driving a display device including an array of pixels arranged in a plurality of columns and a plurality of rows, said method comprising:

receiving a first n-bit data word indicative of a first intensity value to be displayed on a pixel of a first row of said display, said first n-bit data word capable of defining $2^n$ intensity values;

defining a first time period during which an electrical signal corresponding to said first intensity value is to be asserted on said pixel of said first row;

updating said electrical signal asserted on said pixel of said first row more than n times and less than $2^n$ times during said first time period;

receiving a second n-bit data word indicative of a second intensity value to be displayed on a pixel of a second row of said display, said second n-bit data word capable of defining $2^n$ intensity values;

defining a second time period during which an electrical signal corresponding to said second intensity value is to be asserted on said pixel of said second row, said second time period being temporally offset with respect to said first time period; and updating said electrical signal asserted on said pixel of said second row more than n times and less than $2^n$ times during said second time period.

2. A method according to claim 1, wherein said second time period is temporally offset with respect to said first time period by an amount given by $$\frac{\theta T_1}{2^n - 1},$$

where $T_1$ represents the duration of said first time period, and $\theta$ is an integer greater than or equal to one.

3. A method according to claim 1, further comprising:

receiving a third n-bit data word indicative of a third intensity value to be displayed on a pixel of a third row of said display; and defining a third time period during which an electrical signal corresponding to said third intensity value is to be asserted on said pixel of said third row, said third time period being temporally offset with respect to said second time period and said first time period.

4. A method according to claim 3, wherein said third time period is temporally offset with respect to said second time period by an amount given by $$\frac{T_1}{2^n - 1},$$

where $T_1$ represents the duration of said first time period.

5. A method according to claim 3, wherein said third time period is temporally offset with respect to said first time period by an amount given by $$\frac{2T_1}{2^n - 1},$$

where $T_1$ represents the duration of said first time period.

6. A method according to claim 3, wherein the durations of said first time period, said second time period, and said third time period are equal.

7. A method according to claim 1, wherein each of said first and said second time periods are composed of $(2^n-1)$ time intervals.

8. A method according to claim 7, wherein said second time period is temporally offset with respect to said first time period by an amount equal to one of said time intervals.

9. A method according to claim 7, wherein:

said array of pixels includes more than $2^n-1$ rows;

said rows of said array are divided into $2^n-1$ groups;

a first number of said groups include a first number of said rows; and a second number of said groups include a second number of said rows.

10. A method according to claim 9, wherein said rows of said array are grouped in the same order as said rows are arranged in said display.

11. A method according to claim 9, further comprising:

defining a different time period for each group of said rows, each of said different time periods being equal in length to said first time period, being temporally offset with respect to all other said different time periods, and beginning during one of said time intervals;

associating each of said different time periods with one of said rows; and asserting electrical signals corresponding to intensity values on said pixels of each row during said different time period associated with said each row.

12. A method according to claim 9, wherein each of said first number of groups and each of said second number of groups include at least $$INT\left(\frac{r}{2^n - 1}\right)$$

rows, where r represents the number of said rows in said array and INT is the integer function.

13. A method according to claim 12, wherein:

said first number of rows and said second number of said rows are different; and each group of said first number of groups include $$\left(INT\left(\frac{r}{2^n - 1}\right) + 1\right)$$

rows of said array.

14. A method according to claim 13, wherein said first number of groups includes (rMOD($2^n$−1)) groups.

15. A method according to claim 12, wherein said second number of groups includes (($2^n$−1)−rMOD($2^n$−1)) groups, where MOD is the remainder function.

16. A method according to claim 9, wherein:

electrical signals asserted on the pixels of said rows of said display are updated by said groups, the rows of each group being updated sequentially within the group; and some but not all of said groups are updated during each of said time intervals.

17. A method according to claim 7, wherein:

said step of updating said electrical signal asserted on said pixel of said first row includes updating said electrical signal during some but not all of said time intervals; and said step of updating said electrical signal asserted on said pixel of said second row includes updating said electrical signal during some but not all of said time intervals.

18. A method according to claim 1, further comprising:

initializing said electrical signal on said pixel of said first row at a first time selected from a first plurality of predetermined times depending on the value of at least one of the bits of said first n-bit data word; and terminating said electrical signal on said pixel of said first row at a second time selected from a second plurality of predetermined times such that the duration from said first time to said second time during which said electrical signal is asserted on said pixel corresponds to said first intensity value.

19. A method according to claim 1, further comprising:

initializing an electrical signal on said pixel of said first row at a first time depending on the value of at least one of the bits of said first n-bit data word;

discarding at least one bit of said first n-bit data word; and terminating said electrical signal on said pixel of said first row at a second time determined from any remaining bits of said first n-bit data word such that the duration from said first time to said second time that said electrical signal is asserted on said pixel corresponds to said first intensity value.

20. A method according to claim 1, further comprising:

dividing said first time period into a plurality of time intervals;

updating said electrical signal asserted on said pixel of said first row during each of a plurality of consecutive ones of said time intervals during a first portion of said first time period; and updating the electrical signal asserted on said pixel of said first row every $m^{th}$ one of said time intervals during a second portion of said first time period, m being an integer greater than one.

21. A method according to claim 1, further comprising:

dividing said first time period into a plurality of time intervals;

asserting said electrical signal on said pixel of the first row in a first bias direction with respect to a common electrode of said display during a first group of said time intervals; and asserting said electrical signal on said pixel of the first row in a second bias direction with respect to said common electrode during a second group of said time intervals.

22. An electronically readable medium having code embodied therein for causing an electronic device to perform the method of claim 1.

23. A method according to claim 1, further comprising:

outputting a series of time values; and wherein said step of updating said electrical signal on said pixel of said first row includes providing a single bit to said pixel; and said single bit has a value dependent on the value of at least one of the bits of said first n-bit data word and one of said time values.

24. A method according to claim 1, wherein said step of updating said electrical signal asserted on said pixel of said first row includes:

reading a value currently being asserted on said pixel of said first row; and using said read value to determine a next value to be asserted on said pixel of said first row.

25. A display driver for driving an array of pixels arranged in a plurality of rows and a plurality of columns, said display driver comprising:

a data input terminal set for receiving n-bit data words, each n-bit data word capable of defining $2^n$ intensity values; and control logic operative to receive a first n-bit data word via said data input terminal set, said first n-bit data word indicative of a first intensity value to be displayed on a pixel of a first row of said display;

define a first time period during which an electrical signal corresponding to said first intensity value is to be asserted on said pixel of said first row;

update said electrical signal asserted on said pixel of said first row more than n times and less than $2^n$ times during said first time period;

receive a second n-bit data word via said data input terminal set, said second n-bit data word indicative of a second intensity value to be displayed on a pixel of a second row of said display;

define a second time period during which an electrical signal corresponding to said second intensity value is to be asserted on said pixel of said second row, said second time period being temporally offset with respect to said first time period; and update said electrical signal asserted on said pixel of said second row more than n times and less than $2^n$ times during said second time period.

26. A display driver according to claim 25, wherein said second time period is temporally offset with respect to said first time period by an amount given by $$\frac{\theta T_1}{2^n - 1},$$

where $T_1$ represents the duration of said first time period, and θ is an integer greater than one.

27. A display driver according to claim 25, wherein said control logic is further operative to:

receive a third n-bit data word via said data input terminal set, said third n-bit data word indicative of a third intensity value to be displayed on a pixel of a third row of said display; and define a third time period during which an electrical signal corresponding to said third intensity value is to be asserted on said pixel of said third row, said third time period being temporally offset with respect to said second time period and said first time period.

28. A display driver according to claim 27, wherein said third time period is temporally offset with respect to said second time period by an amount given by $$\frac{T_1}{2^n-1},$$

where $T_1$ represents the duration of said first time period.

29. A display driver according to claim 27, wherein said third time period is temporally offset with respect to said first time period by an amount given by $$\frac{2T_1}{2^n-1},$$

where $T_1$ represents the duration of said first time period.

30. A display driver according to claim 27, wherein the durations of said first time period, said second time period, and said third time period are equal.

31. A display driver according to claim 25, wherein said control logic is further operative to divide each of said first and said second time periods into $(2^n-1)$ time intervals.

32. A display driver according to claim 31, wherein said second time period is temporally offset with respect to said first time period by an amount equal to one of said time intervals.

33. A display driver according to claim 31, wherein:

said array of pixels includes more than $2^n-1$ rows;

said rows of said array are divided into $2^n-1$ groups;

a first number of said groups include a first number of said rows; and a second number of said groups include a second number of said rows.

34. A display driver according to claim 33, wherein said rows of said array are grouped in the same order as said rows are arranged in said display.

35. A display driver according to claim 33, wherein said control logic is further operative to:

define a different time period for each group of said rows, each of said different time periods being equal in length to said first time period, being temporally offset with respect to all other said different time periods, and beginning during one of said time intervals;

associate each of said different time periods with one of said rows; and assert electrical signals corresponding to intensity values on said pixels of each row during said different time period associated with said each row.

36. A display driver according to claim 35, wherein said control logic is further operative to:

update electrical signals asserted on the pixels of said rows of said display by said groups and update said group by sequentially updating each row of the group; and update electrical signals asserted on said rows of some but not all of said groups during each of said time intervals.

37. A display driver according to claim 33, wherein each of said first number of groups and each of said second number of groups include at least $$INT\left(\frac{r}{2^n-1}\right)$$

rows, where r represents the number of said rows in said array and INT is the integer function.

38. A display driver according to claim 37, wherein:

said first number of rows and said second number of said rows are different; and each of said first number of groups include $$\left(INT\left(\frac{r}{2^n-1}\right)+1\right)$$

rows of said array.

39. A display driver according to claim 38, wherein said first number of groups include $(\mathrm{rMOD}(2^n-1))$ groups.

40. A display driver according to claim 37, wherein said second number of groups includes $((2^n-1)-\mathrm{rMOD}(2^n-1))$ groups, where MOD is the remainder function.

41. A display driver according to claim 31, wherein said control logic is further operative to:

update said electrical signal asserted on said pixel of said first row during some but not all of said time intervals; and update said electrical signal asserted on said pixel of said second row during some but not all of said time intervals.

42. A display driver according to claim 25, wherein said control logic is further operative to:

initialize said electrical signal on said pixel of said first row at a first time selected from a first plurality of predetermined times depending on the value of at least one of the bits of said first n-bit data word; and terminate said electrical signal on said pixel of said first row at a second time selected from a second plurality of predetermined times such that the duration from said first time to said second time during which said electrical signal is asserted on said pixel corresponds to said first intensity value.

43. A display driver according to claim 25, wherein said control logic is further operative to:

initialize an electrical signal on said pixel of said first row at a first time depending on the value of at least one of the bits of said first n-bit data word;

discard at least one bit of said first n-bit data word; and terminate said electrical signal on said pixel of said first row at a second time determined from any remaining bits of said first n-bit data word such that the duration from said first time to said second time that said electrical signal is asserted on said pixel corresponds to said first intensity value.

44. A display driver according to claim 25, wherein said control logic is further operative to:

divide said first time period into a plurality of time intervals;

update said electrical signal asserted on said pixel of said first row during each of a plurality of consecutive ones of said time intervals during a first portion of said first time period; and update the electrical signal asserted on said pixel on said first row every $m^{th}$ one of said time intervals during a second portion of said first time period, m being an integer greater than one.

45. A display driver according to claim 25, wherein said control logic is further operative to:

divide said first time period into a plurality of time intervals;

assert said electrical signal on said pixel of said first row in a first bias direction with respect to a common electrode of said display during a first group of said time intervals; and assert said electrical signal on said pixel of said first row in a second bias direction with respect to said common electrode during a second group of said time intervals.

46. A display driver according to claim 25, wherein said control logic includes:

a timer operative to output a series of time values; and output logic coupled to receive said time values and n-bit data words to be written to particular pixels of said display, said output logic operative to provide a single data bit to each pixel, said single data bits each having a value dependent on values of at least some of said bits of said n-bit data words and said time values;

whereby for a n-bit data word having a particular value, said output logic provides a data bit having a first predetermined value to a particular pixel responsive to a first particular time value and provides a data bit having a different predetermined value to said particular pixel responsive to a different particular time value.

47. A display driver according to claim 25, wherein said control logic is further operative to:

read values currently being asserted on said pixels; and use said read values to determine next values to be asserted on said pixels.

48. A display driver for driving an array of pixels arranged in a plurality of rows and a plurality of columns, said display driver comprising:

an input terminal set for receiving n-bit image data, each n-bit data word capable of defining $2^n$ intensity values; and means for asserting a signal corresponding to said n-bit image data on said pixels of said display such that a time period in which a signal corresponding to one n-bit data value of a single image is asserted one of said pixels of one of said rows is temporally offset with respect to a second time period in which another signal corresponding to another n-bit data value of the same image is written to another of said pixels of another of said rows;

means for updating said signal corresponding to said one n-bit data value more than n times and less than $2^n$ times during said time period; and means for updating said signal corresponding to said another n-bit data value more than n times and less than $2^n$ times during said second time period.

* * * * *